US007087368B1

(12) United States Patent
Kashiwagi et al.

(10) Patent No.: US 7,087,368 B1
(45) **Date of Patent: *Aug. 8, 2006**

(54) SILVER SALT PHOTOTHERMOGRAPHIC DRY IMAGING MATERIAL, IMAGE RECORDING METHOD AND IMAGE FORMING METHOD FOR THE SAME

(75) Inventors: Hiroshi Kashiwagi, Hino (JP); Narito Goto, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/263,157

(22) Filed: Oct. 31, 2005

Related U.S. Application Data

(62) Division of application No. 10/718,295, filed on Nov. 20, 2003.

(30) Foreign Application Priority Data

Nov. 25, 2002 (JP) ..... 2002-340720
Nov. 26, 2002 (JP) ..... 2002-342196
Nov. 27, 2002 (JP) ..... 2002-343793

(51) Int. Cl.
*G03C 1/00* (2006.01)
*G03C 1/005* (2006.01)
*G03C 1/494* (2006.01)

(52) U.S. Cl. ..... 430/617; 430/618; 430/619; 430/620; 430/559; 430/348; 430/631

(58) Field of Classification Search ..... 430/617–620, 430/559, 348, 631
See application file for complete search history.

(56) References Cited

U.S. PATENT DOCUMENTS

2004/0106074 A1* 6/2004 Kashiwagi et al. ..... 430/350
2004/0115569 A1* 6/2004 Kashiwagi et al. ..... 430/542
2004/0229175 A1* 11/2004 Goto ..... 430/542
2005/0170300 A1* 8/2005 Sasaki et al. ..... 430/619

* cited by examiner

*Primary Examiner*—Geraldine Letscher
(74) *Attorney, Agent, or Firm*—Lucas & Mercanti, LLP

(57) ABSTRACT

A silver salt photothermographic dry imaging material including non-photosensitive aliphatic carboxylic acid silver salts; a photosensitive emulsion containing photosensitive silver halide grains; a silver ion reducing agent; a binder; and a cyan coloring leuco dye. A percentage of the photosensitive silver halide grains having a mean particle size of 0.01 or more μm and 0.04 μm or less is 5% or more by mass and 50% or less by mass of total photosensitive silver halide grains by conversion into a silver amount.

5 Claims, 1 Drawing Sheet

SILVER SALT PHOTOTHERMOGRAPHIC DRY IMAGING MATERIAL, IMAGE RECORDING METHOD AND IMAGE FORMING METHOD FOR THE SAME

CROSS REFERENCE TO RELATED APPLICATIONS

This Application is a Divisional of U.S. patent application Ser. No. 10/718,295, filed Nov. 20, 2003 which, in turn, claims the priority of three Japanese Patent Applications 2002-340720, filed Nov. 25, 2002, 2002-342196, filed Nov. 26, 2002 and 2002-343793, filed Nov. 27, 2002, the priorities of which are all claimed.

BACKGROUND OF THE INVENTION

1. Field of the Invention

The present invention relates to a silver salt photothermographic dry imaging material (hereinafter, also referred to as "photothermographic imaging material") with low photographic fog, high sensitivity and high maximum density, which are good in color tone and excellent in rapid thermal development suitability, and an image recording method and an image forming method using the same.

Further, The present invention relates to a photothermographic imaging material, and particularly a photothermographic imaging material with high density which are excellent in light radiated image stability, silver color tone, changes of silver color tone with time, density unevenness at thermal development and image storage stability in storage at room temperature.

2. Description of Related Art

Recently, in the fields of medical care and print plate making, waste solutions involved in wet processing of image formation materials have been problematic in terms of working property, and reduction of processing waste solutions has been strongly desired in the light of environmental preservation and saving space. Thus, technology concerning photothermal photographic materials for photographic technology use such as laser imagers and laser image setters where efficient exposure is possible and clear black images with high resolution can be formed has been required.

As the technology according to the above photothermal photographic materials, for example, as described in U.S. Pat. Nos. 3,152,904 and 3,487,075, or D. H. Klosterboer, "Dry Silver Photographic Materials" (Handbook of Imaging Materials, Marcel Dekker, Inc., page 48, 1991), known are silver salt photothermographic dry imaging materials (hereinafter, also referred to as photothermographic imaging materials or simply imaging materials) containing an organic silver salt, photosensitive silver halide and a reducing agent on a support. This silver salt photothermographic dry imaging material has an advantage capable of providing users with a system which is simpler and does not impair the environment because no solution type processing chemical is used at all.

Thus, the photothermographic imaging materials where image formation can be performed only by adding heat have come into practical use and rapidly prevailed in the above fields.

Typically in image diagnosis using imaging materials for the medical use, silver color tone formed by the development is an important factor which determines good or poor image quality. A silver ion reducing agent, a compound which forms a complex with silver ions, and a compound which bleaches fine silver nuclei which are sources of photographic fog produced on the surface of silver halide grains are contained in the silver salt photothermographic dry imaging material, and it is not easy to control developed silver shapes and maintain the image thereof after the thermal development. That is, not only the silver color tone immediately after thermally developing the imaging material must be controlled but also color tone changes must be reduced at a long term storage before the thermal development and at the storage of images after the thermal development. In earlier technology, these improvements have been attempted by controlling the developed silver shapes. For example, disclosed are the methods for reducing the changes of "color tone" under an atmosphere with high moisture by making particle sizes of the silver halide grains and fatty acid silver salt crystals small and controlling a "potency range" at the thermal development to the certain range (e.g., see Patent References 1 and 2).

Also, proposed are the improvement methods by activating photothermographic property by contrivance of fatty acid silver salt crystal structures (e.g., see Patent References 3 and 4), but it can not help being said that all methods are at insufficient levels in terms of realizing the stable silver color tone. Also disclosed is the method using leuco compounds which imagewisely produce yellow compounds by oxidation-reduction reaction at the thermal development, in combination with the certain silver ion reducing agent (e.g., see Patent Reference 5). However, the technology described in Patent Reference 5 is more excellent in improvement level of the color tone compared to the above technology which controls the developed silver shape, but has disadvantages that the photographic fog and deterioration of the color tone changes frequently occur at the long term storage and at the image storage probably because produced dyestuffs are unstable and further adversely affect the silver halide.

Also, in the light of effectively utilizing the silver which is a valuable resource, efforts to increase the maximum density on the imaging materials at an identical amount of the silver must be continued. A basic technical concept for this is to make individual developed silver small at the identical silver amount and make the particle sizes of photosensitive silver halide grains small. That is, the combination with so-called sensitization technology becomes essential. But when the individual developed silvers are made small, extents of optical scattering and absorption are changed and thus the silver color tone is changed. Thus, a new technology where the increase of maximum density, sensitization and color tone are compatible has been required.

These silver salt photothermographic dry imaging materials are characterized by making photosensitive silver halide grains provided in a photosensitive layer a photosensor, making an organic silver salt a source of silver ions, and in that images are formed by heat developing at 80 to 250° C. with a built-in reducing agent and no photographic fixing is carried out.

It is desirable to minimize an applied amount of silver which is a valuable resource in the dry imaging materials as well as in imaging materials in earlier technology. A basic technology includes making the photosensitive silver halide grains small. That is, individual developed silver produced after the heat developing becomes fine when a number of development initiation points is increased, and thus it is advantageous in terms of optical density because a ratio of a sectional area which the developed silver occupies per unit sectional area of the material is increased in the dry imaging material made of the same amount of silver. That is, it is possible to enhance a covering power value, increase the maximum density or accomplish saving silver. In technical examples included as the other technology for covering power enhancement, for example, disclosed is the technology to contain compounds which imagewasely produce chemical species capable of forming the development initiation points on and at vicinity of non-photosensitive aliphatic silver carboxylate and compounds similar thereto in the dry imaging material (e.g., see Patent References 6 and 7). In these technologies, improvement of covering power enhancement is observed, but they also have faults. Deterioration of image color tone is one example thereof. That is, as described in The Theory of the Photographic Process, fourth edition, pages 475 to 476 and Journal of Chemical Physics p-6755 to p-6759, 116 (2002), when sizes and shapes of the developed silver are changed, color tone of the developed silver is changed depending on absorption light and scattering light properties. When fine developed silver is produced, it mainly takes on a red tinge, and thus it often shifts from the color tone desired in the market. The reason why this color tone change is observed is thought to be that the number and ratio of fine silver clusters are increased, and in particular, it is noticeably observed at a high density area where the optical density is 2.0 or more. Thus, it has been difficult to simultaneously control the covering power enhancement and image color tone. Especially, in the silver salt photothermographic dry imaging material for the medical use, image quality improvement to enable more precise diagnosis is said to be one of extremely important properties, and as one example thereof, desired is the image color tone having the color tone where fatigue of the eyes is unlikely brought at observation.

At the same time, ideas have been made to improve the color tone. For example, a mix of photosensitive silver halide with different particle sizes and changes of halide compositions have been studied to control the shapes and sizes of the developed silver. Also, the ideas by the compounds referred to as color toning agents known to play a role as a silver carrier at the heat developing are disclosed (e.g., see Patent References 8 and 9), but it can not be said that significant improvement is obtained.

Also, the improvement of color materials has been attempted. For example, the improvement by leuco dyes is disclosed (e.g., see Patent References 10 and 11), but it can control only a part of hue, and further there is no description and suggestion for color tone improvement at the optical density of 2.0 or more. The improvement by coupler type coloring dyestuffs is disclosed (e.g., see Patent Reference 12), but the color tone control is difficult, slight deviance of the color tone occurs in every process, and reproducibility is poor.

Furthermore, when numerous fine silver clusters are present, so-called image storage stability is easily deteriorated such as the case where the imaging material after heating process is exposed under irradiated light. Specifically, many examples where silver image density and color tone are easily changed are observed. If residual sensitivity of the photosensitive silver halide after the heating process is low, this effect is reduced, but still it cannot be said that it is a sufficient level, and it is not preferable because the sensitivity at the regular exposure is also reduced. No reason other than the photosensitivity mentioned above is unclear, but for example, the finer the silver clusters are, the more the number increases, and this might easily become catalysis which reduces the silver of the residual silver salt. Or it might be because the fine developed silver per se is unstable for light and heat.

Therefore, strongly required is the technology where the color tone of images is improved with accomplishing the covering power enhancement and further the image storage stability after the heating process is improved.

Further, the photothermographic imaging materials (hereinafter, also referred only to as "photothermographic materials" or "imaging materials") have already been suggested from the past. For example, they are described in U.S. Pat. Nos. 3,152,904 and 3,487,075, or D. H. Klosterboer, "Dry Silver Photographic Materials" (Handbook of Imaging Materials, Marcel Dekker, Inc., page 48, 1991), known are silver salt photothermographic dry imaging materials (hereinafter, also referred to as photothermographic imaging materials or simply imaging materials) containing an organic silver salt, photosensitive silver halide and a reducing agent on a support. This silver salt photothermographic dry imaging material has an advantage capable of providing users with a system which is simpler and does not impair the environment because no solution type processing chemical is used at all.

This photothermographic material is processed by a thermal development apparatus which adds stable heat to the photothermographic material to form the image, typically called a thermal developer. As mentioned above, in conjunction with the recent rapid prevalence, this thermal developer has been supplied in the market in large quantities. In the meanwhile, there has been problematic in that slipping property between the imaging material and a transport roller or processing members of the thermal developer changes, and transport failure and density unevenness occur. Also there has been problematic in that the density of the photothermographic imaging material varies with time. It has been found that these phenomena noticeably occur in the photothermographic imaging materials where image exposure is performed by laser light and subsequently the image is formed by thermal development. Also, recently, compaction of laser imager and acceleration of photographic processing have been required.

Therefore, property improvement of the photothermographic imaging materials becomes essential. For downsizing the thermal development processing apparatus, it is more advantageous to use a heat drum mode than to use a horizontal transport mode, but there has been problematic in that powder drop off, density unevenness and roller mark easily occur at the thermal development processing. Also, even when the rapid processing is carried out, to obtain sufficient density of the photothermographic imaging material, it is effective to use those with smaller mean particle size as silver halide to enhance covering power and use development accelerators such as hydrazine and vinyl compounds as shown in JP-A-11-295844 and JP-A11-352627. However, when these technologies were used, there was problematic in that density changes (printout property) with time after the thermal development processing became large and the silver color tone became extremely different compared to wet type X-ray films in earlier technology. Improvement technology of the printout property is disclosed in JP-A-2001-133925, regulation technology of the silver color tone is disclosed in JP-A-11-231460, JP-A-2002-169249, JP-A-2002-236334 and JP-A-2002-296729, and technology to inhibit the increase of photographic fog before and after the development is disclosed (see Patent References 13 to 15), but it could not be said that they were sufficient to solve all the above problems.

[Patent References]

1. JP-A-10-282601
2. JP-A-2001-109100
3. JP-A-2002-23303
4. JP-A-2002-49119
5. JP-A-2002-169249
6. JP-A-2002-287294 (page 1)
7. JP-A-2002-296730 (page 1)
8. JP-A-2002-116522 (page 1)
9. JP-A-2002-174877 (page 1)
10. JP-A-11-231460 (page 1)
11. JP-A-2002-169249 (page 1)
12. JP-A-2002-246927 (page 1)
13. U.S. Pat. No. 5,686,228
14. U.S. Pat. No. 6,171,767
15. JP-A-11-231460

SUMMARY OF THE INVENTION

The present invention has been performed in view of the above problems, and a first object thereof is to provide a silver salt photothermographic dry imaging material with high sensitivity and low photographic fog, which is excellent in image color tone and silver image stability after thermal development, and an image recording method and an image forming method using the same.

A second object of the present invention is to provide a silver salt photothermographic dry imaging material where the nearly same image color tone is reproduced even when a density area is changed, and an image recording method and an image forming method using the same.

Further, a third object of the present invention is to provide a silver salt photothermographic dry imaging material which is excellent in reproducibility of image color tone in every heat treatment and where density unevenness after the heat treatment is improved, and an image recording method and an image forming method using the same.

Moreover, a fourth object of the present invention is to provide a silver salt photothermographic dry imaging material with low photographic fog, high sensitivity and high maximum density, which are excellent in image color tone and excellent in rapid thermal development suitability, as well as an image recording method and an image forming method using the same.

Furthermore, a fifth object of the present invention is to provide a photothermographic imaging material with high density which are excellent in light radiated image stability, silver color tone, change of silver color tone with time, density unevenness at the thermal development and image storage stability in storage at room temperature. Also, the object of the invention is to further provide the photothermographic imaging materials which are excellent in image storage stability in storage at high temperature or excellent in film transportability and environmental suitability if necessary.

In order to achieve the above-described objects, according to a first aspect of the present invention, the silver salt photothermographic dry imaging material of the present invention comprises non-photosensitive aliphatic carboxylic acid silver salts; a photosensitive emulsion containing photosensitive silver halide grains; a silver ion reducing agent; a binder; and a cyan coloring leuco dye, wherein a percentage of the photosensitive silver halide grains having a mean particle size of 0.01 μm or more and 0.04 μm or less is 5% or more by mass and 50% or less by mass of total photosensitive silver halide grains by conversion into a silver amount.

In the silver salt photothermographic dry imaging material, preferably, the non-photosensitive aliphatic carboxylic acid silver salts are manufactured by making a silver ion-containing solution using water or a mixture of water and an organic solvent as a solvent react with an alkali metal salt of aliphatic carboxylic acid-containing solution using water, an organic solvent or a mixture of water and the organic solvent as a solvent under existence of tertiary alcohol.

Further, according to a second aspect of the present invention, the silver salt photothermographic dry imaging material of the present invention comprises non-photosensitive aliphatic carboxylic acid silver salts; a photosensitive emulsion containing photosensitive silver halide grains; a silver ion reducing agent; a binder; and a cyan coloring leuco dye, wherein the non-photosensitive aliphatic carboxylic acid silver salts are manufactured by making a silver ion-containing solution using water or a mixture of water and an organic solvent as a solvent react with an alkali metal salt of aliphatic carboxylic acid-containing solution using water, an organic solvent or a mixture of water and the organic solvent as a solvent under existence of tertiary alcohol.

In the above-described first and second aspects, preferably, the binder contains latex of polymer with an equilibrium water content of 2% or less by mass at 25° C. and at 60% RH.

Moreover, according to a third aspect of the present invention, the silver salt photothermographic dry imaging material of the present invention comprises non-photosensitive aliphatic carboxylic acid silver salts; a photosensitive emulsion containing photosensitive silver halide grains; a silver ion reducing agent; a binder; and a cyan coloring leuco dye, wherein the binder contains latex of polymer with an equilibrium water content of 2% or less by mass at 25° C. and at 60% RH.

Further, according to a fourth aspect of the present invention, the silver salt photothermographic dry imaging material of the present invention comprises a support; a photosensitive layer containing non-photosensitive aliphatic carboxylic acid silver salts, photosensitive silver halide grains, a silver ion reducing agent and a binder, the photosensitive layer being provided on the support; a cyan coloring leuco dye; and at least one compound selected from the group of compounds represented by the following Formulas (1) to (4), (A-8), (A-9), (PO) and (J).

(1)

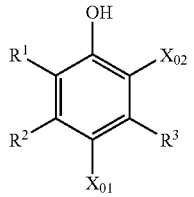

(2)

$$Z_{10}—P—L_1—(C{=}Q_1)—Y_1$$

(3)

$$Z_{20}—SO_2—SM_2$$

-continued (4)

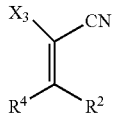

(A-8)

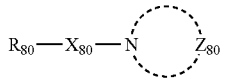

(A-9)

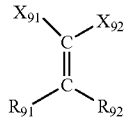

(PO)

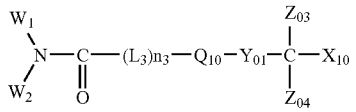

(J)

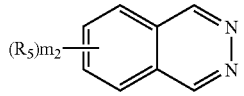

Here, in the Formula (1), with respect to $R^1$, $R^2$ and $R^3$, the adjacent groups may be mutually bonded to form a ring. Further, in the Formula (A-9), $X_{91}$ and $X_{92}$ may be bonded to each other to form a ring structure. In addition, $X_{91}$ and $R_{91}$ are represented in a cis form, however, it includes a form of trans of $X_{91}$ and $R_{91}$. Furthermore, in the Formula (J), when m2 is 2 or more, the two adjacent $R_5$s may form an aliphatic or aromatic ring.

By containing the compound represented by the Formula (A-8) or (A-9), it becomes possible to reduce the silver color tone changes with time in addition to being high density and excellent in silver color tone and light radiated image stability.

Further, by containing the compound represented by the Formula (PO), it becomes possible to improve the image storage stability in storage at room temperature in addition to being high density and excellent in silver color tone and light radiated image stability. Furthermore, by containing the compound represented by the Formula (J), it becomes possible to improve the density unevenness at the thermal development in addition to being high density and excellent in silver color tone and light radiated image stability.

In the silver salt photothermographic dry imaging material, preferably, the photosensitive silver halide grains are chemically sensitized.

More preferably, chalcogen sensitization is performed to the photosensitive silver halide grains with at least one sulfur sensitizer represented by the following Formulas (5-1) to (5-3) or a sulfur sensitizer having a nucleus represented by the following Formula (5-4), (5-5) or (5-6).

(5-1)

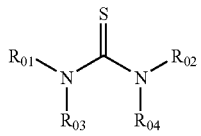

-continued (5-2)

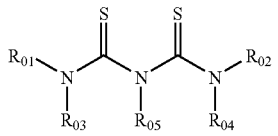

(5-3)

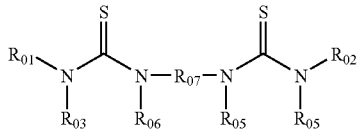

(5-4)

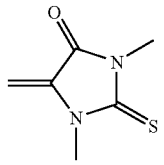

(5-5)

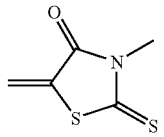

(5-6)

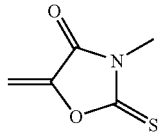

Furthermore, preferably, chalcogen sensitization is performed to the photosensitive silver halide grains with at least one selenium sensitizer represented by the following Formulas (6-1) and (6-2).

(6-1)

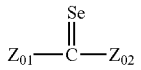

(6-2)

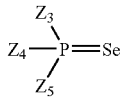

Here, in the Formula (6-1), $Z_{01}$ and $Z_{02}$ may be the same as or different from each other, and $A_1$, $A_2$, $A_3$ and $A_4$ also may be the same as or different from each other. Further, $A_1$ and $A_2$ may be a hydrogen atom or an acyl group. Moreover, in the Formula (6-2), $Z_3$, $Z_4$ and $Z_5$ may be the same as or different from each other.

Further, it is preferable that chalcogen sensitization is performed to the photosensitive silver halide grains with at least one tellurium sensitizer represented by the following Formulas (7-1) to (7-6).

(7-1)

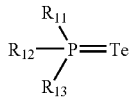

-continued (7-2)

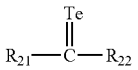

(7-3)

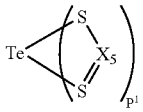

(7-4)

$Te(L_2)m_1(X^1)n_1$ (7-5)

$Pd(X^2)_2[Te(R')_2]_2$ (7-6)

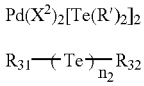

Here, in the Formula (7-2), $R_{21}$ represents an aliphatic group, an aromatic group, a heterocyclic group or an $NR_{23}(R_{24})$, the $R_{21}$ represents an —$NR_{25}(R_{26})$, an —$N(R_{27})N(R_{28})R_{29}$ or an —$OR_{30}$. Then, $R_2$, and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, and $R_{23}$ and $R_{30}$ may be bonded to form a ring. Further, in the Formula (7-6), $R_{31}$ and $R_{32}$ may be the same as or different from each other.

Furthermore, the photosensitive silver halide grains are preferable to be chemically sensitized with a gold sensitizer represented by the following Formula (8).

$$Au(III)L'rY_3q \quad (8)$$

In the above-described first to fourth aspects, preferably, coefficient of determination $R^2$ of a linear regression straight line is 0.998 or more and 1.000 or less, the $R^2$ being made by measuring each density at optical density of 0.5, 1.0, 1.5 and minimum optical density on a silver image obtained-after thermal development processing of the silver salt photothermographic dry imaging material and disposing u* and v* at the above each optical density on two dimensional coordinates where a horizontal and vertical axes in CIE 1976 (L*u*v*) color space are made u* and v*, respectively; and v* value of an intersection point with the vertical axis of the linear regression straight line is −5 or more and 5 or less; and a slope (v*/u*) is 0.7 or more and 2.5 or less.

In the silver salt photothermographic dry imaging material, a compound represented by the following Formula (A-6) in a side of a face having the photosensitive layer is preferably contained.

(A-6)

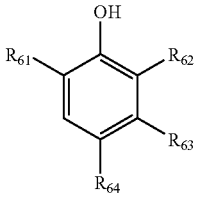

Furthermore, preferably, an average gradation is from 2.0 to 4.0 at an optical density of 0.25 to 2.5 in diffused light on a characteristic curve shown on rectangular coordinates where unit lengths of diffuse density (Y axis) and common logarithm exposure amount (X axis) are equal on an image obtained by thermally developing at a development temperature of 123° C. for a development time of 13.5 sec.

More preferably, a glass transition temperature Tg of the binder is from 70° C. to 150° C. Thereby, it becomes possible to enhance the image storage stability in storage at higher temperature.

Further preferably, a compound represented by the following Formula (SF) is contained.

$$(Rf—(L_4)_{n4}—)_{p2}—(Y_3)_{m4}—(A)_{q1} \quad (SF)$$

Thereby, it becomes possible to further enhance the film transportability and the environmental suitability (accumulation in vivo).

Further, it is preferable to contain at least one silver saving agent selected from a vinyl compound, a hydrazine derivative, a silane compound and a quaternary onium salt in a side of a face having the photosensitive layer.

Moreover, preferably, the silver halide grains are chemically sensitized with a chalcogen compound. More preferably, an amount of silver contained in the photosensitive layer is preferable to be from 0.3 to 1.5 g/m$^2$.

Here, the material may contain the silver halide grains having a mean particle size of 10 to 40 nm.

Preferably, the mean particle size is 10 to 35 nm. When the mean particle size of the silver halide is less than 10 nm, sometimes the image density is reduced and the light radiated image stability is deteriorated. Also when it is more than 40 nm, the image density is sometimes reduced. Here, the mean particle size is referred to a length of an arris of the silver halide particle when the silver halide particle is in normal crystal shape such as cubic or octahedral shape. Also, when the silver halide particle is a tabular particle, it is referred to a diameter when the particle is converted into a circle with the same area as a projected area of a major surface of the particle. When the particle is in the other shape which is not the normal crystal, such as spherical particle and bar particle, the diameter when a sphere with the same volume as that of the silver halide particle is thought is calculated as the particle size. The measurement was carried out using electron microscopy, and the mean particle size was obtained by averaging the measured values of 300 particle sizes.

Further, the silver halide grains may contain silver halide grains with a mean particle size of 10 to 40 nm and a mean particle size of 45 to 100 nm.

By combining the silver halide grains with the mean particle size of 45 to 100 nm and the silver halide grains with the mean particle size of 10 to 40 nm, it is possible to enhance the image density or improve (reduce) the image density reduction with time. A mass ratio of the silver halide grains with the mean particle size of 10 to 40 nm to the silver halide grains with the mean particle size of 45 to 100 nm is preferably from 95 to 5 to 50:50, and more preferably from 90:10 to 60:40.

Further, the reducing agent is preferable to be a compound represented by the following Formula (A-1), (A-4) or (A-5).

(A-1)

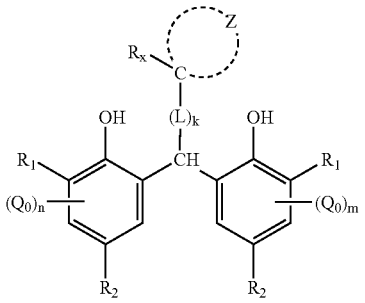

(A-4)

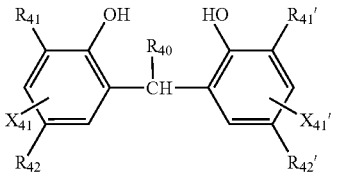

(A-5)

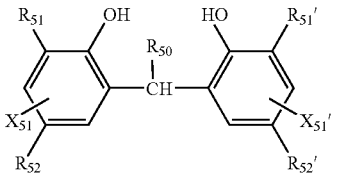

(A)

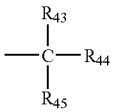

Here, in the Formula (A-1), Z represents an atomic group required to configure a 3- to 10-membered ring with carbon atoms, and Rx represents a hydrogen atom or an alkyl group. $R_1$, $R_2$ and $Q_0$ represent groups capable of being substituted on the benzene ring, L represents a bivalent linkage group, k represents an integer of 0 or 1, and n and m represents an integer of 0 to 2. A plurality of $R_1$, $R_2$ and $Q_0$ may be the same as or different from each other. Further, in the Formula (A-4), $R_{40}$ represents the Formula (A), and $R_{43}$ to $R_{45}$ each represent a hydrogen atom or a substituent. When $R_{43}$ to $R_{45}$ in the Formula (A) do not form the ring one another, $R_{40}$ comprises at least one ethylene group which may be substituted or acetylene group which may be substituted. When $R_{43}$ to $R_{45}$ in the Formula (A) form the ring one another, $R_{40}$ comprises at least one ethylene group which may be substituted or acetylene group out of this ring. $R_{41}$, $R_{41}'$, $R_{42}$, $R_{42}'$, $X_{41}$, and $X_{41}'$ each represents a hydrogen atom or a substituent.

In the Formula (A-5), $R_{50}$ represents a hydrogen atom or a substituent. $R_{51}$, $R_{51}'$, $R_{52}$, $R_{52}'$, $X_{51}$, and $X_{51}'$ each represents a hydrogen atom or a substituent. However, at least one of $R_{51}$, $R_{51}'$, $R_{52}$, $R_{52}'$, $X_{51}$, and $X_{51}'$ comprises an ethylene group which may be substituted or an acetylene group which may be substituted.

Furthermore, the reducing agent represented by the Formula (A-1) is preferable to be a reducing agent represented by the following Formula (A-2).

(A-2)

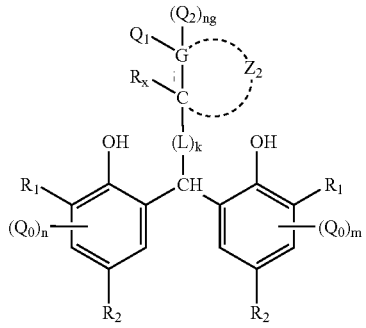

In the formula, $Q_1$ represents a halogen atom, an alkyl, aryl or hetero ring group, $Q_2$ represents a hydrogen atom, a halogen atom, an alkyl, aryl or hetero ring group, and the halogen atoms specifically include chlorine, bromine, fluorine and iodine. Preferably it is fluorine, chlorine or bromine. G represents a nitrogen or carbon atom. However, when G is a nitrogen atom, ng is 0. When G is a carbon atom, ng is 0 or 1. $Z_2$ represents a carbon atom and an atomic group required for configuring a 3- to 10-membered non-aromatic ring together with G. $R_1$, $R_2$, $R_x$, $Q_0$, L, k, n and m are the same as defined in the Formula (A-1).

More preferably, the non-aromatic ring represented by $Z_2$ in the Formula (A-2) is a 6-membered non-aromatic ring.

Further, according to a fifth aspect of the present invention, the method for recording an image on the material in the above-described first to fourth aspects of the present invention, comprises performing image exposure according to a vertical multiple mode laser scanning exposure apparatus.

Moreover, according to a sixth aspect of the present invention, the method for forming an image after performing image recording on the material in the above-described first to fourth aspects of the present invention, comprises thermal developing in a state containing 40 to 4500 ppm of organic solvent.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

Figure 1:
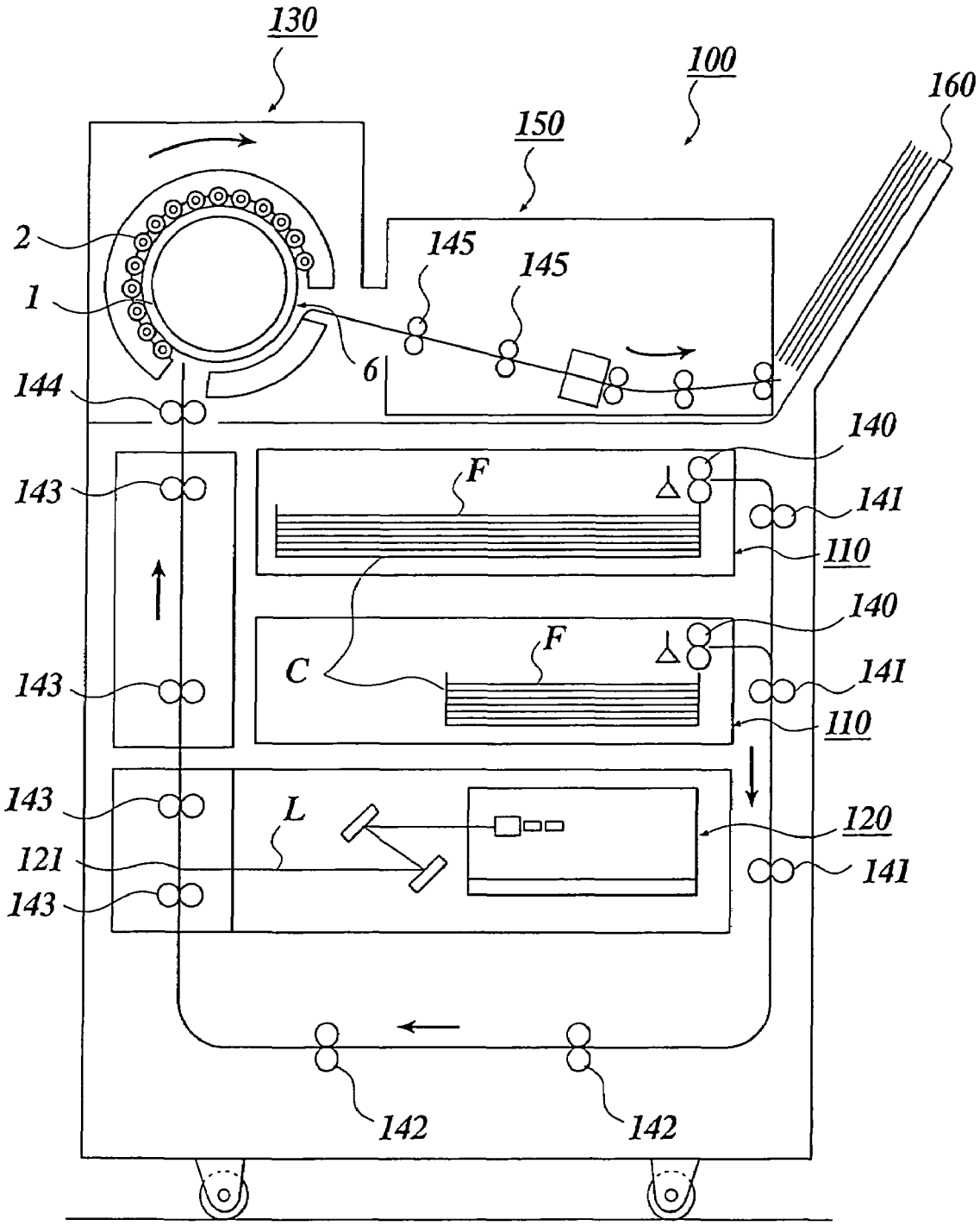
FIG. 1 is a view showing a specific example of a thermal development apparatus.

DETAILED DESCRIPTION OF THE INVENTION (Non-Photosensitive Aliphatic Silver Carboxylate)

First, described is non-photosensitive aliphatic silver carboxylate according to the invention.

The non-photosensitive aliphatic silver carboxylate according to the invention is a reducible silver source, and is preferably a silver salt of long chain aliphatic carboxylic acid with 10 to 30 carbons, and preferably from 15 to 25 carbons. Examples of the suitable silver salts include the followings.

For example, included are silver salts of gallic, oxalic, behenic, stearic, arachidic, palmitic, lauric acids and the like, and preferable silver salts include silver behenate, silver arachidate and silver stearate.

Further, the following compounds may be used together with the non-photosensitive aliphatic silver carboxylate of the present invention within the range not damaging the effects of the present invention. As these compounds, for example, it is possible to use carboxyalkylthio urea salts of silver, e.g., silver salts of 1-(3-carboxypropyl) thiourea, 1-(3-carboxypropyl)-3,3-dimethyl thiourea; silver salts or silver complexes of polymer reaction product of aldehyde with hydroxy-substituted aromatic carboxylic acid, e.g., silver salts or silver complexes of the reaction product of aldehydes (formaldehyde, acetaldehyde, butylaldehyde, etc.) with hydroxy-substituted acids (e.g., salicylic acid, benzoic acid, 3,5-hydroxybenzoic acid); silver salts or silver complexes of thiones, e.g., silver salts or silver complexes of 3(2-carboxyethyl)-4-hydroxymethyl-4-thiazoline-2-thione, and 3-carboxymethyl-4-thiazoline-2-thione, etc.; complexes or salts of silver with nitrogen acid selected from imidazole, pyrazole, urazole, 1,2,4-thiazole and 1H-tetrazole, 3-amino-5-benzylthio-1,2,4-triazole and benzotriazole; silver salts of saccharine, 5-chlorosalicylaldoxime, and the like; and silver mercaptides.

Also, in the present invention, it is preferred that two or more aliphatic silver carboxylates are mixed in terms of enhancing development property and forming silver images with a high density and a high contrast, and it is preferable to prepare by mixing a silver ion solution with two or more aliphatic carboxylic acid mixture.

On the other hand, in the light of image storage stability after the development, it is preferred that a content of the silver salt of aliphatic carboxylic acid with a melting point at 50° C. or above preferably 60° C. or above which is a raw material of the aliphatic silver carboxylate is 60% or more, preferably 70% or more, and more preferably 80% or more. From this point of view, specifically it is preferred that the content of silver behenate is high.

The aliphatic silver carboxylate compound is obtained by mixing a water soluble silver compound and a compound forming a complex with the silver. Preferably used are a normal mixing method; a reverse mixing method; a simultaneous mixing method; a controlled double jet method described in JP-A-9-127643. For example, crystal of the aliphatic silver carboxylate is made by adding an alkali metallic salt (e.g., sodium behenate, sodium arachidate) to an organic acid to make an organic acid alkali metallic salt soap and subsequently mixing the soap with silver nitrate by the controlled double jet method. At that time, the silver halide grains may be mixed.

The aliphatic silver carboxylate according to the invention may be crystal particles having a core/shell structure disclosed in U.S. Pat. No. 6,465,167, Europe Patent No. 1,168,069A1, and JP-A-2002-23303, or dimer disclosed in Europe Patent No. 1,152,287A2 and JP-A-2002-49119. In the case of making the core/shell structure, the organic silver salt other than the aliphatic silver carboxylate, e.g., the silver salt of organic compounds such as phthalic acid and benzimidazole may be used for whole of either or a part of the core or shell parts as the component of crystal particles.

In the aliphatic silver carboxylate according to the invention, an average diameter of corresponding circles is preferably 0.05 μm or more and 0.8 μm or less, and an average thickness is preferably 0.005 μm or more and 0.07 μm or less, and especially preferably the average diameter of corresponding circles is 0.2 μm or more and 0.5 μm or less and the average thickness is 0.01 μm or more and 0.05 μm or less.

When the average diameter of corresponding circles is 0.05 μm or less, it is excellent in transparency, but the image storage stability is poor. Also when the average diameter of corresponding circles is 0.8 μm or more, devitrification is intense. When the average thickness is 0.005 μm or less, a surface area is large and supply of silver ions at the development is rapidly performed, the silver ions are not used in the silver image at low density parts, a large amount of the silver ions remaining in film is present, and consequently the image storage stability is extremely deteriorated. When the average thickness is 0.07 μm or more, the surface area becomes small and the image storage stability is improved, but the supply of the silver at the development is slow resulting in unevenness of developed silver shape especially at the high density part, and consequently the maximum density easily becomes low.

To obtain the average diameter of corresponding circles, the aliphatic silver carboxylate after dispersing is diluted and dispersed on grids with carbon support film, photographed by transmission electron microscope (e.g., 2000FX type supplied from Japan Electron Optics Laboratory Co., Ltd.) at a direct magnification of 5000 folds, a negative film is imported as a digital image by a scanner, 300 or more of the particle sizes (corresponding circles) are measured using an appropriate image processing software, and the average particle size can be calculated.

To obtain the average thickness, it can be calculated by the method using the regular TEM (transmission electron microscope).

Concerning the other electron microscopy observation methods and sample making techniques in detail, it is possible to refer to "Medical/Biological Electron Microscope Observation Methods edited by Japanese Society of Electron Microscopy, Kanto Branch" (Maruzen) and "Electron Microscope Sample Making Methods edited by Japanese Society of Electron Microscopy, Kanto Branch" (Maruzen), respectively.

It is preferred that TEM images recorded in an appropriate media is resolved into at least 1024 pixels×1024 pixels, and preferably 2048 pixels×2048 pixels per image and the image processing by a computer is carried out. To carry out the image processing, it is preferred to convert analog image recorded on films into digital images by the scanner and give shading compensation, contrast/edge emphasis and the like if necessary. Subsequently histograms are made and the sites corresponding to the aliphatic silver carboxylate are extracted by binarization.

Using appropriate software, the thickness of 300 or more of the above extracted aliphatic silver carboxylate particles were measured manually and the average value is obtained.

The method for obtaining the aliphatic silver carboxylate particles having the above shape is not especially limited, but it is effective to keep the mixing state at the formation of the organic acid alkali metallic salt soap or the mixing state when silver nitrate is added to the soap good or to optimally set a ratio of the organic acid to the soap and a ratio of silver nitrate reacting with the soap.

In the present invention, it is preferred that the tabular aliphatic silver carboxylate particles (referred to the aliphatic silver carboxylate-particles with the average diameter of corresponding circles of 0.05 μm or more and 0.8 μm or less and the average thickness of 0.005 μm or more and 0.07 μm or less) are predispersed along with binders and surfactants if necessary, and subsequently dispersed/pulverized by a media dispersing machine or a high pressure homogenizer. As the above predispersing method, it is possible to use general agitators such as anchor type and propeller type, a high speed rotary centrifuging radiating agitator (dissolver) and a high speed shearing agitator (homo mixer).

Also, as the above media dispersing machine, it is possible to use rolling mills such as a ball mill, planetary ball mill and vibrating ball mill, media mixing mills such as a bead mill and attritor, and the others such as a basket mill, and as high pressure homogenizers, it is possible to use various types such as a type of conflicting to walls and plugs, a type where a liquid is divided into two and then the liquids are crashed at a high-speed and a type of passing through thin orifices.

As ceramics used for ceramic beads used at media dispersion, preferred are, for example, $Al_2O_3$, $BaTiO_3$, MgO, ZrO, BeO, $Cr_2O_3$, $SiO_2$, $SiO_2$—$Al_2O_3$, $Cr_2O_3$—MgO, MgO—CaO, MgO—C, MgO—$Al_2O_3$ (spinel), SiC, $TiO_2$, $K_2O$, $Na_2O$, BaO, PbO, $B_2O_3$, $SrTiO_3$ (strontium titanate), $BeAl_2O_4$, $Y_3Al_5O_{12}$, $ZrO_2$—$Y_2O_3$ (cubic zirconia), 3BeO—$Al_2O_3$—$6SiO_2$ (synthetic emerald), C (synthetic diamond), $Si_2O$-$nH_2O$, silicon nitride, yttrium stabilized zirconia, zirconia strengthened alumina and the like. Yttrium stabilized zirconia and zirconia strengthened alumina (hereinafter, abbreviated the zirconia-containing ceramics as zirconia) are specially preferably used from the reason why production of impurities due to friction with beads and the dispersing machine at the dispersion is low.

In the apparatuses used upon dispersing the tabular organic silver salt particles, as materials of members to which the organic silver salt particles contact, it is preferable to use ceramics such as zirconia, alumina, silicon nitride and boron nitride, or diamond, and among others it is preferable to use zirconia.

When the above dispersion is carried out, it is preferred that the binder is added at a concentration of 0.1 to 10% of the organic silver salt by mass, and it is preferred that liquid temperature is less than 45° C. throughout from predispersion to main dispersion. A preferable operating condition of the main dispersion includes the condition of 29 MPa to 100 MPa and two times or more of operations when the high pressure homogenizer is used as the dispersion means as the preferable operating condition. Also when the media dispersing machine is used as the dispersing means, the condition where a peripheral velocity is from 6 m/second to 13 m/second is included as the preferable condition.

In the present invention, it is preferred that the non-photosensitive aliphatic silver carboxylate particles are those formed in the presence of the compound which functions as a crystal growth inhibitor or a dispersant. Also, it is preferred that the compound which functions as the crystal growth inhibitor or the dispersant is an organic compound having hydroxyl or carboxyl group.

In the present invention, it is preferable to manufacture the aliphatic silver carboxylate under the condition where t-butanol which functions as the dispersant coexists as described below in the manufacture step of the aliphatic silver carboxylate. Because, this has functions to make smaller particle sizes and make further monodisperse compared to the case of manufacturing under the condition where this does not coexist, and thus higher covering power is obtained.

Alcohol with 10 or less of carbons, preferably secondary alcohol and tertiary alcohol reduce viscosity by raising solubility of sodium aliphatic carboxylate in the particle making step, and make monodisperse and smaller particle sizes by enhancing an agitation efficacy. Branched aliphatic carboxylic acid and aliphatic unsaturated carboxylic acid do not produce large crystals and consequently make smaller particle sizes because their steric hindrance is higher than that of linear aliphatic carboxylic acid which is a main component when the aliphatic silver carboxylate is crystallized and disarrangement of crystal lattice becomes large.

A solution in a silver ion-containing solution herein means the given solution, and for example, is an aqueous solution or a mix aqueous solution with an organic solvent. As the organic solvents which can be used here, it is possible to use the given solvents as long as they are water-miscible, those adversely affecting photographic performance are not preferable, the solvent is preferably alcohol or acetone which is water-miscible, more preferably tertiary alcohol, and still preferably tertiary alcohol with 4 to 6 carbons. The tertiary alcohol with 4 to 6 carbons may be comprised in the above silver ion-containing solution, and in that case, it is 70% or less, and preferably 50% or less as a volume based on the whole volume of the aqueous solution of water-soluble silver salt. The temperature of that solution is preferably 0° C. or above and 50° C. or below, more preferably 5° C. or above and 30° C. or below, and in the case where the aqueous solution comprising the water-soluble silver salt and the tertiary alcohol aqueous solution of the aliphatic carboxylic acid alkali metallic salt are simultaneously added, the temperature at 5° C. or above and 15° C. or below is the most preferable.

The aliphatic carboxylic acid alkali salt used in the invention is typically supplied in the form of solution or suspension, preferably in the form of solution. The solution herein is the given solution, and for example includes the aqueous solution, the mix aqueous solution with the organic solvent or the organic solvent solution. As the organic solvents which can be used here, it is possible to use the given solvent, those adversely affecting photographic performance are not preferable, the solvent is preferably alcohol or acetone which is water-miscible, more preferably tertiary alcohol, and still preferably tertiary alcohol with 4 to 6 carbons. In the case where the alkali metallic salt of aliphatic carboxylic acid is supplied in the mix aqueous solution with the organic solvent, the amount of the organic solvent used to obtain evenness of liquid is 3% or more and 70% or less and preferably 5% or more and 50% or less as a solvent volume based on the volume of water. At that time, the optimal solvent volume varies depending on reaction temperature, and thus the optimal amount can be determined by trials and errors.

In order to form the aliphatic silver carboxylate in the invention, it is preferable to contain the organic solvent at the amount where the alkali metallic salt of aliphatic carboxylic acid is not ribbon-like association or micelle but can be substantially clear in at least one of the silver ion solution, the aliphatic carboxylic acid alkali metallic salt solution or suspension and a solution precedently prepared at the reaction field. In the added silver ion-containing solution and the aliphatic carboxylic acid alkali metallic salt solution or suspension, pH can be adjusted depending on required properties of the particles. A given acid or alkali can be added to adjust the pH. Also depending on the required property of the particles, for example, for the control of particle sizes of the prepared aliphatic silver carboxylate, the temperature in a reaction vessel can be voluntarily set, and it is also possible to adjust the added silver ion-containing solution and the aliphatic carboxylic acid alkali metallic salt solution or suspension to the given temperature. It is preferable to heat and retain the aliphatic carboxylic acid alkali metallic salt solution or suspension at 50° C. or above to secure fluidity of the liquid. It is preferred that the aliphatic solver carboxylate used for the invention is prepared in the presence of tertiary alcohol. The tertiary alcohols used for the invention is preferably those with 15 or less of total carbons, and especially preferably those with 10 or less. Examples of preferable tertiary alcohols include t-butanol and like, but the invention is not limited thereto.

The tertiary alcohol used for the invention may be added at any timing of the preparation of the aliphatic silver carboxylate, but it is preferable to add at the preparation of the aliphatic carboxylic acid alkali metallic salt and use by dissolving the aliphatic carboxylic acid alkali metallic salt. Also the tertiary alcohol can be voluntarily used in the range of mass ratio at 0.01 to 10 to $H_2O$ as the solvent at the preparation of the aliphatic silver carboxylate, but the range of 0.03 to 1 is preferable. It is preferred that the preferable scale-like aliphatic silver carboxylate in the invention is manufactured by the method where the temperature difference is made 20° C. or above and 85° C. or below between the liquid in the reaction vessel (is preferably the aqueous solution comprising the water-soluble silver salt precedently added, or water or the mix solvent of water and tertiary alcohol when the aqueous solution comprising water-soluble silver salt is not precedently added and is added in parallel with the tertiary alcohol aqueous solution comprising the metallic salt, and when the aqueous solution comprising water-soluble silver salt is precedently added, the water or the mix solvent of the water and the tertiary alcohol may be precedently added) and the tertiary alcohol aqueous solution comprising the aliphatic carboxylic acid alkali metallic salt when the aqueous solution comprising water-soluble silver salt and the tertiary alcohol aqueous solution comprising the aliphatic carboxylic acid alkali metallic salt are reacted in the reaction vessel (including the step where the tertiary alcohol aqueous solution comprising the aliphatic carboxylic acid alkali metallic salt is added to the liquid in the reaction vessel).

Crystal form and the like of the aliphatic silver carboxylate are preferably controlled by retaining such a temperature difference during the addition of the tertiary alcohol aqueous solution comprising the aliphatic carboxylic acid alkali metallic salt. The tertiary alcohol aqueous solution comprising the aliphatic carboxylic acid alkali metallic salt used in the invention is preferably the mix solvent of water and tertiary alcohol with 4 to 6 carbons to obtain evenness of the liquid. When the carbons surpass this, it is not preferable because compatibility with water is lost. In the tertiary alcohols with 4 to 6 carbons, t-butanol which is the most compatible with water is the most preferable. Alcohols other than tertiary alcohols are not preferable because they have reducibility and disturb the formation of aliphatic silver carboxylate. The amount of tertiary alcohol combined with the tertiary alcohol aqueous solution of the aliphatic carboxylic acid alkali metallic salt is 3% or more and 70% or less, and preferably 5% or more and 50% or less as a solvent volume based on a water volume of this tertiary alcohol aqueous solution.

The concentration of aliphatic carboxylic acid alkali metallic salt in the tertiary alcohol aqueous solution of the aliphatic carboxylic acid alkali metallic salt used for the invention is 7% or more and 50% or less, preferably 7% or more and 45% or less, and more preferably 10% or more and 40% or less by mass as the mass ratio. The temperature of the tertiary alcohol aqueous solution of the aliphatic carboxylic acid alkali metallic salt added to the reaction vessel is preferably 50° C. or above and 90° C. or below, more preferably 60° C. or above and 85° C. or below, and most preferably 65° C. or above and 85° C. or below for the purpose of retaining the temperature required to avoid crystallization and solidification phenomena of the aliphatic carboxylic acid alkali metallic salt. Also, it is preferable to constantly control at the certain temperature selected from the above range to constantly control the reaction temperature.

In the method for manufacture of the invention, to control the shape of the formed aliphatic silver carboxylate, the temperatures of the silver ion solution and the aliphatic carboxylic acid alkali metallic salt solution are adjusted to an appropriate temperature. The temperature of the silver ion solution is preferably 5° C. or above and 60° C. or below, and more preferably 5° C. or above and 40° C. or below for the purpose of securing stability of the liquid. The temperature of the aliphatic carboxylic acid alkali metallic salt solution is preferably 50° C. or above and 90° C. or below and more preferably 60° C. or above and 85° C. or below for the purpose of retaining the temperature required to avoid the crystallization and solidification phenomena of alkali soap. Moreover, to the silver ion-containing solution, the solution or suspension of the aliphatic carboxylic acid alkali metallic salt, or the liquid in the reaction vessel to which both solution are added, it is possible to add, for example, the compounds represented by the Formula (1) of JP-A-62-65035, the water-soluble group-containing N-heterocyclic compounds as described in JP-A-62-150240, the inorganic peroxides as described in JP-A-50-101019, the sulfur compounds as described in JP-A51-78319, and the disulfide compounds as described in JP-A-57-643, and hydrogen peroxide and the like. The reaction temperature during the formation of silver salt is required to maintain at 5° C. or above and 60° C. or below, and is maintained more preferably at 10° C. or above and 50° C. or below and still preferably at 20° C. or above and 45° C. or below. It is possible to further improve the performance as the photographic imaging material by maintaining such a reaction temperature.

In the present invention, the aliphatic silver carboxylate is typically prepared by reacting the solution or suspension of the aliphatic carboxylic acid alkali metallic salt (includes Na, K, Li salts, etc.) with the silver ion-containing solution. The preparation of the aliphatic silver carboxylate can be performed in the given suitable vessel by a batch-wise mode or a continuous mode. Agitation in the reaction vessel can be performed by the given agitation method depending on required properties of the particles. As the method for preparing the aliphatic silver carboxylate, it is possible to preferably use any of the method where the silver ion-containing solution is gradually or rapidly added to the reaction vessel in which the solution or suspension of the aliphatic carboxylic acid alkali metallic salt is placed, the method where the precedently prepared solution or suspension of the aliphatic carboxylic acid alkali metallic salt is gradually or rapidly added to the reaction vessel in which the silver ion-containing solution is placed, and the method where the precedently prepared silver ion-containing solution and solution or suspension of the aliphatic carboxylic acid alkali metallic salt are simultaneously added to the reaction vessel. The silver ion-containing solution and the solution or suspension of the aliphatic carboxylic acid alkali metallic salt can be used at the given concentration for the control of the particle size of aliphatic silver carboxylate (generally preferable values are previously described herein), and can be added at the given addition velocity. As the addition method of the silver ion-containing solution and the solution or suspension of the aliphatic carboxylic acid alkali metallic salt, they can be added by the method for adding at the constant addition velocity, the accelerating addition method or the decelerating addition method by a given time function. Also, they may be added to the surface of the liquid or in the liquid of the reaction liquid. In the case of the method where the precedently prepared silver ion-containing solution and solution or suspension of the aliphatic carboxylic acid alkali metallic salt are simultaneously added to the reaction vessel, either the silver ion-containing solution or the solution or suspension of the aliphatic carboxylic acid alkali metallic salt can be precedently added, but it is preferred that the silver ion-containing solution is precedently added. A preceding degree is preferably from 0 to 50%, and more preferably from 0 to 25% by volume based on total addition amount. Also as described in JP-A-9-127643, it is possible to preferably use the method for the addition with controlling pH or a silver potential in the reaction liquid during the reaction.

In the present invention, in the case of using the tertiary alcohol aqueous solution of the aliphatic carboxylic acid alkali metallic salt, the aliphatic silver carboxylate is manufactured by (i) the method where the tertiary alcohol aqueous solution of the aliphatic carboxylic acid alkali metallic salt is singly added into the solution where the whole amount of silver ion-containing solution is precedently present in the reaction vessel, or ii) the method where the time period is present where the silver ion-containing solution and the solution or suspension of the aliphatic carboxylic acid alkali metallic salt are simultaneously added to the reaction vessel (simultaneous addition method). In the present invention, the simultaneous addition method is preferable in terms of controlling the average particle size of the aliphatic silver carboxylate and narrowing the distribution thereof. In such a case, it is preferred that the amount of 30% or more by volume based on the total addition amount is added simultaneously. More preferably the amount of 50 to 75% by volume is added simultaneously. When either one is precedently added, it is preferable to precede the silver ion-containing solution. In any cases, the temperature of the liquid (precedently added silver ion-containing solution described above, or the solvent precedently added in the reaction vessel as described below when the silver ion-containing solution is not precedently added) in the reaction vessel is preferably 5° C. or above and 75° C. or below, more preferably 5° C. or above and 60° C. or below, and most preferably 10° C. or above and 50° C. or below. It is preferable to control at the certain constant temperature selected from the above temperature throughout all steps of the reaction, but it is also preferable to control by several temperature patterns within the above temperature range.

In the present invention, in the case of using the tertiary alcohol aqueous solution of the aliphatic carboxylic acid alkali metallic salt, the temperature difference between the tertiary alcohol aqueous solution of the aliphatic carboxylic acid alkali metallic salt and the liquid in the reaction vessel is preferably 20° C. or above and 85° C. or below, and more preferably 30° C. or above and 80° C. or below. In this case, it is preferred that the temperature of the tertiary alcohol aqueous solution of the aliphatic carboxylic acid alkali metallic salt is higher. By this, preferably controlled are the velocity of precipitating as fine crystal by rapidly cooling the tertiary alcohol aqueous solution of the aliphatic carboxylic acid alkali metallic salt at high temperature in the reaction vessel and the velocity of making the aliphatic silver carboxylate by the reaction with the silver ions, and it is possible to preferably control crystal form, crystal sizes and crystal size distribution of the aliphatic silver carboxylate. Also, simultaneously it is possible to improve the performance as the photothermographic recording material, especially photothermographic imaging material. The solvent may be precedently contained in the reaction vessel, and water is preferably used for the precedently placed solvent, but the mix solvent with the above tertiary alcohol is also preferably used.

The organic silver salts which can be used for the silver salt photothermographic dry imaging material of the invention (hereinafter, referred to organic silver salts according to the invention) are reducible silver sources, and as organic silver salts as silver ion supplying source for silver image formation in the invention, preferred are silver salts of organic acids and hetero organic acids, especially in these salts, silver salts of long chain (from 10 to 30, preferably from 15 to 25 carbons) aliphatic carboxylic acids, and silver salts of nitrogen-containing heterocyclic compounds. Also preferred are organic or inorganic complexes described in Research Disclosure (hereinafter, also referred to as RD) 17029 and 29963 such as those where ligands have values of 4.0 to 10.0 as a total stability constant for silver ions. Examples of these suitable silver salts include the followings.

It is possible to include silver salts of organic acids, e.g., silver salts of gallic acid, oxalic acid, behenic acid, stearic acid, arachidic acid, palmitic acid, lauric acid, etc.

Among them, especially preferable silver salts include the silver salts of long chain (from 10 to 30, preferably from 15 to 25 carbons) aliphatic carboxylic acids such as silver behenate, silver arachidate and silver stearate.

The other examples include the organic silver salts described in a paragraph number of [0193]of JP-A-2001-83659. For the methods for manufacturing the organic silver salts and the particle sizes of the organic silver salts, it is possible to refer to the description in the paragraph numbers of [0194] to [0197] of the same patent. Also, as the organic silver salts according to the invention, it is possible to use the technologies described in the paragraph numbers of [0028] to [0033] of JP-A-2001-48902 and in the paragraph numbers of [0025] to [0041] of JP-A-2000-72777.

Also, it is preferred that two or more organic silver salts are mixed in terms of increasing development performance and forming silver images with high density and high contrast, and for example, it is preferable to prepare by mixing a silver ion solution to a mixture of two or more organic acids.

An organic silver salt compound can be obtained by mixing a water soluble silver compound and a compound which forms complex with the silver, and preferably used are a normal mixing method, a reverse mixing method, a simultaneous mixing method, a controlled double jet method as described in JP-A-9-127643, and the like. For example, an alkali metallic salt (e.g., sodium hydroxide, potassium hydroxide, etc.) is added to an organic acid to make an organic acid alkali metallic salt soap (e.g., sodium behenate, sodium arachidate, etc.), and subsequently crystal of an organic silver salt is made by mixing silver nitrate with the soap. At that time, silver halide grains may be mixed.

It is possible to use various shapes of the above organic silver salt according to the present invention, but tabular particles are preferable. Especially, preferred are the particles which are tabular organic silver salt particles with an aspect ratio of 3 or more and where the average value of an acicular ratio of the tabular organic silver salt particles measured from a major plane direction is from 1.1 or more and less than 10.0 in order to increase a filling rate in a photosensitive layer by reducing shape anisotropy of nearly parallel opposed two faces (major planes) having maximum area. Besides, more preferable acicular ratio is from 1.1 or more and less than 5.0.

Also, tabular organic silver salt particles with the aspect ratio of 3 or more represents that the tabular organic silver salt particles occupy 50% or more of the number of whole organic silver salt particles. Further, in the organic silver salt according to the present invention, the tabular organic silver salt particles with the aspect ratio of 3 or more occupy preferably 60% or more, more preferably 70% or more (number), and especially preferably 80% or more (number) of the number of whole organic silver salt particles.

Tabular particles with the aspect ratio of 3 or more are the particles where a ratio of a particle size to a thickness, so-called the aspect ratio (abbreviated as AR) represented by the following formula is 3 or more.

AR=Particle size(μm)/Thickness(μm)

The aspect ratio of the tabular organic silver salt particles is preferably from 3 to 20, and more preferably from 3 to 10. The reasons are that the organic silver salt particles are easily close-packed when the aspect ratio is too low whereas when the aspect ratio is too high, then the organic silver salt particles are easily overlapped and light scattering and the like easily occur because the particles are easily dispersed in a clung state, resulting in reduction of clear feeling of imaging materials. Thus, the range described above is preferable.

To measure the particle size of the organic silver salt particles described above, the organic silver salt after dispersion is diluted, dispersed on grids with carbon support film, photographed by transmission electron microscope (e.g., 2000 FX type, direct magnification 5000 folds supplied from Japan Electron Optics Laboratory Co. Ltd.), and the particle size is measured. Besides, when the average particle size is obtained, a negative image is imported as a digital image by a scanner, 300 or more particle sizes (diameter of corresponding circle) are measured using an appropriate image processing software, and the average particle size is calculated.

To obtain the thickness of the organic silver salt particles described above, it is calculated by a method using TEM (transmission electron microscope) as shown below.

First, an image formation layer coated on a support is attached on an appropriate holder by an adhesive, and an ultra thin slice with thickness of 0.1 to 0.2 μm is made using a diamond knife in a direction perpendicular to the support face. The ultra thin slice made is supported by copper mesh, transferred on a carbon film hydriphilized by glow discharge, a bright-field image is observed at a magnification of 5,000 to 40,000 folds using transmission electron microscope (hereinafter abbreviated as TEM) with cooling at −130° C. or below by liquid nitrogen, and the image is quickly recorded on a film, imaging plate, CCD camera and the like. At that time, it is preferred that parts where there is no break and sagging in the slice are appropriately chosen as the filed to be observed.

It is preferred that those supported with an organic film such as extremely thin collodion and formvar are used as the carbon film, and more preferably it is the film of carbon alone obtained by forming on a rock salt substrate and solving/removing the substrate or obtained by removing the above organic film by an organic solvent or ion etching. An accelerating voltage of TEM is preferably from 80 to 400 kV, and especially preferably from 80 to 200 kV.

It is preferred that TEM image recorded in an appropriate medium is resolved into at least 1024 pixels×1024 pixels, preferably 2048 pixels×2048 pixels per image and image processing by a computer is carried out. To carry out the image processing, it is preferred that an analog image recorded on the film is converted into the digital image by the scanner and given are shading compensation and contrast/edge emphasis and the like if necessary. Subsequently, a histogram is made, and sites corresponding to the organic silver salt particles are extracted by binarization processing.

To obtain the average thickness, the thickness of 300 or more organic silver salt particles extracted above is manually measured by appropriate software, and the average value is obtained.

Also, the average value of the acicular ratio of the tabular organic silver salt particles is obtained by the following method.

First, the photosensitive layer comprising the tabular organic silver salt particles are made swell in an organic solvent capable of dissolving a light photosensitive layer binder to exfoliate from the support, and ultrasonic washing using the above solvent, centrifugation and elimination of supernatant are repeated five times. Besides, the above steps are performed under a safe light. Subsequently, the sample is diluted with MEK (methylethylketone) such that an organic silver solid concentration is 0.01%, dispersed by sonication, and then dripped on a polyethylene terephthalate film hydrophilized by glow discharge to dry. It is preferred that the film loaded with the particles is used for the observation after performing oblique deposition of Pt—C with a thickness of 3 nm from an angle of 30° against a film face by electron beam using a vacuum evaporation apparatus.

Concerning the other electron microscopy observation methods and sample making techniques in detail, it is possible to refer to "Medical/Biological Electron Microscope Observation Methods edited by Japanese Society of Electron Microscopy, Kanto Branch" (Maruzen) and "Electron Microscope Sample Making Methods edited by Japanese Society of Electron Microscopy, Kanto Branch" (Maruzen), respectively.

For the sample made, a secondary electron image is observed using a field emission type scanning electron microscope (hereinafter abbreviated as FE-SEM) at an accelerating voltage of 2 kV to 4 kV and at a magnification of 5000 to 20000 folds, and image saving into an appropriate record medium is carried out.

For the above processing, it is convenient to use an apparatus capable of AD converting image signals from the electron microscope body and directly recording on memory as digital information, but analog images recorded on Polaroid films and the like can be used by converting into digital images by the scanner and if necessary giving shading compensation and contrast/edge emphasis and the like.

It is preferred that the image recorded in an appropriate medium is resolved into at least 1024 pixels×1024 pixels, preferably 2048 pixels×2048 pixels per image and image processing by a computer is carried out.

As a procedure of the image processing described above, first, the sites corresponding to the organic silver salt particles with the aspect ratio of 3 or more are extracted by making the histogram and by the binarization processing. The necessarily agglomerated particles are cut by an appropriate algorithm or manual manipulation, and contour extraction is carried out. Subsequently, a maximum length (MX LNG) and a minimum width (WIDTH) of each particle are measured for at least 1000 particles, and the acicular ratio is obtained for each particle by the following formula. Here, the maximum length of particle is referred to the maximum value when two points in the particle is tied with a straight line. The minimum width of particle is referred to the value when a distance of parallel lines becomes the minimum value when two parallel lines circumscribed to the particle are drawn.

Acicular ratio=(*MX LNG*)/(WIDTH)

Subsequently, the average value of the acicular ratio is calculated for entire particles measured. It is preferred that length compensation (scale compensation) per pixel and two dimensional strain compensation of the instrumental system are thoroughly carried out precedently using the standard samples when measured by the above procedure. As the standard sample, suitable are uniform latex particles (DULP) commercially available from Dow Chemical in US, preferred are polystyrene particles having a coefficient of variation of less than 10% for the particle sizes of 0.1 to 0.3 μm, and specifically available is a lot with a particle size of 0.212 μm and standard deviation of 0.0029 μm.

The image processing technology in detail can refer to "Image Processing Application Technology (Kogyo Chosakai) edited by Hiroshi Tanaka", and the image processing program or apparatus is not especially limited as long as it is one where the above manipulation is possible, but one example includes Luzex-III supplied from Nireco Corporation.

The method where the organic silver salt particles having the above shape are obtained is not especially limited, but effective are that a mixing state at the formation of the organic acid alkali metallic salt soap and/or a mixing state at the addition of silver nitrate to the soap are kept well and that a rate of silver nitrate which reacts with the soap is made optical.

It is preferred that the tabular organic silver salt particles according to the present invention are predispersed with a binder and surfactants if necessary and subsequently dispersed/pulverized by a media dispersing machine or a high pressure homogenizer. For the above predispersion, it is possible to use common mixers such as anchor type and propeller type, a high-speed rotation centrifuging radiation type mixer (dissolver) and a high-speed rotation shearing type mixer (homo mixer).

Also, as the above media dispersing machine, it is possible to use rolling mills such as a ball mill, planetary ball mill and vibrating ball mill, media mixing mills such as a bead mill and attritor, and the others such as a basket mill, and as high pressure homogenizers, it is possible to use various types such as a type of conflicting to walls and plugs, a type where a liquid is divided into two and then the liquids are crashed at a high-speed and a type of passing through thin orifices.

As ceramics used for ceramic beads used at media dispersion, preferred are, for example, $Al_2O_3$, $BaTiO_3$, MgO, ZrO, BeO, $Cr_2O_3$, $SiO_2$, $SiO_2$—$Al_2O_3$, $Cr_2O_3$—MgO, MgO—CaO, MgO—C, MgO—$Al_2O_3$ (spinel), SiC, $TiO_2$, $K_2O$, $Na_2O$, BaO, PbO, $B_2O_3$, $SrTiO_3$ (strontium titanate), $BeAl_2O_4$, $Y_3Al_5O_{12}$, $ZrO_2$—$Y_2O_3$ (cubic zirconia), 3BeO—$Al_2O_3$—$6SiO_2$ (synthetic emerald), C (synthetic diamond), $Si_2O$-$nH_2O$, silicon nitride, yttrium ŝtabilized zirconia, zirconia strengthened alumina and the like. Yttrium stabilized zirconia and zirconia strengthened alumina (hereinafter, abbreviated the zirconia-containing ceramics as zirconia) are specially preferably used from the reason why production of impurities due to friction with beads and the dispersing machine at the dispersion is low.

In the apparatuses used upon dispersing the tabular organic silver salt particles, as materials of members to which the organic silver salt particles contact, it is preferable to use ceramics such as zirconia, alumina, silicon nitride and boron nitride, or diamond, and among others it is preferable to use zirconia.

When the above dispersion is carried out, it is preferred that the binder is added at a concentration of 0.1 to 10% of the organic silver salt by mass, and it is preferred that liquid temperature is less than 45° C. throughout from predispersion to main dispersion. A preferable operating condition of the main dispersion includes the condition of 29.42 MPa to 98.06 MPa and two times or more of operations when the high pressure homogenizer is used as the dispersion means as the preferable operating condition. Also when the media dispersing machine is used as the dispersing means, the condition where a peripheral velocity is from 6 m/second to 13 m/second is included as the preferable condition.

Also, the preferable aspect in the photothermographic imaging materials according to the present invention is made by coating the organic silver salt having the characteristics that the rate of the organic silver salt particles which exhibit a projected area of less than 0.025 $\mu m^2$ when a sectional face perpendicular to the support face of the material is observed by the electron microscope is 70% or more of whole projected areas and the rate of the particles which exhibit the projected area of 0.2 μm2 or more is 10% or less of whole projected areas of the organic silver salt particles, and further a photosensitive emulsion containing the photosensitive silver halide. In such a case, it is possible to obtain the state where agglomeration of the organic silver salt particles is low and the particles are distributed evenly in the photosensitive emulsion.

The conditions to make the photosensitive emulsion having such characteristics are not especially limited, but include that the mixing state at the formation of organic acid alkali metallic salt soap and/or the mixing state at the addition of silver nitrate to the soap are kept well, that the rate of silver nitrate which reacts to the soap is made optical, dispersing by the media dispersing machine or the high pressure homogenizer for dispersion/pulverization, that the use amount of binder (concentration) is made from 0.1 to 10% of the organic silver salt by mass at that time, agitating at the peripheral velocity of 2.0 m/second or more using the dissolver at the preparation of solution, in addition to that the temperature is less than 45° C. throughout from dry to the termination of main dispersion as the preferable conditions.

For the projected area of the organic silver salt particles having the certain projected area value and the rate based on the whole projected areas described above, the sites corresponding to the organic silver salt particles are extracted by the method using TEM (transmission electron microscope) as is described in the sites to obtain the average thickness of the tabular particles described above.

At that time, agglomerated particles are processed by regarding as one particle, and the area of each particle (AREA) is obtained. Likewise, the areas are obtained for at least 1,000 particles and preferably 2,000 particles, and sorted into three groups of A: less than 0.025 $\mu m^2$, B: 0.025 $\mu m^2$ or more and less than 0.2 $\mu m^2$, and C, 0.2 $\mu m^2$ or more. It is preferred that the imaging materials of the present invention are those which fulfill the condition where the sum of areas of the particles belonging to A group is 70% or more of the area of entire particles and the sum of areas of the particles belonging to C group is 10% or less of the area of measured entire particles.

It is preferred that length compensation (scale compensation) per pixel and two dimensional strain compensation of the instrumental system are thoroughly carried out precedently using the standard samples and using the method which has been performed upon calculating the average value of the acicular ratio, when measured by the above procedure.

As with the above, the image processing technology in detail can refer to "edited by Hiroshi Tanaka, Image Processing Application Technology (Kogyo Chosakai)", and the image processing program or apparatus is not especially limited as long as it is one where the above manipulation is possible, but one example includes Luzex-III supplied from Nireco Corporation.

It is preferred that the organic silver salt particles according to the present invention are monodisperse particles, preferable monodisperse degree is from 1 to 30%, and the image with high density is obtained by making the monodisperse particles in this range. The monodisperse degree herein is defined by the following formula.

$$\text{Monodisperse degree}=\{(\text{Standard deviation of particle sizes})/(\text{Mean value of particle sizes})\}\times 100$$

The average particle size (circle corresponding diameter) of the organic silver salt described above is preferably from 0.01 to 0.3 μm, and more preferably from 0.02 to 0.2 μm. Besides, the average particle size (diameter of corresponding circle) represents the diameter of a circle which has the same area as each particle image observed by the electron microscope.

To prevent devitrification of the imaging materials in the present invention, it is preferred that the total amount of silver halide and organic silver salt is from 0.3 g or more and 1.5 g or less per $m^2$ in terms of the silver amount. The preferable images are obtained when used as medical images by making this range. When it is less than 3 g per $m^2$, the image density is reduced in some cases. Also when it is more than 1.5 g per $m^2$, sensitivity reduction occurs at printing to PS plates in some cases.

[Silver Halide]

Described is silver halide according to the present invention (hereinafter also referred to photosensitive silver halide grains or silver halide grains). Besides, the silver halide according to the present invention is referred to the silver halide crystalline particles treated and manufactured to be capable of originally absorbing light as an inherent nature of the silver halide crystal or capable of absorbing visual light or infrared light by artificial physicochemical methods, and such that physicochemical changes occur in the silver halide crystal or on the surface of the crystal when light is absorbed in any area of the light wavelength range from the ultraviolet light area to the infrared light area.

The photosensitive silver halide according to the invention can be also prepared as the silver halide particle emulsion using the methods described in P. Glafkides, Chimie et Physique Photographique (published by Paul Montel, 1967); G. F. Duffin, Photographic Emulsion Chemistry (published by The Focal Press, 1966); V. L. Zelikman et al., Making and Coating Photographic Emulsion (published by The Focal Press, 1964). In these, preferred is a so-called controlled double jet method where the silver halide grains are prepared with controlling the forming condition. The halogen composition is not especially limited, and may be any of silver chloride, silver chloride bromide, silver chloride iodide bromide, silver bromide, silver iodide bromide, and silver iodide. Also, the particle formation of the silver halide according to the invention is typically divided into two stages of silver halide seed particle (nucleus) generation and particle growth, may be performed by the method where they are performed simultaneously and continuously or the method where the nucleus (seed particle) formation and the particle growth are separated, and it is possible to use the technology described in the paragraph number [0063] of JP-A-2001-83659.

In the case of silver iodide bromide, it is preferred that a content of iodine is in the range of 0.02 to 6 mol %/Ag mol. Iodine may be contained to distribute in entire silver halide grains. Or an iodine concentration at the certain site of the silver halide grains, for example, at a central part of the particle may be made high and at a vicinity of surface may be made low or substantially zero to make a core/shell structure.

Particle formation is typically divided into two stages of silver halide seed particle (nuclear) generation and particle growth, the method where these are carried out continuously at a time may be used, and the method where nuclear (seed particle) formation and the particle growth are separately carried out may be used. The controlled double jet method where the particle formation is carried out by controlling pAg, pH which are the particle formation condition is preferable because the particle shape and size can be controlled. For example, when the method where the nuclear generation and the particle growth are separately carried out is performed, first a silver salt aqueous solution and a halide aqueous solution are mixed evenly and rapidly in a gelatin aqueous solution to generate the nuclear (seed particle), and subsequently the silver halide grains are prepared by a particle growth step where the particles are grown with supplying the silver salt aqueous solution and the halide aqueous solution under controlled pAg and pH. The desired silver halide photographic emulsion can be obtained by eliminating unnecessary salts by a desalting step such as the desalting method known in the art such as a noodle method, flocculation method, ultrafiltration method and electric dialysis method after the particle formation.

The photosensitive silver halide according to the invention preferably have the smaller average particle size in order to keep white turbidity after the image formation low and obtain good image quality. The average particle size is 0.2 μm or less, more preferably from 0.01 μm to 0.17 μm, and especially preferably from 0.02 μm to 0.14 μm. Here, the particle size is referred to an arris length of the silver halide particle when the silver halide particle is in so-called normal crystal such as cubic or octahedral shape. Also, when the silver halide particle is a tabular particle, it is referred to a diameter when the particle is converted into a circle with the same area as a projected area of a major surface.

It is preferred that particle sizes of the silver halide grains are smaller on the whole to keep white turbidity and color tone (yellow tinge) low after the image formation and to obtain good image quality. In the invention, it is one of characteristics that sum (converted into the silver amount) of the silver halide grains having the particle sizes in the range of 0.01 μm to 0.04 μm is in the range of 5 to 50% by mass based on the silver amount of total silver halide grains. Preferably, as a value when the particles of less than 0.02 μm are excluded in a measurement, the sum of silver amount of the silver halide grains in the range of 0.02 μm to 0.04 μm is from 10 to 40% or less by mass based on the silver amount of total silver halide grains.

Covering power and image color tone are compatible by making the distribution of silver halide grains used in the range defined above. That is, when the percentage of the silver halide with small particle sizes is high, then the development point number becomes many and the high covering power is obtained. At the same time, probably due to the increase of fine development points, the image color tone takes on a red tinge especially at a high density area at heating development and deterioration tendency is observed, but it is improved by combining the cyan coloring leuco dye combined. Moreover, when fine developed silver or fine silver halide grains are present, the optical density and image color tone are easily changed at the image storage, but the deterioration is reduced to a unremarkable degree in the range of the particle sizes and the mass percentage of the invention.

In the present invention, it is preferred that particle sizes of the silver halide grains are monodisperse. The monodisperse herein is referred to those where a coefficient of variation of the particle sizes obtained by the following formula is 30% or less. Preferably it is 20% or less and more preferably 15% or less.

Coefficient of variation of particle sizes %=(Standard deviation of particle sizes/Mean value of particle sizes)×100

Shapes of the silver halide grains can include a regular hexahedron, octahedron, 14-hedron particles, tabular particles, spherical particles, stick particles, potato-shaped particles and the like, but in these, preferred are regular hexahedron, octahedron, 14-hedron, and tabular silver halide grains.

Particularly, it is possible to use the technology described in the paragraph numbers of [0064] to [0066] of JP-A-2001-83659. The particle shape may be any of cubic, octahedral, 14-hedral and tabular shapes. In the case of the tabular silver halide grains, the average aspect ratio could be approximately 1.5 or more and 100 or less, and preferably 2 or more and 50 or less. It is possible to apply the technologies described in U.S. Pat. Nos. 5,264,337, 5,314,798 and 5,320,958 for these. Also, as the particle formation technology, it is possible to apply the technologies described in the paragraph numbers of [0068] to [0090] of JP-A-2001-83659.

When the tabular silver halide grains are used, the average aspect ratio is preferably 1.5 or more and 100 or less, and more preferably 2 or more and 50 or less. These are described in U.S. Pat. Nos. 5,264,337, 5,314,798 and 5,320,958, and the target tabular particles can be readily obtained. Additionally, particles where corners of the silver halide grains uproll can be preferably used.

Crystal habits of external surfaces of the halogenated solver particles are not especially limited, but it is preferred to use the silver halide grains having the crystal habit compatible for the selectivity at a high rate when a sensitizing dye having the crystal habit (face) selectivity is used in absorption reaction of the sensitizing dye onto the surface of the silver halide grains. For example, when the sensitizing dye which is selectively absorbed to crystal face with mirror index [100] is used, it is preferred that a occupying rate of the [100] face is high on the external surface of the silver halide grains, and this rate is preferably 50% or more, more preferably 70% or more, and especially preferably 80% or more. Besides, the rate of mirror index [100] face can be obtained by T. Tani, J. Imaging Sci., 29, 165 (1985) where absorption dependency of [111] face and [100] face is utilized in the absorption of sensitizing dye.

It is preferred that the silver halide grains of the present invention are prepared using low molecular weight gelatin with the average molecular weight of 50,000 or less at the formation of the particles, and in particular it is preferable to use at the nuclear formation of the silver halide grains.

In the present invention, the low molecular weight gelatin is preferably one with the average molecular weight of 50,000 or less, preferably from 2,000 to 40,000, and especially preferably from 5,000 to 25,000. The average molecular weight of gelatin can be measured by gel filtration chromatography. The low molecular weight gelatin can be obtained by enzymatically decomposing by adding gelatinase to an aqueous solution of gelatin with the average molecular weight of about 100,000 usually used, by hydrolyzing by adding an acid or an alkali to the solution, by thermally decomposing by heating in air or under pressure, by decomposing by sonication or by combining these methods.

A concentration of dispersion medium at the nuclear formation is preferably 5% by mass, and it is preferable to perform at the low concentration of 0.05 to 3.0% by mass.

It is preferred that the compound represented by the following Formula is used for the silver halide grains used for the present invention at the particle formation.

$$YO(CH_2CH_2O)_m(CH(CH_3)CH_2O)_p(CH_2CH_2O)n\ Y_4$$

In the Formula, $Y_4$ represents a hydrogen atom, —$SO_3M$ or —CO—B—COOM, M represents a hydrogen atom, an alkali metal atom, an ammonium group or an ammonium group substituted with an alkyl group of 5 or more carbon atoms, B represents a chain or a cyclic group which forms an organic dibasic acid, m5 and n5 represent from 0 to 50, respectively, and p3 represents from 1 to 100.

The polyethyleneoxide compound represented by the above Formula is preferably used as a defoaming agent for remarkable effervescence when photographic emulsion raw materials are stirred and moved such as a step where a gelatin aqueous solution is produced, a step where a water soluble halide and a water soluble silver salt are added to the gelatin solution and a step where the photographic emulsion is coated on the support, upon producing silver halide photographic imaging materials, and the technology using as the defoaming agent is described, for example, in JP-A-44-9497. The polyethyleneoxide compound represented by the above Formula also works as the defoaming agent at the nuclear formation.

The compound represented by the above Formula is preferably used at 1% or less by mass based on the silver, and more preferably is used at from 0.01 to 0.1% by mass.

The polyethyleneoxide compound represented by the above Formula could be present at the nuclear formation, and it is preferable to precedently add to the dispersion medium before the nuclear formation, but it may be added during the nuclear formation, or it may be used by adding to a silver salt aqueous solution or a halide aqueous solution used at the nuclear formation. Preferably it is used by adding to the halide aqueous solution or both aqueous solutions at from 0.01 to 2.0% by mass. Also, it is preferred to make the compound represented by the above Formula present over at least 50% of time period of the nuclear formation step, and more preferably present over 70% or more of the time period. The compound represented by the above Formula may be added as powder or by dissolving in a solvent such as methanol.

Besides, the temperature at the nuclear formation is typically from 5 to 60° C., preferably from 15 to 50° C., and it is preferable to control in the temperature range even when the temperature is constant, a temperature rising pattern (e.g., when the temperature at the start of nuclear formation is 25° C., the temperature is gradually elevated during the nuclear formation, and the temperature at the end of nuclear formation is 40° C.) or a reverse pattern thereof.

The concentration of the silver salt aqueous solution and the halide aqueous solution is preferably 3.5 mol/L or less, and further it is preferable to use at the low concentration of 0.01 to 2.5 mol/L. An addition velocity of silver ions at the nuclear formation is preferably from $1.5\times10^{-3}$ mol/min to $3.0\times10^{-1}$ mole/min per L of reaction solution, and more preferably from $3.0\times10^{-3}$ mol/min to $8.0\times10^{-2}$ mol/min.

At the nuclear formation, pH can be typically set in the range of 1.7 to 10, but since particle size distribution of the formed nuclei is broadened at pH of the alkali side, pH is preferably from pH 2 to 6. Also, at the nuclear formation, pBr is from 0.05 to 3.0, preferably, from 1.0 to 2.5, and more preferably from 1.5 to 2.0.

The silver halide grains used for the present invention may be added to an image formation layer by any methods, and at that time, it is preferred that the silver halide grains are positioned to come close to reducible silver source (organic silver salt).

It is preferred that the silver halide grains used for the present invention are precedently prepared and added to a solution for the preparation of organic silver salt particles in terms of production control because the preparation step of silver halide and the preparation step of organic silver salt particles can be separately treated. But, as described in British Patent No. 1,447,454, the silver halide grains can be produced nearly simultaneously with the production of organic silver salt particles by coexisting a halogen ingredient such as halide ions with the organic silver salt formation ingredients and inpouring the silver ions thereto when the organic silver salt particles are prepared.

Also, it is possible to prepare the silver halide grains by making a halogen-containing compound act to the organic silver salt and by conversion of the organic silver salt. That is, it is possible to make the silver halide forming ingredients act to a solution or dispersion of precedently prepared organic silver salt or a sheet material comprising the organic silver salt and to convert a part of the organic silver salt into photosensitive silver halide.

As the silver halide forming ingredients, there are inorganic halogen compounds, onium halides, halogenated hydrocarbons, N-halogen compounds, and the other halogen-containing compounds. For specific examples thereof, there are metallic halogenated matter, inorganic halogen compounds such as halogenated ammonium, e.g., onium halides such as trimethylphenyl ammonium bromide, cetylethyldimethyl ammonium bromide and trimethylbenzyl ammonium bromide, e.g., halogenated hydrocarbons such as iodoform, bromoform, carbon tetrachloride and 2-bromo-2-methylpropane, N-halogen compounds such as N-bromosuccinateimide, N-bromophthalimide and N-bromoacetamide, and the other, e.g., triphenylmethyl chloride, triphenylmethyl bromide, 2-bromoacetate, 2-bromoethanol, dichlorobenzophenone and the like described in detail in U.S. Pat. Nos. 4,009,039, 3,457,075, 4,003,749, British Patents No. 1,498,956, JP-A-53-27027 and JP-A53-25420. This way, the silver halide can be also prepared by converting a part of or all silver in the organic silver salt into the silver halide by the reaction of the organic silver salt and the halogen ions. Also, these silver halide grains produced by converting a part of the organic silver salt may be combined with the silver halide separately prepared.

For these silver halide grains, both the silver halide grains separately prepared and the silver halide grains by the conversion of organic silver salt are preferably used at from 0.001 to 0.7 mol for 1 mol of the organic silver salt, and more preferably used at from 0.03 to 0.5 mol.

It is one of characteristics that the photosensitive silver halide grains according to the invention are the silver halide grains where latent image formation on the surface is inhibited because the latent image capable of functioning as catalysis of the development reaction is formed on the surface of the silver halide grains in the exposure before thermal development and many latent images are formed inward than the surface of the silver halide grains in the exposure after thermal development processing.

Also, as described in Example-11 of U.S. Pat. No. 6,423,481, the photosensitive silver halide grains formed in the organic solvent may be used. That is, if dispersion binders of protection colloid of AgX and aliphatic silver carboxylate are the same, the photosensitive silver halide grains and the non-photosensitive aliphatic silver carboxylate particles become easily uniform and adjacent, consequently, the silver released from the non-photosensitive aliphatic silver carboxylate particles at the heating development easily migrates to the latent images and the vicinity thereof on the photosensitive silver halide which becomes the catalyst, and thus there is some cases where higher covering power is obtained.

In the present invention, it is preferred that an electronic trapping dopant is contained inside the silver halide grains, and this structure improves the sensitivity and the image storage stability.

In the present invention, the method for containing the appropriate dopant inside the photosensitive silver halide grains is not especially limited, and, for example, it is possible to use the methods described in JP-A-9-43765 and JP-A-2001-42471. The electronic trapping dopants used here are referred to those which are silver which configures the silver halide and elements or compounds other than halogens, where sites such as electronic trapping lattice defect occur by having nature where the dopant itself can trap (capture) free electrons or by containing the dopant inside the silver halide grains. For example, included are metallic ions other than silver, or salts or complexes thereof, chalcogens (oxygen group elements) such as sulfur, selenium and tellurium or chalcogens, or nitrogen atom-containing inorganic compounds or organic compounds, rare earth ions or complexes thereof and the like.

The metallic ions or the salts or complexes thereof can include lead ions, bismuth ions, gold ions, or lead bromide, lead nitrate, lead carbonate, lead sulfate, bismuth nitrate, bismuth chloride, bismuth trichloride, bismuth carbonate, sodium bismuthate, aurate chloride, lead acetate, lead stearate, bismuth acetate and the like.

As the compounds comprising the chalcogen such as sulfur, selenium and tellurium, it is possible to use chalcogen-releasing various compounds generally known as chalcogen sensitizers in the photograph industry. Also, as chalcogen- or nitrogen-containing organic matters, heterocyclic compounds are preferable. For example, they are imidazole, pyrazole, pyridine, pyrimidine, pyrazine, pyridazine, triazole, triazine, indole, indazole, purine, thiadiazole, oxadiazole, quinoline, phthalazine, naphthylidine, quinoxaline, quinazoline, cinnoline, pteridine, acridine, fenantroline, fenadine, tetrazole, thiazole, oxazole, benzimidazole, benzoxazole, benzothiazole, indolenine, and tetrazaindene, and preferably imidazole, pyridine, pyrimidine, pyrazine, pyridazine, triazole, triazine, thiadiazole, oxadiazole, quinoline, phthalazine, naphthylidine, quinoxaline, quinazoline, cinnoline, tetrazole, thiazole, oxazole, benzimidazole, benzoxazole, benzothiazole, and tetrazaindene.

The above heterocyclic compounds may have substituents, and the substituents are preferably alkyl, alkenyl, aryl, alkoxy, aryloxy, acyloxy, acyl, alkoxycarbonyl, aryloxycarbonyl, acylamino, alkoxycarbonylamino, sulfonylamino, sulfamoyl, carbamoyl, sulfonyl, ureido, phosphate-amide groups, halogen atoms, cyano, sulfo, carboxyl, nitro and heterocyclic groups, more preferably alkyl, aryl, alkoxy, aryloxy, acyl, acylamino, aryloxycarbonylamino, sulfonylamino, sulfamoyl, carbamoyl, ureido, phosphate-amido groups, halogen atoms, cyano, nitro and heterocyclic groups, and still preferably alkyl, aryl, alkoxy, aryloxy, acyl, acylamino, sulfonylamino, sulfamoyl, carbamoyl groups, halogen atoms, cyano, nitro and heterocyclic groups.

Ions of transition metals belonging to VI to XI Groups of the periodic table of elements may be contained in the silver halide grains used for the invention by chemically preparing an oxidized state of the metal with ligands to function as the electronic trapping dopant such as the above dopant or to function as a hole trapping dopant. As the above transition metals, preferred are W, Fe, Co, Ni, Cu, Ru, Rh, Pd, Re, Os, Ir, and Pt.

In the present invention, the above various dopants may be used alone or in combination with two or more of the same or different compounds or complexes. These dopants may be introduced to inside the silver halide grains in any chemical form.

A preferable content of the dopant is preferably in the range of $1\times10^{-9}$ to $1\times10$ mol, more preferably in the range of $1\times10^{-8}$ to $1\times10^{-1}$ mol, and still preferably from $1\times10^{-6}$ to $1\times10^{-2}$ per mol of the silver.

But the optical amount depends on types of the dopants, particle sizes and shapes of the silver halide grains, environmental conditions and the like, and therefore it is preferable to consider optimization of dopant addition condition depending on these conditions. It is preferred that the silver halide used for the present invention contains ions of transit metals belonging to Groups 6 to 11 in periodic table of elements. As the above metals, preferred are W, Fe, Co, Ni, Cu, Ru, Rh, Pd, Re, Os, Ir, Pt and Au. These may be used alone, or two or more of the same type or different type metallic complexes may be combined. These metallic ions may be obtained by introducing the metallic salt in the silver halide, and can be introduced into the silver halide in a metallic complex or complex ion form. A content is preferably in the range of $1\times10^{-9}$ mol to $1\times10^{-2}$ mol, and more preferably from $1\times10^{-8}$ to $1\times10^{-4}$. In the present invention, the transit metallic complex or complex ion is preferably one represented by the following Formula.

$$[ML_6]^m$$

In the Formula, M represents a transit metal selected from the elements of Groups 6 to 11 in the periodic table of elements, L represents a ligand, and m represents 0, -, 2-, 3- or 4-. Specific examples of the ligand represented by L include halogen ion (fluorine ion, chlorine ion, bromine ion and iodine ion), cyanide, cyanate, thiocyanate, selenocyanate, tellurocyanate, ligands of azide and aquo, nitrosyl, thionitrosyl and the like, and preferably are aquo, nitrosyl and thionitrosyl. When the aquo ligand is present, it is preferable to occupy one or two of the ligands. L may be the same or different.

When the aquo ligand is present, it is preferable to occupy one or two of the ligands. As the transition metal coordinated complex ions, it is possible to use those described in the paragraph numbers of [0094] to [0095] of JP-A-2001-83659.

It is preferred that the compound which provides these metallic ions or complex ions is added at the silver halide particle formation and incorporated in the silver halide grains, and it may be added at any stage of the preparation of silver halide grains, i.e., before and after the nuclear formation, growth, physical maturation, and chemical sensitization, but it is preferable to add at the stage of nuclear formation, growth or physical maturation, it is more preferable to add at the stage of nuclear formation or growth, and in particular preferably it is added at the stage of nuclear formation. When added, the compound may be added by dividing in several times; can be evenly contained in the silver halide grains; and can be contained by possessing a distribution in the particle as described in JP-A-63-29603, JP-A-2-306236, JP-A-3-167545, JP-A-4-76534, JP-A-6-110146 and JP-A-5-273683.

These metallic compounds can be added by dissolving in water or an appropriate solvent (e.g., alcohols, ethers, glycols, ketones, esters, amides). For example, there are the method where an aqueous solution of powder of the metallic compound or an aqueous solution in which the metallic compound and NaCl, KCl are dissolved together has been added in a water soluble silver salt solution during the particle formation or a water soluble halide solution, or the method where the metallic compound is added as the third aqueous solution when the silver salt aqueous solution and the halide aqueous solution are simultaneously mixed to prepare the silver halide particle by a three solution simultaneous mixing method, the method where an aqueous solution of a required amount of the metallic compound is put in a reactor during the particle formation, or the method where the other silver halide grains in which the metallic ions or complex ions have been precedently doped are added to dissolve at the preparation of the silver halide. Especially, the method where the aqueous solution of powder of the metallic compound or the aqueous solution in which the metallic compound and NaCl, KCl are dissolved together is added to the halide aqueous solution is preferable. When added on the particle surface, the aqueous solution of the required amount of metallic compound can be put in the reactor immediately after the particle formation, during or at the end of the physical maturation, or at the chemical maturation.

Separately prepared photosensitive silver halide grains can be desalted by the desalting methods known in the art such as the noodle method, flocculation method, ultrafiltration method and electric dialysis method, but can be also used without desalting in the photothermographic imaging materials.

Non-metallic dopants can be introduced to inside of the silver halide by the same method as that for the above metallic dopants. In the imaging materials according to the invention, it can be evaluated whether the above dopant has the electronic trapping property or not by the method generally used in the photographic industry as follows. That is, the silver halide emulsion made up of the silver halide grains where the above dopants or the fragments thereof are doped inside the silver halide grains can be evaluated by measuring a reduced degree of photoconduction on the basis of the silver halide grains where no dopant is contained using a photoconduction measurement method such as a microwave photoconduction measurement method. Or the evaluation can be performed by a comparative experiment of an inside sensitivity and a surface sensitivity of the silver halide particle.

The silver halide grains according to the invention may be added to the photosensitive layer by any methods. At that time, it is preferable to dispose such that the silver halide grains come close to a reducible silver source (aliphatic silver carboxylate).

It is preferred that the photosensitive silver halide is chemically sensitized. Concerning the preferable chemical sensitization, it is possible to use the chemical sensitizers and the technology described in the paragraph numbers of [0044] to [0045] of JP-A-2000-112057.

It is preferred that the photosensitive silver halide is spectrally sensitized. Concerning the preferable spectral sensitization, it is possible to use the sensitizing dyestuffs and technology described in the paragraph numbers of [0099] to [0144] of JP-A-2001-83659.

In the photosensitive silver halide according to the invention, in addition to the Supersensitizer according to the invention, the Supersensitizers known in the art may be combined and used along with the sensitizing dyestuffs according to the invention. For the Supersensitizers, it is possible to use the compounds described in the paragraph numbers of [0148] to [0152] of JP-A-2001-83659.

Also, the heterocyclic aromatic mercapto compound and the heterocyclic aromatic disulfide compound which are the Supersensitizers according to the invention also exert the effect as the Antifoggant.

It is preferred that the silver halide is precedently prepared and added to a solution for the preparation of aliphatic silver carboxylate particles in terms of separately dealing with a preparation step of the aliphatic silver carboxylate particles and a preparation step of the silver halide and in terms of production control. But as described in British Patent No. 1,447,454, the silver halide can be produced in nearly parallel with the production of aliphatic silver carboxylate particles by making halogen components such as halide ions coexist with aliphatic silver carboxylate forming components and inpouring silver ions thereto upon the preparation of the aliphatic silver carboxylate particles. Also, it is possible to prepare the silver halide grains by making a halogen-containing compound act on the aliphatic silver carboxylate and by conversion of the aliphatic silver carboxylate. That is, the silver halide forming components can be made act on a solution or a dispersion of the aliphatic silver carboxylate or a sheet material of the aliphatic silver carboxylate precedently prepared, and a part of the aliphatic silver carboxylate cen be converted into photosensitive silver halide.

As the silver halide particle forming components, there are inorganic halogen compounds, onium halides, halogenated hydrocarbons, N-halogen compounds and the other-containing halogen compounds. As specific examples thereof, there are, for example, the inorganic halogen compounds such as metallic halogen compounds and halogenated ammonium particularly described in U.S. Pat. Nos. 4,009,039, 3,457,075, 4,003,749, British Patent No. 1,498,956 IP-A-53-27027 and JP-A-53-25420, for example, onium halides such as trimethylphenylammonium bromide, cetylethyldimethylammonium bromide and trimethylbenzylammonium bromide, for example, halogenated hydrocarbons such as iodoform, bromoform, carbon tetrachloride and 2-bromo-2-methyl propane, N-halogen compounds such as N-bromosuccinateimide, N-bromophthalimide and N-bromoacetamide, and the others, for example, triphenylmethyl chloride, triphenylmethyl bromide, 2-bromoacetic acid, 2-bromoethanol, dichlorobenzophenone and the like. This way, the silver halide can be prepared by converting a part of or the whole silver in the organic acid silver salt into the silver halide by the reaction of the organic acid silver and the halogen ions. Also, the silver halide grains manufactured by converting a part of the aliphatic silver carboxylate may be combined with the silver halide separately prepared.

For these silver halide grains, it is preferred that both the silver halide grains separately prepared and the silver halide grains by the conversion of the aliphatic silver carboxylate are used at 0.001 to 0.7 mol, and preferably from 0.03 to 0.5 mol per mol of the aliphatic silver carboxylate.

The photosensitive silver halide grains separately prepared can be desalted to eliminate unnecessary salts at a desalting step by the desalting methods known in the art such as a noodle method, a flocculation method, an ultrafiltration method and electrodialysis method, but can be used without desalting.

[Reducing Agent]

In the present invention, as a reducing agent (silver ion reducing agent), especially a compound where at least one type of reducing agents is a bisphenol derivative is used alone, or used in conjunction with a reducing agent having the other different chemical structure. In the photothermographic imaging materials according to the present invention, it is possible to unexpectedly inhibit performance deterioration due to the occurrence of photographic fog during CP storage of the photothermographic imaging materials and color tone deterioration in storage of silver images after the thermal development.

Hereinafter, described are silver reducing agents which can be preferably used in the invention. Examples of the suitable silver reducing agents built-in the silver salt photothermal photographic dry imaging material of the invention are described in U.S. Pat. Nos. 3,770,448, 3,773,512, 3,593,863, Research Disclosure (hereinafter, sometimes abbreviated as RD) No. 17029 and RD No. 29963, and can be used by appropriately selecting from the silver reducing agents known in the art. When the aliphatic silver carboxylate is used for the organic silver salt, it is possible to use polyphenols where two or more phenol groups are linked via alkylene group or sulfur, especially bisphenols where two or more phenol groups where alkyl (e.g., methyl, ethyl, propyl, t-butyl, cyclohexyl groups, etc) or acyl group (e.g., acetyl, propionyl groups, etc.) substitutes to at least one position adjacent to hydroxy substitution position of the phenol group are linked via alkylene group or sulfur.

As the reducing agents used for the present invention, used are the reducing agent of the Formula (A-1), more preferably the Formula (A-2), the compound of a Formula (A-4) or a Formula (A-5).

(A-1)

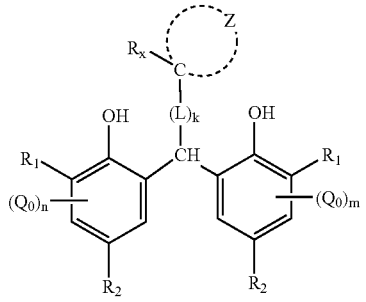

In the Formula (A-1), Z represents an atomic group required for configuring a 3- to 10-membered ring along with the carbon atom, and Rx represents a hydrogen atom or an alkyl group. $R_1$, $R_2$ and $Q_0$ each represents a group capable of being substituted on the benzene ring, L represents a bivalent linkage group, k represents an integer of 0 to 1, n and m represent an integer of 0 to 2. Multiple $R_1$, $R_2$ and $Q_0$ may be the same or different.

In the Formula (A-1), Z represents an atomic group required to configure a 3- to 10-membered ring with carbon atoms, and Z is preferably a 3- to 10-membered non-aromatic ring or a 5- to 6-membered aromatic ring and more preferably a 3- to 10-membered non-aromatic ring. As the rings, specifically, the 3-membered rings include cyclopropyl, aziridil, oxyranyl, the 4-membered rings include cyclobutyl, cyclobutenyl, oxetanyl, and azetidinyl, the 5-membered rings include cyclopentyl, cyclopentenyl, cyclopentadienyl, tetrahydrofuranyl, pyrolidinyl, and tetrahydrothienyl, the 6-membered rings include cyclohexane, cyclohexenyl, cyclohexadienyl, tetrahydropyranyl, pyranyl, piperidinyl, dioxanyl, tetrahydrothiopyranyl, norcaranyl, norpinanyl and norbornyl, the 7-membered rings include cycloheptyl, cycloheptinyl and cycloheptadienyl, the 8-membered rings include cycloctanyl, cyclooctenyl, cyclooctadienyl and cyclooctatrienyl, the 9-membered rings include cyclononanyl, cyclononenyl, cyclononadienyl and cyclononatrienyl, and the 10-membered rings include cyclodecanyl, cyclodecenyl, cyclodecadienyl, cyclodecatrienyl, and the like.

The 3- to 6-membered rings are preferable, the 5- to 6-membered rings are more preferable, the 6-membered rings are most preferable, and among them, hydrocarbon rings containing no heteroatom are preferable. The ring may form a spiro bond with the other ring via spiro atoms, or may be condensed with the other ring including the aromatic rings in any way. Also, the ring can have any substituents on the ring. It is especially preferred that the hydrocarbon ring is the hydrocarbon ring comprising alkenyl or alkynyl structure including —C═C— and —C≡C—.

The substituents specifically include halogen atoms (e.g., fluorine, chlorine, bromine atoms), alkyl groups (e.g., methyl, ethyl, propyl, butyl, pentyl, iso-pentyl, 2-ethylhexyl, octyl, decyl groups, etc.), cycloalkyl groups (e.g., cyclohexyl, cycloheptyl groups, etc.), alkenyl groups (e.g., etenyl-2-propenyl, 3-butenyl, 1-methyl-3-propenyl, 1-methyl-3-butenyl groups, etc.), cycloalkenyl groups (e.g., 1-cycloalkenyl, 2-cycloalkenyl groups, etc.), alkynyl groups (e.g., ethynyl, 1-propinyl groups, etc.), alkoxy groups (e.g., methoxy, ethoxy, propoxy groups, etc.), alkylcarbonyloxy groups (e.g., acetyloxy group, etc.), alkylthio groups (e.g., methylthio, trifluoromethylthio groups, etc.), carboxyl groups, alkylcarbonylamino groups (e.g., acetylamino group, etc.), ureide groups (e.g., methylaminocarbonylamino group, etc.), alkylsulfonylamino groups (e.g., methanesulfonylamino group, etc.), alkylsulfonyl groups (e.g., methanesulfonyl, trifluoromethanesulfonyl groups, etc.), carbamoyl groups (e.g., carbamoyl, N,N-dimethylcarbamoyl, N-morpholinocarbonyl groups, etc.), sulfamoyl groups (e.g., sulfamoyl, N,N-dimethylsulfamoyl, morpholinosaulfamoyl groups, etc.), trifluoromethyl, hydroxyl, nitro, cyano groups, alkylsulfoneamide groups (e.g., methanesulfoneamide, butanesulfoneamide groups, etc.), alkylamino groups (e.g., amino, N,N-dimethylamino, N,N-diethylamino groups, etc.), sulfo, phosphono, sulfite, sulfino groups, alkylsulfonylaminocarbonyl groups (e.g., methanesulfonylaminocarbonyl, ethanesulfonylaminocarbonyl groups, etc.), alkylcarbonylaminosulfonyl groups (e.g., acetoamidesulfonyl, methoxyacetoamidesulfonyl groups, etc.), alkynylaminocarbonyl groups (e.g., acetoamidecarbonyl, methoxyacetoamidecarbonyl groups, etc.), alkylsulfinylaminocarbonyl groups (e.g., methanesulfinylaminocarbonyl, ethanesulfinylaminocarbonyl groups, etc.), and the like. When there are two or more substituents, they may be the same or different. Especially preferable substituents are alkyl groups.

Next, the case where Z is a 5- to 6-membered aromatic cyclic group is described. The aromatic carbocyclic ring may be monocyclic or condensed cyclic, preferably includes monocyclic or bicyclic aromatic carbocyclic rings with 6 to 30 carbons (e.g., benzene ring, naphthalene ring, etc.), and preferably used is benzene ring. Also, aromatic heterocyclic rings are preferably 5- to 6-membered aromatic heterocyclic rings which may have condensed rings. More preferably they are 5-membered aromatic heterocyclic rings which may have condensed rings. Such heterocyclic rings are preferably imidazole, pyrazole, thiophene, furan, pyrrole, pyridine, pyrimidine, pyrazine, pyridazine, triazole, triazine, indole, indazole, purine, thiadiazole, oxadiazole, quinoline, phthalazine, naphthylidine, quinoxaline, quinazoline, cinnoline, pteridine, acridine, fenantrone, fenadine, tetrazole, thiazole, oxazole, benzimidazole, benzoxazole, benzothiazole, indolenine and tetrazaindene, more preferably imidazole, pyrazole, thiophene, furan, pyrrole, triazole, thiadiazole, tetrazole, thiazole, benzimidazole and benzothiazole, and especially preferably thiophene, furan and thiazole. The above ring may be condensed with the other ring including the aromatic ring in any manner. The ring can have the given substituents on it. The substituents can include the same substituents as the substituents on the 3- to 10-membered non-aromatic cyclic groups mentioned above. When Z is the 5- to 6-membered aromatic cyclic group, the most preferable is that Z is the 5-membered aromatic heterocyclic group.

$R_1$ and $R_2$ represent groups capable of being substituted on the benzene ring, and include, for example, hydrogen atoms, alkyl, alkenyl, alkynyl, aryl or heterocyclic ring groups. As the alkyl groups, it is specifically preferable to be the alkyl groups with 1 to 10 carbons. Specific examples include methyl, ethyl, propyl, isopropyl, butyl, t-butyl, pentyl, iso-pentyl, 2-ethylhexyl, octyl, decyl, cyclohexyl, cycloheptyl, 1-methylcyclohexyl groups and the like. As alkenyl groups, included are etenyl-2-propenyl, 3-butenyl, 1-methyl-3-propenyl, 3-pentenyl, 1-methyl-3-butenyl, 1-cycloalkenyl, 2-cycloalkenyl groups and the like. As alkynyl groups, included are ethynyl, 1-propinyl groups and the like. More preferably, included are methyl, ethyl, isopropyl, t-butyl, cyclohexyl, 1-methylcyclohexyl groups and the like. They are preferably methyl, t-butyl and 1-methycyclohexyl groups, and most preferably methyl group. As the aryl groups, specifically included are phenyl, naphthyl, anthranil groups and the like. The heterocyclic ring groups specifically include aromatic hetero ring groups such as pyridine, quinoline, isoquinoline, imidazole, pyrazole, triazole, oxazole, thiazole, oxadiazole, thiadiazole and tetrazole groups, and non-aromatic hetero ring groups such as pyperidino, morpholino, tetrahydrofuryl, tetrahydrothienyl and tetrahydropyranyl groups. These groups may further have substituents, and the substituents can include substituents on the rings described above. Multiple $R_1$ and $R_2$ may be the same or different, but the most preferable is the case where all are methyl groups.

In the most preferable combination of $R_1$ and $R_2$, $R_1$ is a tertiary alkyl group (e.g., t-butyl, 1-methylcyclohexyl, etc.) and $R_2$ is a primary alkyl group (e.g., methyl, 2-hydroxyethyl, etc.).

$R_x$ represents a hydrogen atom or an alkyl group, and as the alkyl group, it is specifically preferable to be the alkyl group with 1 to 10 carbons. Specific examples include methyl, ethyl, propyl, isopropyl, butyl, t-butyl, pentyl, iso-pentyl, 2-ethyl-hexyl, octyl, decyl, cyclohexyl, cycloheptyl, 1-methylcyclohexyl, etenyl-2-propenyl, 3-butenyl, 1-methyl-3-propenyl, 3-pentenyl, 1-methyl-3-butenyl, 1-cycloalkenyl, 2-cycloalkenyl, ethynyl, 1-propinyl groups and the like. More preferably included are methyl, ethyl isopropyl groups and the like. Preferably $R_x$ is a hydrogen atom.

$Q_0$ represents a group capable of being substituted on the benzene ring, and can specifically include alkyl groups with 1 to 25 carbons (e.g., methyl, ethyl, propyl, isopropyl, tert-butyl, pentyl, hexyl, cyclohexyl groups, etc.), halogenated alkyl groups (e.g., trifluoromethyl, perfluorooctyl groups, etc.), cycloalkyl groups (e.g., cyclohexyl, cyclopentyl groups, etc.), alkynyl groups (propargyl group, etc.), glycidyl, acrylate, methacrylate groups, aryl groups (e.g., phenyl group, etc.), heterocyclic ring groups (e.g., pyridyl, thiazolyl, oxazolyl, imidazolyl, furyl, pyrrolyl, pyrazinyl, pyrimidinyl, pyridazinyl, selenazolyl, suliforanyl, piperidinyl, pyrazolyl, tetrazolyl groups, etc.), halogen atoms (chlorine, bromine, iodine, fluorine atoms), alkoxy groups (methoxy, ethoxy, propyloxy, pentyloxy, cyclopentyloxy, hexyloxy, cyclohexyloxy groups, etc.), aryloxy groups (phenoxy group, etc.), alkoxycarbonyl groups (methyloxycarbonyl, ethyloxycarbonyl, butyloxycarbonyl groups, etc.), aryloxycarbonyl groups (phenyloxycarbonyl groups, etc.), sulfonamide groups (methanesulfonamide, ethanesulfonamide, butanesulfonamide, hexanesulfonamide, cyclohexanesulfonamide, benzenesulfonamide groups, etc.), sulfamoyl groups (aminosulfonyl, methylaminosulfonyl, dimethylaminosulfonyl, butylaminosulfonyl, hexylaminosulfonyl, cyclohexylaminosulfonyl, phenylaminosulfonyl, 2-pyridylaminosulfonyl groups, etc.), urethane groups (methylureide, ethylureide, pentylureide, cyclohexylureide, phenylureide, 2-pyridylureide groups, etc.), acyl groups (acetyl, propionyl, butanoyl, hexanoyl, cyclohexanoyl, benzoyl, pyridinoyl groups, etc.), carbamoyl groups (aminocarbonyl, methyaminocarbonyl, dimethylaminocarbonyl, propylaminocarbonyl, pentylaminocarbonyl, cyclohexylaminocarbonyl, phenylaminocarbonyl, 2-pyridylaminocarbonyl groups, etc.), amide groups (acetamide, propionamide, butanamide, hexanamide, benzamide groups, etc.), sulfonyl groups (methylsulfonyl, ethylsulfonyl, butylsulfonyl, cyclohexylsulfonyl, phenylsulfonyl, 2-pyridylsulfonyl groups, etc.), amino groups (amino, ethylamino, dimethylamino, butylamino, cyclopentylamino, anilino, 2-pyridylamino groups, etc.), cyano, nitro, sulfo, carboxyl, hydroxyl, oxamoyl groups and the like. These groups may be further substituted with these groups. And, n and m represent an integer of 0 to 2, and most preferably both n and m are 0.

L represents a bivalent linkage group, preferably is an alkylene group such as methylene, ethylene, and propylene, and the number of carbons is preferably from 1 to 20, and more preferably from 1 to 5, and k represents an integer of 0 to 1, and most preferably is the case of k=0.

(A-2)

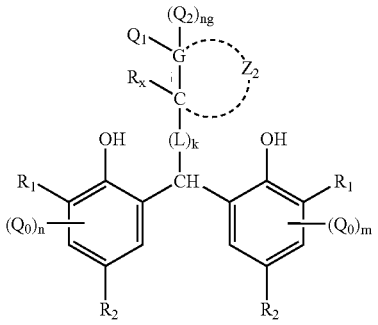

In the Formula (A-2), $Q_1$ represents a halogen atom, an alkyl, aryl or heterocyclic group, and $Q_2$ represents a hydrogen atom, a halogen atom, an alkyl, aryl or heterocyclic group. G represents a nitrogen atom or a carbon atom, and ng is 0 when G is the nitrogen atom and ng is 0 or 1 when G is the carbon atom. $Z_2$ represents an atomic group required for configuring a 3- to 10-membered non-aromatic ring along with the carbon atom and G. $R_1$, $R_2$, $R_x$, $Q_0$, L, k, n and m are the same as defined in the above Formula (A-1).

In the Formula (A-2), $Q_1$ represents a halogen atom, an alkyl, aryl or hetero ring group, $Q_2$ represents a hydrogen atom, a halogen atom, an alkyl, aryl or hetero ring group, and the halogen atoms specifically include chlorine, bromine, fluorine and iodine. Preferably it is fluorine, chlorine or bromine. As the alkyl group, specifically it is preferable to be the alkyl group with 1 to 10 carbons. Specific examples include methyl, ethyl, propyl, isopropyl, butyl, t-butyl, pentyl, iso-pentyl, 2-ethyl-hexyl, octyl, decyl, cyclohexyl, cycloheptyl, 1-methylcyclohexyl groups and the like. As alkenyl groups, included are etenyl-2-propenyl, 3-butenyl, 1-methyl-3-propenyl, 3-pentenyl, 1-methyl-3-butenyl, 1-cycloalkenyl, 2-cycloalkenyl groups and the like. As alkynyl groups, included are ethynyl, 1-propinyl groups and the like. More preferably, they are methyl and ethyl groups. The aryl groups specifically include phenol and naphthyl groups. The hetero ring groups preferably include 5- to 6-memberd hetero aromatic groups such as pyridyl, furyl, thienyl and oxazolyl groups. G represents a nitrogen or carbon atom, and is preferably a carbon atom, and ng represents 0 or 1 and is preferably 1.

$Q_1$ is most preferably a methyl group, $Q_2$ is preferably a hydrogen atom or a methyl group and most preferably a hydrogen atom.

$Z_2$ represents a carbon atom and an atomic group required for configuring a 3- to 10-membered non-aromatic ring together with G, and the 3- to 10-membered non-aromatic ring is the same as defined in the Formula (A-1) described above.

$R_1$, $R_2$, $R_x$, $Q_0$, k, n and m are the same as defined in the Formula (A-1).

Next, the reducing agents represented by the Formula (A-4) or (A-5) are described.

(A-4)

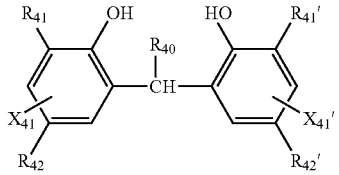

(A-5)

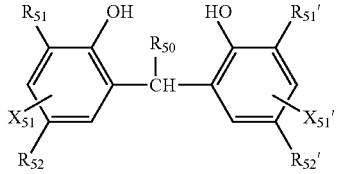

(A)

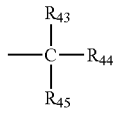

In the above formula, $R_{40}$ represents the above Formula (A). $R_{43}$ to $R_{45}$ each represents a hydrogen atom or a substituent. When C in the above Formula (A) does not form a ring along with any of $R_{43}$ to $R_{45}$, $R_{40}$ comprises at least one ethylene group which may be substituted, or acetylene group which may be substituted. When C in the above Formula (A) forms a ring along with either of $R_{43}$ to $R_{45}$, $R_{40}$ comprises at least one ethylene group which may be substituted, or acetylene group which may be substituted out of the ring. $R_{41}$, $R_{41}'$, $R_{42}$, $R_{42}'$, $X_{41}$ and $X_{41}'$, each represents a hydrogen atom or a substituent. $R_{50}$ represents a hydrogen atoms or a substituent. $R_{51}$, $R_{51}'$, $R_{52}$, $R_{52}'$, $X_{51}$ and $X_{51}'$ each represents a hydrogen atom or a substituent. But, at least one of $R_{51}$, $R_{51}'$, $R_{52}$, $R_{52}'$, $X_5$, and $X_{51}'$ comprises the ethylene group which may be substituted or the acetylene group which may be substituted.

In the Formula (A-4), $R_{40}$ represents the Formula (A), and $R_{43}$ to $R_{45}$ each represent a hydrogen atom or a substituent. The substituents represented by $R_{43}$ to $R_{45}$ include, for example, alkyl groups (methyl, ethyl, propyl, isopropyl, cyclopropyl, butyl, isobutyl, sec-butyl, t-butyl, cyclohexyl, 1-methyl-cyclohexyl groups, etc.), alkenyl groups (vinyl, propenyl, butenyl, pentenyl, isohexenyl, cyclohexenyl, butenylidene, isopentylidene groups, etc.), alkynyl groups (ethynyl, propinylidene groups, etc.), aryl groups (phenyl, naphthyl groups, etc.), hetero ring groups (furyl, thienyl, pyridyl, tetrahydrofuranyl groups, etc.), halogen, hydroxyl, alkoxy, aryloxy, acyloxy, sulfonyloxy, nitro, amino, acylamino, sulfonylamino, sulfonyl, carboxy, alkoxycarbonyl, aryloxycarbonyl, carbamoyl, sulfamoyl, cyano, sulfo groups and the like.

When $R_{43}$ to $R_{45}$ in the Formula (A) do not form the ring one another, $R_{40}$ comprises at least one ethylene group which may be substituted (2,6-dimethyl-5-heptenyl, 1,5-dimethyl-4-hexenyl, etc.) or acetylene group which may be substituted (1-propinyl, etc.).

When $R_{43}$ to $R_{45}$ in the Formula (A) form the ring (phenyl, naphthyl, furyl, thienyl, pyridyl, cyclohexyl, cyclohexenyl, etc.) one another, $R_{40}$ comprises at least one ethylene group (vinyl, propenyl, acryloxy, methacryloxy, etc.) which may be substituted or acetylene group (ethynyl, acetylenecarbonyloxy, etc.) out of this ring.

$R_{41}$, $R_{41}'$, $R_{42}$, $R_{42}'$, $X_{41}$, and $X_{41}'$ each represents a hydrogen atom or a substituent, and the substituents include the same groups as the substituents included in the description of $R_{43}$ to $R_{45}$.

$R_{41}$, $R_{41}'$, $R_{42}$, and $R_{42}'$ are preferably alkyl groups, and specifically include the same groups as the alkyl groups included in the description of $R_{43}$ to $R_{45}$.

In the Formula (A-5), $R_{50}$ represents a hydrogen atom or a substituent, and the substituent includes the same groups as the substituents included in the description of $R_{43}$ to $R_{45}$. $R_{50}$ is preferably a hydrogen atom, alkyl, alkenyl, or alkynyl, and more preferably a hydrogen atom or alkyl group.

$R_{51}$, $R_{51}'$, $R_{52}$, $R_{52}'$, $X_{51}$, and $X_{51}'$ each represents a hydrogen atom or a substituent, and the substituents include the same groups as the substituents included in the description of $R_{43}$ to $R_{45}$ in the Formula (A-4).

$R_{51}$, $R_{51}'$, $R_{52}$, and $R_{52}'$ are preferably alkyl, alkenyl and alkynyl groups, and specifically include the same groups as the examples of alkyl, alkenyl and alkynyl groups included in the description of $R_{43}$ to $R_{45}$.

But, at least one of $R_{51}$, $R_{51}'$, $R_{52}$, $R_{52}'$, $X_{51}$, and $X_{51}'$ comprises an ethylene group which may be substituted (vinyl, ally, methacryloxymethyl, etc.) or an acetylene group which may be substituted (ethynyl, propargyl, propargyloxycarbonyloxymethyl, etc.).

In the present invention, it is preferable to combine the compound represented by the Formula (A-1) and the compound represented by the following Formula (A-3). A combination ratio is preferably [weight of the Formula (A-1)]:[weight of the Formula (A-3)]=95:5 to 55:45, and more preferably from 90:10 to 60:40.

(A-3)

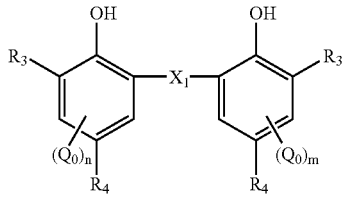

In the Formula (A-3), $X_1$ represents a chalcogen atom or CHR. The chalcogen atom is sulfur, selenium or tellurium, and preferably a sulfur atom. R in CHR represents a hydrogen atom, a halogen atom or an alkyl group, the halogen atoms are, for example, fluorine, chlorine or bromine atoms, and the alkyl group is preferably a substituted or unsubstituted alkyl group with 1 to 20 carbons. Specific examples of the alkyl groups are, for example, methyl, ethyl, propyl, butyl, hexyl, heptyl, vinyl, ally, butenyl, hexadienyl, ethenyl-2-propenyl, 3-butenyl, 1-methyl-3-propenyl, 3-pentenyl, 1-methyl-3-butenyl, and the like.

These groups may further have substituents, and as the substituent, it is possible to use the substituents described in the Formula (A-1). Also, when there are two or more substituents, they may be the same or different.

$R_3$ represents alkyl groups, may be the same or different, and at least one is a secondary or tertiary alkyl group. The alkyl groups are preferably substituted or unsubstituted ones with 1 to 20 carbons, and specifically include methyl, ethyl, propyl, isopropyl, butyl, isobutyl, t-butyl, t-amyl, t-octyl, cyclohexyl, cyclopentyl, 1-methylcyclohexyl, 1-methylcyclopropyl groups and the like.

The substituents of the alkyl group are not especially limited, and for example, include aryl, hydroxy, alkoxy, aryloxy, alkylthio, arylthio, acylamino, sulfonamide, sulfonyl, phosphoryl, acyl, carbamoyl, ester groups, halogen atoms and the like. Also it may form a saturated ring together with $(Q_0)_n$ and $(Q_0)_m$. All of $R_3$s are preferably secondary or tertiary alkyl groups, and carbons of 2 or more and 20 or less are preferable. They are more preferably tertiary alkyl groups. More preferably, they are t-butyl, t-amyl, and 1-methylcyclohexyl groups, and most preferably 1-methylcyclohexyl groups.

$R_4$ represents a hydrogen atom or a group capable of being substituted to benzene ring. The groups capable of being substituted to benzene group include, for example, halogen atoms such as fluorine, chlorine and bromine atoms, aryl, cycloalkyl, alkenyl, cycloalkenyl, alkynyl, amino, acyl, acyloxy, acylamino, sulfonylamino, sulfamoyl, carbamoyl, alkylthio, sulfonyl, alkylsulfonyl, sulfinyl, cyano, hetero ring groups and the like. Multiple $R_3$ and $R_4$ may be the same or different.

$R_4$ has preferably from 1 to 5 carbons and more preferably from 1 to 2 carbons. These groups may further have substituents, and as the substituents, it is possible to use the substituents described in the Formula (A-1). All of $R_4$ are preferably alkyl groups with 1 to 20 carbons, and most preferably methyl groups.

$Q_0$, n and m are the same as defined in the Formula (A-1). Also, $Q_0$ may form a saturated ring together with $R_{33}$ and $R_{34}$. $Q_0$ is preferably a hydrogen atom, a halogen atom or an alkyl group, and more preferably a hydrogen atom.

Hereinafter, specific examples of the compounds represented by the Formulae (A-1) to (A-5) of the present invention are listed, but the invention is not limited thereto.
(A-1)
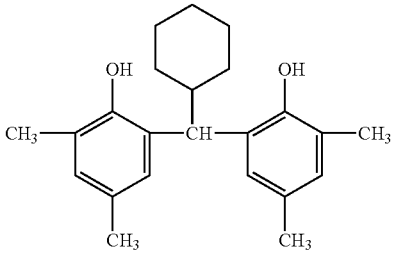
(A-2)
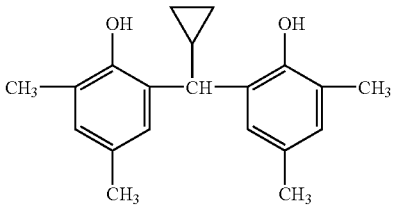
(A-3)
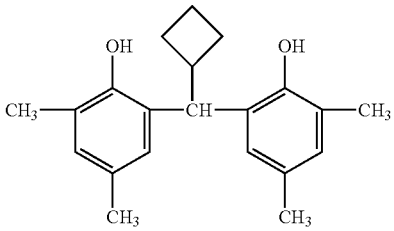
(A-4)
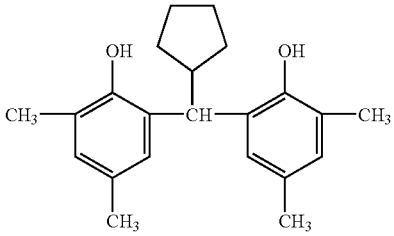
(A-5)
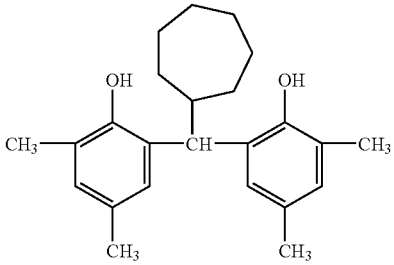
(A-6)
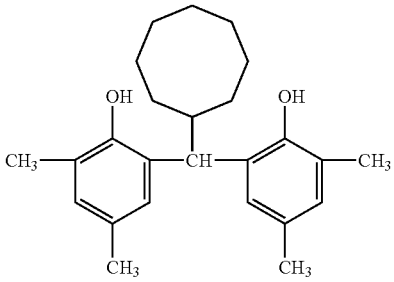
-continued
(A-7)
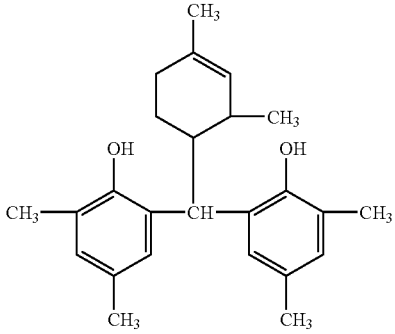
(A-8)
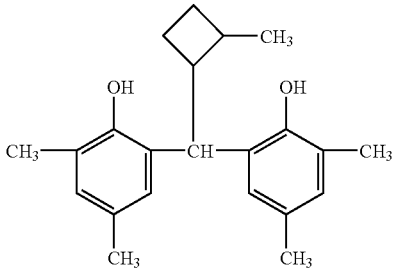
(A-9)
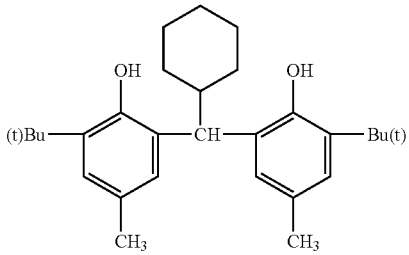
(A-10)
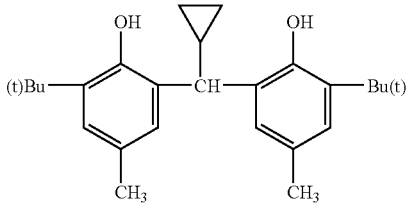
(A-11)
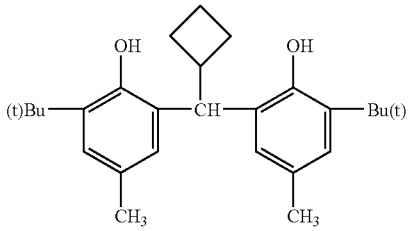
(A-12)
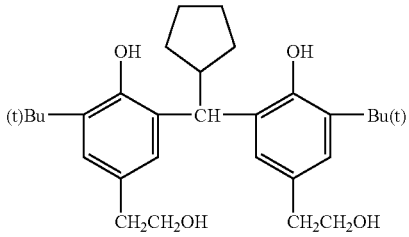

-continued
(A-13)
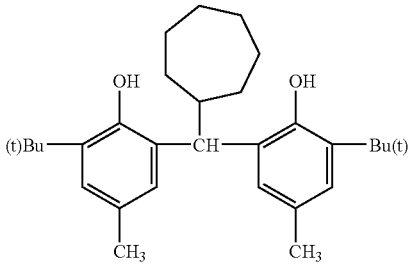
(A-14)
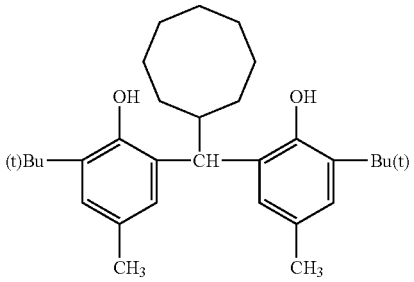
(A-15)
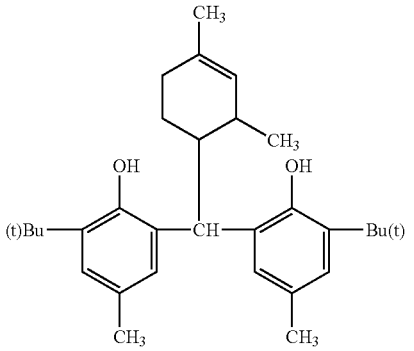
(A-16)
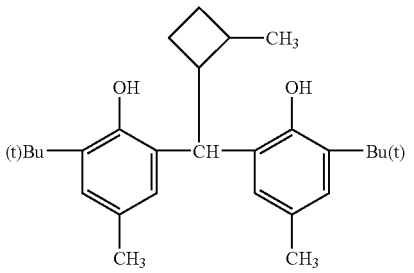
(A-17)
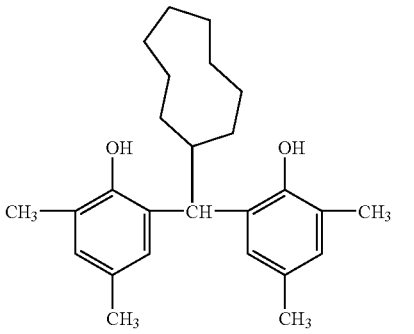
-continued
(A-18)
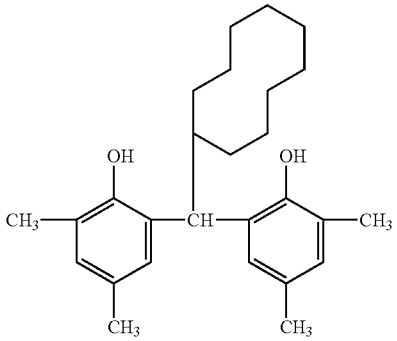
(A-19)
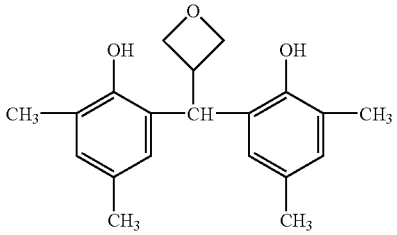
(A-20)
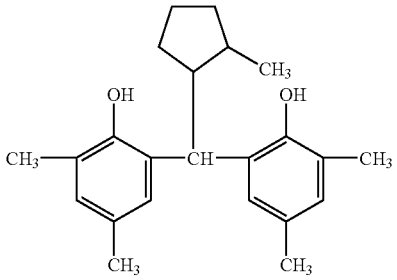
(A-21)
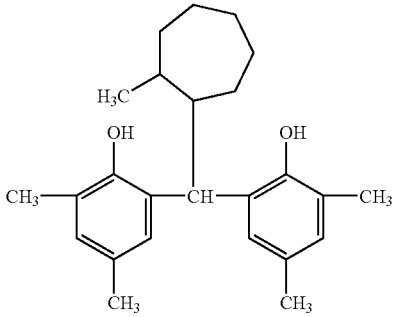
(A-22)
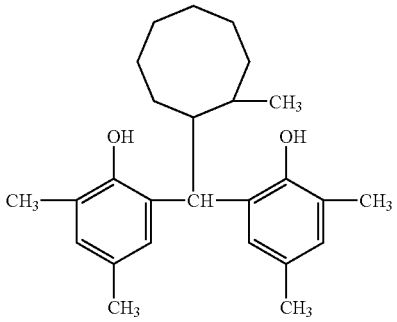

-continued
(A-23)
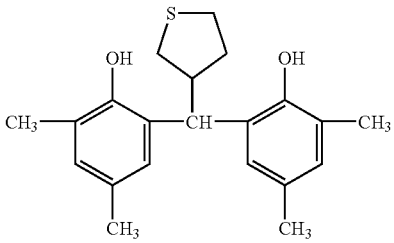
(A-24)
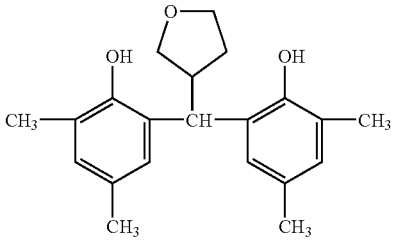
(A-25)
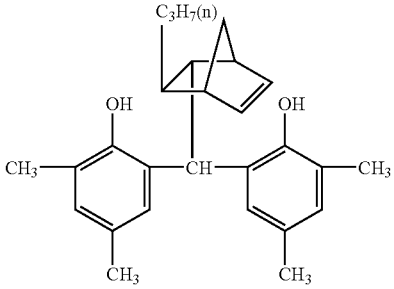
(A-26)
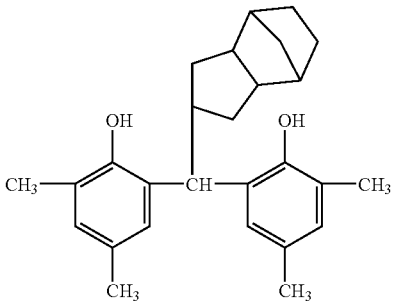
(A-27)
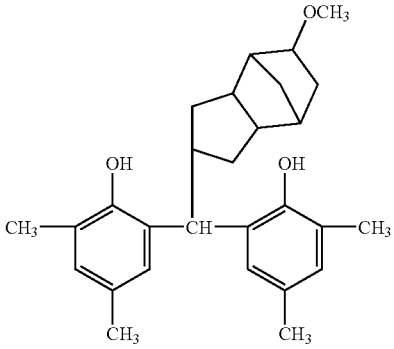
-continued
(A-28)
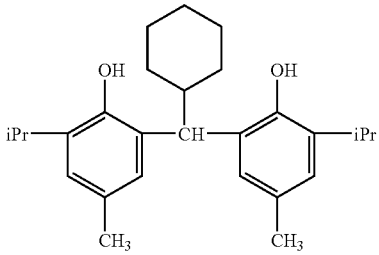
(A-29)
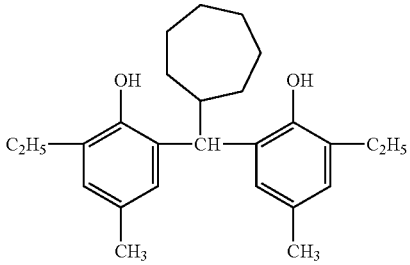
(A-30)
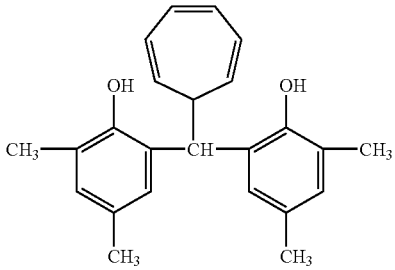
(A-31)
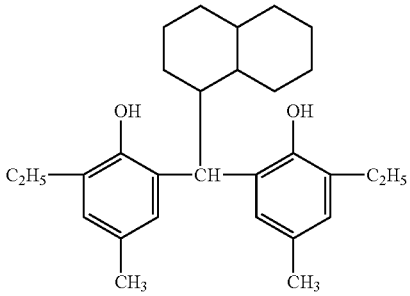
(A-32)
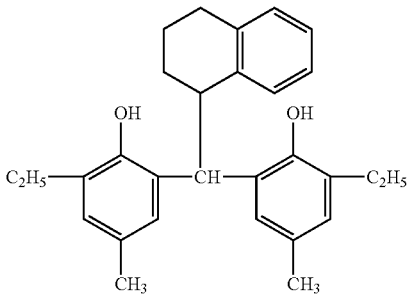

-continued
(A-33)
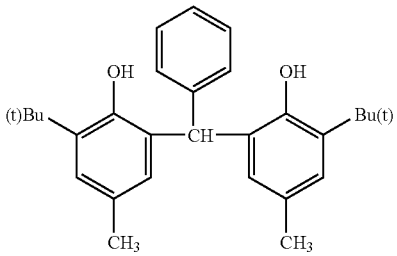
(A-34)
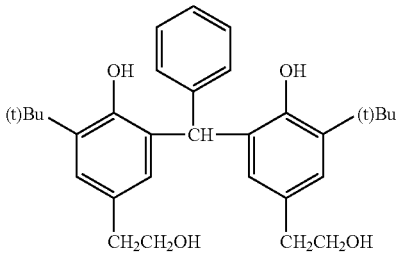
(A-35)
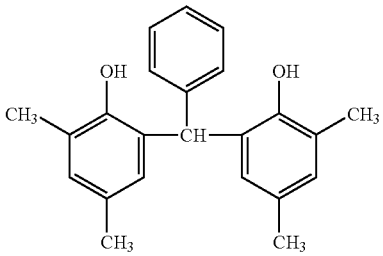
(A-36)
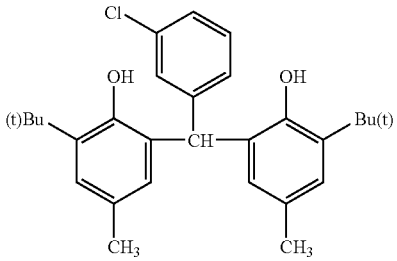
(A-37)
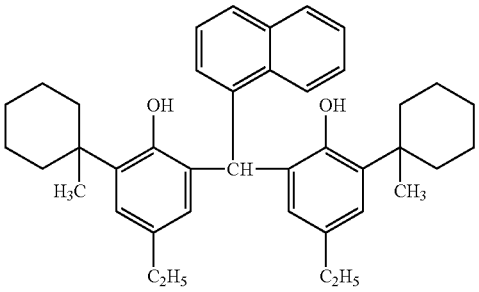
-continued
(A-38)
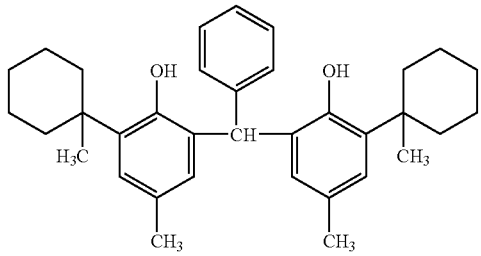
(A-39)
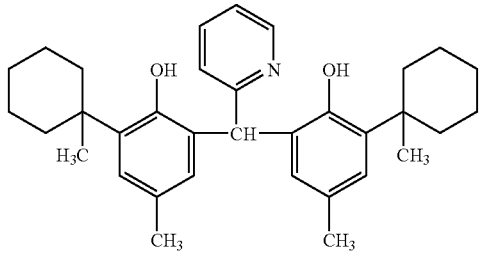
(A-40)
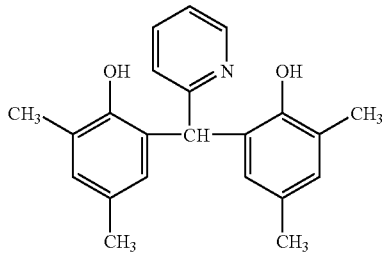
(A-41)
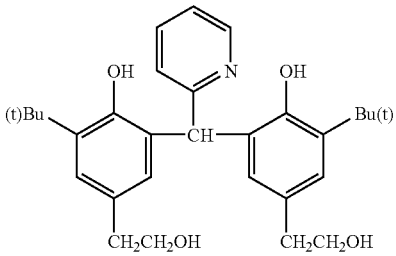
(A-42)
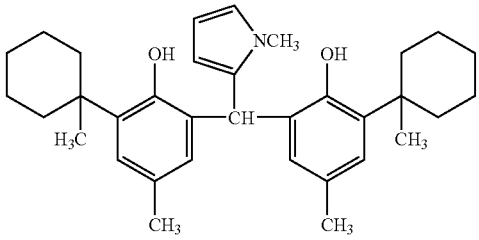
(A-43)
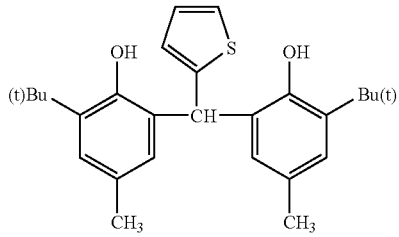

-continued
(A-44)
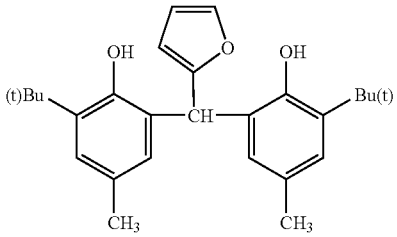
(A-45)
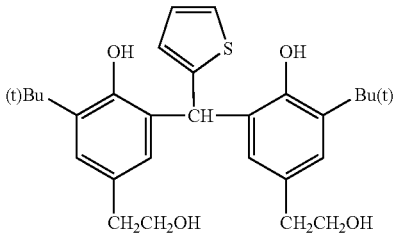
(A-46)
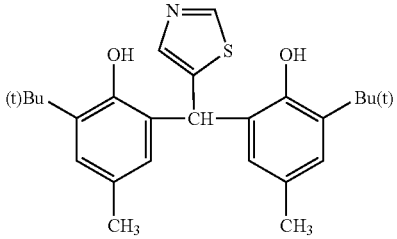
(A-47)
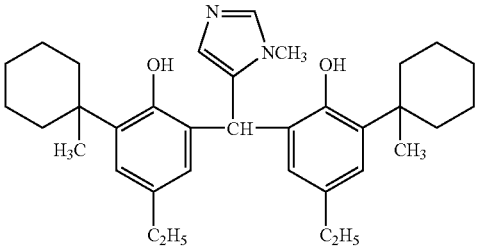
(A-48)
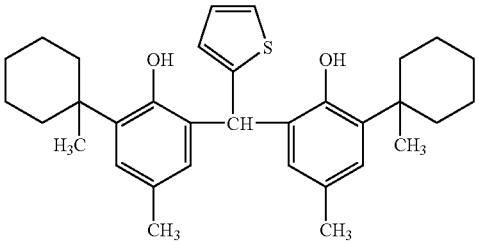
(A-49)
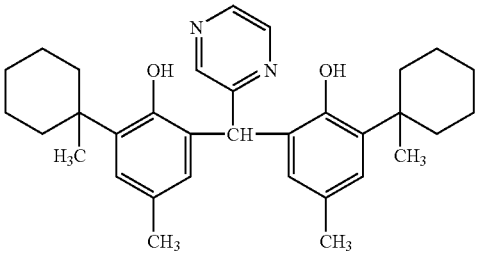
-continued
(A-50)
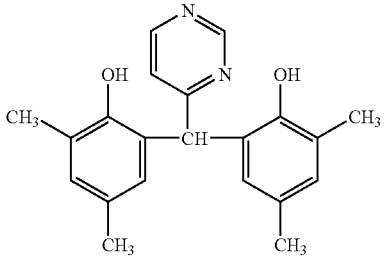
(A-51)
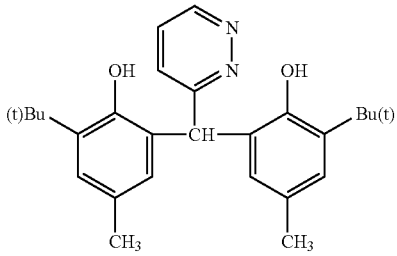
(A-52)
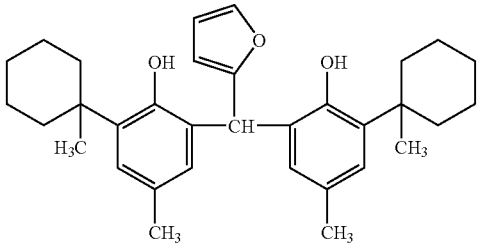
(A-53)
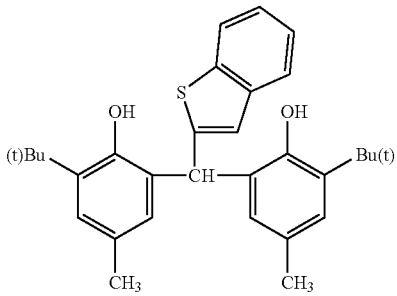
(A-54)
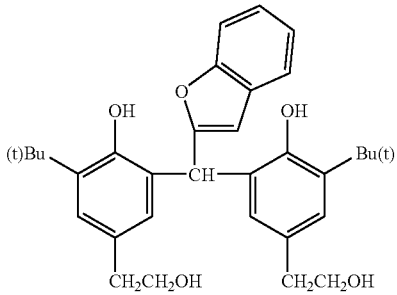

-continued
(A-55)
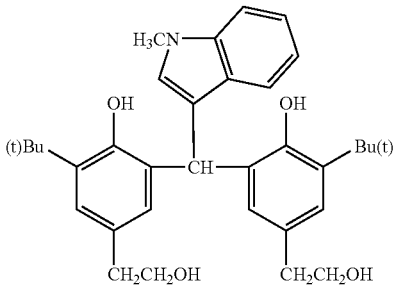
(A-56)
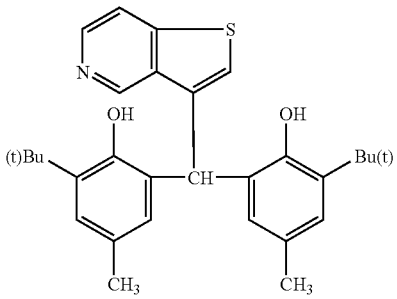
(A-57)
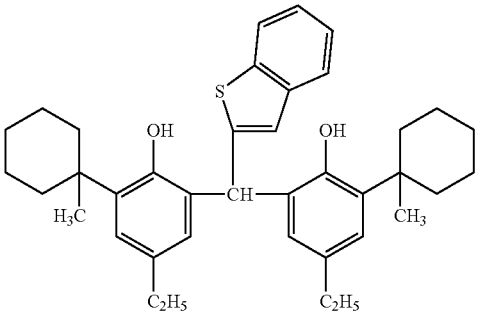
(A-58)
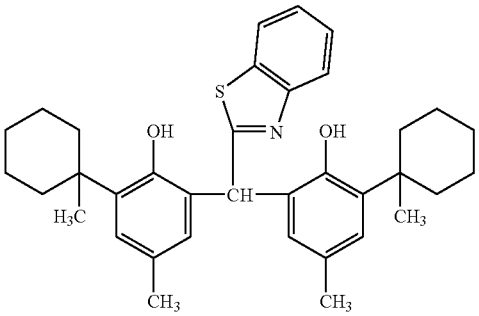
(A-59)
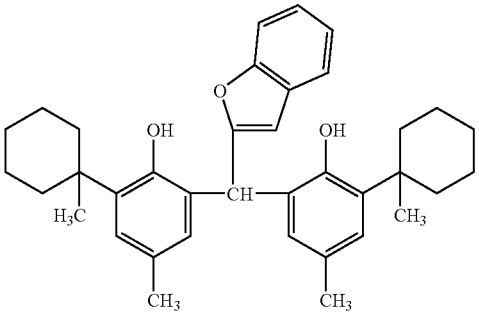
-continued
(A-60)
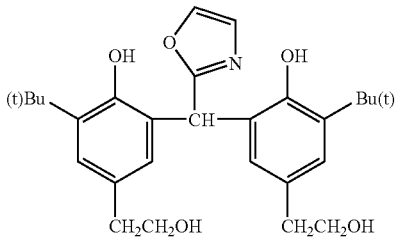
(A-61)
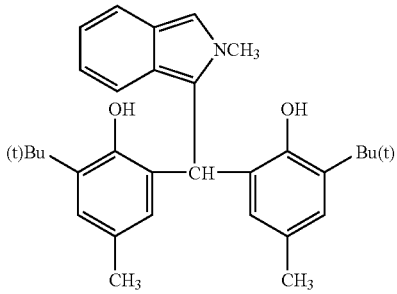
(A-62)
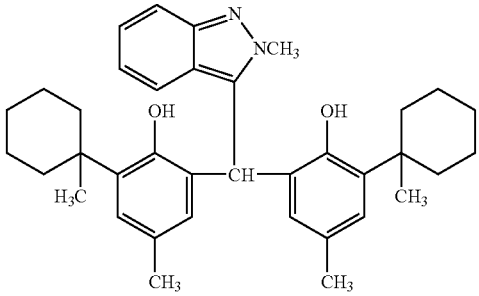
(A-63)
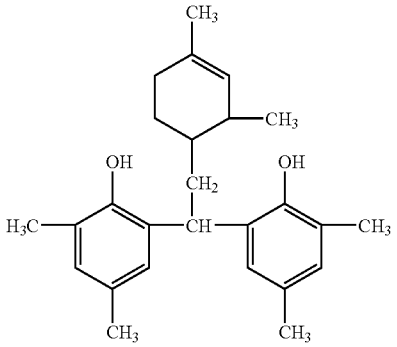
(A-64)
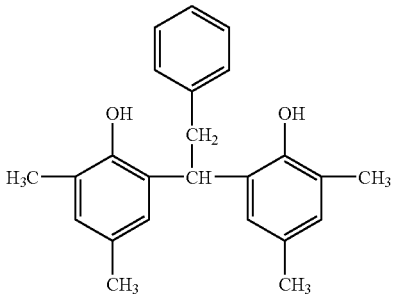

-continued
(A-65)
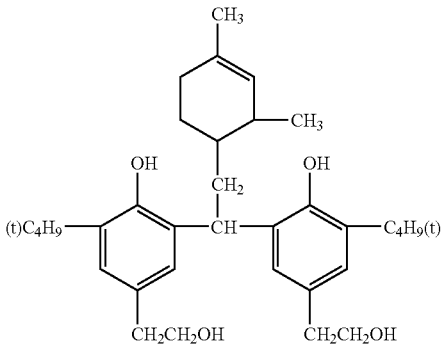
(A-66)
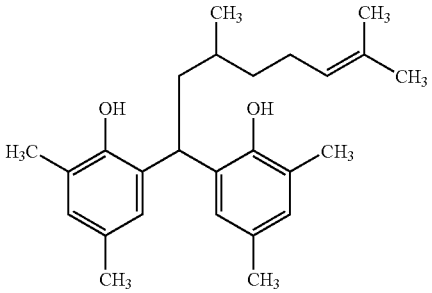
(A-67)
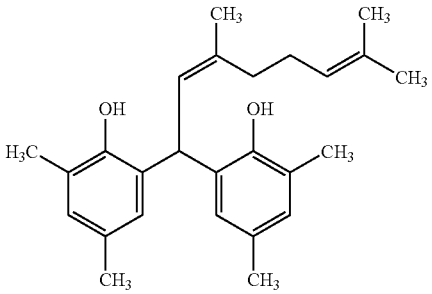
(A-68)
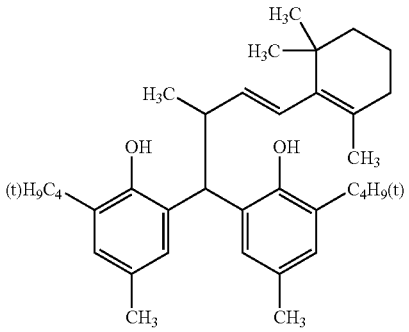
(A-69)
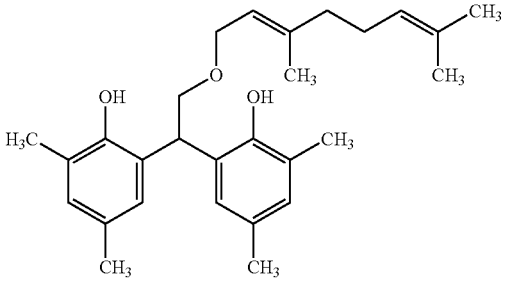
-continued
(A-70)
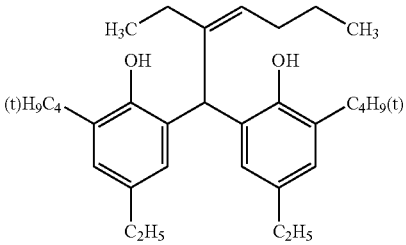
(A-71)
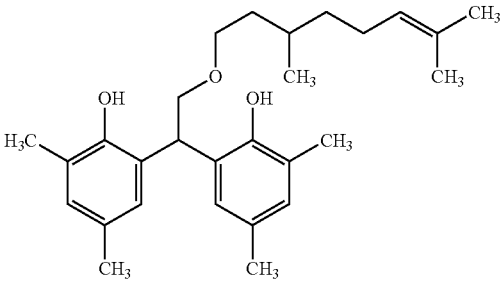
(A-72)
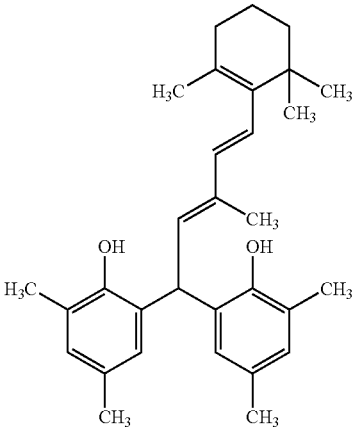
(A-73)
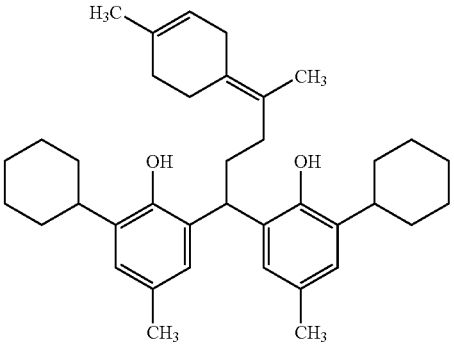

-continued
(A-74)
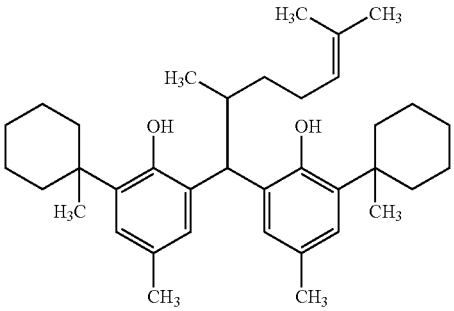
(A-75)
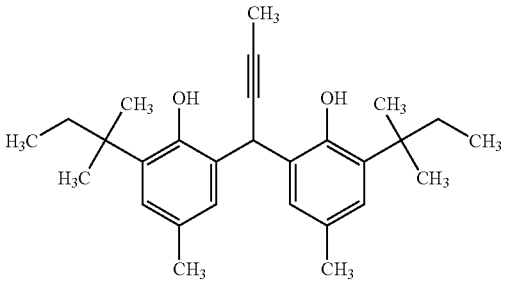
(A-76)
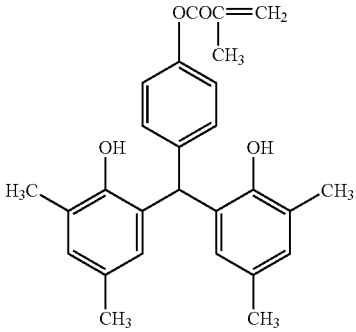
(A-77)
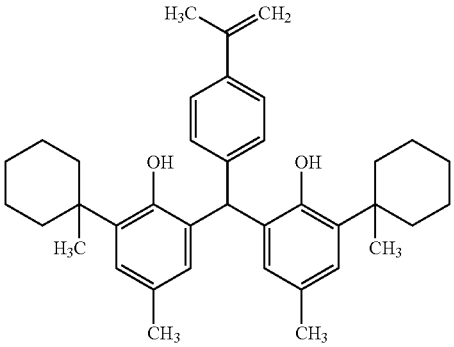
-continued
(A-78)
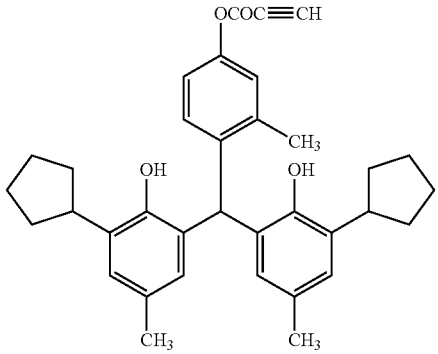
(A-79)
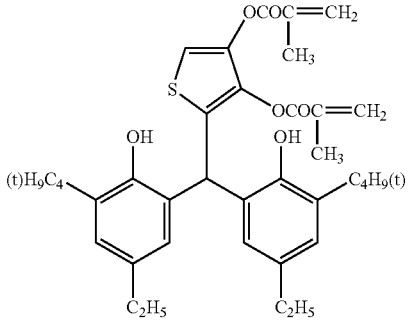
(A-80)
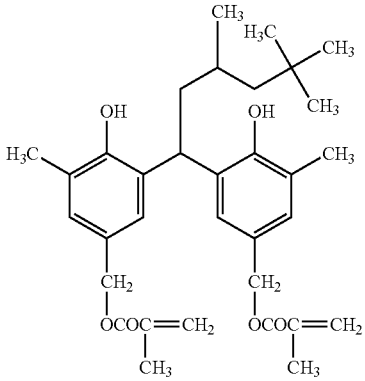
(A-81)
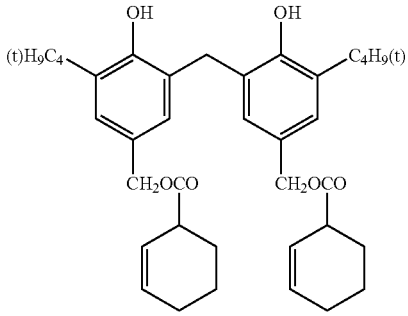
(A-82)
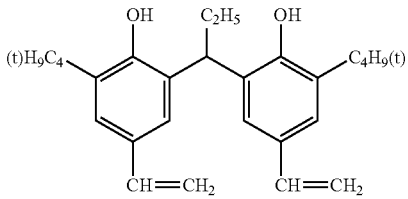

-continued
(A-83)
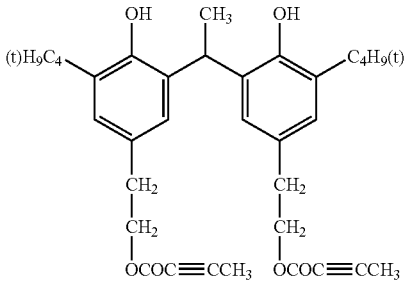
(A-84)
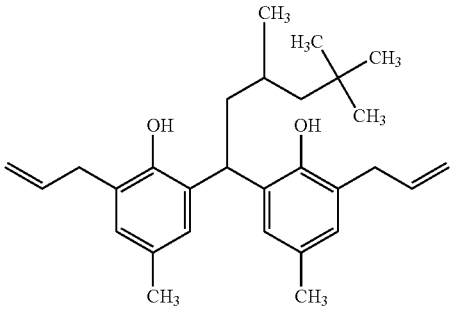
(A-85)
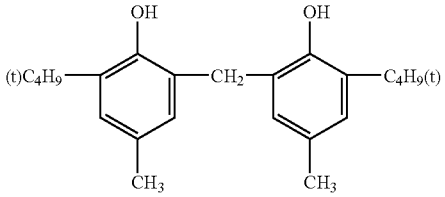
(A-86)
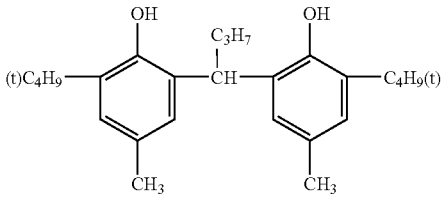
(A-87)
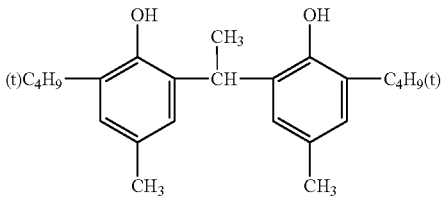
(A-88)
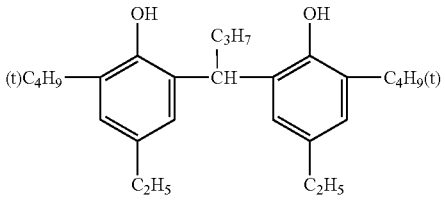
-continued
(A-89)
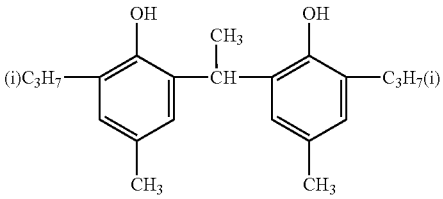
(A-90)
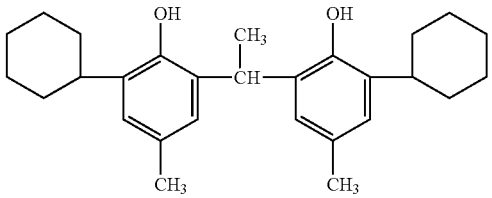
(A-91)
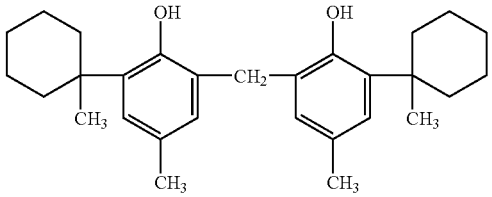
(A-92)
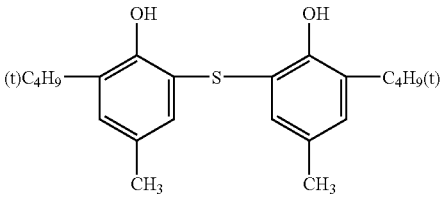
(A-93)
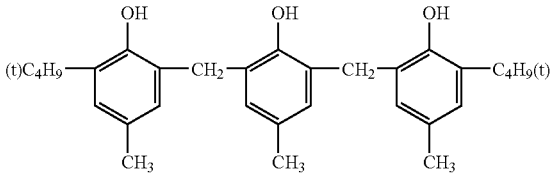
(A-94)
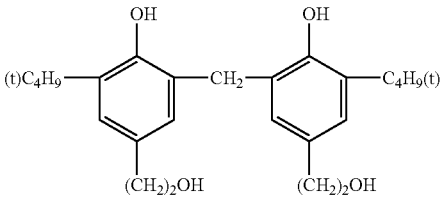
The compounds represented by the Formulas (A-1), (A-2) and (A-3) of the present invention can be easily synthesized by the methods known in earlier technology. The preferable synthesis scheme is displayed below by taking the case corresponding to the Formula (A-1) as an example.

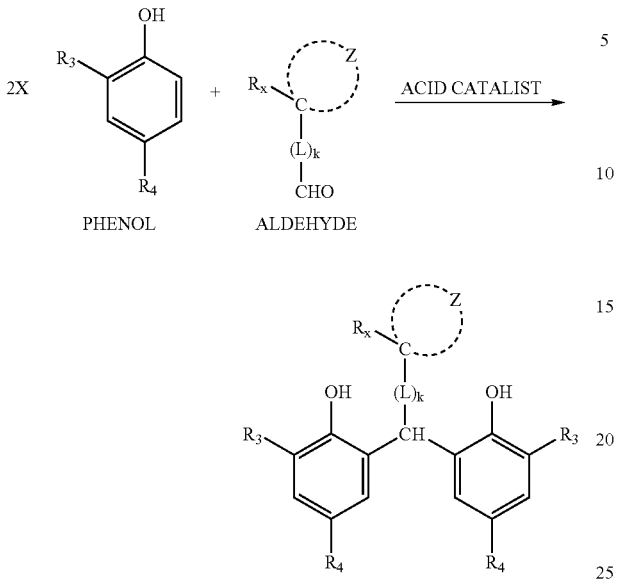

That is, the target compound corresponding to the Formula (A-1) can be obtained with a good yield by preferably dissolving or suspending two equivalents of phenol and one equivalent of aldehyde with no solvent or in an appropriate solvent, adding a catalytic amount of acid, and preferably reacting at the temperature of −20 to 120° C. for 0.5 to 60 hours. This is the same for the compounds represented by the Formula (A-2) or (A-3).

The organic solvents are preferably hydrocarbon type organic solvents, and specifically include benzene, toluene, xylene, dichloromethane, chloroform and the like. Preferably it is toluene. Furthermore, in terms of the yield, it is the most preferable to react with no solvent. As the acid catalysis, it is possible to any of inorganic and organic acids, but preferably used are concentrated hydrochloric acid, p-toluene sulfonate, and phosphoric acid. It is preferred that the catalysis is used at 0.001 to 1.5 equivalents based on the corresponding aldehyde. The reaction temperature is preferably around room temperature (15 to 25° C.), and the reaction time period is preferably from 3 to 20 hours.

The compounds represented by the Formula (A-4) of the invention (the synthetic schemes of 1–66 and 1–76 are described as the representatives) can be synthesized by the following methods.

SYNTHESIS OF (1-66)

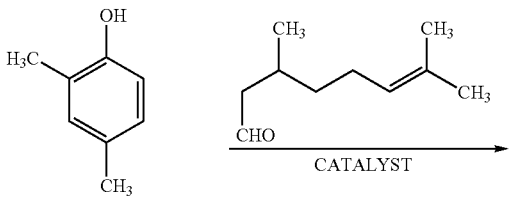

-continued

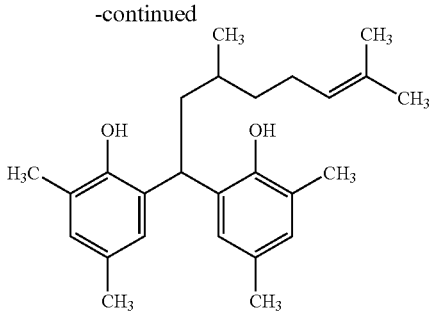

SYNTHESIS OF (1-76)

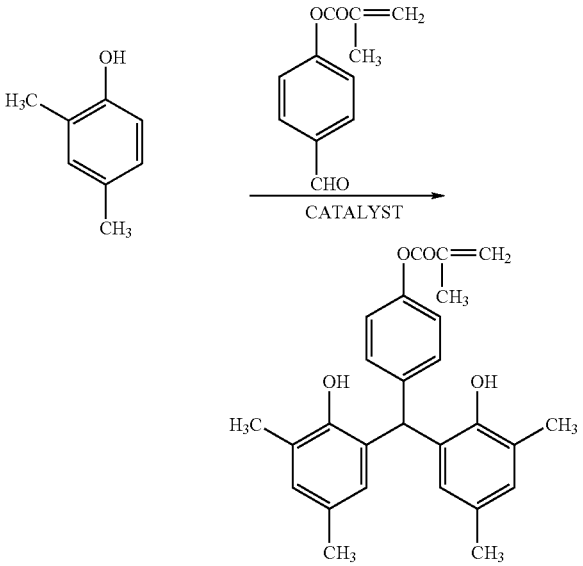

The compounds represented by the Formula (A-4) or (A-5) can be synthesized by reacting the phenol derivative and the aldehyde derivative in the solvent such as water, methanol, ethanol, acetonitrile, tetrahydrofuran, ethyl acetate, toluene and N,N-dimethylformamide using the catalysis such as hydrochloric acid, sulfuric acid and p-toluene sulfonate according the above scheme.

The reducing agents which the photothermographic imaging material contains are those which reduce the organic silver salt to form silver images. The reducing agents which can be combined with the reducing agent of the present invention are described in, for example, U.S. Pat. Nos. 3,770,448, 3,773,512, and 3,593,863, Research Disclosure (hereinafter, abbreviated as RD) 17029 and 29963, JP-A-11-119372 and JP-A-2002-62616.

The use amount of the reducing agent including the compounds represented by the Formulae (A-1) to (A-5) is preferably from $1\times10^{-2}$ to 10 mol, and especially preferably from $1\times10^{-2}$ to 1.5 mol per mol of the silver.

Since the reducing agent which has protons such as bisphenols and sulfonamidephenols is used as the reducing agent in the silver salt photothermographic dry imaging material of the invention, it is preferable to contain the compound which can inactivate the reducing agent by producing active species capable of withdrawing these hydrogen. As a colorless photo oxidative substance, preferred is the compound capable of producing free radicals as reaction active species at the exposure. As these compounds, it is possible to use the biimidazolyl compounds described in the paragraph numbers of [0065] to [0069] of JP-A-2001-249428 and the iodonium compounds described in the paragraph numbers of [0071] to [0082] of JP-A-2001-249428.

In the silver salt photothermographic dry imaging material of the invention, as the compound which inactivates the reducing agent such that the reducing agent can not reduce the organic silver salt to the silver, it is possible to use the compound which releases halogen atoms as the active species. As specific examples of the compounds which produce active halogen atoms, it is possible to use the compounds disclosed in the paragraph numbers of [0086] to [0102] of JP-A-2001-249428.

(Cyan Coloring Leuco Dyes)

The cyan coloring leuco dyes preferably used in the invention are described.

It is one of characteristics to use the cyan coloring leuco dye as a color tone adjuster in the silver salt photothermographic dry imaging material (hereinafter also simply referred to as imaging material) of the invention.

The leuco dye could be any colorless or slightly colored compound which becomes a colored form by being oxidized when heated at a temperature of about 80 to 200° C. for about 0.5 to 30 sec, and it is possible to use any leuco dyes which are oxidized with silver ions to form dyestuffs. The compounds having pH sensitivity and capable of being oxidized to the colored state are useful.

In the invention, those especially preferably used as the cyan coloring leuco dyes are dye image forming agents where absorbance at 600 to 700 nm is increased by being oxidized, JP-A-59-206831 (especially, the compounds where λmax is within the range of 600 to 700 nm), the compounds of the Formula (I) to (IV) of JP-5-204087 (specifically, the compounds (1) to (18) described in the paragraphs of [0032] to [0037]), and the compounds of the Formula 4 to 7 of JP-A-11-231460 (specifically, the compounds No. 1 to No. 79) described in the paragraph [0105]).

The cyan coloring leuco dyes especially preferably used in the invention are represented by the following Formula (CL).

(CL)

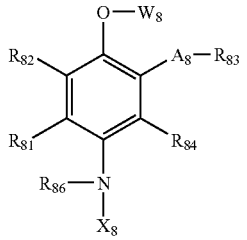

In the Formula, $R_{81}$ and $R_{82}$ are hydrogen atoms, halogen atoms, substituted or unsubstituted alkyl, alkenyl, alkoxy and —NHCO—$R_{10}$ groups ($R_{10}$ represents an alkyl, aryl or heterocyclic group), or $R_{81}$ and $R_{82}$ are the groups which are bound one another to form an aliphatic hydrocarbon ring, aromatic hydrocarbon ring or heterocycle. A8 represents —NHCO—, —CONH— or —NHCONH— group, and $R_{83}$ represents a substituted or unsubstituted alkyl, aryl or heterocyclic group. Also, —$A_8$—$R_{83}$ may be a hydrogen atom. $W_8$ represents a hydrogen atom or —CONH—$R_{85}$, —CO—$R_{85}$ or —CO—O—$R_{85}$ group ($R_{85}$ represents a substituted or unsubstituted alkyl, aryl or heterocyclic group.), and $R_{84}$ represents a hydrogen atom, halogen atom, a substituted or unsubstituted alkyl, alkenyl, alkoxy, carbamoyl or nitrile group. $R_{86}$ represents —CONH—$R_{87}$, —CO—$R_{87}$ or —CO—O—$R_{87}$ group ($R_{87}$ represents a substituted or unsubstituted alkyl, aryl or heterocyclic group.). $X_8$ represents a substituted or unsubstituted aryl or heterocyclic group.

In the Formula (CL), as the halogen atoms represented by $R_{81}$ and $R_{82}$, included are for example fluorine, bromine, chlorine atoms and the like. As the alkyl groups represented by $R_{81}$ and $R_{82}$, included are the alkyl groups with up to 20 carbon atoms (e.g., methyl, ethyl, butyl, dodecyl, etc.). As the alkenyl groups represented by $R_8$, and $R_{82}$, included are the alkenyl groups with up to 20 carbon atoms (e.g., vinyl, allyl, butenyl, hexenyl, hexadienyl, etenyl-2-propenyl, 3-butenyl, 1-methyl-3-propenyl, 3-pentenyl, 1-methyl-3-butenyl, etc.). As the alkoxy groups represented by $R_{81}$ and $R_{82}$, included are the alkoxy groups with up to 20 carbon atoms (e.g., methoxy, ethoxy groups, etc.). Also, in —NHCO—$R_{10}$, as the alkyl, aryl and heterocyclic groups represented by $R_{10}$, included are the alkyl groups with up to 20 carbon atoms (e.g., methyl, ethyl, butyl, dodecyl, etc.), the aryl groups with 6 to 20 carbon atoms such as phenyl, naphthyl and thienyl groups, and the heterocyclic groups such as thiophene, furan, imidazole, pyrazole and pyrrole groups, respectively. The alkyl groups represented by $R_{83}$ are preferably the alkyl groups with up to 20 carbon atoms, and for example, included are methyl, ethyl, butyl, dodecyl and the like. The aryl groups represented by $R_{83}$ are preferably the aryl groups with 6 to 20 carbon atoms, and for example, included are phenyl, naphthyl, thienyl groups and the like. As the heterocyclic groups represented by $R_{83}$, included are thiophene, furan, imidazole, pyrazole, pyrrole groups and the like. In —CONH—$R_{85}$, —CO—$R_{85}$ or —CO—O—$R_{85}$ represented by $W_8$, the alkyl groups represented by $R_{85}$ are preferably the alkyl groups with up to 20 carbon atoms, and for example, included are methyl, ethyl, butyl, dodecyl and the like, the aryl groups represented by $R_{85}$ are preferably the aryl groups with 6 to 20 carbon atoms, and for example, included are phenyl, naphthyl, thienyl groups and the like, and as the heterocyclic groups represented by $R_{85}$, included are, for example, thiophene, furan, imidazole, pyrazole, pyrrole groups and the like.

The halogen atoms represented by $R_{84}$, for example, included are fluorine, chlorine, bromine, iodine groups and the like. As the alkyl groups represented by $R_{84}$, for example, included are the chain or cyclic alkyl groups such as methyl, butyl, dodecyl and cyclohexyl groups. As alkenyl groups represented by $R_{84}$, included are the alkenyl groups with up to 20 carbon atoms (e.g., vinyl, allyl, butenyl, hexenyl, hexadienyl, etenyl-2-propenyl, 3-butenyl, 1-methyl-3-propenyl, 3-pentenyl, 1-methyl-3-butenyl, etc.). As alkoxy groups represented by $R_{84}$, for example, included are methoxy, butoxy, tetradecyloxy groups and the like. The carbamoyl groups represented by $R_{84}$, for example, included are diethylcarbamoyl, phenylcarbamoyl groups and the like. Also, nitrile groups are preferable. In these, the hydrogen atom and the alkyl group are more preferable. The above $R_{83}$ and $R_{84}$ may be linked one another to form a cyclic structure.

The above groups can further have a single substituent or multiple substituents. As the typical substituents, included are halogen atoms (e.g., fluorine, chlorine, bromine atoms, etc.), alkyl groups (e.g., methyl, ethyl, propyl, butyl, dodecyl, etc.), hydroxy, cyano, nitro groups, alkoxy groups (e.g., methoxy, ethoxy, etc.), alkylsulfonamide groups (e.g., methylsulfonamide, octylsulfonamide, etc.), arylsulfonamide groups (e.g., phenylsulfonamide, naphthylsulfonamide, etc.), alkylsulfamoyl groups (e.g., butylsulfamoyl, etc.), arylsulfamoyl groups (e.g., phenylsulfamoyl, etc.), alkyloxycarbonyl groups (e.g., methoxycarbonyl, etc.), aryloxycarbonyl groups (e.g., phenyloxycarbonyl, etc.), aminosulfonamide, acylamino, carbamoyl, sulfonyl, sulfinyl, sulfoxy, sulfo, aryloxy, alkoxy, alkylcarbonyl, arylcarbonyl, aminocarbonyl groups and the like.

$R_{10}$ or $R_{85}$ is preferably phenyl group, and more preferably the phenyl group having multiple halogen atoms and cyano groups as the substituents.

In —CONH—$R_{87}$, —CO—$R_{87}$ or —CO—O—$R_{87}$ group represented by $R_{86}$, the alkyl groups represented by $R_{87}$ are preferably the alkyl groups with up to 20 carbon atoms and for example included are methyl, ethyl, butyl, dodecyl groups and the like, the aryl groups represented by $R_{87}$ are preferably the aryl groups with 6 to 20 carbons and for example included are phenyl, naphthyl, thienyl groups and the like, and as the heterocyclic groups represented by $R_{87}$, for example included are thiophene, furan, imidazole, pyrazole and pyrrole groups and the like.

As the substituents which the groups represented by $R_{87}$ can have, it is possible to use those which are the same as the substituents included in the description for $R_{81}$ to $R_{84}$ of the Formula (CL).

The aryl groups represented by $X_8$ include the aryl groups with 6 to 20 carbon atoms such as phenyl, naphthyl and thienyl groups, and the heterocyclic groups represented by $X_8$ include thiophene, furan, imidazole, pyrazole and pyrrole groups and the like.

As the substituents which the groups represented by $X_8$ can have, it is possible to use those which are the same as the substituents included in the description for $R_{81}$ to $R_{84}$ of the Formula (CL). As the groups represented by $X_8$, preferable are the aryl or heterocyclic group having the alkylamino group (diethylamino, etc.) at a para-position. These groups may comprise photographically useful groups.

The representative leuco dyes include, for example, biphenol leuco dye, phenol leuco dye, Indoaniline leuco dye, acrylated azine leuco dye, phenoxazine leuco dye, phenodiazine leuco dye and phenothiazine leuco dye and the like. Also, useful are the leuco dyes disclosed in U.S. Pat. Nos. 3,445,234, 3,846,136, 3,994,732, 4,021,249, 4,021,250, 4,022,617, 4,123,282, 4,368,247, 4,461,681, and JP-A-50-36110, JP-A-59-206831, JP-A-5-204087, JP-A-11-231460, JP-A-2002-169249, and JP-A-2002-236334.

It is preferred that the leuco dyes with various colors are used alone or in combination with multiple types to adjust the given color tone. Especially, the dye used for the invention is leuco dye which develops cyan color, and even a leuco dye which has a different structure can be combined if it develops the same cyan color.

It is preferred that coloring density is properly adjusted in association with the color tone of the developed silver per se. In the invention it is preferred that the color is developed to have a reflection optical density of 0.01 to 0.05 or a transmission optical density of 0.005 to 0.03 and the color tone is adjusted to become the image within the preferable color tone described below. As addition methods, it is possible to contain in a coating solution for the photosensitive layer or a coating solution for the layer adjacent thereto to contain in these layers by dispersing in water or dissolving in an organic solvent. The organic solvent can be optionally selected from alcohols such as methanol and ethanol, ketones such as acetone and methylethylketone, aromatic types such as toluene and xylene. The use amount is in the range of $1\times10^{-2}$ to 10 ml, and preferably from $1\times10^{-2}$ to 1.5 mol per mol of the silver. Further, the addition amount ratio of the cyan coloring leuco dye to the total addition amount of the reducing agents represented by the Formulas (A-1) to (A-5) is preferably from 0.001 to 0.2, more preferably, from 0.005 to 0.1 by mole ratio. Specific examples of the leuco dyes which develop the cyan color especially preferable for the invention are described in JP-A-5-204087 and JP-A-11-231460 described above.

Specific examples of the cyan coloring leuco dyes (CL) are shown below, but the cyan coloring leuco dyes used for the invention are not limited thereto.

(CA-1)

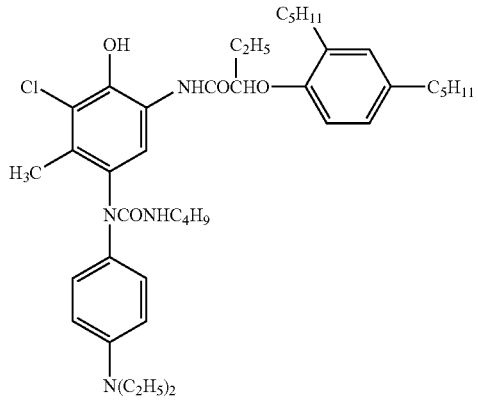

(CA-2)

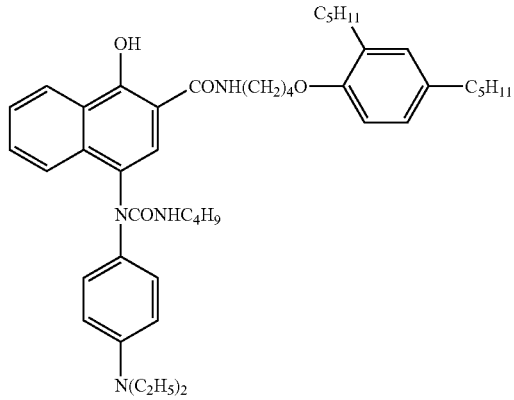

(CA-3)

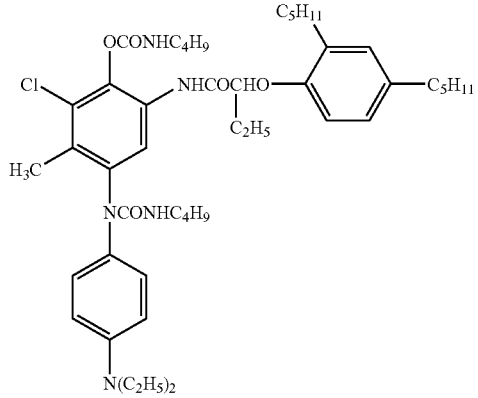

-continued
(CA-4)
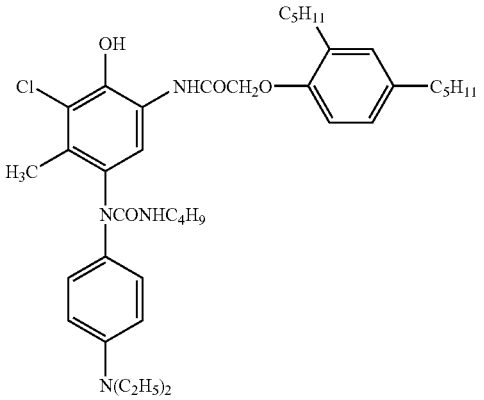
(CA-5)
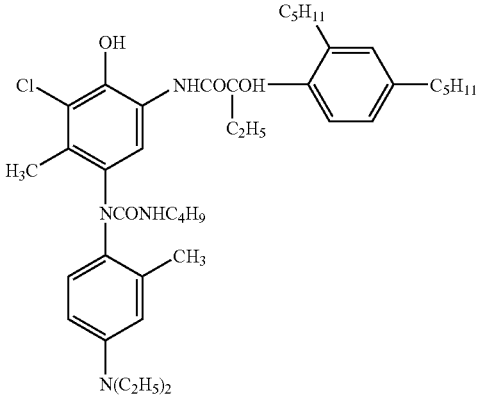
(CA-6)
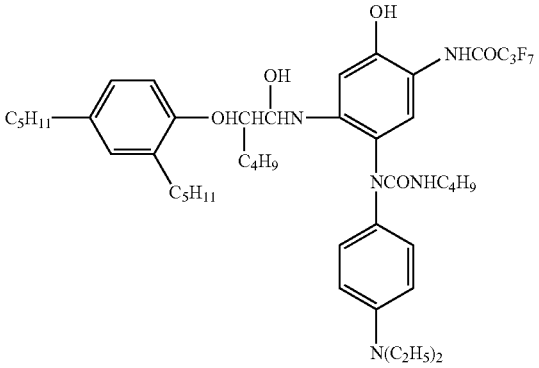
(CA-7)
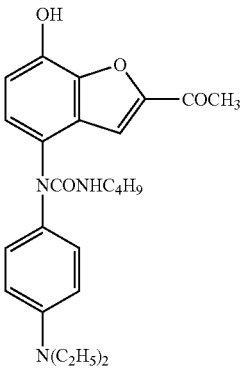
-continued
(CA-8)
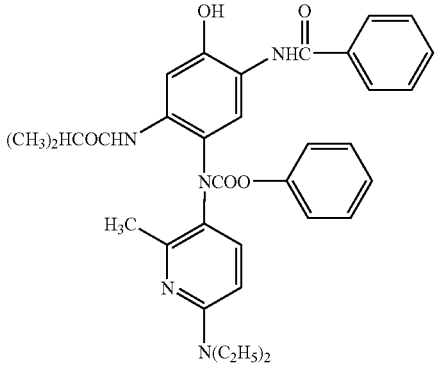
(CA-9)
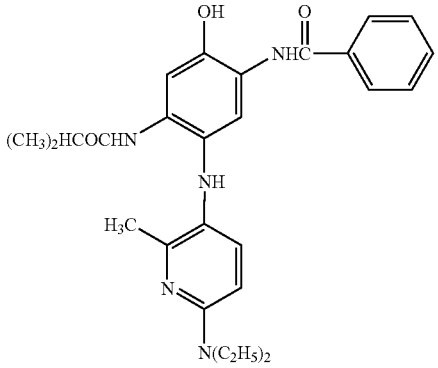
(CA-10)
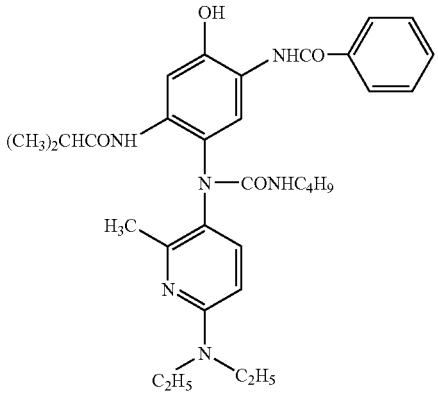
(CA-11)
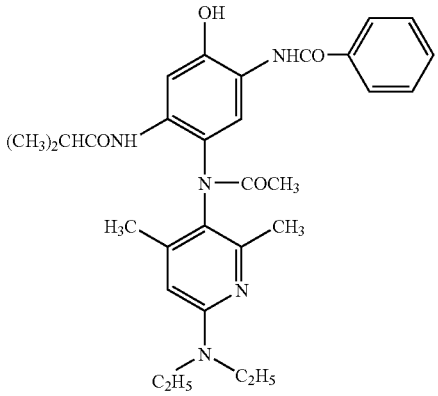

-continued (CA-12)

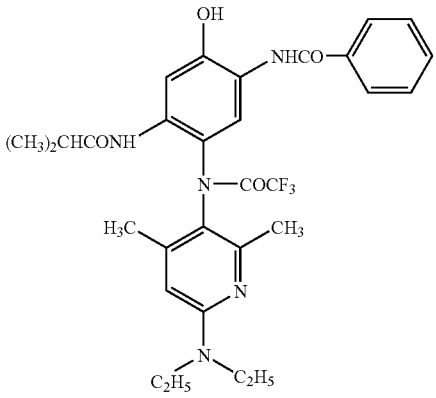

(CA-13)

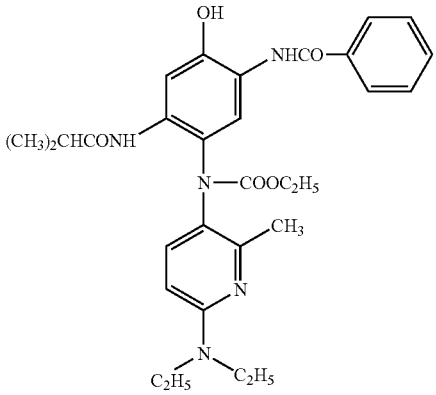

The addition amount of the cyan coloring leuco dye is typically from 0.00001 to 0.05 mol/mol of Ag, preferably from 0.0005 to 0.02 mol/mol of Ag, and more preferably from 0.001 to 0.01 mol/mol of Ag. In the invention, a sum total of the maximum density at the maximum absorbance wavelength of dyestuff image formed by the cyan leuco dye is preferably 0.01 or more and 0.50 or less, more preferably 0.02 or more and 0.30 or less, and especially preferably it is preferable to develop color to have a value of 0.03 or more and 0.10 or less.

In the invention, it is possible to make it possible to coordinate more delicate color tones by combining the following magenta coloring leuco dye and yellow coloring leuco dye in addition to the above cyan coloring leuco dye.

In the invention, especially as the yellow coloring leuco dye, preferably used is a dye image forming agent represented by the Formula (A-6) where absorbance at 360 to 450 nm is increased by being oxidized. The compounds of the Formula (A-6) preferably used are described in detail. In the Formula (A-6), $R_{61}$ represents a substituted or unsubstituted alkyl group. In the Formula (A-6), when $R_{62}$ is a substituent except a hydrogen atom, $R_{61}$ represents the alkyl group. As the alkyl group, preferable is the alkyl group with 1 to 30 carbons, and the alkyl group may be unsubstituted or have substituents. As the alkyl group, specifically preferable are methyl, ethyl, butyl, octyl, isopropyl, t-butyl, t-octyl, t-amyl, sec-butyl, cyclohexyl, and 1-methyl-cyclohexyl groups and the like. The groups which are sterically larger than isopropyl group (e.g., isopropyl, isononyl, t-butyl, t-amyl, t-octyl, cyclohexyl, 1-methyl-cyclohexyl, adamanthyl groups, etc.) are preferable. In these, secondary or tertiary alkyl groups are preferable, and t-butyl, t-octyl, t-amyl groups and the like which are tertiary alkyl groups are especially preferable. When $R_{61}$ has substituents, the substituents include halogen atoms, aryl, alkoxy, amino, acyl, acylamino, alkylthio, arylthio, sulfonamide, acyloxy, oxycarbonyl, carbamoyl, sulfamoyl, sulfonyl, phosphoryl groups and the like.

$R_{62}$ represents a hydrogen atom, a substituted or unsubstituted alkyl group or a substituted or unsubstituted acylamino group. The alkyl group represented by $R_{62}$ is preferably the alkyl group with 1 to 30 carbons. The acylamino represented by $R_{62}$ is preferably the acylamino group with 1 to 30 carbons. The description of the alkyl groups is the same as that of $R_{61}$. The acylamino group may be unsubstituted or have substituents, and specifically includes acetylamino, alkoxyacetylamino, aryloxyacetylamino groups and the like. $R_{62}$ is preferably the hydrogen atom or the unsubstituted alkyl group with 1 to 24 carbons, and specifically includes methyl, isopropyl, and t-butyl groups. $R_{61}$ and $R_{62}$ are not 2-hydroxyphenylmethyl groups.

$R_{63}$ represents a hydrogen atom, or a substituted or unsubstituted alkyl group. The alkyl group represented by $R_{63}$ is preferably the alkyl group with 1 to 30 carbons. The description of the alkyl groups is the same as that of $R_{61}$. $R_{63}$ is preferably the hydrogen atom or the unsubstituted alkyl group with 1 to 24 carbons, and specifically includes methyl, isopropyl, and tert-butyl groups. It is preferred that one of either $R_{62}$ or $R_{63}$ is the hydrogen atom.

$R_{64}$ represents a group capable of being substituted to benzene ring, and for example is the same group as described for $R_2$ in the Formula (A-1). As $R_{64}$, preferred are the substituted or unsubstituted alkyl groups with 1 to 30 carbons and oxycarbonyl groups with 2 to 30 carbons, and the alkyl groups with 1 to 24 carbons are more preferable. The substituents of the alkyl groups include aryl, amino, alkoxy, oxycarbonyl, acylamino, acyloxy, imide, ureido groups and the like. More preferable are aryl, amino, oxycarbonyl, and alkoxy groups. These substituents of the alkyl groups may be further substituted with these substituents.

The preferred dye structure is represented by the following Formula (A-7).

The Formula (A-6) is preferably a bisphenol compound represented by the following Formula (A-7).

(A-7)

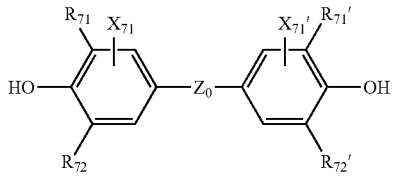

In the formula, $Z_0$ represents —S— group or —C($R_{73}$)($R_{13}$')— group, $R_{73}$ and $R_{73}$' each represent hydrogen atoms or substituents. The substituents represented by $R_{73}$ and $R_{73}$' include the same groups as the substituents included in the description of $R_{43}$ to $R_{45}$ in the Formula (A-4). $R_{73}$ and $R_{73}$' are preferably hydrogen atoms or alkyl groups.

$R_{71}$, $R_{72}$, $R_{71}$' and $R_{72}$' each represents a substituent, and the substituents include the same groups as the substituents included in the description of $R_{43}$ to $R_{45}$ in the Formula (A-4).

$R_{71}$, $R_{72}$, $R_{71}$' and $R_{72}$' are preferably alkyl, alkenyl, alkynyl, aryl, hetero ring groups and the like, and more preferably alkyl groups.

The substituents on alkyl group include the same groups as the substituents included in the description of $R_{43}$ to $R_{45}$ in the Formula (A).

$R_{71}$, $R_{72}$, $R_{71}'$ and $R_{72}'$ are more preferably tertiary alkyl groups such as t-butyl, t-amyl, t-octyl and 1-methyl-cyclohexyl.

$X_{71}$ and $X_71'$ each represents a hydrogen atom or a substituent, and the substituents include the same groups as the substituents included in the description of $R_{43}$ to $R_{45}$ in the Formula (A-4).

The compounds represented by the Formulae (A-6) to (A-7) can include the compounds (II-1) to (II-40) described in [0032] to [0038] of JP-A-2002-169249, and the compounds (ITS-1) to (ITS-12) described in [0026] of EP 1,211,093.

Hereinafter, specific examples of the bisphenol compounds represented by the Formulae (A-6) and (A-7) are shown, but the present invention is not limited thereto.

(B-1)

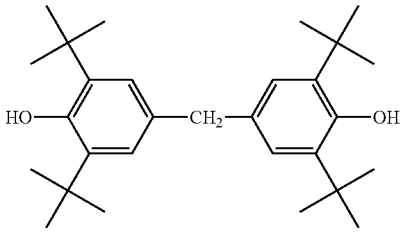

(B-2)

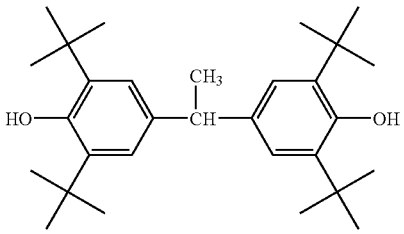

(B-3)

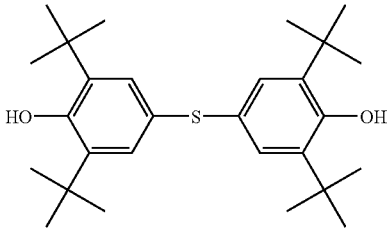

(B-4)

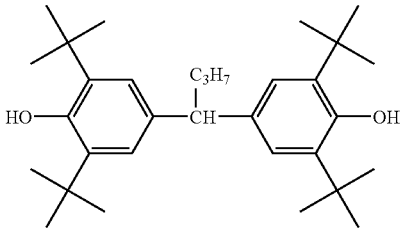

-continued (B-5)

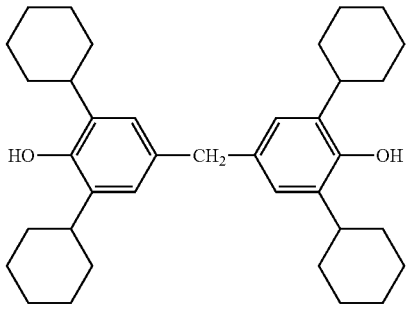

(B-6)

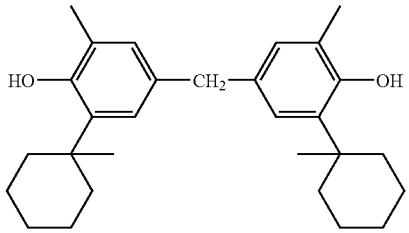

(B-7)

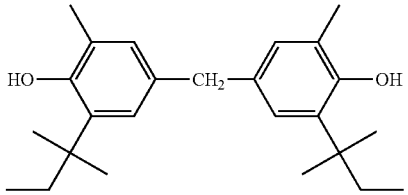

(B-8)

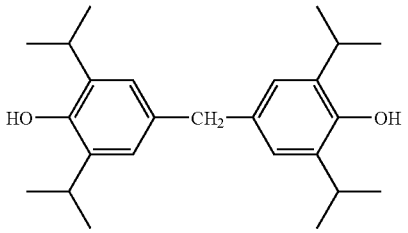

(B-9)

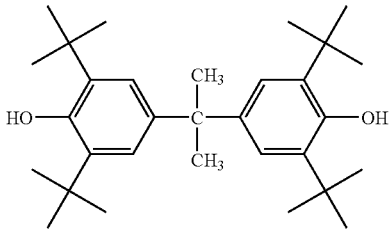

(B-10)

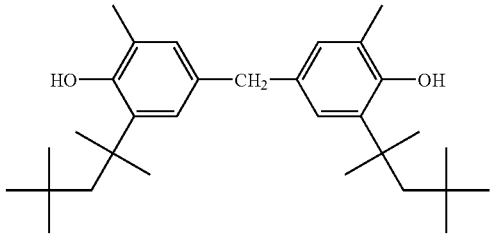

-continued (B-11)

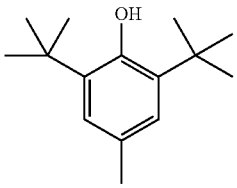

(B-12)

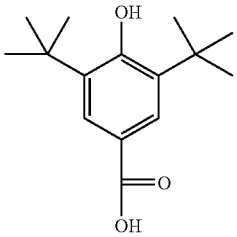

(B-13)

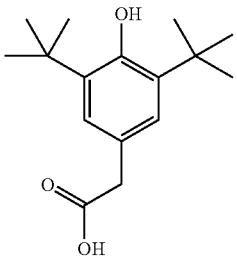

(B-14)

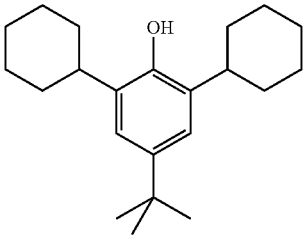

(B-15)

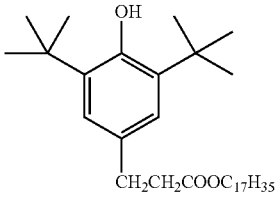

The preferred addition mode and addition amount are the same as the preferred range of the above-mentioned cyan coloring leuco dye.

The addition amount of the compound (hindered phenol compound) of the Formula (A-6) (including the compounds of the Formula (A-7)) is typically from 0.00001 to 0.01 mol/mol of Ag, preferably from 0.0005 to 0.01 mol/mol of Ag, and more preferably from 0.001 to 0.008 mol/mol of Ag.

Next, the compounds represented by the Formulas (1) to (4) according to the invention are described. An effect as an Antifoggant is observed in these compounds. In the invention, at least one selected from the Formulas (1) to (4) is contained in the silver salt photothermographic dry imaging material, but when multiple types selected from the Formulas (1) to (4) are combined, preferable effects are often obtained. The layer to be contained in silver salt photothermographic dry imaging material is not especially limited, but preferably it is preferable to be contained in the layer at the same side as the photosensitive layer as viewed from the support, and more preferably it is the photosensitive layer.

The compounds of the Formula (1) according to the invention are described.

In the Formula (1), $X_{01}$ and $X_{02}$ each represent hydrogen atoms, halogen atoms, alkyl, cycloalkyl, aryl, heterocyclic groups, —COOH or salts thereof, or aryl or alkyl groups which are bound via bivalent linkage groups. But at least one of $X_{01}$ and $X_{02}$ is —COOH or the salt thereof. $R^1$, $R^2$ and $R^3$ each represent hydrogen atoms, halogen atoms, alkyl, cycloalkyl, alkenyl, aryl, heterocyclic groups, or aryl, heterocyclic or alkyl groups which are bound via bivalent linkage groups. Also, adjacent $R^1$, $R^2$ and $R^3$ each may bind one another to form a ring. The above alkyl, cycloalkyl, aryl and heterocyclic groups may have substituents. Also, it is preferred that any group of $R^1$ to $R^3$ is bound to aryl or heterocyclic group via the bivalent linkage group.

The halogen atoms include, for example, fluorine, chlorine, bromine, iodine atoms and the like. The alkyl groups may be straight or branched, preferably have from 1 to 30 carbons, and include, for example, methyl, ethyl, propyl, butyl, t-butyl, octyl, dodecyl groups and the like. The cycloalkyl groups include, for example, cyclohexyl group. The alkenyl groups may be straight or branched, preferably have from 1 to 30 carbons, and include, for example, propenyl, butenyl, nonenyl groups and the like. The aryl groups include phenyl naphthyl groups and the like. These may have substituents, and the substituents include halogen atoms and groups such as alkyl, sulfonyl, amide and carboxyl. The heterocyclic groups can include tetrahydropyranyl, pyridyl, furyl, thienyl, imidazolyl, thiazolyl, thiadiazolyl, oxadiazolyl groups and the like. Also, when the heterocyclic group has substituents, it is preferable to comprise at least one electron withdrawing group as the substituent.

Representative compounds are shown below.

1-1

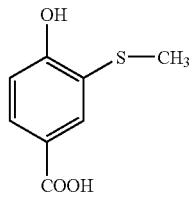

1-2

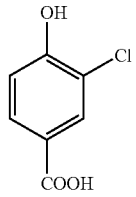

1-3

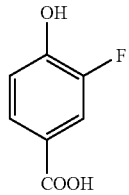

-continued
1-4
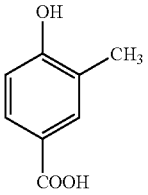
1-5
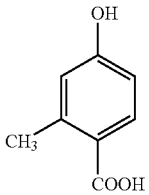
1-6
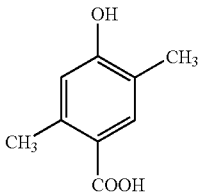
1-7
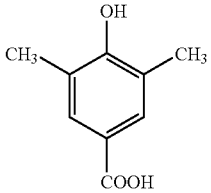
1-8
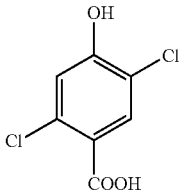
1-9
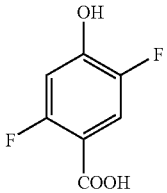
1-10
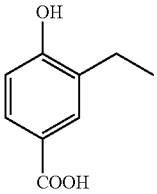
1-11
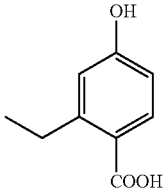
-continued
1-12
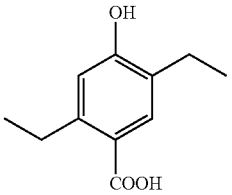
1-13
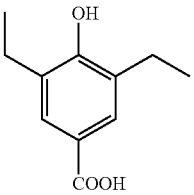
1-14
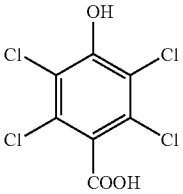
1-15
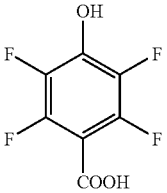
1-16
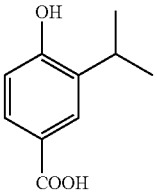
1-17
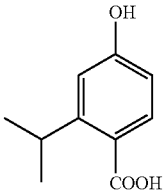
1-18
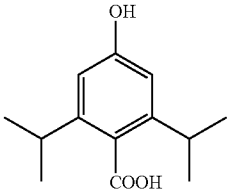
1-19
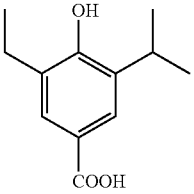

-continued
1-20
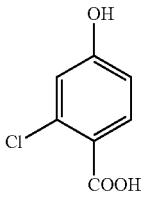
1-21
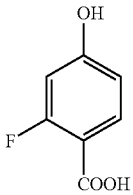
1-22
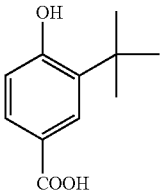
1-23
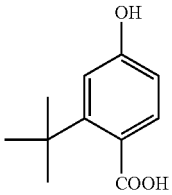
1-24
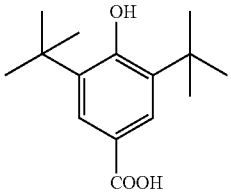
1-25
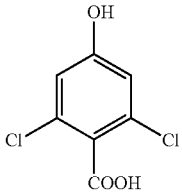
1-26
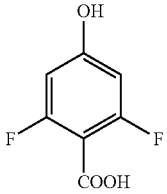
-continued
1-27
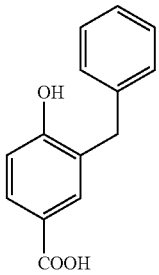
1-28
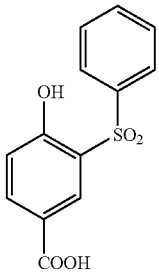
1-29
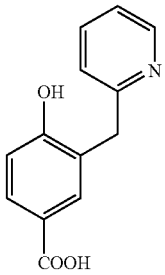
1-30
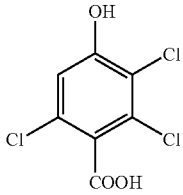
1-31
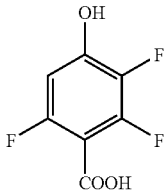
1-32
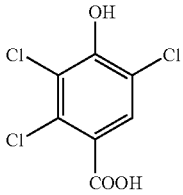

-continued
1-33
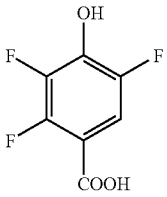
1-34
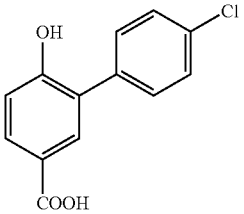
1-35
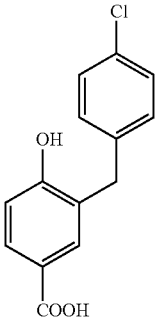
1-36
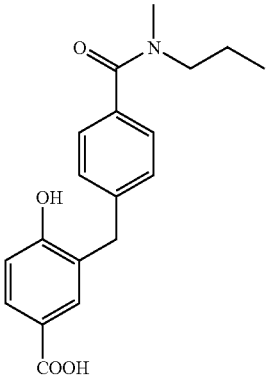
1-37
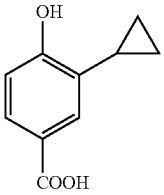
1-38
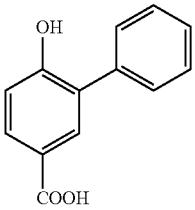
-continued
1-39
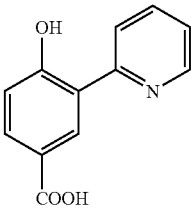
1-40
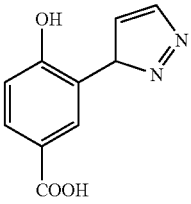
1-41
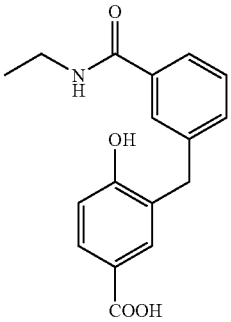
1-42
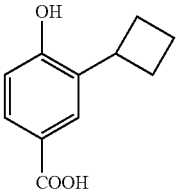
1-43
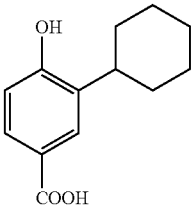
1-44
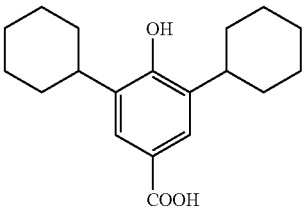
1-45
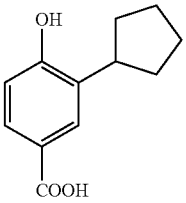

-continued
1-46
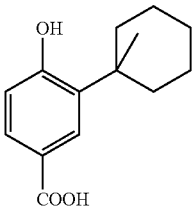
1-47
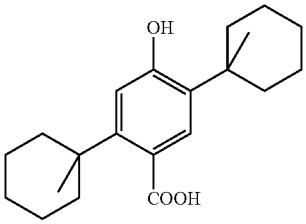
1-48
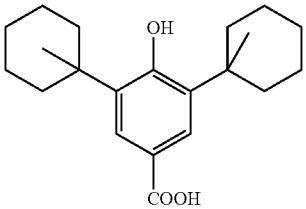
1-49
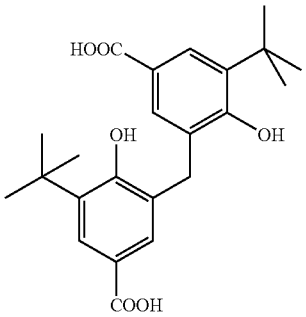
1-50
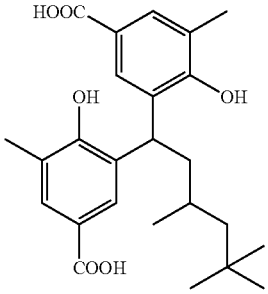
1-51
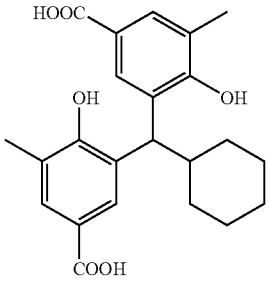
-continued
1-52
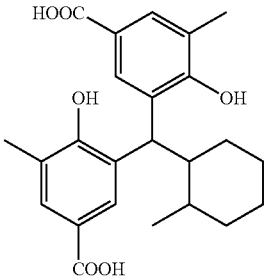
1-53
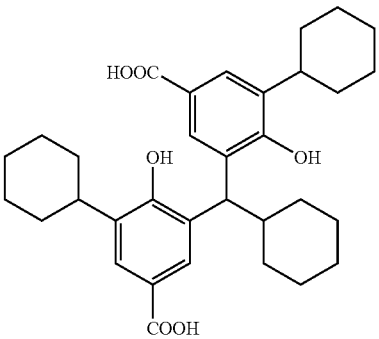
1-54
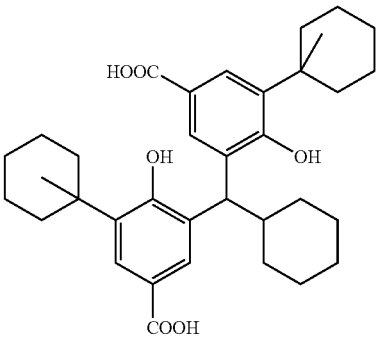
1-55
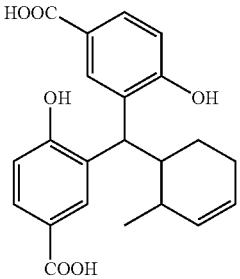
1-56
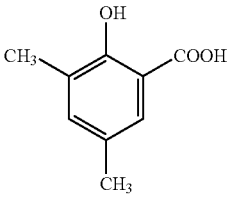

-continued
1-57
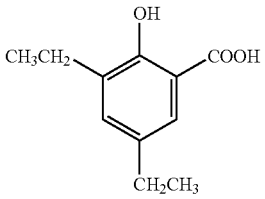
1-58
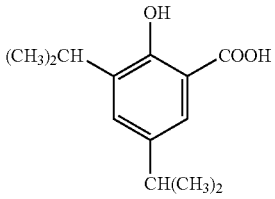
1-59
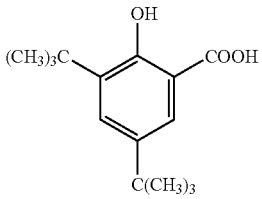
1-60
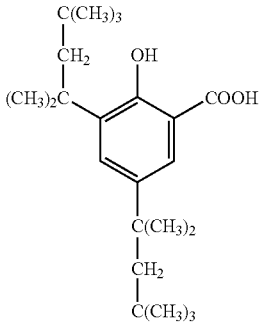
1-61
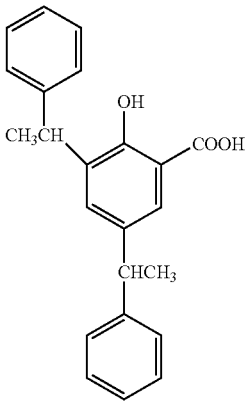
-continued
1-62
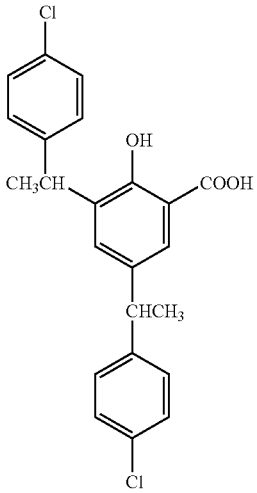
1-63
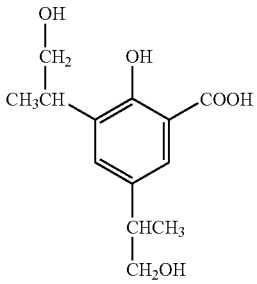
1-64
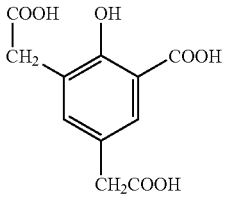
1-65
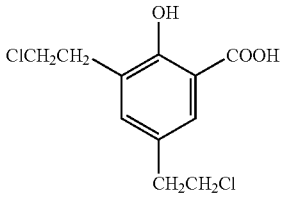
1-66
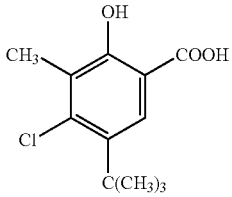

-continued
1-67
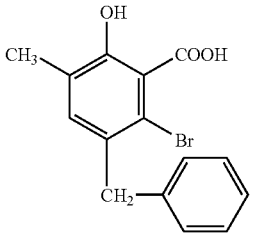
1-68
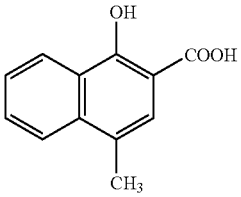
1-69
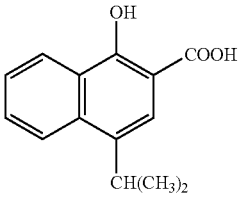
1-70
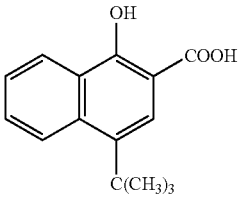
1-71
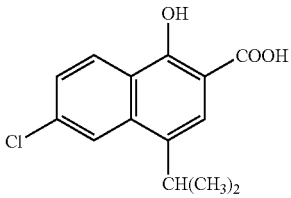
1-72
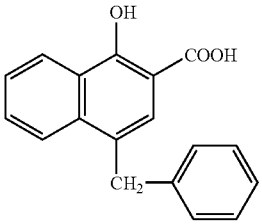
1-73
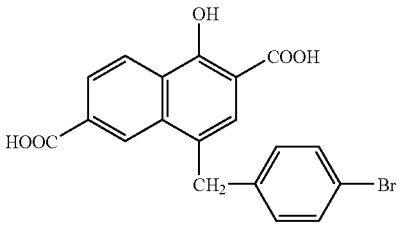
-continued
1-74
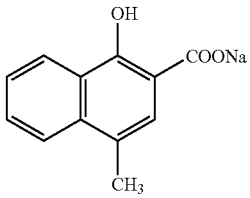
1-75
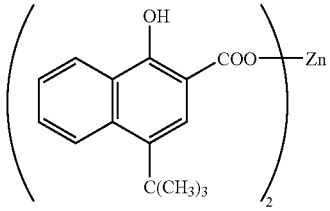
1-76
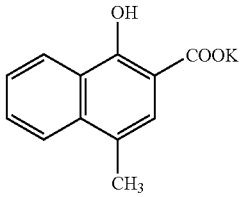
1-77
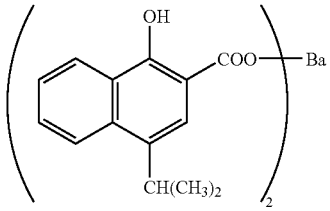
1-78
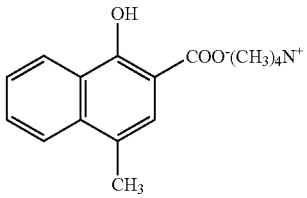
1-79
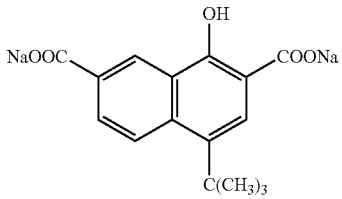
1-80
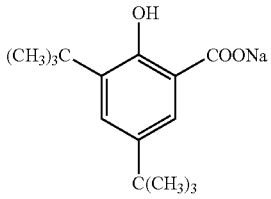

-continued
1-81
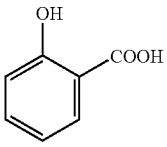
1-82
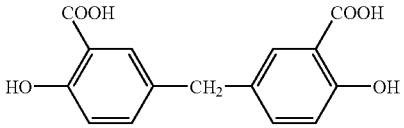
1-83
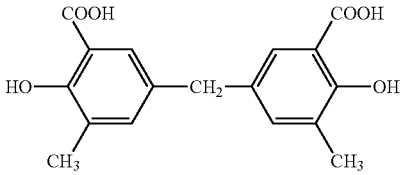
1-84
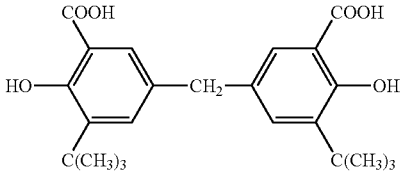
1-85
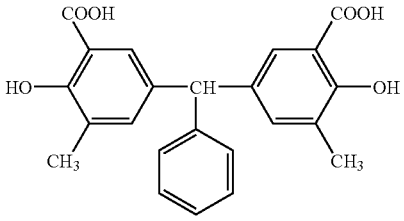
1-86
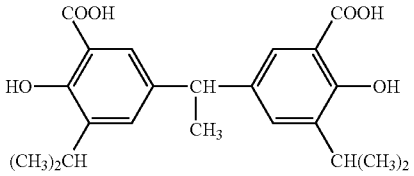
1-87
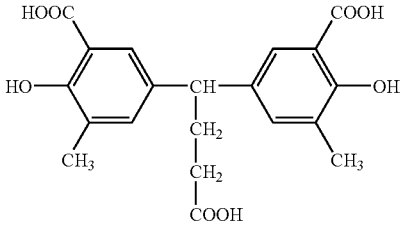
1-88
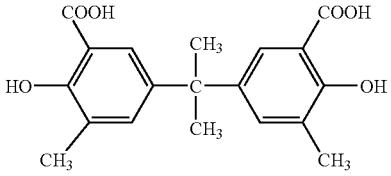
-continued
1-89
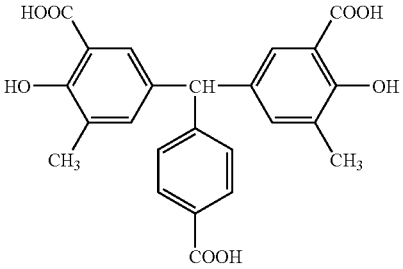
1-90
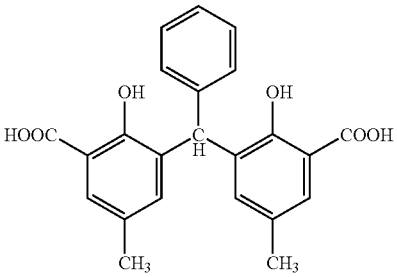
1-91
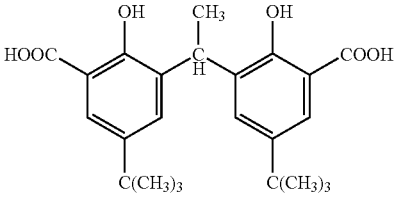
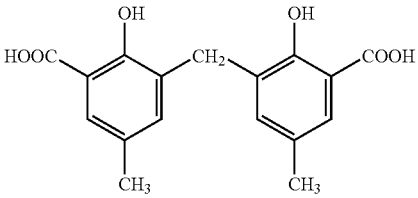
1-93
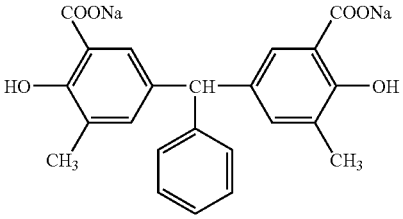
1-94
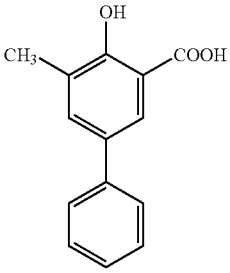

-continued 1-95

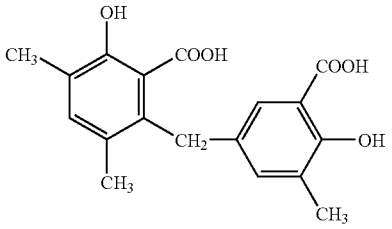

1-96

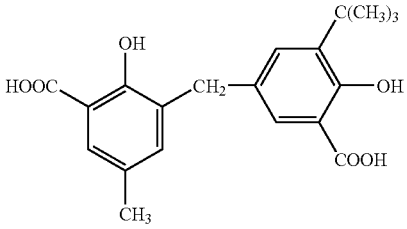

1-97

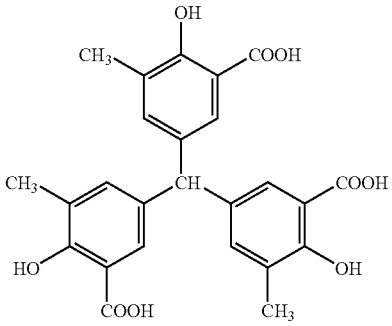

1-98

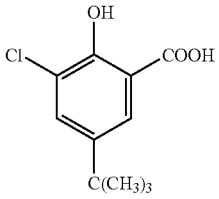

1-99

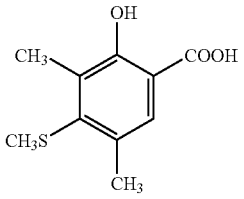

1-100

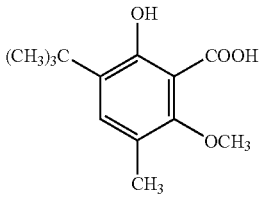

Then, the compounds represented by the Formula (2) are sequentially described.

In the above Formula (2), P represents an oxygen atom, sulfur atom or NH group. $Q_1$ represents an oxygen or sulfur atom. $Y_1$ represents $OM_1$, SH, $SM_1$ or $NH_2$ group. $M_1$ represents counterion. $L_1$ represents a bivalent linkage group. $Z_{10}$ represents an alkyl, aryl or heterocyclic group.

The addition amount of the compound represented by the Formula (2) is preferably 0.001 mol or more and 0.2 mol or less per mol of silver, more preferably 0.001 mol or more and 0.1 mol or less, and especially preferably 0.005 mol or more and 0.05 mol or less per mol of the silver.

The compounds represented by the above Formula (2) are described in more detail.

In the above Formula (2), preferable combinations of the substituents represented by $—(C{=}Q_1)—Y_1$ are carboxy groups, carboxylate salts, thiocarboxy groups, thiocarboxylate salts, dithiocarboxy groups, dithiocarboxylate salts, and carbamoyl groups. M represents the counterion, and examples of the counterions include inorganic or organic ammonium ions (e.g., ammonium ions, triethyl ammonium ions, pyridinium ions), metallic ions (e.g., sodium ions, potassium ions), alkali earth metallic ions (e.g., calcium ions, magnesium ions), and the other metallic ions (e.g., aluminium ions, barium ions, zinc ions). The counterions can include ionic polymers, or the other organic compounds having reverse charge, or metallic complex ions (e.g., hydroxopentaaqua-aluminium (III) ions, tris (2,2'-bipyridine) ferric (II) ions). Also, the counterions may form an intramolecular salt with the other substituent in the molecule. Preferable are sodium, potassium, ammonium, triethyl ammonium, and pyridinium ions, and more preferable are sodium, potassium and ammonium ions.

The linkage group represented by $L_1$ is the bivalent linkage group with a length for preferably from 1 to 4 atoms and more preferably 1 or 2 atoms, and further may have substituents. Preferable examples can include $—CH_2—$, $—CH_2CH_2—$, $—CH(CH_3)—$, $—CH(CH_2CH_3)CH_2—$ and the like. Especially preferable is $—CH_2—$.

$Z_{10}$ represents an alkyl, aryl or heterocyclic group. The alkyl groups represented by $Z_{10}$ are straight, branched or cyclic alkyl groups or the combination thereof, and the number of carbons is preferably from 1 to 40, more preferably from 1 to 30, and still preferably from 1 to 25. Examples include groups such as methyl, ethyl, allyl, propyl, isopropyl, butyl, sec-butyl, isobutyl, t-butyl, pentyl, sec-pentyl, isopentyl, tert-pentyl, hexyl, cyclohexyl, octyl, tert-octyl, decyl, undecyl, dodecyl, tridecyl, pentadecyl, nonadecyl, icosyl, docosyl, 2-hexyldecyl, 2-ethylhexyl, 6-methyl-1-(3-methylhexyl)nonyl and benzyl.

The alkyl groups represented by $Z_{10}$ may have substituents, the substituents may be any known groups, and include, for example, halogen atoms (e.g., fluorine, chlorine, bromine, iodine atoms), alkyl, alkenyl, alkynyl, aryl, heterocyclic groups (including N-substituted nitrogen-containing heterocyclic groups, e.g., morpholino group), alkoxycarbonyl, aryloxycarbonyl, carbamoyl, imino, imino groups substituted with N atoms, thiocarbonyl, carbazoyl, cyano, thiocarbamoyl, alkoxy, aryloxy, heterocyclic oxy, acyloxy (alkoxy or aryloxy)carbonyloxy, sulfonyloxy, acylamide, sulfonamide, ureido, thioureido, imide, (alkoxy or aryloxy) carbonylamino, sulfamoylamino, semicarbazide, thiosemicarbazide, (alkyl or aryl)sulfonylureido, nitro, (alkyl or aryl)sulfonyl, sulfamoyl, groups comprising phosphate amide or phosphate ester structure, silyl, carboxyl groups or salts thereof, sulfo groups or salts thereof, phosphate groups, quaternary ammonium groups and the like. These substituents may be further substituted with these substituents. The examples can be include aryloxyalkyl, alkoxyalkyl, polyalkyleneoxyalkyl groups (e.g., hydroxyethoxyethyl, ethoxyethyl, ethoxyethoxyethyl groups, etc.), alkylthioalkyl groups (e.g., ethylthioethyl group, etc.)

The aryl groups represented by $Z_{10}$ are monocyclic or condensed cyclic aryl groups, and the number of carbons is preferably from 6 to 20, more preferably from 6 to 16, and still preferably from 6 to 10. Phenyl or naphthyl group is preferable. The aryl groups represented by $Z_{10}$ may have substituents, the substituents may be any groups as long as the substituents do not adversely affect photographic performance, and for example, included are the same groups as the substituents of the above alkyl groups. A preferable substituted position of the substituent on the aryl group is position 2, and it is preferred that the substituents can form a complex with silver ions together with P, $Q_1$, or $Y_1$. The preferable examples of the substituents and the substituted position can include 2-carboxy, 2-carbamoyl, 2-thiocarboxy, 2-dithiocarboxy groups and the like.

The heterocyclic groups represented by $Z_{10}$ are preferably 5- to 7-membered saturated or unsaturated monocyclic or condensed rings where the heterocyclic ring comprises one or more heteroatoms selected from the group consisting of nitrogen, oxygen and sulfur atoms. Examples of the heterocyclic rings include preferably pyridine, quinoline, isoquinoline, pyrimidine, pyrazine, pyridazine, phthalazine, triazine, furan, thiophene, pyrrole, oxazole, benzoxazole, thiazole, benzothiazole, imidazole, benzimidazole, thiadiazole, triazole, and the like, and are more preferably pyridine, quinoline, pyrimidine, thiadiazole and benzothiazole, and especially preferably pyridine, quinoline and pyrimidine. The heterocyclic groups represented by $Z_{10}$ may have substituents, and the substituents include, for example, the same groups as the substituents of the above alkyl groups.

$Z_{10}$ are preferably phenyl, naphthyl, quinolyl, pyridyl, pyrimidyl, and polyethyleneoxy groups, more preferably phenyl, substituted phenyl groups, and especially preferably 2-alkylphenyl, 2,4-dialkylphenyl, 2-carboxyphenyl, 2-carbamoylphenyl and 2-thiocarboxyphenyl. Also, the substituents of $Z_{10}$ may have so-called ballast groups known in the art as photographic materials, absorption groups to silver salts and groups which impart water solubility. The substituents may bind one another to form bis type, tris type or tetrakis type, and may polymerize one another to form polymer.

The compounds represented by the Formula (2) can be used by dissolving in water or an appropriate organic solvent such as alcohols (methanol, ethanol, propanol, fluorochemical alcohol, etc.), ketones (acetone, methylethylketone, etc.) dimethylformamide, dimethylsulfoxide, methyl cellosolve and the like. Also, they can be used by dissolving in the organic solvent with high boiling point such as dibutyl phthalate, tricrezil phosphate, glyceryl triacetate or diethyl phthalate using a cosolvent such as ethyl acetate and cyclohexane and mechanically preparing an emulsified dispersion by an emulsified dispersion method already well-known. Or it is also possible to use by dispersing powder of the compound represented by the Formula (2) in an appropriate solvent such as water by a ball mill, a colloid mill or sonication according to the method known as a solid dispersion method.

The compound represented by the Formula (2) may be added to any layer at the side of the photosensitive layer face containing the organic silver salt for the support, but especially, it is preferred that it is added to the layer containing the organic silver salt or the adjacent layer thereof.

In the present invention, the compound represented by the above Formula (2) is represented by the following Formula (2A), and is more preferably represented by the following Formula (2B).

(2A)

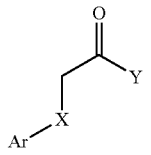

In the Formula (2A), Ar is aryl group, X is O or S, and Y is $NH_2$, OH or $O^-M^+$. M represents a metallic atom. The aryl group represented by Ar is preferably phenyl group having substituents. The phenyl group can be substituted with various substituents. Non-limiting substituents include alkyl groups (e.g., methyl, ethyl, propyl, isopropyl, etc.), alkenyl, alkaryl groups (e.g., p-tolyl), aralkyl groups (e.g., benzyl), carboxylic acid groups or carboxylate ester groups (e.g., C(O)OH, C(O)O—$R^6$), amido groups and nitrogen-substituted amido groups (e.g., C(O)$NH_2$, C(O)$NHR^6$, C(O)$NR^6{}_2$), halogen atoms (e.g., fluorine, chlorine, bromine, iodine), alkoxy groups (e.g., methoxy, ethoxy, etc.), aryloxy groups (e.g., phenoxy, etc.), cyano, alkylsulfonyl or arylsulfonyl groups. It is considered that one or more substituents are present on the phenyl group. This types of compounds, preparation and introduction methods thereof are known by those having ordinary knowledge in the field of organic chemistry. Many of them are commercially available. $R^6$ is the substituent, and preferably an alkoxy group with 1 to 10 carbons.

(2B)

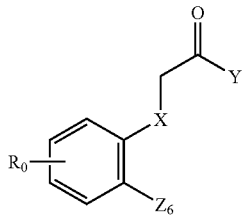

In the Formula (2B), X and Y are the same as those defined in the above Formula (2A). Preferably, $R_0$ is hydrogen, alkyl group with 1 to 10, preferably 1 to 6 carbons, alkoxy group with 1 to 10, preferably 1 to 6 carbons. Preferably $Z_6$ is H, COOH or $CONH_2$.

In the compounds represented by the above Formula (2A) or (2B), when Y is $O^-M^+$ (M is the metallic atom), it is preferred that the metal is the metal belonging to Ia or Ib Groups of the periodic table. It is preferred that the metal is the alkali metal such as lithium, sodium or potassium. When Y is $O^-M^+$ (M is the metallic atom), stoichiometry of the Formula (2A) or (2B) is sometimes slightly different from that shown. When Y is $O^-M^+$ (M is the metallic atom), it should be appreciated that the metallic atom should not impart color to the compound represented by the above Formula (2A) or (2B) and that the metal is not photosensitive or heat sensitive. The compounds represented by the Formula (2A) or (2B) can be synthesized by techniques well known in the art.

Representative examples of the compounds represented by the Formula (2), (2A) and (2B) according to the invention are shown below, but these representatives are aimed to exemplify and no limitation is intended.

2-1
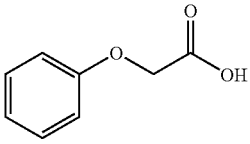
2-2
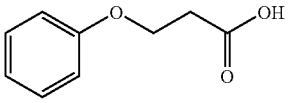
2-3
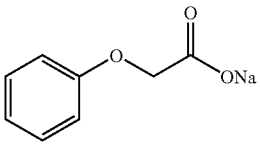
2-4
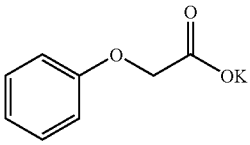
2-5
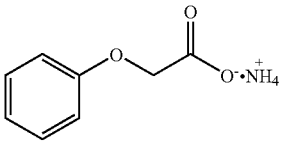
2-6
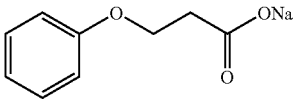
2-7
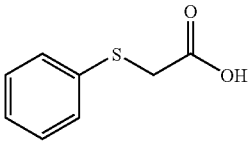
2-8
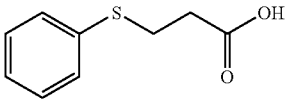
2-9
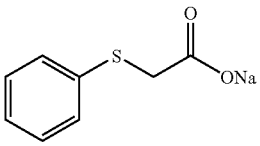
2-10
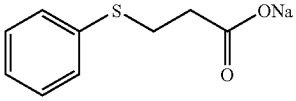
2-11
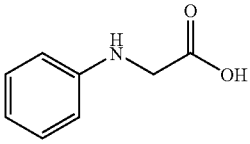
-continued
2-12
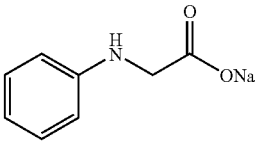
2-13
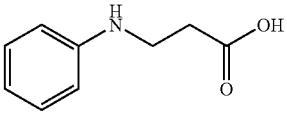
2-14
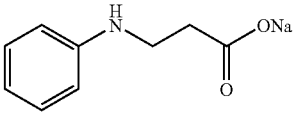
2-15
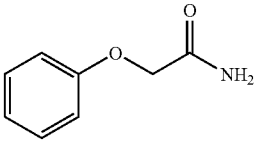
2-16
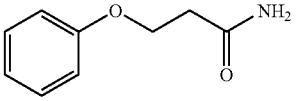
2-17
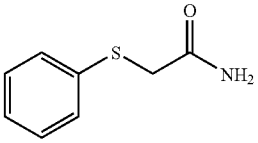
2-18
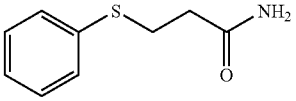
2-19
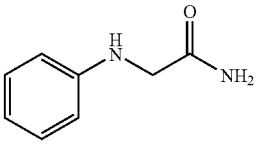
2-20
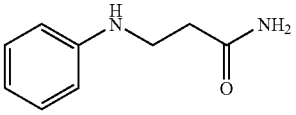
2-21
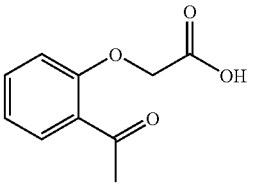
2-22
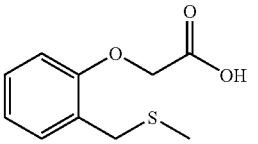

-continued
2-23
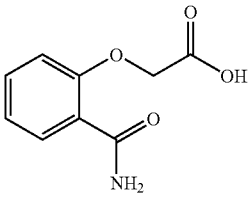
2-24
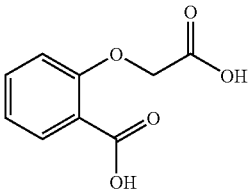
2-25
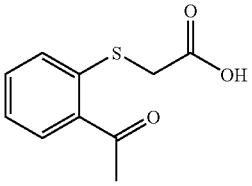
2-26
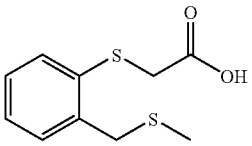
2-27
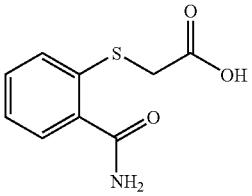
2-28
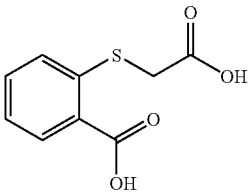
2-29
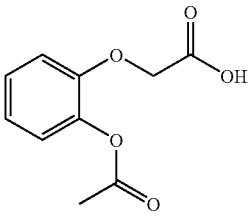
2-30
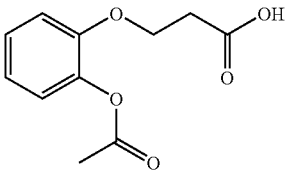
-continued
2-31
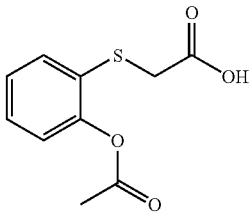
2-32
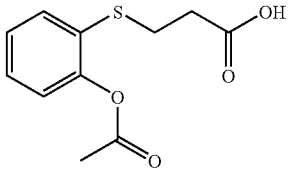
2-33
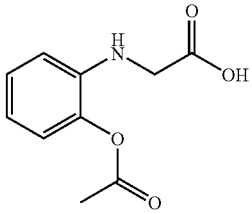
2-34
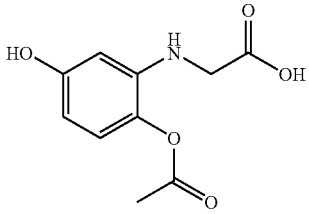
2-35
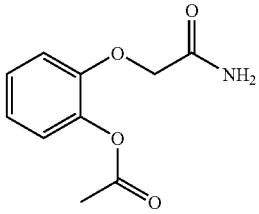
2-36
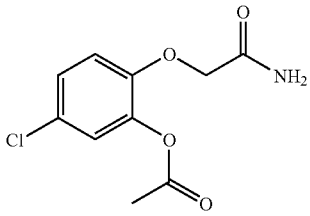
2-37
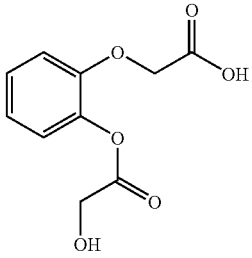

-continued
2-38
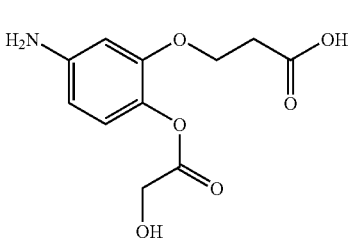
2-39
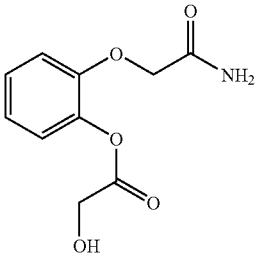
2-40
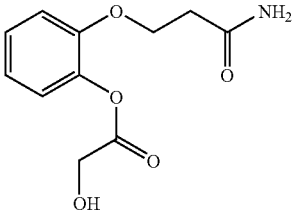
2-41
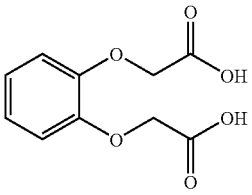
2-42
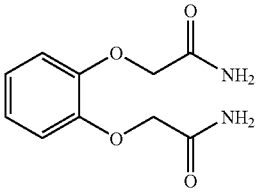
2-43
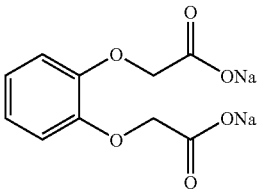
2-44
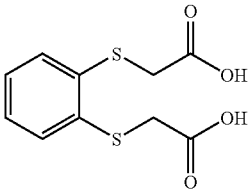
-continued
2-45
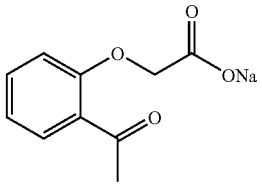
2-46
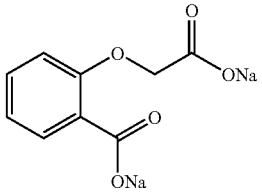
2-47
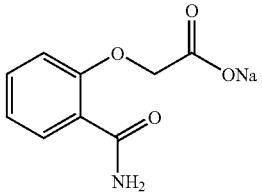
2-48
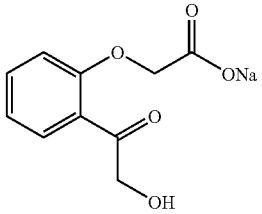
2-49
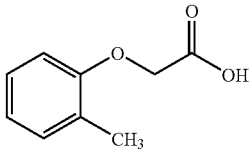
2-50
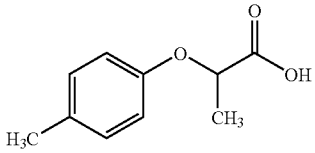
2-51
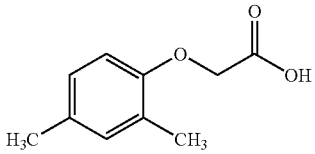
2-52
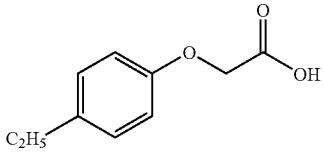

-continued
2-53
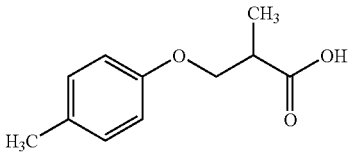
2-54
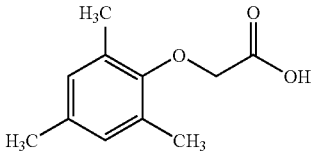
2-53a
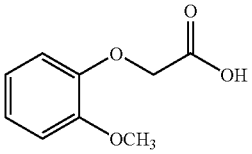
2-54a
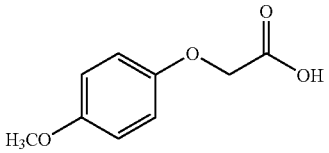
2-55
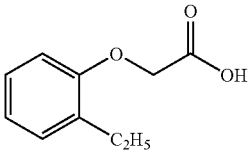
2-56
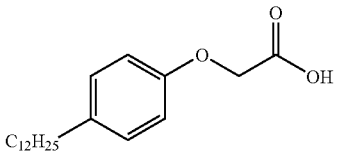
2-57
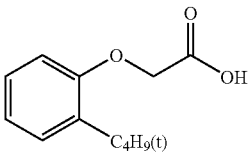
2-58
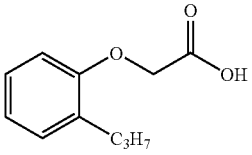
2-59
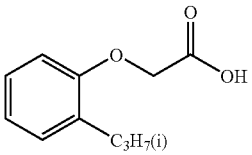
-continued
2-60
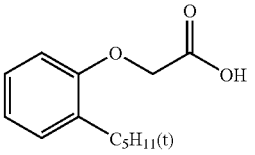
2-61
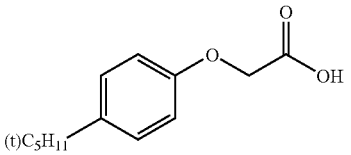
2-62
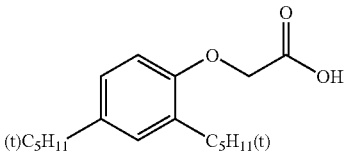
2-63
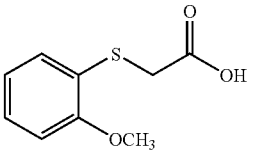
2-64
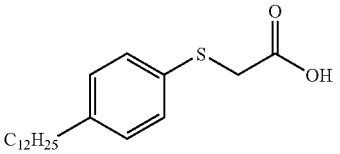
2-65
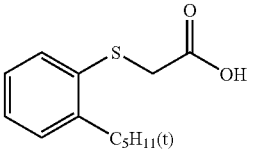
2-66
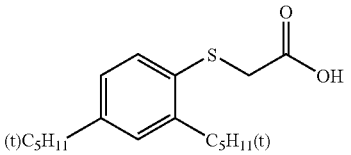
2-67
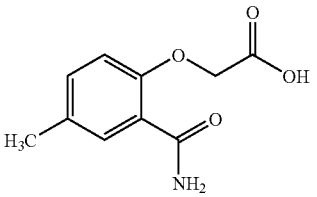
2-68
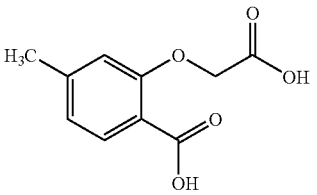

-continued
2-69
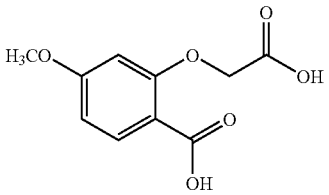
2-70
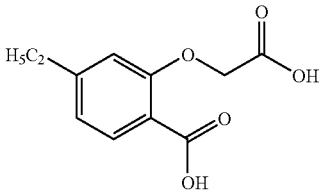
2-71
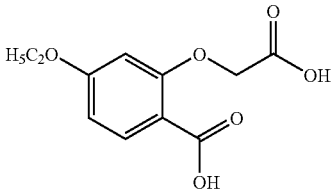
2-72
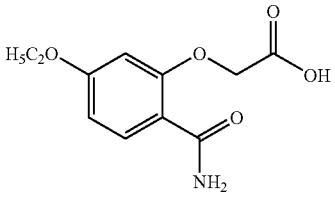
2-73
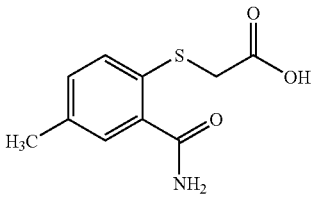
2-74
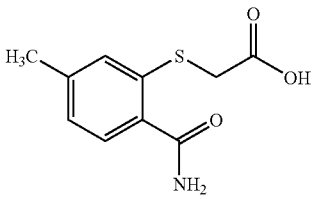
2-75
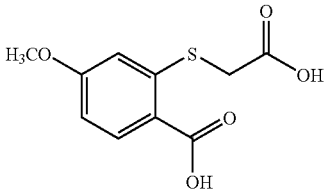
-continued
2-76
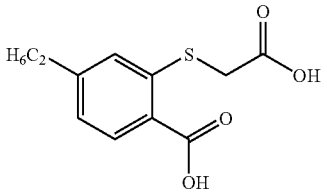
2-77
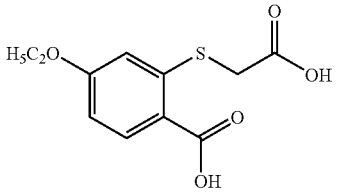
2-78
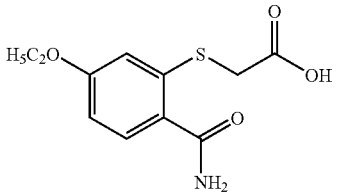
2-79
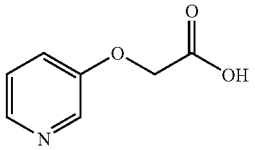
2-80
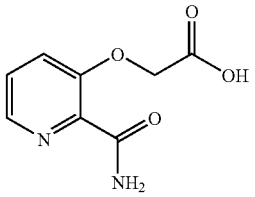
2-81
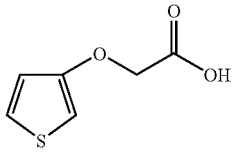
2-82
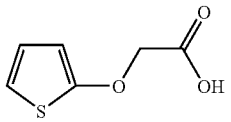
2-83
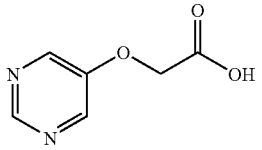
2-84
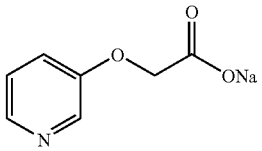

-continued 2-85

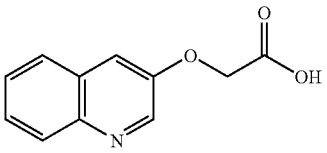

2-86

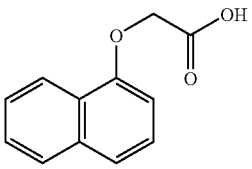

2-87

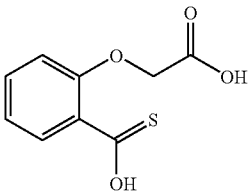

2-88

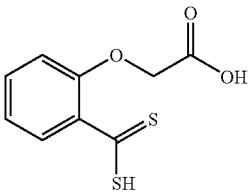

2-89

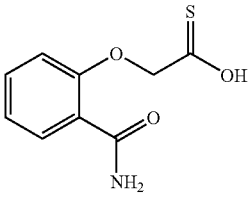

2-90

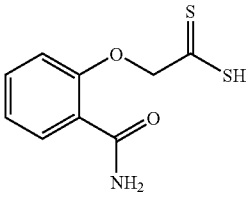

2-91

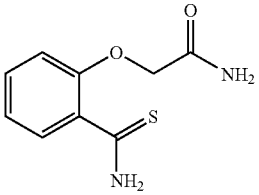

2-92

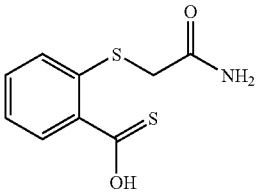

2-93 $C_{12}H_{25}OCH_2CO_2H$

-continued 2-94 $C_8H_{17}OCH_2CO_2H$ 2-95

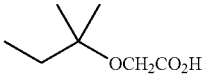

2-96

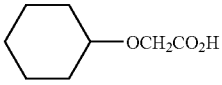

2-97

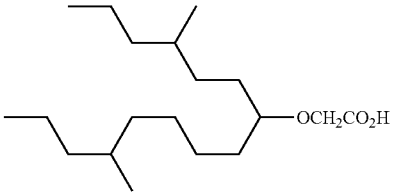

2-98

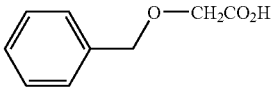

2-99 $C_8H_{17}CHCH_2OCH_2CO_2H$ ($C_6H_{13}$)

2-100 $C_2H_5OC_2H_4OCH_2CO_2H$ 2-101 $C_2H_5OC_2H_4OC_2H_4OCH_2CO_2H$ 2-102 $HOC_2H_4OC_2H_4OCH_2CO_2H$ 2-103 $HSC_2H_4SC_2H_4OCH_2CO_2H$ 2-104 $C_2H_5SC_2H_4OCH_2CO_2H$ 2-105

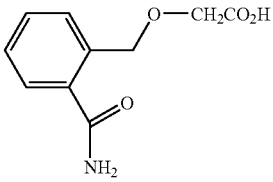

2-106

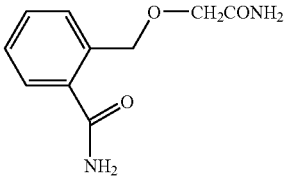

Then, thiosulfonate salts represented by the Formula (3) are described.

$$Z_{20}—SO_2—S—M_2 \quad (3)$$

In the above Formula (3), $Z_{20}$ represents an aliphatic hydrocarbon group, aryl or heterocyclic group, and $M_2$ represents cation. As the aliphatic hydrocarbon groups represented by $Z_{20}$, it is possible to apply straight, branched or cyclic alkyl groups (the number of carbons is preferably from 1 to 20, more preferably from 1 to 12, and especially preferably from 1 to 8, e.g., methyl, ethyl, n-propyl, isopropyl, n-butyl, iso-butyl, sec-butyl, tert-butyl, n-octyl, iso-amyl, tert-amyl, hexyl, dodecyl, octadecyl, cyclohexyl, etc.), alkenyl groups (the number of carbons is preferably from 2 to 20, more preferably from 2 to 12, and especially preferably from 2 to 8, e.g., vinyl, allyl, 2-butenyl, 3-pentyl, etc.), and alkynyl groups (the number of carbons is preferably from 2 to 20, more preferably from 2 to 12, and especially preferably from 2 to 8, e.g., propargyl, 3-pentinyl, etc.). These may have substituents. The substituents include aryl groups (the number of carbons is preferably from 6 to 30, more preferably from 6 to 20, and especially preferably from 6 to 12, e.g., phenyl, p-methylphenyl, naphthyl, etc.), amino groups (the number of carbons is preferably from 0 to 20, more preferably from 0 to 10, and especially preferably from 0 to 6, e.g., amino, methylamino, dimethylamino, diethylamino, dibenzylamino, etc.), alkoxy groups (the number of carbons is preferably from 1 to 20, more preferably from 1 to 12, and especially preferably from 1 to 8, e.g., methoxy, ethoxy, butoxy, etc.), aryloxy groups (the number of carbons is preferably from 6 to 20, more preferably from 6 to 16, and especially preferably from 6 to 12, e.g., phenyloxy, 2-naphthyloxy, etc.), acyl groups (the number of carbons is preferably from 1 to 20, more preferably from 1 to 16, and especially preferably from 1 to 12, e.g., acetyl, benzoyl, formyl, pivaloyl, etc.), alkoxycarbonyl groups (the number of carbons is preferably from 2 to 20, more preferably from 2 to 16, and especially preferably from 2 to 12, e.g., methoxycarbonyl, ethoxycarbonyl, etc.), aryloxycarbonyl groups (the number of carbons is preferably from 7 to 20, more preferably from 7 to 16, and especially preferably from 7 to 10, e.g., phenoxycarbonyl, etc.), acyloxy groups (the number of carbons is preferably from 1 to 20, more preferably from 2 to 16, and especially preferably from 2 to 10, e.g., acetoxy, benzoyloxy, etc.), acylamino groups (the number of carbons is preferably from 1 to 20, more preferably from 2 to 16, and especially preferably from 2 to 10, e.g., acetylamino, valerylamino, benzoylamino, etc.), alkoxycarbonylamino groups (the number of carbons is preferably from 2 to 20, more preferably from 2 to 16, and especially preferably from 2 to 12, e.g., methoxycarbonylamino, etc.), aryloxycarbonylamino groups (the number of carbons is preferably from 7 to 20, more preferably from 7 to 16, and especially preferably from 7 to 12, e.g., phenyloxycarbonylamino, etc.), sulfonylamino groups (the number of carbons is preferably from 1 to 20, more preferably from 1 to 16, and especially preferably from 1 to 12, e.g., methanesulfonylamino, benzenesulfonylamino, etc.), sulfamoyl groups (the number of carbons is preferably from 0 to 20, more preferably from 0 to 16, and especially preferably from 0 to 12, e.g., sulfamoyl, methylsulfamoyl, dimethylsulfamoyl, phenylsulfamoyl, etc.), carbamoyl groups (the number of carbons is preferably from 0 to 20, more preferably from 0 to 16, and especially preferably from 0 to 12, e.g., carbamoyl, diethylcarbamoyl, phenylcarbamoyl, etc.), ureido groups (the number of carbons is preferably from 1 to 20, more preferably from 1 to 16, and especially preferably from 1 to 12, e.g., ureido, methylureido, phenylureido, etc.), alkylthio groups (the number of carbons is preferably from 1 to 20, more preferably from 1 to 16, and especially preferably from 1 to 12, e.g., methylthio, ethylthio, etc.), arylthio groups (the number of carbons is preferably from 6 to 20, more preferably from 6 to 16, and especially preferably from 6 to 12, e.g., phenylthio, etc.), sulfonyl groups (the number of carbons is preferably from 1 to 20, more preferably from 1 to 16, and especially preferably from 1 to 12, e.g., mesyl, tosyl, etc.), sulfinyl groups (the number of carbons is preferably from 1 to 20, more preferably from 1 to 16, and especially preferably from 1 to 12, e.g., methanesulfinyl, benzenesulfinyl, etc.), phosphate-amide groups (the number of carbons is preferably from 1 to 20, more preferably from 1 to 16, and especially preferably from 1 to 12, e.g., diethyl phosphate-amide, phenyl phosphate-amide, etc.), hydroxy, mercapto groups, halogen atoms (e.g., fluorine, chlorine, bromine, iodine), cyano, sulfo, carboxy, nitro, hydroxsam, sulfino, hydrazino, sulfonylthio, thiosulfonyl, heterocyclic (e.g., imidazolyl, pyridyl, furyl, piperidyl, morpholinyl, morpholino, etc.), disulfide groups and the like. In these groups, the group capable of forming the salt may form the salt. These substituents may be further substituted. Also, when there are two or more substituents, they may be the same or different.

The substituents of the aliphatic hydrocarbon groups represented by $Z_{20}$ are preferably aryl, alkoxy, heterocyclic, cyano, acyl, alkoxycarbonyl, sulfamoyl, carbamoyl, sulfonyl, nitro groups, halogen atoms, carboxy, and amino groups, and more preferably aryl, heterocyclic, cyano, alkoxy and sulfonyl groups. The aliphatic hydrocarbon groups represented by Z are preferably alkyl groups, and more preferably chain alkyl groups. The aryl groups represented by Z are the condensed cyclic aryl groups with preferably from 6 to 30 and more preferably from 6 to 20 carbons, more preferably the monocyclic or condensed cyclic aryl groups with 6 to 20 carbons, and for example, include phenyl, naphthyl and the like, and are especially preferably phenyl groups.

The aryl groups represented by $Z_{20}$ may have substituents, and as the substituents in addition to those included as the substituents of the aliphatic hydrocarbon groups represented by $Z_{20}$, it is possible to apply alkyl groups (the number of carbons is preferably from 1 to 20, more preferably from 1 to 12, and especially preferably from 1 to 8, e.g., methyl, ethyl, iso-propyl, n-butyl, tert-butyl, n-octyl, tert-amyl, cyclohexyl, etc.), alkenyl groups (the number of carbons is preferably from 2 to 20, more preferably from 2 to 12, and especially preferably from 2 to 8, e.g., vinyl, allyl, 2-butenyl, 3-pentenyl, etc.), and alkynyl groups (the number of carbons is preferably from 2 to 20, more preferably from 2 to 12, and especially preferably from 2 to 8, e.g., propargyl, 3-pentinyl, etc.) and the like.

The substituents of the aryl groups represented by $Z_{20}$ are preferably alkyl, aryl, alkoxy, aryloxy, acyl, alkoxycarbonyl, acyloxy, acylamino, alkoxycarbonylamino, aryloxycarbonylamino, sulfonylamino, sulfamoylamino, carbamoylamino, ureido, alkylthio, arylthio, sulfonyl, sulfinyl, sulfonylthio, thiosulfonyl, phosphate-amido groups, halogen atoms, cyano, carboxy and heterocyclic groups, more preferably alkyl, alkoxy, aryloxy, acyl, alkoxycarbonyl, acyloxy, acylamino, alkoxycarbonylamino, aryloxycarbonylamino, sulfonylamino, carbamoyl, ureido, alkylthio, arylthio, sulfonyl, sulfinyl, phosphate-amide and heterocyclic groups, still preferably alkyl, alkoxy, aryloxy, acylamino, sulfonylamino, sulfamoyl, carbamoyl, ureido, phosphate-amide, carboxy and heterocyclic groups, and especially preferably alkyl, alkoxy, aryloxy, acylamino, sulfonylamino, sulfamoyl, carbamoyl, ureido and carboxy groups.

The heterocyclic groups represented by $Z_{20}$ are 3- to 10-membered saturated or unsaturated heterocyclic rings containing al least one of N, O or S atoms, and these may be monocyclic and may further form a condensed ring with the other ring. Specific examples of the heterocyclic groups include the groups such as thienyl, furyl, pyranyl, 2H-pyrrolyl, pyrrolyl, imidazolyl, pyrazolyl, isothiazolyl, isoxazolyl, thiazolyl, oxazolyl, 1,2,3-triazolyl, 1,2,4-triazolyl, 1,3,4-oxadiazolyl, 1,3,4-thiadiazolyl, pyridil, pyrazinyl, pyrimidinyl, pyridazinyl, indolizinyl, isoindolizinyl, 3H-indolyl, indolyl, 1H-indazolyl, purinyl, 4H-quinolizinyl, isoquinolyl, quinolyl, phthalazinyl, naphthylizinyl, quinoxalinyl, quinazolinyl, cinnolinyl, pteridinyl, carbazolyl, β-carbolinyl, phenanthridinyl, acrydinyl, perimidinyl, phenanthrolinyl, phenazinyl, phenarsazinyl, phenothiazinyl, furazanyl, phenoxazinyl, isocromanil, cromanil, pyrrolidinyl, pyrrolinyl, immidazolidinyl, immidazolinyl, pyrazolidinyl, pyrazolinyl, piperidyl, piperadinyl, indolinyl, isoindolinyl, quinuclidinyl, morpholinyl, tetrazolyl, benzimidazolyl, benzoxazolyl, benzothiazolyl, benztriazolyl, triazinyl, urasil, triazopyrimidinyl and the like. Preferably they are pyrrolyl, imidazolyl, pyrazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolyl, 1H-indazolyl, purinyl, 4H-quinolizinyl, isoquinolyl, quinolyl, phthalazinyl, naphthylizinyl, quinoxalinyl, quinazolyl, cinnolinyl, pteridinyl, tetrazolyl, benzimidazolyl, benzoxazolyl, benzothiazolyl, benzothiazolyl, triazinyl, urasil and triazopyrimidinyl.

More preferably, they are imidazolyl, pyrazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolyl, 1H-indazolyl, purinyl, quinolyl, phthalazinyl, naphthylizinyl, quinoxalinyl, quinazolyl, cinnolinyl, pteridinyl, tetrazolyl, benzimidazolyl, benzoxazolyl, benzothiazolyl, benztriazolyl, triazinyl, and triazopyrimidinyl.

The heterocyclic groups represented by $Z_{20}$ may have substituents, and as the substituents, in addition to those included as the substituents of the aliphatic hydrocarbon groups represented by $Z_{20}$, it is possible to apply alkyl groups (the number of carbons is preferably from 1 to 20, more preferably from 1 to 12, and especially preferably from 1 to 8, e.g., methyl, ethyl, iso-propyl, tert-butyl, n-octyl, tert-amyl, cyclohexyl, etc.), alkenyl groups (the number of carbons is preferably from 2 to 20, more preferably from 2 to 12, and especially preferably from 2 to 8, e.g., vinyl, allyl, 2-butenyl, 2-pentenyl, etc.), alkynyl groups (the number of carbons is preferably from 2 to 20, more preferably from 2 to 12, and especially preferably from 2 to 8, e.g., propargyl, 3-pentinyl, etc.) and the like.

The substituents of heterocyclic groups represented by $Z_{20}$ are preferably alkyl, aryl, alkoxy, aryloxy, acyl, alkoxycarbonyl, acyloxy, acylamino, sulfonylamino, sulfamoylamino, carbamoyl, ureido, phosphate-amide, alkylthio, arylthio, sulfonyl, sulfinyl, sulfonylthio groups, halogen atoms, cyano, nitro and heterocyclic groups, more preferably alkyl, aryl, alkoxy, acyl, alkoxycarbonyl, acyloxy, acylamino, sulfonylamino, sulfamoyl, sulfonylthio, carbamoyl, ureido and heterocyclic groups, still preferably alkyl, aryl, alkoxy, acyl, aryloxy, acylamino, sulfonylamino, sulfamoyl, carbamoyl, ureido, phosphate-amide and heterocyclic groups, and especially preferably alkyl, alkoxy, aryloxy, acylamino, sulfonylamino, sulfamoyl, sulfonylthio, carbamoyl, ureido and heterocyclic groups. As $Z_{20}$, chain alkyl and aryl groups (e.g., phenyl groups) are preferable.

$M_2$ represents cation, and for example, represents hydrogen ions, alkali metallic (Na, K, etc.) ions, substituted or unsubstituted ammonium ions.

Next, specific examples of the compounds represented by the Formula (3) are shown, but the invention is not limited thereto.

(3-1) $CH_3SO_2SNa$ (3-2) $C_2H_5SO_2SNa$ (3-3) $HOOC—CH_2CH_2SO_2SK$

-continued (3-4) $(n)C_4H_9SO_2SNa$ (3-5) $NC—CH_2CH_2CH_2SO_2SNa$ (3-6) $(n)C_8H_{17}SO_2SNa$ (3-7) $(n)C_{12}H_{25}SO_2SNa$ (3-8) $ClCH_2(CH_2)_4SO_2SK$ (3-9) $(n)C_{18}H_{37}SO_2SNa$ (3-10) $(n)C_4H_9SO_2SK$ (3-11) $(n)C_8H_{17}SO_2SK$ (3-12) $(CH_3)_2CHCH_2SO_2SNa$ (3-13) $(CH_3)_2CHCH_2CH_2SO_2SNa$ (3-14) 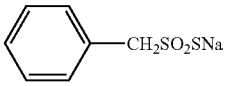

(3-15) $(n)C_8H_{17}SO_2S^-\cdot(n)(C_4H_9)_4N^+$ (3-16) 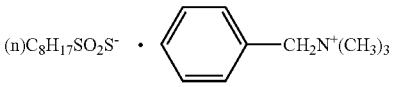

(3-17) $H_2N—CH_2CH_2SO_2SH$ (3-18) $CH_3O—CH_2CH_2SO_2SNa$ (3-19) 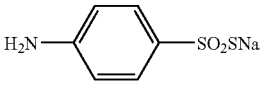

(3-20) 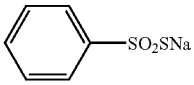

(3-21) 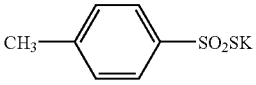

(3-22) 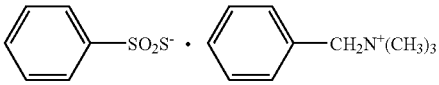

(3-23) 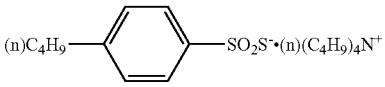

(3-24) 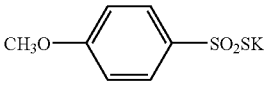

(3-25) 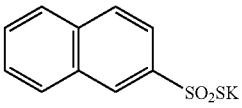

-continued (3-26)

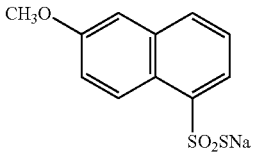

(3-27)

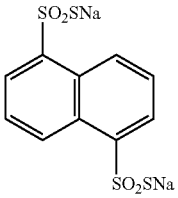

(3-28)

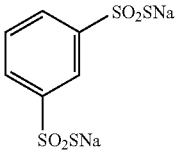

(3-29)

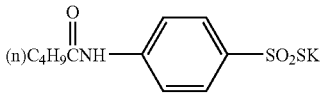

(3-30)

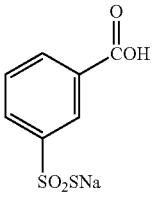

(3-31)

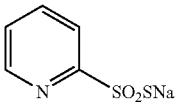

(3-32)

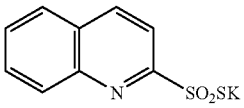

(3-33)

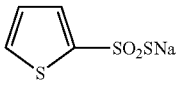

(3-34)

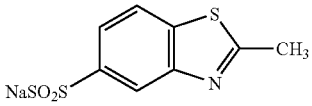

(3-35)

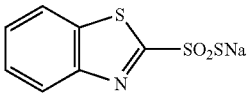

(3-36)

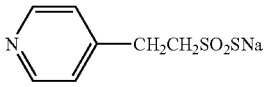

-continued (3-37)

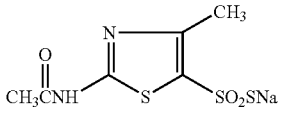

(3-38)

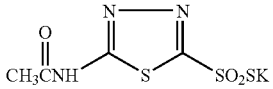

(3-39)

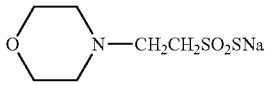

(3-40)

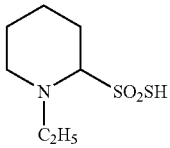

The compounds represented by the Formula (3) according to the invention may be commercially available or synthesized by known methods. For example, they can be synthesized by the reaction of sulfonyl halide and alkali sulfide or the reaction of sulfinate salt and sulfur.

The compounds represented by the Formula (3) according to the invention can be used by dissolving in water or an appropriate solvent such as alcohols (methanol, ethanol, propanol, fluorinated alcohol) ketones (acetone, methylethylketone), dimethylformamide, dimethylsulfoxide, methyl cellosolve and the like.

Also, they can be used by dissolving in the organic solvent with high boiling point such as dibutyl phthalate, tricrezil phosphate, glyceryl triacetate or diethyl phthalate using a cosolvent such as ethyl acetate and cyclohexane and mechanically preparing an emulsified dispersion by an emulsified dispersion method already well-known. Or they can be used by dispersing powder in water by a ball mill, a colloid mill, a sand grinder mill, Manton Gaulin, a micro fluidizer or sonication.

The compound represented by the Formula (3) may be added to a layer at the face side where the silver halide emulsion layer which is an image formation layer is provided for the support, i.e., the silver halide emulsion layer or any of the other component layers, but it is preferable to add to the silver halide emulsion layer or the adjacent layer thereof. The addition amount of the compounds represented by the Formula (3) according to the invention is in the range of 0.2 to 200 mmol, preferably from 0.3 to 100 mmol and more preferably from 0.5 to 30 mmol per mol of the silver. They may be used alone or in combination with two or more.

Next, the compounds represented by the Formula (4) according to the invention are described.

In the above Formula (4), $R^4$ represents a hydroxyl group or a metallic salt of the hydroxyl group, $R^5$ represents an alkyl or aryl group, and $X_3$ represents an electron withdrawing group or $R^5$ and $X_3$ together can form a ring comprising the electron withdrawing group.

The compound represented by the Formula (4) of the invention is at least one type of substituted propenenitrile compounds.

The compound represented by the Formula (4) of the invention is added to the photosensitive layer or the layer adjacent to the photosensitive layer. In the above Formula (4), the aryl group means an aromatic ring structure (including fused rings and substituted rings), and preferably represents phenyl or naphthyl.

Also, $R^5$ and $X_3$ may comprise the other substituents. As well known in the art, the substitution is not only accepted but also desirable in some cases, and the substitution is anticipated in the compounds used in the invention. In order to simplify the discussion and description of the certain substituent, a chemical species which can be substituted and a chemical species which can not be substituted are discriminated using the terms, "group" and "site". That is, when a substituent is described using the term "group" such as "aryl group", the substituent goes beyond a basic precise definition of the group to include the use of the other substituents. When a substituent is described using "site", only the unsubstituted group is included.

For example, the term "alkyl group" includes not only simple hydrocarbon chains such as methyl, ethyl, propyl, t-butyl, cyclohexyl, isooctyl and octadecyl but also alkyl chains having the substituents known in the art such as hydroxyl, alkoxy, phenyl, halogen atoms (F, Cl, Br and I), cyano, nitro, amino and carboxy. For example, alkyl groups include ether groups (e.g., $CH_3$—$CH_2$—$CH_2$—O—$CH_2$—), haloalkyls, nitroalkyls, carboxyalkyls, hydroxyalkyls, sulfoalkyls and the like. On the other hand, "alkyl site" is limited to inclusion of simple hydrocarbon alkyl chains such as methyl, ethyl, propyl, t-butyl, cyclohexyl, isooctyl and octadecyl. The substituents such as extremely strong electron withdrawing or oxidative substituents which inconveniently react with the other active components are of course excluded by those skilled in the art because they are not inactive or harmless.

The compound represented by the Formula (4) of the invention is required to have the electron withdrawing group $X_3$ which binds to the same carbon atom as nitrile group. The propenenitrile compound is also required to have $R^4$ and $R^5$ groups which are bound to the positions shown in the above formula.

As described above, $X_3$ is the electron withdrawing group. Here, the electron withdrawing of $X_3$ is defined by "Hammett's constant σp". Hammett's constant σp is defined by Hammett's rule: Log $K/K^0=\sigma p\rho$ (wherein $K^0$ is an acid dissociation constant of a reference substance in an aqueous solution at 25° C., K is a similar constant of para-substituted acid, and ρ is the dissociation constant 1.0 of para-substituted benzoic acid) The positive Hammett's constant σ indicates that the group is electron withdrawing.

The electron withdrawing group $X_3$ must be electron withdrawing at least equivalent to —COOR (R is, for example, H, —$CH_3$ or —$CH_2CH_3$). The reported Hammett's constants are 0.43, 0.39 and 0.46 for —COOH, —$COOCH_3$ and —$COOCH_2CH_3$, respectively. That is, Hammett's constant of the electron withdrawing group $X_3$ must be 0.39 or more. Non-limiting examples of such electron withdrawing groups include cyano, alkoxycarbonyl, metaloxycarbonyl, hydroxycarbonyl, nitro, acetyl, perfluoroalkyl, alkylsulfonyl, arylsulfonyl, and the other groups listed in Lange, Handbook of Chemistry, 14th edition, McGraw-Hill, Section 9, pages 2 to 7, 1992.

$R^4$ may be hydroxy or a metallic salt of hydroxy [e.g., $OM^+$ (wherein $M^+$ is metallic cation)]. Preferable $M^+$ is monovalent cation such as $Li^+$, $Na^+$, $K^+$ and $Fe^+$, but bivalent and trivalent cations may be used.

$R^5$ may be an alkyl or aryl group. When $R^5$ is the alkyl group, it is the alkyl group with preferably from 1 to 20, more preferably from 1 to 10 and most preferably from 1 to 4 carbons. Especially preferably $R^1$ is methyl group. When $R^1$ is the aryl group, it is preferably the aryl group with from 5 to 10 and more preferably from 6 to 10 carbons. Most preferably $R^1$ is phenyl group. Or $R^5$ and $X_3$ together can also configure a ring containing the electron withdrawing group. Preferably the ring is the 5-, 6- or 7-membered ring. Examples of such rings are lactone ring or cyclohexenone ring shown in the following compound 4-8.

The propenenitrile compounds may be prepared by the method described below. Useful and representative propenenitrile compounds of the invention are shown below. Many of these compounds can exist in either "enol" or "keto" tautomeric form, but only "enol" form is shown in the following formulae. These representative examples are exemplifications, and the invention is not limited thereto.

4-1

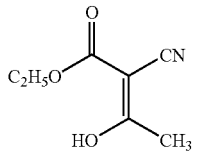

4-2

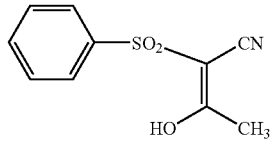

4-3

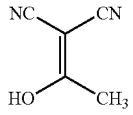

4-4

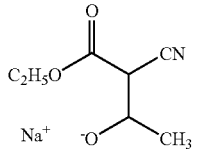

4-5

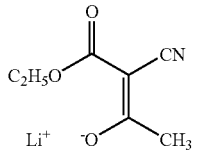

4-6

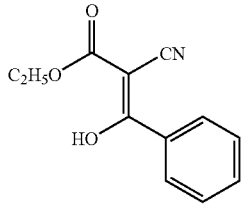

4-7

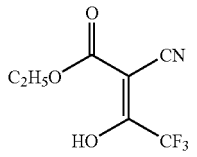

-continued 4-8

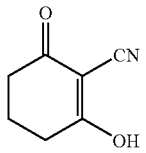

The compounds of the above Formula (4) according to the invention are different from those described in U.S. Pat. No. 5,545,515. The compounds described in U.S. Pat. No. 5,545,515 requests hydrogen substitution at an end position (i.e., position corresponding to $R_2$ in the compound of the invention) of acrylonitrile group in order to impart a co-developer effect with high contrast. In a different point from the compounds described in U.S. Pat. No. 5,545,515, the compounds of the applicant's invention have no hydrogen substituent at the position of $R^5$. This reduces initial photographic fog without imparting high contrast to photothermal photographs and thermal transfer factors.

[Fob Inhibitor and Image Stabilizer]

Described are an Antifoggant and an image stabilizer used for the photothermographic imaging material of the invention.

Since as the reducing agent, mainly used is the reducing agent such as bisphenols and sulfonamidephenols having proton, it is preferable to contain compounds capable of inactivating the reducing agent by producing active species capable of withdrawing these hydrogen atoms. Suitably, preferred is the compound as colorless photooxidation substance capable of producing free radicals as reaction active species at exposure.

Therefore, it may be any compound as long as it is the compound having these functions, but organic free radical made up of multiple atoms is preferable. It may be the compound having any structure as long as it is the compound having such functions and which cause no special adverse effect on the photothermographic imaging material.

Also, the compounds which produce these free radicals are preferably those having carbocyclic or heterocyclic aromatic groups in order to make produced free radicals have stability capable of contacting sufficiently to react with and inactivate the reducing agent.

Representatives of these compounds can include biimidazolyl compounds and iodonium compounds represented below. Preferable specific examples thereof can include, for example, the compound examples described in JP-A-2000-321711. The addition amount of these compounds is preferably from $10^{-3}$ to $10^{-1}$ mol/m$^2$, and preferably from $5\times10^{-3}$ to $5\times10^{-2}$ mol/m$^2$. The compound can be contained in any layer of the imaging material of the invention, but it is preferable to contain at the vicinity of the reducing agent.

Also, as Antifoggants and image stabilizers, it is possible to preferably use the compounds which release halogen atoms as active species. As specific examples of the compounds which produce these active halogen atoms, there are the compounds of the Formula (9) shown below.

(9)

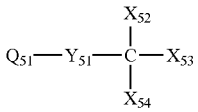

In the Formula (9), $Q_{51}$ represents an aryl or heterocyclic group. $X_{52}$, $X_{53}$ and $X_{54}$ represent hydrogen atoms, halogen atoms, acyl, alkoxycarbonyl, aryloxycarbonyl, sulfonyl, or aryl groups, and at least one is the halogen atom. $Y_{51}$ represents, —C(═O)—, —SO— or —$SO_2$—.

The aryl group represented by $Q_{51}$ may be monocyclic or condensed cyclic, is preferably the monocyclic or bicyclic aryl group with 6 to 30 carbons (e.g., phenyl, naphthyl, etc.), more preferably phenyl or naphthyl group, and still preferably phenyl group.

The heterocyclic group represented by $Q_{51}$ is the 3- to 5-membered saturated or unsaturated heterocyclic group comprising at least one of N, O or S, and this may be monocyclic or may form a condensed ring with the other ring.

The heterocyclic groups are preferably 5- to 6-membered unsaturated heterocyclic groups which may have condensed rings, and more preferably 5- to 6-membered aromatic heterocyclic groups which may have condensed rings. The heterocyclic groups are still preferably 5- to 6-membered aromatic heterocyclic groups which may have condensed rings comprising nitrogen atoms, and especially preferably 5- to 6-membered aromatic heterocyclic groups which may have condensed rings comprising 1 to 4 nitrogen atoms. Heterocycles in such heterocyclic groups are preferably imidazole, pyrazole, pyridine, pyrimidine, pyrazine, pyridazine, triazole, triazine, indole, indazole, purine, thiadiazole, oxadiazole, quinoline, phthalazine, naphthylidine, quinoxaline, quinazoline, cinnoline, pteridine, acridine, fenantroline, fenadine, tetrazole, thiazole, oxazole, benzimidazole, benzoxazole, benzothiazole, indolenine, and tetrazaindene, more preferably, imidazole, pyridine, pyrimidine, pyrazine, pyridazine, triazole, triazine, thiadiazole, oxadiazole, quinoline, phthalazine, naphthylidine, quinoxaline, quinazoline, cinnoline, tetrazole, thiazole, oxazole, benzimidazole, benzoxazole, benzothiazole and tetrazaindene, still preferably, imidazole, pyridine, pyrimidine, pyrazine, pyridazine, triazole, triazine, thiadiazole, quinoline, phthalazine, naphthylidine, quinoxaline, quinazoline, cinnoline, tetrazole, thiazole, benzimidazole, and benzothiazole, and especially preferably pyridine, thiadiazole, quinoline and benzothiazole.

The aryl group and the heterocyclic group represented by $Q_{51}$ may have substituents in addition to —$Y_{51}$—C($X_{52}$)($X_{53}$)($X_{54}$), and the substituents are preferably alkyl, alkenyl, aryl, alkoxy, aryloxy, acyloxy, acyl, alkoxycarbonyl, aryloxycarbonyl, acyloxy, acylamino, alkoxycarbonylamino, aryloxycarbonylamino, sulfonylamino, sulfamoyl, carbamoyl, sulfonyl, ureido, phosphate-amide groups, halogen atoms, cyano, sulfo, carboxyl, nitro and heterocyclic groups, more preferably alkyl, aryl, alkoxy, aryloxy, acyl, acylamino, alkoxycarbonylamino, aryloxycarbonylamino, sulfonylamino, sulfamoyl, carbamoyl, ureido, phosphate-amide groups, halogen atoms, cyano, nitro and heterocyclic groups, still preferably alkyl, aryl, alkoxy, aryloxy, acyl, acylamino, sulfonylamino, sulfamoyl, carbamoyl groups, halogen atoms, cyano, nitro and heterocyclic groups, and especially preferably alkyl, aryl groups and halogen atoms.

$X_{52}$, $X_{53}$ and $X_{54}$ are preferably halogen atoms, haloalkyl, acyl, alkoxycarbonyl, aryloxycarbonyl, carbamoyl, sulfamoyl, sulfonyl and heterocyclic groups, more preferably halogen atoms, haloalkyl, acyl, alkoxycarbonyl, aryloxycarbonyl and sulfonyl, and especially preferably halogen atoms. In the halogen atoms, chlorine, bromine and iodine atoms are preferable, chlorine and bromine atoms are more preferable, and bromine atoms are especially preferable.

$Y_{51}$ represents —C(═O)—, —SO—, or —$SO_2$—, and is preferably —$SO_2$—.

The addition amount of these compounds is preferably in the range where the increase of printout silver due to the production of silver halide does not substantially become problematic. It is preferred that their percentage for the compounds which produce no active halogen radical is 150% or less at the maximum, and preferably 100% or less. Specific examples of these compounds which produce active halogen radicals can include the compounds (III-1) to (III-23) described in the paragraph numbers of [0086] to [0087] of JP-A2002-169249.

Next, described are the compounds represented by the Formula (PO) especially preferably used in the invention.

In the Formula (PO), $Z_{03}$ and $Z_{04}$ each independently represent halogen atoms (fluorine, chlorine, bromine and iodine), but it is the most preferable that both $Z_{03}$ and $Z_{04}$ are bromine atoms. In the Formula (PO), $X_{10}$ denotes a hydrogen atom or an electron withdrawing group, and as the electron withdrawing groups, it is possible to use those later-described for $X_{21}$ of the Formula (G). The preferable electron withdrawing groups are, for example, cyano, alkoxycarbonyl, aryloxycarbonyl, carbamoyl, sulfamoyl, alkylsulfonyl, arylsulfonyl groups, halogen atoms, acyl and heterocyclic groups, preferable are hydrogen or halogen atom, and the most preferable is the bromine atom. In the Formula (PO), $Y_{01}$ represents —CO— or —$SO_2$— group, and is preferably —$SO_2$—.

In the Formula (PO), $Q_{10}$ represents an arylene or bivalent heterocyclic group. The arylene groups represented by $Q_{10}$ in the Formula (PO) are preferably the arylene groups of condensed rings with 6 to 30 carbons, more preferably the arylene groups of monocyclic or condensed rings with 6 to 20 carbons, include, for example, phenylene and naphthylene groups, and are especially preferably phenylene groups. The arylene groups represented by $Q_{10}$ may have substituents, and the substituents may be any groups as long as the substituents do not adversely affect photographic performance, and include, for example, halogen atoms (fluorine, chlorine, bromine or iodine atom), alkyl groups (including aralkyl, cycloalkyl, active methine groups etc.), alkenyl, alkynyl, aryl groups, heterocyclic groups (including N-substituted nitrogen-containing heterocyclic groups, e.g., morpholino groups), quaternarized nitrogen-containing heterocyclic groups (e.g., pyridinio groups), acyl, alkoxycarbonyl, aryloxycarbonyl, carbamoyl, carboxy groups or salts thereof, imino, imino groups substituted with nitrogen atoms, thiocarbonyl, carbazoyl, cyano, thiocarbamoyl, alkoxy groups (including the groups comprising repeat unites of ethyleneoxy or propyleneoxy groups), aryloxy, heterocyclicoxy, acyloxy (alkoxy or aryloxy) carbonyloxy, sulfonyloxy, acylamino, sulfonamide, ureido, thioureido, imide, (alkoxy or aryloxy) carbonylamino, sulfamoylamino, semicarbazide, thiosemicarbazide, hydrazino, quaternary ammonio, (alkyl or aryl) sulfonylureido, nitro, (alkyl, aryl or heterocyclic) thio, acylthio, (alkyl or aryl) sulfonyl, (alkyl or aryl) sulfinyl, hydroxyl, sulfo groups or salts thereof, sulfamoyl, phosphoryl, groups comprising phosphate amide or phosphate ester structure, silyl groups and the like. These substituents may be substituted with these substituents per se.

As the substituents of the arylene groups represented by $Q_{10}$ of the Formula (PO), especially preferable are alkyl, alkoxy, aryloxy groups, halogen atoms, carboxyl groups or the salts thereof, the salts of sulfo groups, and phosphate groups.

In the Formula (PO), heterocycles in the bivalent heterocyclic groups represented by $Q_{10}$ are 5- to 7-membered saturated or unsaturated heterocycles containing at least one of N, O or S atoms, and these may be monocyclic or may form condensed rings with the other rings. The heterocycles in the bivalent heterocyclic groups represented by $Q_{10}$ include, for example, pyridine, pyrazine, pyrimidine, benzothiazole, benzimidazole, thiadiazole, quinoline, isoquinoline, triazole and the like. These may have substituents, which include, for example, the same groups as the substituents of the arylene groups represented by $Q_{10}$. $Q_{10}$ of the Formula (PO) is preferably the arylene group, and especially preferably phenylene group. When $Q_{10}$ represents the phenylene group, it is preferred that —$Y_{01}$—C($X_{10}$) ($Z_{03}$) ($Z_{04}$) and —$(L_3)_{n3}$—CON($W_1$) ($W_2$) are bound at a meta-position one another.

$L_3$ in the Formula (PO) represents a bivalent linkage group, and includes, for example, alkylene groups (the number of carbons is preferably from 1 to 30, more preferably from 1 to 20, and especially preferably from 1 to 10.), arylene groups (the number of carbons is preferably from 6 to 30, more preferably from 6 to 20, and especially preferably from 6 to 10.), alkenylene groups (the number of carbons is preferably from 2 to 30, more preferably from 2 to 20, and especially preferably from 2 to 10.), alkynylene groups (the number of carbons is preferably from 2 to 30, more preferably from 2 to 20, and especially preferably from 2 to 10.), bivalent heterocyclic groups (the number of carbons is preferably from 1 to 30, more preferably from 1 to 20, and especially preferably from 1 to 10.), groups comprising —O—, —NR—, —CO—, —S—, —SO—, —$SO_2$—, or phosphorus atom(s), groups formed by combination thereof, and the like (here, the groups represented by R is the hydrogen atom, the alkyl group which may have substituents, or the aryl group which may have substituents.). The linkage group represented by $L_3$ of the Formula (PO) may have substituents, which include, for example, the same groups as the substituents of the arylene groups represented by $Q_{10}$. The linkage groups represented by $L_3$ of the Formula (PO) are preferably alkylene, arylene, —O—, —NRCO—, —$SO_2$NR— group and the groups formed by the combination thereof. In the Formula (PO), n3 is 0 or 1, and preferably 0.

In the Formula (PO), $W_1$ and $W_2$ each independently represent hydrogen atoms, alkyl, aryl or heterocyclic groups. The alkyl groups represented by $W_1$ and $W_2$ of the Formula (PO) may be any of straight, branched, cyclic groups or the combinations thereof, and the number of carbons is preferably from 1 to 20, more preferably from 1 to 12, and especially preferably from 1 to 6. For example, included are methyl, ethyl, allyl, n-propyl, iso-propyl, n-butyl, sec-butyl, iso-butyl, n-pentyl, sec-pentyl, iso-pentyl, 3-pentyl, n-hexyl, n-octyl, n-dodecyl, cyclohexyl groups and the like.

The alkyl groups represented by $W_1$ and $W_2$ of the Formula (PO) may have substituents, and include, for example, those which are the same as the substituents of the arylene groups represented by $Q_{10}$. The substituents of the alkyl groups represented by $W_1$ and $W_2$ are preferably halogen atoms, alkenyl, alkynyl, aryl, heterocyclic, carbamoyl, alkoxy, aryloxy, sulfonamide, (alkyl or aryl) thio, (alkyl or aryl) sulfonyl groups, sulfo groups or the salts thereof, carboxyl groups or the salts thereof, phosphate groups or the salts thereof, or hydroxyl groups, more preferably halogen atoms, alkenyl, alkynyl, aryl, carbamoyl, alkoxy, aryloxy, (alkyl or aryl) thio groups, sulfo groups or the salts thereof, carboxyl groups or the salts thereof, or hydroxyl groups, and especially preferably halogen atoms, alkenyl, carbamoyl, alkoxy, alkylthio, groups, the salts of sulfo groups, carboxyl groups or the salts thereof, or hydroxyl groups.

The aryl groups represented by $W_1$ and $W_2$ of the Formula (PO) are the monocyclic or condensed cyclic aryl groups, and the number of carbons is preferably from 6 to 20, more preferably from 6 to 16, and especially preferably from 6 to 10. For example, phenyl and naphthyl groups are included, and phenyl groups are preferable. The aryl groups represented by $W_1$ and $W_2$ may have substituents, which include, for example, those which are the same as the substituents of the alkyl groups represented by $W_1$ and $W_2$, and preferable ranges are the same.

The heterocycles represented by $W_1$ and $W_2$ of the Formula (PO) are 5- to 7-membered saturated or unsaturated heterocycles comprising at least one of N, O or S atoms. These may be monocyclic or may further form condensed rings with the other rings. For example, included are pyridyl, pyrazinyl, pyrimidinyl, thiazolyl, imidazolyl, benzothiazolyl, benzimidazolyl, thiadiazolyl, quinolyl, isoquinolyl, triazolyl and the like. These may have substituents, which include, for example, those which are the same as the substituents of the alkyl groups represented by $W_1$ and $W_2$, and the preferable ranges are the same. $W_1$ and $W_2$ may be the same or different, and may be bound one another to make a cyclic structure. $W_1$ and $W_2$ are preferably the hydrogen atoms or the alkyl groups or the aryl groups, and especially preferably the hydrogen atoms or the alkyl groups.

As the organic polyhalogen compounds represented by the Formula (PO), included are the compounds of P1 to P117 described in the paragraph of [0036] to [0052] of JP-A-2001-133925. Specific examples are shown below, but the polyhalogen compounds available for the imaging materials of the invention are not limited thereto.

(PO-1)

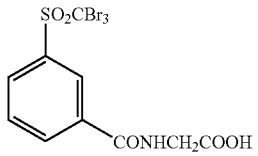

(PO-2)

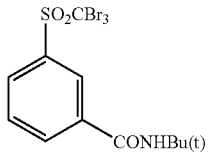

(PO-3)

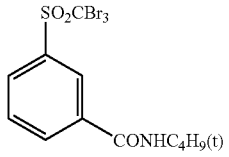

-continued (PO-4)

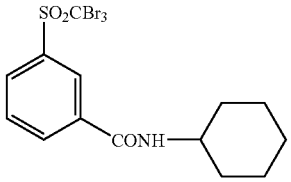

(PO-5)

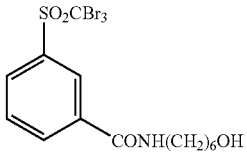

(PO-6)

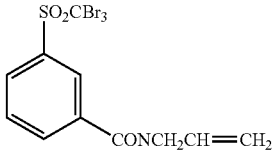

(PO-7)

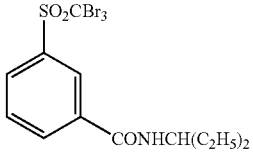

(PO-8)

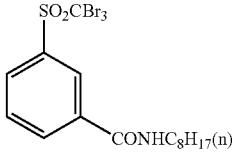

(PO-9)

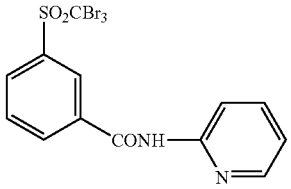

(PO-10)

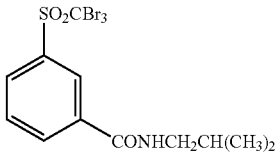

In the invention, it is especially preferable to combine the compound of the Formula (PO) and the compound of the Formula (9) in terms of improving the image storage stability in the storage at room temperature.

Next, described are the compounds of the Formula (A-8) used in the invention.

In the above formula, $Z_{80}$ represents an atomic group required for forming a nitrogen-containing heterocycle. The above nitrogen-containing heterocycles also comprise the nitrogen-containing heterocycles having a condensed cyclic structure. Examples of the nitrogen-containing heterocycles formed by $Z_{80}$ can include pyrrole, indole, isoindole, carbazole, imidazole, pyrazole, benzotriazole, benzimidazole, naphthimidazole, 1,2,3-triazole, 1,2,4-triazole, tetrazole, 1H-indazole, purine, perimidine, phenoxazine, phenothiazine, pyrrolidine, imidazolidine, pyrazolidine, piperidine, piperazine, 2-pyrroline, 2-imidazoline, 3-pyrazoline, morpholine, indoline, isoindoline, thiazole, thiazoline, oxazole, benzoxazole, naphthoxazole, oxazoline, selenazole, naphthoselenazole, selenazoline, tellurazole, benzotellurazole, naphthotellurazole, tellurazoline, indolenine, pyridine, quinoline, isoquinoline, oxadiazole, thiadiazole and the like as the preferable examples.

More preferable examples of the nitrogen-containing heterocycles formed by $Z_{80}$ can include pyrrole, indole, isoindole, carbazole, imidazole, pyrazole, benzotriazole, benzimidazole, naphthimidazole, 1,2,3-triazole, 1,2,4-triazole, tetrazole, 1H-indazole, purine, perimidine, pyrrolidine, imidazolidine, pyrazolidine, piperidine, piperazine, 2-pyrroline, 2-imidazoline, 3-pyrazoline, morpholine, indoline, isoindoline, thiazoline, oxazoline and the like.

As the nitrogen-containing heterocycles formed by $Z_{80}$, especially preferable are benzotriazole, 1H-indazole, benzimidazole, 1,2,3-triazole, 1,2,4-triazole, tetrazole, 2H-thiazoline, and imidazoline.

The nitrogen-containing heterocycles formed by $Z_{80}$ may further have substituents, and the multiple substituents may be bound to form a ring. As examples of the substituents of the nitrogen-containing heterocycles, it is possible to use those described as the substituents on the ring in the Formula (A-1) and the substituents described in the paragraph numbers of [0023] to [0028] of JP-A-2002-236335.

In the above formula, $R_{80}$ represents an alkyl, alkenyl, alkynyl, aryl, alkaryl, aralkyl groups, which may have substituents, a saturated or unsaturated heterocyclic group, and is more preferably an alkyl, aryl, saturated or unsaturated heterocyclic group. As the alkyl groups, the number of carbons is preferably from 1 to 30, more preferably from 1 to 22, and especially preferably from 4 to 22. For example, included are methyl, ethyl, propyl, n-butyl, t-butyl, allyl, benzyl, pentyl, hexyl, n-octyl, t-octyl, nonyl, decyl, dodecyl, hexadecyl, heptadecyl, icosa, docosa, methoxyethyl, ethoxyethyl, phenetyl, triethyl, phenoxyethyl, phenoxypropyl, naphthoxyethyl, sulfophenetyl, 2,2,2-trifluoroethyl, 2,2,3,3-tetrafluoropropyl, carbamoylethyl, hydroxyethyl, 2-(2-hydroxyethoxy)ethyl, carboxymethyl, carboxyethyl, ethoxycarbonylmethyl, sulfoethyl, 2-chloro-3-sulfopropyl, 3-sulfopropyl, 2-hydroxy-3-sulfopropyl, 3-sulfobutyl, 4-sulfobutyl, 2-(2,3-dihydroxypropyloxy)ethyl, 2-[2-(3-sulfopropyloxy) ethoxy]ethyl, acetylaminoethyl, methylsulfonylaminoethyl, methylsulfonylaminocarbonylethyl, acetylaminocarbonylethyl groups and the like.

As the aryl groups represented by $R_{80}$, the number of carbons is preferably from 6 to 30, more preferably from 6 to 22, and especially preferably from 6 to 20. Examples of the aryl groups represented by $R_{80}$ include phenyl, naphthyl, p-tolyl, m-tolyl, p-chlorophenyl, p-bromophenyl, o-chlorophenyl, m-cyanophenyl, p-carboxyphenyl, o-carboxyphenyl, o-(methoxycarbonyl)phenyl, p-hydroxyphenyl, p-methoxyphenyl, m-ethoxyphenyl, o-nitrophenyl, pentafluorophenyl, 2,4,6-(isopropyl)phenyl, mesityl groups and the like.

The saturated or unsaturated heterocyclic groups represented by $R_{80}$ can include furyl, thienyl, pyridyl, oxazolyl, thiazolyl, imidazolyl, pyrazolyl, benzoxazolyl, benzothiazolyl, benzimidazolyl, morpholinyl, quinolyl, piperazino, pyrrolidinyl and the like. These groups represented by $R_{81}$ may further have substituents, and examples of the substituents can include the substituents of the heterocycles formed by Z described above.

The compounds represented by the Formula (A-8) can be easily synthesized according to the methods described in Zh. Obshch. Khim., 2614 (1959), Indian J. Chem., 1273 (1986), J. Gen. Chem. U.S.S.R (Engl. Transl.), 188 (1965).

Specific examples of the compounds represented by the Formula (A-8) of the invention are shown below, but the invention is not limited thereto.

(8-1)

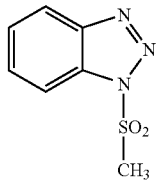

(8-2)

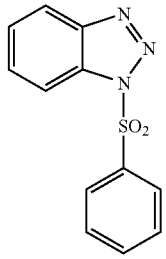

(8-3)

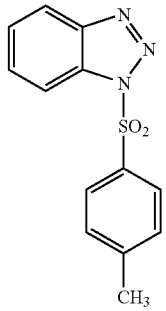

(8-4)

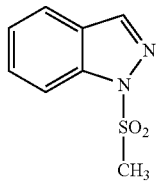

(8-5)

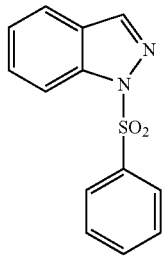

(8-6)

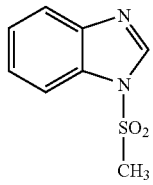

-continued (8-7)

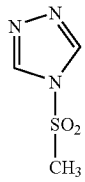

(8-8)

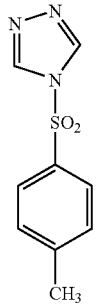

(8-9)

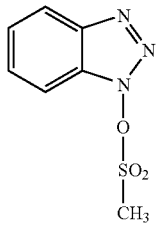

(8-10)

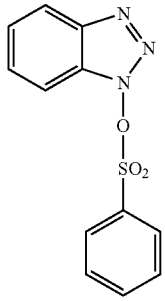

Next, described are the compounds of the Formula (A-9) used in the invention.

$X_{91}$ and $X_{92}$ are electron withdrawing groups. The electron withdrawing of $X_{91}$ and $X_{92}$ is defined by "Hammett's constant σp". Hammett's constant σp is defined by Hammett's rule: Log $K/K^0=\sigma\rho\rho$ (wherein $K^0$ is an acid dissociation constant of a reference substance in an aqueous solution at 25° C., K is a similar constant of para-substituted acid, and ρ is the dissociation constant 1.0 of para-substituted benzoic acid). The positive Hammett's constant σ indicates that the group is electron withdrawing.

The electron withdrawing groups $X_{91}$ and $X_{92}$ must be electron withdrawing at least equivalent to —COOR(R is, for example, H, —$CH_3$ or —$CH_2CH_3$). The reported Hammett's constants are 0.43, 0.39 and 0.46 for —COOH, —$COOCH_3$ and —$COOCH_2CH_3$, respectively. That is, Hammett's constant σp of the electron withdrawing groups $X_{91}$ and $X_{92}$ must be 0.39 or more. Non-limiting examples of such electron withdrawing groups include cyano, alkoxycarbonyl, metaloxycarbonyl, hydroxycarbonyl, nitro, acetyl, perfluoroalkyl, alkylsulfonyl, arylsulfonyl, and the other groups listed in Lange, Handbook of Chemistry, 14th edition, McGraw-Hill, Section 9, pages 2 to 7, 1992.

$R_{91}$ may be hydroxy or a metallic salt of hydroxy [e.g., $OM^+$ (wherein $M^+$ is metallic cation)]. Preferable $M^+$ is monovalent cation such as $Li^+$, $Na^+$, $K^+$ and $Fe^+$, but bivalent and trivalent cations may be used. $R_{92}$ is preferably an alkyl or aryl group. When $R_{82}$ is the alkyl group, it is the alkyl group with preferably from 1 to 20, more preferably from 1 to 10 and most preferably from 1 to 4 carbons. Especially preferably $R_{92}$ is methyl group. When $R_{92}$ is the aryl group, it is preferably the aryl group with from 5 to 10 and more preferably from 6 to 10 carbons. Most preferably $R_{92}$ is phenyl group. Or $X_{91}$ and $X_{92}$ may also configure a ring structure. In addition, $X_{91}$ and $R_{92}$ are shown in cis form, however, trans form is included therein. Preferably the ring is the 5-, 6- or 7-membered ring. Examples of such rings are lactone ring or cyclohexenone ring. Specific examples of the compounds of the Formula (A-9) are shown below, but the invention is not limited thereto.

(9-1)

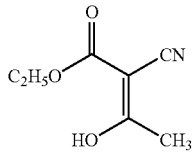

(9-2)

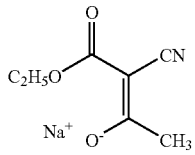

(9-3)

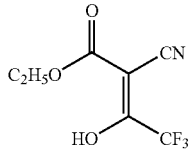

(9-4)

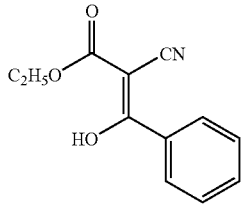

(9-5)

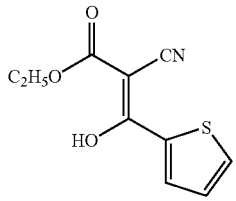

(9-6)

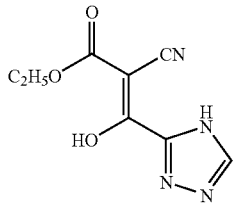

-continued (9-7)

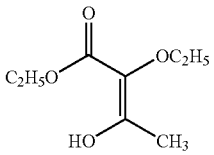

(9-8)

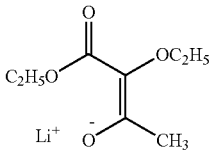

(9-9)

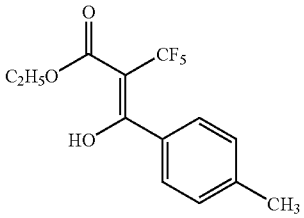

(9-10)

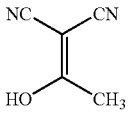

(9-11)

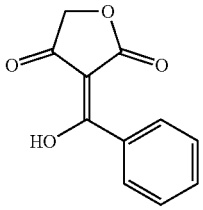

(9-12)

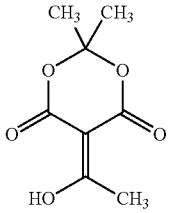

(9-13)

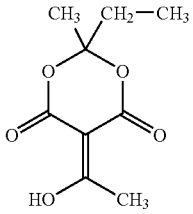

Next, described is an Antifoggant preferably used in the invention. The Antifoggants preferably used in the invention can include, for example, the compounds a to j described in [0012] of JP-A-8-314059, thiosulfonate esters A to K described in [0028] of JP-A-7-209797, the compound examples (1) to (44) described in from page 14 of JP-A-55-140833, the compounds (1-1) to (1-6) described in [0063] and (C-1) to (C-3) in [0066] of JP-A-2001-13627, the compounds (III-1) to (III-108) described in [0027] of JP-A-2002-90937, the compounds VS-1 to VS-7, the compounds HS-1 to HS-5 described in [0013] of JP-A-6-208192 as the compounds of vinylsulfones and/or β-halosulfones, the compounds KS-1 to KS-8 described in JP-A-2000-330235 as sulfonylbenzotriazole compounds, and the compounds PR-01 to PR-08 described in JP-T-2000-515995 as propenenitrile compounds.

The above Antifoggant is generally used at the amount of at least 0.001 mol per mol of the silver. Typically, the range thereof is from 0.01 to 5 mol per mol of the silver, and preferably from 0.02 to 0.6 mol per mol of the silver.

In addition to the above compounds, the compound known as the Antifoggant in earlier technology may be comprised in the photothermographic imaging material of the invention, and may be the compound capable of producing the same reaction active species as the above compounds or may be the compound with different inhibition mechanism. For example, included are the compounds described in U.S. Pat. Nos. 3,589,903, 4,546,075, 4,452,885, JP-A-59-57234, U.S. Pat. Nos. 3,874,946, 4,756,999, JP-A-9-288328, and JP-A-9-90550. Additionally, the other Antifoggants include the compounds disclosed in U.S. Pat. No. 5,028,523, EP Nos. 600,587, 605,981, and 631,176.

When the reducing agent used for the invention has aromatic hydroxy group (—OH), especially in the case of bisphenols, it is preferable to combine a non-reducing compound having a group capable of forming hydrogen bond with these groups.

In the present invention, especially preferable specific examples of hydrogen bonding compounds include the compounds (UU-1) to (II-40) described in [0061] to [0064] of JP-A-2002-90937.

Also as the compounds which inactivate the reducing agent such that the reducing agent can not reduce the aliphatic silver carboxylate to the silver, preferred are those of which reaction active species are not halogen atoms, but the compound which releases halogen atoms as the active species can be also used by combining the compound which releases the active species which are not halogen atoms. Many compounds which release halogen atoms as the active species are known, and good effects are obtained by combination.

Also in addition to the above compounds, the compounds known as the Antifoggants in earlier technology may be comprised in the silver salt photothermographic dry imaging material of the invention, and they may be the compounds capable of producing the same reaction active species as those of the above compounds or the compounds with different photographic fog inhibiting mechanism. For example, included are the compounds described in U.S. Pat. Nos. 3,589,903, 4,546,075, 4,452,885, JP-A59-57234, U.S. Pat. Nos. 3,874,946, 4,756,999, JP-A-9-288328 and JP-A9-90550. Additionally as the other Antifoggants, included are the compounds disclosed in U.S. Pat. No. 5,028,523, and Europe Patents Nos. 600,587, 605,981 and 631,176.

In the present invention, as the Antifoggant and the image stabilizer, in addition to the above compounds, it is possible to preferably use the compounds capable of forming a chelate ring with silver ions, for example, the compounds having two carboxyl groups at proximal positions such as phthalic acids and capable of forming the chelate ring with silver ions.

[Fluorinated Surfactant]

In the present invention, in order to improve film transport property and environmental aptitude (accumulation in vivo) in a thermal development apparatus, fluorinated surfactants represented by the Formula (SF) are used.

In the Formula (SF), Rf represents a fluorine atom-containing substituent, and the fluorine atom-containing substituents include, for example, alkyl groups with 1 to 25 carbons which are substituted with fluorine atoms (e.g., methyl, ethyl, butyl, octyl, dodecyl and octadecyl groups, etc. substituted with fluorine atoms), or alkenyl groups which are substituted with fluorine atoms (e.g., propenyl, butenyl, nonenyl and dodecenyl groups, etc. substituted with fluorine atoms).

$L_4$ represents a bivalent linkage group containing no fluorine atom, and the bivalent linkage groups containing no fluorine atom include, for example, alkylene groups (e.g., methylene, ethylene, butylene groups, etc.), alkyleneoxy groups (methyleneoxy, ethyleneoxy, butyleneoxy groups, etc.), oxyalkylene groups (e.g., oxymethylene, oxyethylene, oxybutylene groups, etc.), oxyalkyleneoxy groups (e.g., oxymethyleneoxy, oxyethyleneoxy, oxyethyleneoxyethyleneoxy groups, etc.), phenylene, oxyphenylene, phenyloxy, oxyphenyloxy groups or the combination thereof.

A represents an anion group or a salt group thereof, and for example, includes carboxylic acid group or the salt group thereof (sodium, potassium and lithium salts), sulfonic acid group or the salt group thereof (sodium, potassium and lithium salts), and phosphoric acid group or the salt group thereof (sodium, and potassium salts).

$Y_3$ represents a tervalent or tetravalent linkage group having no fluorine atom, and for example, includes atomic groups which are tervalent or tetravalent linkage group having no fluorine atom and made up of mainly carbon and nitrogen atoms, and m4 and n4 represent integers of 0 or 1, and preferably 1.

The fluorinated surfactants represented by the Formula (SF) can be obtained by further introducing the anion group (A) for example by sulfate esterification to the compound (alkanol compound with partial Rf) obtained by the addition reaction or the condensation reaction of a fluorine atom-introducing alkyl compound (e.g., the compounds having trifluoromethyl, pentafluoroethyl, perfluorobutyl, perfluorooctyl and perfluorooctadecyl groups) and an alkenyl compound (e.g., perfluorohexenyl and perfluorononenyl groups) with 1 to 25 carbons, with a trivalent to hexavalent alkanol compound introducing no fluorine atom, an aromatic compound or a hetero compound having 3 to 4 hydroxy groups introducing no fluorine atom.

The above tervalent to hexavalent alkanol compound includes glycerine, pentaerythritol, 2-methyl-2-hydroxymethyl-1,3-propanediol, 2,4-dihydroxy-3-hydroxymethylpentene, 1,2,6-hexanetriol, 1,1,1-tris (hydroxymethyl)propane, 2,2-bis (butanol)-3, aliphatic triol, tetramethylolmethane, D-sorbitol, xylitol, D-mannitol and the like.

Also, the aromatic compound and hetero compound with the above 3 to 4 hydroxy groups include 1,3,5-trihydroxybenzene and 2,4,6-trihydroxypyridine.

Hereinafter, shown are preferable specific examples of the fluorinated surfactants represented by the Formula (SF).

SF-1

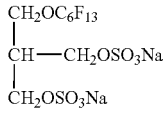

SF-2

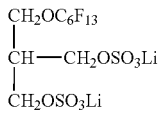

SF-3

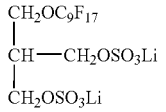

SF-4

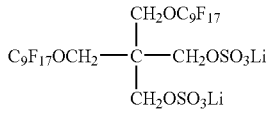

SF-5

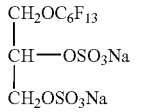

SF-6

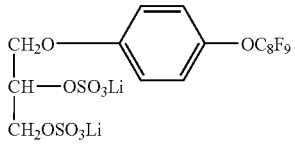

SF-7

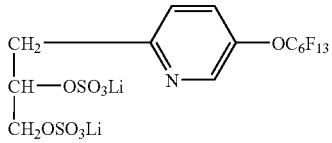

SF-8

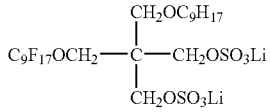

SF-9

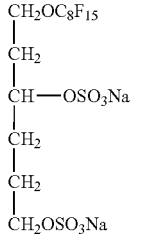

SF-10

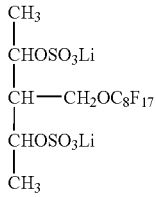

SF-11

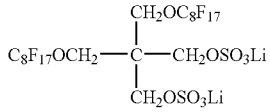

-continued

SF-12

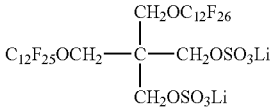

SF-13

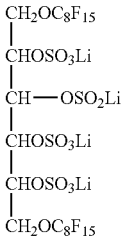

SF-14

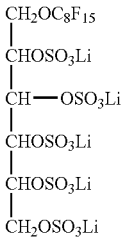

SF-15

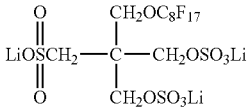

SF-16

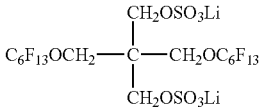

SF-17

SF-18

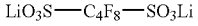

The fluorinated surfactants represented by the Formula (SF) of the invention can added to the coating solution according to the methods known in the art. That is, it can be added by dissolving in polar solvents such as alcohols such as methanol and ethanol, ketones such as methylethylketone and acetone, methylsulfoxide, and dimethylformamide. Also it can be added by making into fine particles of 1 μm or less and dispersing in water or the organic solvent by sand mill dispersion, jet mill dispersion, ultrasonic dispersion and homogenizer dispersion. Numerous technologies are disclosed for fine particle dispersion technology, and the dispersion can be carried out according to these technologies. It is preferred that the fluorinated surfactant represented by the Formula (SF) is added to the protection layer of the outermost layer.

The addition amount of the fluorinated surfactant represented by the Formula (SF) of the invention is preferably from $1\times10^{-8}$ to $1\times10^{-1}$ mol per $m^2$, and especially preferably from $1\times10^{-5}$ to $1\times10^{-2}$ mol per $m^2$. When it is less than the former range, electrostatic property is not obtained whereas when it is over the former range, temperature dependency is high and storage stability under high temperature is deteriorated.

In the photothermographic imaging material of the invention, it is preferred that Lb/Le is 1.5 or more and 10 or less, further preferably, 2.0 or more and 10 or less, when the mean particle size of matting agents comprised in an outermost face at the side having the image formation layer is made Le (μm), and that comprised in an outermost face at the side having the back coat layer is made Lb (μm). Density unevenness at thermal development can be improved by making Lb/Le this range.

(Binders)

Hereinafter, the binders which can be used in the invention are described.

Binders suitable for the photothermographic imaging material of the invention are transparent or translucence, generally colorless, and include natural polymer synthetic resins, polymers, copolymers, and the other media which form film, for example, those described in [0069] of JP-A-2001-330918. Among them, the binders preferable for the photosensitive layer of the photothermographic imaging material according to the invention are polyvinyl acetals, and the especially preferable binder is polyvinyl butyral. Details are described below. Also, for non-photosensitive layers such as a face coating layer and a base coating layer, especially a protection layer and a back coat layer, preferred are cellulose esters which are polymers with higher softening temperature, especially polymers such as triacetylcellulose and cellulose acetate butyrate. The above binders can be used in combination of two or more if necessary. For the binder, it is preferable to use those at least one or more of polar group selected from —COOM, $—SO_3M$, $—OSO_3M$, $—P{=}O(OM)_2$, $—O—P{=}(OM)_2$ (M represents a hydrogen atom or an alkali metal base), $—N(R)_2$, $—N^+(R_3)$ (R represents a hydrocarbon group), epoxy group, —SH, —CN and the like are introduced by copolymerization or addition reaction, and $—SO_3M$, and $—OSO_3M$ are especially preferable. The amount of such a polar group is from $1\times10^{-1}$ to $1\times10^{-8}$ mol/g, and preferably from $1\times10^{-2}$ to $1\times10^{-6}$ mol/g.

Such a binder is used in the effective range to function as the binder. The effective range can be easily determined by those skilled in the art. For example, as an index when at least retaining the organic silver salt at the image formation layer, a ratio of the binder to the organic silver salt is preferably from 15:1 to 1:2, and especially the range of 8:1 to 1:1 is preferable. That is, it is preferred that the amount of binder in the image formation layer is from 1.5 to 6 $g/m^2$. More preferably it is from 1.7 to 5 $g/m^2$. When it is less than 1.5 $g/m^2$, the density at an unexposed part is drastically increased and there are sometimes unusable cases.

A glass transition temperature Tg of the binder used in the invention is preferably 70° C. or above and 105° C. or below. Tg can be obtained by measuring with a differential thermometer, and an intersecting point of a baseline and a slope of an endothermic peak is rendered the glass transition temperature.

In the present invention, the glass transition temperature (Tg) is obtained by the method described in Brandwrap et al., "Polymer Handbook" III-139 to III-179 pages (1966, Willy and Sun Publisher).

When the binder is a copolymer resin, Tg is obtained by the following formula.

$$Tg(\text{copolymer})(^\circ\text{ C.})=v_1Tg_1+v_2Tg_2+\ldots v_nTg_n$$

$v_1$, $V_2$ . . . $V_n$ represent a percentage by mass of a monomer in the copolymer, and $Tg_1$, $Tg_2$ . . . $Tg_n$ represent Tg (° C.) of a single polymer obtained from each monomer in the copolymer.

An accuracy of Tg calculated according to the above formula is ±5° C.

When using the binder with Tg of 70 to 105° C., the sufficient and maximum density can be obtained in the image formation, and thus it is preferable.

As the binder of the invention, Tg is from 70 to 105° C., the number average molecular weight is from 1,000 to 1,000,000, preferably from 10,000 to 500,000, and the polymerization degree is from about 50 to 1,000.

The polymers or copolymers comprising the ethylenic unsaturated monomer mentioned above as a component unit include those described in [0069] of JP-A-2001-330918.

Among them, the especially preferable examples include alkyl methacrylate esters, aryl methacrylate esters, styrenes and the like. In such polymer compounds, it is preferable to use the polymer compounds having acetal group. It is more preferable to be polyvinyl acetal having acetoacetal structure, and for example, it is possible to include polyvinyl acetal shown in U.S. Pat. Nos. 2,358,836, 3,003,879 and 2,828,204, and British Patent No. 771,155.

As the polymer compounds having the acetal group, especially preferred are the compounds represented by the following Formula (V).

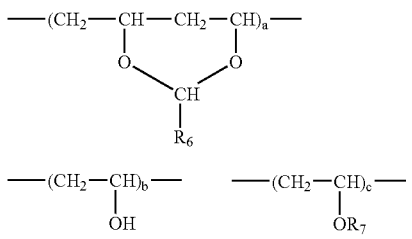

(V)

In the Formula, $R_6$ represents an unsubstituted alkyl, substituted alkyl, aryl or substituted aryl group, and is preferably a group other than aryl group. $R_7$ represents unsubstituted alkyl, substituted alkyl, unsubstituted aryl, substituted aryl group, —$COR_8$ or $ONHR_8$. $R_8$ is the same as defined $R_6$.

The unsubstituted alkyl groups represented by $R_6$, $R_7$ and $R_8$ are preferably those with 1 to 20 carbons, and more preferably those with 1 to 6 carbons. These may be linear or branched, and preferably linear alkyl groups are preferable. Such substituents include, for example, methyl, ethyl, n-propyl, isopropyl, n-butyl, isobutyl, t-butyl, n-amyl, t-amyl, n-hexyl, cyclohexyl, n-hepsyl, n-octyl, t-octyl, 2-ethylhexyl, n-nonyl, n-decyl, n-dodecyl, n-octadecyl and the like. Methyl or propyl group is especially preferable.

The unsubstituted aryl groups are preferably those with 6 to 20 carbons, and for example include phenyl, naphthyl groups and the like. The groups capable of being substituted to the above alkyl or aryl group include alkyl groups (e.g., methyl, n-propyl, t-amyl, t-octyl, n-nonyl, dodecyl groups, etc.), aryl groups (e.g., phenyl group, etc.), nitro, hydroxy, cyano, sulfo groups, alkoxy groups (e.g., methoxy group, etc.), aryloxy groups (e.g., phenoxy group, etc.), acyloxy groups (e.g., acetoxy group, etc.), acylamino groups (e.g., acetylamino group, etc.), sulfonamide groups (e.g., methanesulfonamide group, etc.), sulfamoyl groups (e.g., methylsulfamoyl group, etc.), halogen atoms (e.g., fluorine, chlorine, bromine atoms), carboxy, carbamoyl groups (e.g., methylcarbamoyl group, etc.), alkoxycarbonyl groups (e.g., methoxycarbonyl group, etc.), sulfonyl groups (e.g., methylsulfonyl group, etc.) and the like. When these substituents are two or more, they may be the same or different. The total carbon number of substituted alkyl group is preferably from 1 to 20, and the total carbon number of substituted aryl group is preferably from 6 to 20.

As $R_7$, preferred is —$COR_8$ ($R_8$ is an alkyl or aryl group) or —$CONR_8$ ($R_8$ is an aryl group). And, a, b and c is values showing the weight of respective repeat units by mol %, a is in the range of 40 to 86 mol %, b is in the range of 0 to 30 mol %, c is in the range of 0 to 60 mol %, which represent the numbers to be a+b+c=100 mol %. Especially preferably, a is in the range of 50 to 86 mol %, b is in the range of 5 to 25 mol %, and c is in the range of 0 to 40 mol %. Each repeat unit having each composition ratio of a, b and c may be made up of the same or different components.

The polymer compounds represented by the above Formula (V) can be synthesized by the general method for synthesis described in "Vinyl Acetate Resins" edited by Ichiro Sakurai (1962, Kobunshi Kagaku Kankokai).

As polyurethane resins which can be used in the invention, it is possible to use those known in the art where the structure is polyester polyurethane, polyether polyurethane, polyetherpolyester polyurethane, polycarbonate polyurethane, polyesterpolycarbonate polyurethane, polycaprolactone polyurethane and the like. Also, it is preferable to have at least one OH group at each end of polyurethane molecule and thus total two or more OH groups. Since OH groups form three dimensional network structure by crosslinking with polyisocyanate which is a hardening agent, it is more preferable to include more groups in the molecules. Especially, when OH groups are located at the molecular ends, the reactivity to the hardening agent is high, and thus it is preferable. Polyurethane has preferably 3 or more OH groups at the molecular ends, and it is especially preferable to have 4 or more. When polyurethane is used in the invention, it is preferred that the glass transition temperature is from 70 to 105° C., elongation after fracture is from 100 to 2000% and breaking stress for link chain is from 0.5 to 100 N/mm$^2$.

These polymer compounds (polymers) may be used alone or in blend of two or more. The above polymer is used as the main binder for the image formation layer of the invention. The main binder here is referred to a "state where the above polymer occupies 50% or more by mass of the total binders of the image formation layer". Therefore, the other polymers may be blended in the range of less than 50% by mass of the total binders. These polymers is not especially limited as long as they are solvents where the polymer of the invention is solubilized. More preferably included are polyvinyl acetate, polyacryl resins, urethane resins and like.

In the present invention, an organic gelling agent may be contained in the image formation layer. The organic gelling agent herein is referred to compounds such as polyvalent alcohols having a function which makes fluidity of the system disappear or lower by adding to an organic liquid to impart an yield value to the system.

Binders which can be used for the silver salt photothermographic dry imaging material of the invention (hereinafter referred to as binders according to the invention) are transparent or translucent and generally colorless, and natural and synthetic high molecules. As examples of the binders according to the invention, included are the natural or synthetic high molecules described in the paragraph number of [0193] of JP-A-2001-66725. As the binders according to the invention, polyvinyl acetals are preferable, and polyvinyl butyral is especially preferable. As the use amount of binder, a ratio of the binder to the organic silver salt is in the range of 15:1 to 1:2, and especially preferably from 8:1 to 1:1. Also, as the binders according to the invention, polymer latex can be preferably used. Concerning the polymer latex, it is possible to apply the compounds and the technology described in the paragraph numbers of [0194] to [0203] of JP-A-2001-66725.

In the present invention, it is also the preferable aspect that a coating solution for the image formation layer contains polymer latex in aqueous dispersion. In this case, it is preferred that 50% or more by mass of the total binders of the coating solution for the image formation layer is polymer latex in aqueous dispersion.

Also, when the image formation layer according to the invention contains polymer latex, it is preferred that 50% or more by mass of the total binders in the image formation layer is the polymer latex, and more preferably the polymer latex is 70% or more by mass.

"Polymer latex" according to the invention is one where water-insoluble hydriphobic polymer is dispersed in an aqueous dispersion medium as fine particles. The dispersion state may be any of one where the polymer is emulsified in the dispersion medium, emulsified and polymerized one, micelle dispersion, or one where hydriphilic structures are partially present in the molecule and molecular chains per se are in molecular dispersion.

The mean particle size of the dispersed particles is preferably from 1 to 50000 nm, and more preferably in the range of about 5 to 1000 nm. The particle size distribution is not especially limited, and the particles may have a broad particle size distribution or a particle size distribution of monodisperse.

The polymer latex according to the invention may be so-called core/shell type latex in addition to the polymer latex with common uniform structure. In this case, there are sometimes preferable cases when the glass transition temperature is different in the core and the shell. A minimum film forming temperature (MFT) of the polymer latex according to the invention is preferably from −30 to 90° C., and more preferably from about 0 to 70° C. Also, a film forming aid may be added to control the minimum film forming temperature. The film forming aid used for the invention is also called a plasticizer, an organic compound (typically organic solvent) which reduces the minimum film forming temperature of the polymer latex, and for example, described in "Chemistry of Synthetic Latex (written by So-ichi Muroi, published by Kobunshi Kanko, 1970)".

Polymer types used for the polymer latex are acryl, vinyl acetate, polyester, polyurethane, rubber type, vinyl chloride, vinyliden chloride and polyolefin resins, or copolymers thereof and the like. The polymers may be linear polymers, branched polymers or crosslinked polymers. Also, the polymers may be so-called homopolymers where a single monomer is polymerized or copolymers where two or more types of monomers are polymerized. The copolymers may be random copolymers or block copolymers. The molecular weight of the polymer is typically from 5000 to 1000000, and preferably from about 10000 to 100000 by number average molecular weight. When the molecular weight is too small, dynamic strength of the photosensitive layer is insufficient, and when it is too large, it is not preferable because film-making ability is poor.

The polymer latex with equilibrium water content of 0.01 to 2% or less by mass at 25° C. and 60% RH is preferable, and more preferable are those with 0.01 to 1% by mass. For the definition of and the method for measurement of the equilibrium water content, it is possible to refer to, for example, "Kobunshi Kogaku Koza 14, Kobunshi Zairyo Shikenho (edited by Society of Polymer Science, Japan, Chijinshokan).

Specific examples of the polymer latex include latex of methyl methacrylate/ethyl methacrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer, and the like.

These polymers may be used alone or in blend of two or more if necessary. As polymer types of the polymer latex, it is preferred that carboxylic acid ingredient such as acrylate or methacrylate ingredient is contained at about 0.1 to 10% by mass.

Furthermore, hydriphilic polymers such as gelatin, polyvinyl alcohol, methylcellulose, hydroxypropylcellulose, carboxymethylcellulose, and hydroxypropylmethylcellulose may be added in the range of 50% or less by mass based on total binders if necessary. It is preferred that the addition amount of these hydriphilic polymers is 30% or less by mass based on the total binders of the photosensitive layer.

In the preparation of the coating solution for the image formation layer according to the invention, concerning an order of the addition of the organic silver salt and the polymer latex in aqueous dispersion, either one may be added precedently, or they may be added simultaneously, but preferably the polymer latex is added later.

Furthermore, it is preferred that the organic silver salt and further the reducing agent have been mixed before the addition of the polymer latex. Also, in the present invention, after mixing the organic silver salt and the polymer latex, there is problematic in that when the temperature with time is too low, a coating face is impaired whereas when it is too high, the photographic fog is increased, and thus, it is preferred that the coating solution after mixing is retained at 35° C. to 60° C. for the following time period. Especially it is preferred to retain at 35° C. to 55° C. for time elapsing. To maintain such a temperature, a liquid preparation bath for the coating solution could be kept warm.

Concerning the coating of the coating solution for the image formation layer according to the invention, it is preferable to use the coating solution 30 min to 24 hours after mixing the organic silver salt and the polymer latex, more preferably the coating solution is left 60 min to 12 hours after the mixing, and it is especially preferable to use the coating solution 120 min to 10 hours after the mixing.

Here, "after mixing" is referred to subsequence of adding the organic silver salt and the polymer latex in aqueous dispersion and added materials being dispersed evenly.

The imaging materials of the invention are those having the photosensitive layer containing the photosensitive silver halide and further having at least one non-photosensitive layer on at least one face of the support, and the photosensitive layer and at least one non-photosensitive layer are formed by simultaneously drying after coating and providing layers. In this case, polymer latex is used as a major binder of the photosensitive layer. When the polymer latex used for the invention is applied for the major binder of the photosensitive layer, then a diffusion velocity of a toning agent which produces silver carrier at heating development becomes slow, making a latent image on the silver halide grains which becomes a catalyst for reduction of the silver a center, if the range of the non-photosensitive aliphatic silver carboxylate which is a supply source of the silver consumed therein is converted into a sphere, which is then calculated, this radius become often small. That is, it is believed that an influence potency range becomes narrow, the size of developed silver becomes small, and thus the covering power is enhanced.

In the polymer of such polymer latex, preferably the equilibrium water content is 2% or less by mass at 25° C. and at 60% RH.

The non-photosensitive layers herein which are dried in parallel with the photosensitive layer are the layers other than the photosensitive layer in the layers which configure the imaging material of the invention, and the layers formed using coating solutions of aqueous solvents.

Therefore, in the present invention, in two or more layers comprising the above photosensitive and non-photosensitive layers, coating where the aqueous solvent is rendered a coating solvent becomes possible, and it becomes more advantageous in terms of environment and cost compared with the coating by the organic solvent. Also two or more layers are simultaneously dried, and thus it is excellent in coated face states and productivity.

Also, since the polymer latex is used, the occurrence of photographic fog under an atmosphere of high moisture is inhibited.

As binders in earlier technology for the aqueous solvents, gelatin and polyvinyl alcohol are common, but the equilibrium water content of such polymers under the above condition is more than 2% by mass, and the photographic fog under the atmosphere of high moisture is increased.

And, by using gelatin as the binder in the above non-photosensitive layers, among others by using gelatin as the binder in the surface protection layer, the materials becomes practically preferable ones because an effect where coating face states of the imaging material surface become good is large.

Also, concerning the coating face state, a simultaneous dry mode is more advantageous compared with a sequential dry mode, for example, where the photosensitive layer is coated and dried, and subsequently the non-photosensitive layer at the side of the photosensitive layer of the support, such as the surface protection layer is coated and dried.

This way, the present invention has characteristics that it is advantageous in terms of environment and cost, the highly efficient method for manufacture by the simultaneous dry mode can be employed, and further the photographic fog under the atmosphere of high moisture can be reduced, and the coating face state can be improved.

"Polymer latex" according to the invention is one where water-insoluble hydriphobic polymer is dispersed in an aqueous dispersion medium as fine particles. The dispersion state may be any of one where the polymer is emulsified in the dispersion medium, emulsified and polymerized one, micelle dispersion, or one where hydriphilic structures are partially present in the molecule and molecular chains per se are in molecular dispersion.

The polymer latexes of the invention are described in "Synthetic Resin Emulsion (edited by Taira Okuda and Hiroshi Inagaki, published by Kobunshi Kankokai, 1978)", "Application of Synthetic Latexes (edited by Takaaki Sugimura, Yasuo Kataoka, So-ichi Suzuki and Keiji Kasahara, published by Kobunshi Kankokai, 1993)", and "Chemistry of Synthetic Latexes (written by So-ichi Muroi, published by Kobunshi Kankokai, 1970)". The mean particle size of polymer latex dispersed particles is preferably from 1 to 50000 nm, and more preferably in the range of 5 to 1000 nm. The particle size distribution of the dispersed particles is not especially limited.

Polymer types used for the polymer latex are acryl, vinyl acetate, polyester, polyurethane, rubber type, vinyl chloride, vinyliden chloride and polyolefin resins, or copolymers thereof and the like. The polymers may be linear polymers, branched polymers or crosslinked polymers. Also, the polymers may be so-called homopolymers where a single monomer is polymerized or copolymers where two or more types of monomers are polymerized. The copolymers may be random copolymers or block copolymers. The molecular weight of the polymer is typically from 5000 to 1000000, and preferably from about 10000 to 100000 by number average molecular weight. When the molecular weight is too small, dynamic strength of the photosensitive layer is insufficient, and when it is too large, it is not preferable because film-making ability is poor.

The polymer may be monopolymer where a single monomer is polymerized, or copolymer where two or more types of polymers are polymerized. The polymer may be linear or branched, and further may be those where polymers are crosslinked one another. The copolymers may be random, alternate or block copolymers.

As the molecular weight of the polymer, it is desirable that the number average molecular weight Mn is 1000 to 1000000, and preferably from 3000 to 500000. When the number average molecular weight is less than 1000, generally strength of coating films is small and inconvenience such as cracking of the photosensitive layer sometimes occurs.

The equilibrium water content of the polymer of the invention at 25° C. and at 60% RH is necessary to be 2% or less by mass, and is more preferably 0.01% or more and 1.5% or less, and still preferably 0.03% or more and 1% or less by mass.

"Equilibrium water content at 25° C. and at 60% RH" herein can be represented as follows using the weight $W_1$ of polymer in air-conditioning equilibrium under the atmosphere at 25° C. and at 60% RH and the weight $W_0$ of polymer in bone-dry state at 25° C.

$$\text{Equilibrium water content at 25° C. and at 60\% RH} = \{(W_1 - W_0)/W_0\} \times 100 \text{ (\% by mass)}$$

For actual methods for measuring the equilibrium water content, for example, it is possible to refer to "Kobunshi Kogaku Koza 14, Kobunshi Zairyo Shikenho (edited by Society of Polymer Science, Japan, Chijinshokan).

As specific examples of the polymer latex for the binder in the photosensitive layer of the invention, there are the followings.

P-1: Latex of $(MMA)_{60}$-$(EA)_{35}$-$(MAA)_5$ (Mn=50000)

P-2: Latex of -$(MMA)_{50}$-$(2EHA)_{30}$-$(St)_{17}$-$(MAA)_3$- (Mn=50000)

P-3: Latex of -$(St)_{70}$-$(Bu)_{25}$-$(MAA)_5$-(Mn=30000)

P-4: Latex of -$(St)_{65}$-$(Bu)_{27}$-$(DVB)_5$-$(AA)_3$-(Mn=12000)

P-5: Latex of -$(VC)_{50}$-$(MMA)_{45}$-$(AA)_5$-(Mn=20000)

P-6: Latex of -$(VDC)_{70}$-$(MMA)_{20}$-$(EA)_7$-$(MAA)_3$- (Mn=90000)

In the above, the abbreviation represents a configuration unit derived from the monomer shown below, and the numerical value is % by mass. MMA: Methylmethacrylate, EA: Ethylacrylate, MAA: Methacrylic acid, 2EHA: 2-Ethylhexylacrylate, St: Styrene, Bu: Butadiene, DVB: Divinylbenzene, AA: Acrylic acid, VC: Vinyl chloride, VDC: Vinylidene chloride.

Also, such polymers are commercially available, and the followings can be utilized as the polymer latex of the invention.

For example, as the acrylic resins there are Serbian A-4635, 46583, 4601 (Daicel Chemical Industries Ltd.), Nipol LX811, 814, 820, 821, 857 (Zeon Corporation), as polyester resins there are FINETEX ES650, 611, 679, 675, 525, 801, 850 (Dainippon Ink And Chemicals, Incorporated), WD size, WHS (Eastman Chemical) and the like, as polyurethane resins there are HYDRAN AP10, 20, 30, 40, 101H, HYDRAN HW301, 310, 350 (Dainippon Ink And Chemicals, Incorporated) and the like, as vinylidene chloride resins there are L502, L513, L123c, L106c, L111, L114 (Asahi Chemical Industry Co., Ltd.) and the like, as vinyl chloride resins there are G351, G576 (Zeon Corporation) and the like, as rubber type resins there are LACSTAR3307B, 7132C, DS206 (Dainippon Ink And Chemicals, Incorporated), Nipol Lx416, Lx433 (Zeon Corporation) and the like, and as polyolefin resins there are Chemipearl S-120, S-300, SA-100, A-100, V-100, V-200, V-300 (Mitsui Oil & Gas Co., Ltd.) and the like.

For the binders of the invention, these polymers may be used alone or in combination with two or more as the polymer latex.

As the polymer latex used for the invention, especially the latex of styrene-butadiene copolymer is preferable. The molar ratio of a monomer unit of styrene to a monomer unit of butadiene in the styrene-butadiene copolymer is from 50:50 to 95:5, and preferably from 60:40 to 90:10. The rate of the monomer unit of styrene and the monomer unit of butadiene occupying in the copolymer is from 50 to 99%, and preferably from 60 to 97% by mass. The preferable range of the molecular weight is the same as the above.

The latex of styrene-butadiene copolymer which is preferably used for the invention includes the above P-3, P-4, commercially available LACSTAR3307B, 7132C, DS206, Nipol Lx416, Lx433 and the like.

The aqueous solvent herein capable of dissolving or dispersing the polymer of the invention is water or one where water-miscible organic solvent at 70% or less by mass is mixed with water. The water-miscible organic solvents can include, for example, alcohol types such as methyl alcohol, ethyl alcohol and propyl alcohol, cellosolve types such as methyl cellosolve, ethyl cellosolve and butyl cellosolve, ethyl acetate, dimethylformamide and the like.

Even in the case of a system where the polymer is not thermodynamically dissolved and is present in so-called dispersing state, here the term, aqueous solvent is used.

The above polymer latex is used as the major binder for the photosensitive layer of the invention. The major binder here is referred to "a state where the polymer derived from the above polymer latex occupies 50% or more by mass of total binders in the photosensitive layer". More preferably it is 70% or more by mass, and it is also preferable to use only the polymer latex of the invention. The amount is the sum when two or more types are used.

Therefore, the polymer derived from the polymer latex may be contained in the photosensitive layer of the invention at 50% or less, further 30% or less, especially less than 30% and more preferably 20% or less by mass of the total binders. As preferable examples of these polymers, there are gelatin, polyvinyl alcohol and the like.

By using the polymer latex at the above rate in the photosensitive layer of the invention, the equilibrium water content of the polymer mixture at 25° C. and at 60% RH preferably becomes 2% or less by mass.

The amount of the binders in the photosensitive layer of the invention is preferably from 10:1 to 200:1, and more preferably from 20:1 to 100:1 at the mass ratio in a ratio of the binder to the photosensitive silver halide.

The photosensitive layer of the invention is one formed using the coating solution, the solvent for the coating solution is a water solvent containing 30% or more by mass of water, and may contain water-miscible organic solvents described above in addition to water. Examples of preferable water solvents include water (100), water/methanol systems, e.g., water (90)/methanol (10), water (70)/methanol (30), water (60)/methanol (40) and water (50)/methanol (50), water/methanol/isopropyl alcohol systems, e.g., water (80)/methanol (10)/isopropyl alcohol (10), water/dimethylformamide systems, e.g., water (95)/dimethylformamide (5), water/ethyl acetate systems, e.g., water (96)/ethyl acetate (4), water/methanol/butyl cellosolve systems, e.g., water (80)/methanol (10)/butyl cellosolve (10) and the like (numerical values indicate % by mass). Among others, it is preferable to be the solvent containing water at 70% or more by mass.

The binders preferable for the imaging material of the present invention are transparent or translucent. Generally, they are achromatic, and include natural polymer synthetic resin or polymer, copolymer, and mediums which form films. They include, for example, gelatin, gum Arabic, poly (vinyl alcohols), hydroxyethyl cellulose, cellulose acetate, cellulose acetate butyrate, poly (vinylpyrrolidone), casein, amylum, poly (acrylic acid), poly (methyl methacrylic acid), poly (vinyl chloride), poly (methacrylic acid), copoly (styrene-maleic anhydride), copoly (styrene-acrylonitrile), copoly (styrene-butadiene), poly (vinyl acetal)s (for example, poly (vinyl formal) and poly (vinyl butyral)), poly (ester)s, poly (urethane)s, phenoxy resin, poly (vinylidene chloride), poly (epoxide)s, poly (carbonate)s, poly (vinyl acetate), cellulose esters, poly (amide)s. They may be either hydrophilic or hydrophobic.

The binders preferable for the photosensitive layer of the silver salt photothermographic dry imaging material of the invention are polyvinyl acetals, and the especially preferable binder is polyvinyl butyral. Details are described below. Also for the non-photosensitive layers such as an upper coating layer and a lower coating layer, especially the protection layer and the back coat layer, preferred are polymers such as cellulose esters, especially triacetylcellulose and cellulose acetate butyrate which are the polymers with high softening temperature. The above binders are used in combination with two or more if necessary.

Such a binder is used in the effective range to function as the binder. The effective range can be easily determined by those skilled in the art. For example, as an index when at least retaining the organic silver salt at the image formation layer, a ratio of the binder to the organic silver salt is preferably from 15:1 to 1:2, and especially the range of 8:1 to 1:1 is preferable. That is, it is preferred that the amount of binder in the image formation layer is from 1.5 to 6 g/m$^2$. More preferably it is from 1.7 to 5 g/m$^2$. When it is less than 1.5 g/m$^2$, the density at an unexposed part is drastically increased and there are sometimes unusable cases.

As the binders used in the invention, it is preferred that a thermal transition point temperature after the development processing at the temperature of 100° C. or above is 46° C. or above and 200° C. or below. More preferably it is 70° C. or above and 105° C. or below. The thermal transition point temperature herein is a VICAT softening point or a value exhibited by a ring and ball method, and indicates an endothermic peak when the photosensitive layer after the thermal development is isolated and measured using a differential scanning calorimeter (DSC), e.g., EXSTAR 600 (Seiko Instrument Inc.), DSC220C (Seiko Instrument Inc.), DSC-7 (Perkin Elmer) and so on. Generally, the high molecular compounds have the glass transition temperature Tg, but in the silver salt photothermographic dry imaging material, the large endothermic peak appears at lower area than Tg value of the binder resin used in the photosensitive layer. As a result of an intensive study focusing on this thermal transition point temperature, by making this thermal transition temperature 46° C. or above and 200° C. or below, not only toughness of the formed coating film is increased, but also the photographic performances such as the sensitivity, maximum density and image storage stability are remarkably improved.

In the silver salt photothermographic dry imaging material of the invention, as the binders contained in the photosensitive layer containing the aliphatic silver carboxylate, the photosensitive silver halide grains, the reducing agent and the like on the support, it is possible to use high molecular compounds known in earlier technology. They are those with Tg of 70 to 105° C., number average molecular weight of 1,000 to 1,000,000, preferably from 10,000 to 500,000, and polymerization degree of about 50 to 1,000. As such examples, there are compounds made up of polymers or copolymers comprising an ethylenic unsaturated monomer as the configuration unit such as vinyl chloride, vinyl acetate, vinyl alcohol, maleic acid, acrylic acid, acrylate ester, vinylidene chloride, acrylonitrile, methacrylic acid, methacrylate ester, styrene, butadiene, ethylene, vinyl butyral, vinyl acetal and vinyl ether, polyurethane resins and various rubber type resins.

Also included are phenol resins, epoxy resins, polyurethane cured type resins, urea resins, melamine resins, alkyd resins, formaldehyde resins, silicone resins, epoxy-polyamide resins, polyester resins and the like. These resins are particularly described in "Plastic Handbook" published by Asakura Shoten. These high molecular compounds are not especially limited, and may be homopolymers or copolymers as long as the glass transition temperature of the derived polymer is in the range of 70 to 105° C.

Such polymers or copolymers comprising an ethylenic unsaturated monomer as the configuration unit can include acrylate alkylesters, acrylate arylesters, methacrylate alkylesters, methacrylate arylesters, cyanoacrylate alkylesters, cyanoacrylate arylesters, and the like. Their alkyl and aryl groups may be substituted or unsubstituted, and specifically can include methyl, ethyl, n-propyl, isopropyl, n-butyl, isobutyl, sec-butyl, t-butyl, amyl, hexyl, cyclohexyl, benzyl, chlorobenzyl, octyl, stearyl, sulfopropyl, N-ethyl-phenylaminoethyl, 2-(3-phenylpropyloxy)ethyl, dimethylaminophenoxyethyl, furfuryl, tetrahydrofurfuryl, phenyl, cresyl, naphthyl, 2-hydroxyethyl, 4-hydroxybutyl, triethyleneglycol, dipropyleneglycol, 2-methoxyethyl, 3-methoxybutyl, 2-acetoxyethyl, 2-acetoacetoxyethyl, 2-ethoxyethyl, 2-isopropoxyethyl, 2-butoxyethyl, 2-(2-methoxyethoxy)ethyl, 2-(2-ethoxyethoxy)ethyl, 2-(2-butoxyethoxy)ethyl, 2-diphenylphosphorylethyl, ω-methoxypolyethyleneglycol (addition mol n=6), allyl, dimethylamino chloride salt and the like.

The others, the following monomers and the like can be used. It is possible to include vinylesters: as specific examples, vinyl acetate, vinyl propionate, vinyl butylate, vinyl isobutylate, vinyl caproate, vinyl chloroacetate, vinyl methoxyacetate, vinyl phenylacetate, vinyl benzoate, vinyl salicylate, etc.; N-substituted acrylamides, N-substituted methacrylamides and acrylamide, methacrylamide: as N-substituted groups, methyl, ethyl, butyl, t-butyl, cyclohexyl, benzyl, hydroxymethyl, methoxyethyl, dimethylaminoethyl, phenyl, dimethyl, diethyl, β-cyanoethyl, N-(2-acetoacetoxyethyl), diacetone, etc.; olefins, for example, dicyclopentane, ethylene, propylene, 1-butene, 1-pentene, vinyl chloride, vinylidene chloride, isoprene, chloroprene, butadiene, 2,3-dimethylbutadiene; styrenes, for example, methylstyrene, dimethylstyrene, trimethylstyrene, ethylstyrene, isopropylstyrene, t-butylstyrene, chloromethylstyrene, methoxystyrene, acetoxystyrene, chlorostyrene, dichlorostyrene, bromostyrene, vinyl benzoate methylester etc.; vinylethers, for example, methylvinylether, butylvinylether, hexylvinylether, methoxyethylvinylether, dimethylaminoethylvinylether, etc.; N-substituted maleimides: as N-substituted groups, those having methyl, ethyl, propyl, butyl, t-butyl, cyclohexyl, benzyl, n-dodecyl, phenyl, 2-methylphenyl, 2,6-diethylphenyl, 2-chlorophenyl, etc.; as the others, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methylvinylketone, phenylvinylketone, methoxyethylvinylketone, glycidyl acrylate, glycidyl methacrylate, N-vinyloxazolidone, N-vinylpyrrolidone, acrylonitrile, methacrylonitrile, methylenemalonenitrile vinylidene chloride and the like.

In these, especially preferable examples include methacrylate alkylesters, methacrylate arylesters, styrenes and the like. In such high molecular compounds, it is preferable to use the high molecular compounds with acetal groups. Since the high molecular compounds with acetal groups are excellent in compatibility with the aliphatic carboxylic acid produced, an effect to prevent softening a film is large and is preferable.

Also, it is possible to use the polymer of which equilibrium water content at 25° C. and at the relative humidity of 60% is 2% or less by mass as the binder within the range where the effects of the invention are not impaired. More preferably the equilibrium water content is from 0.01 to 1.5%, and still preferably from 0.02 to 1% by mass. For the definition of and the method for measuring the water content, it is possible to refer to, for example, Kobunshi Kogaku Koza 14, Kobunshi Zairyo Sikenho (edited by Society of Polymer Science, Japan, Chijinshokan).

[Crosslinker]

In the present invention, it is well known that the use of a crosslinker for the above binder improves film adherence and reduces development unevenness, and there are also effects that the photographic fog in storage and the production of printout silver after the development are inhibited.

As the crosslinkers used in the invention, it is possible to use various crosslinkers used as photographic materials in earlier technology such as aldehyde, epoxy, ethyleneimine, vinylsulfone, sulfonate ester, acryloyl, carbodiimide, and silane type crosslinkers described in JP-A-50-96216, but preferred are isocyanate, silane, epoxy type compounds or acid anhydride shown below.

The above isocyanate type crosslinkers are isocyanates and addition bodies (adduct bodies) thereof having at least two isocyanate groups, and further specifically include aliphatic diisocyanates, aliphatic diisocyanates having cyclic groups, benzene diisocyanates, naphthalene diisocyanates, biphenyl isocyanates, diphenylmethane diisocyanates, triphenylmethane diisocyanates, triisocyanates, tetraisocyanates, addition bodies of these isocyanates and addition body of these isocyanates with bivalent or trivalent polyalcohol.

As specific examples, it is possible to utilize isocyanate compounds described in pages 10 to 12 of JP-56-5535.

Besides, the addition body of isocyanate and polyalcohol especially improves interlayer adhesiveness, and is high in ability to prevent occurrences of interlayer peeling, displacement of images and cells. Such isocyanate may be placed in any parts of photothermal photographic materials. For example, in a support (especially, when the support is paper, it can be contained in the size composition thereof), it can be added to any layer of the photosensitive layer side of the support such as the photosensitive layer, surface protection layer, intermediate layer, anti-halation layer and under coating layer, and can be added to one or two or more layers of these layers.

Also, as thioisocyanate type crosslinkers which can be used in the invention, useful are also the compounds having thioisocyanate structure corresponding to the above isocyanates.

The amount of the above crosslinker used in the invention is typically from 0.001 to 2 mol per mol of the silver, and preferably in the range of 0.005 to 0.5 mol per mol of the silver.

It is preferred that the isocyanate and thioisocyanate compounds which can be contained in the invention are the compounds having the function as the above crosslinker, but a good result is obtained by even the compound having only one of the functional group.

Examples of the silane compounds which can be used as the crosslinker in the invention include the compounds represented by the Formulae (1) to (3) disclosed in JP-A-2001-264930.

The epoxy compounds which can be used as the crosslinker in the invention could be those having one or more epoxy groups, and the number of epoxy groups, molecular weight and the others are not limited. It is preferred that epoxy group is contained in the molecule as glycidyl group via ether and imino bonds. Also, the epoxy compound may be any of monomer, oligomer and polymer, the number of epoxy groups present in the molecule is typically from about 1 to 10, and preferably from 2 to 4. When the epoxy compound is polymer, it may be either of homopolymer or copolymer, and the preferable range of the number average molecular weight thereof is from about 2000 to 20000.

Also, acid anhydride used for the invention is the compound having at least acid anhydride group represented by the following structure formula.

—CO—O—CO—

The acid anhydride used for the invention could be having one or more of such acid anhydride groups, and the number of acid anhydride groups, molecular weight and the others are not limited.

The above epoxy compounds and acid anhydride may be used alone or in combination of two or more. The addition amount thereof is not especially limited, but the range of $1\times10^{-6}$ to $1\times10^{-2}$ mol/m$^2$ is preferable, and the range of $1\times10^{-5}$ to $1\times10^{-3}$ mol/m$^2$ is more preferable.

In the present invention, the epoxy compound and acid anhydride can be added to any layer of the photosensitive layer side of the support such as the photosensitive layer, surface protection layer, intermediate layer, anti-halation layer and under coating layer, and can be added to one or two or more layers of these layers.

[Color Tones of Images]

Next, described are color tones of the images obtained by thermally developing the photothermographic imaging materials.

Concerning the color tone of the output images for medical diagnosis such as X-ray films in earlier technology, it is said that more accurate diagnostic observation results of the recorded image are easily obtained for interpreting persons in image tone with cooler tone. Here, it is said that the image tone with cool tone is blue-black tone where pure black or black images take on a blue tinge and that the image tone with warm tone is warm-black tone where black images take on a brown tinge. But, so as to perform more strict and quantitative discussions, the color tones are described below on the basis of the expression recommended by International Commission on Illumination (CIE, Commission Internationale de l'Eclairage).

The terms for the color tones, "cooler tone" and "warmer tone" can be expressed by a hue angle, $h_{ab}$ at the minimum density Dmin and at the optical density D=1.0. That is, the hue angle $h_{ab}$ is obtained by the following formula using color coordinates, a* and b* in a color space, L*a*b* which is the color space with perceptually nearly equal paces, recommended by International Commission on Illumination (CIE) in 1976.

$$h_{ab}=\tan^{-1}(b^*/a^*)$$

As a result of investigating by the expression on the basis of the above hue angle, it has been found that the color tone of the silver salt photothermal photographic imaging material according to the invention after the development is preferably in the range of hue angle $h_{ab}$ of 180 degree $<h_{ab}<270$ degree, more preferably 200 degree $<h_{ab}<270$ degree, and most preferably 220 degree $<h_{ab}<260$ degree. This is disclosed in JP-A-2002-6463.

It has been known in earlier technology that diagnostic images with visually preferable color tone are obtained by adjusting u* and v* or a* and b* at the color space CIE 1976 (L*u*v*) or (L*a*b*) at the optical density of around 1.0 to the certain numerical values, and for example it is described in JP-A-2000-29164.

However, for the silver salt photothermal photographic imaging materials according to the invention, as a result of further intensive study, it has been found to have diagnosability equivalent to or more than that of the wet type silver salt imaging materials in earlier technology by adjusting a linear regression straight line to the certain range when the linear regression straight line is made by plotting u* and v* or a* and b* at various photographic densities on a graph where a horizontal axis is made u* or a* and a vertical axis is made v* or b* in CIE 1976 (L*u*v*) color space or (L*a*b*) color space. The preferable ranges are described below.

(1) It is preferable that a coefficient of determination (multiple determination) $R^2$ of the linear regression straight line is 0.998 or more and 1.000 or less when the linear regression straight line is made by measuring each density at the optical density of 0.5, 1.0, 1.5 and the minimum of the silver image obtained after the thermal development processing of the photothermal photographic imaging material and disposing u* and v* at the above each optical density on two dimensional coordinates where the horizontal axis is made u* and the vertical axis is made v* of the CIE 1976 (L*u*v*) color space.

Further it is preferred that a v* value of an intersecting point of the linear regression straight line with the vertical axis is −5 or more and 5 or less and a slope (v*/u*) is 0.7 or more and 2.5 or less.

(2) Also it is preferable that the coefficient of determination (multiple determination) $R^2$ of a linear regression straight line is 0.998 or more and 1.000 or less when the linear regression straight line is made by measuring each density at the optical density of 0.5, 1.0, 1.5 and the minimum of the imaging material and disposing a* and b* at the above each optical density on two dimensional coordinates where the horizontal axis is made a* and the vertical axis is made b* of the CIE 1976 (L*a*b*) color space.

Further, it is preferred that a b* value of an intersecting point of the linear regression straight line with the vertical axis is −5 or more and 5 or less and a slope (b*/a*) is 0.7 or more and 2.5 or less.

Next, described is the method for making the above linear regression straight line, i.e., one example of the method for measuring u*, v* and a*, b* in the CIE 1976 color space.

A four stage wedge sample including an unexposed part and parts of the optical density of 0.5, 1.0 and 1.5 is made using the thermal development apparatus. Each wedge density made in this way is measured using a spectral calorimeter (e.g., CM-3600 d supplied from Minolta Co., Ltd.), and u*, v* or a*, b* are calculated. As a measurement condition at that time, a light source is F7 light source, an angle of field is 10°, and the measurement is carried out in a transmission measurement mode. The measured u*, v* or a*, b* are plotted on the graph where the horizontal axis is made u* or a* and the vertical axis is made v* or b* to obtain the linear regression straight line, from which the coefficient of determination (multiple determination) $R^2$, an intercept and the slope are obtained.

Next, described are specific methods for obtaining the linear regression straight line with the above characteristics.

In the invention, it is possible to optimize the developed silver shape and make the preferable color tone by regulating the addition amounts of the compounds directly and indirectly involved in the development reaction process, such as the following toning agent, developer, silver halide grains and aliphatic silver carboxylate and the like. For example, when the developed silver shape is made into dendrite, the image is prone to take on a blue tinge and when it is made into filament, the image is prone to take on a yellow tinge. That is, the color tone can be regulated by considering such tendencies of the developed silver shape.

In earlier technology, as the toning agents, phthalazinone or phthalazine and phthalic acids, phthalic acid anhydrides are generally used. Examples of the suitable toning agents are disclosed in RD 17029, U.S. Pat. Nos. 4,123,282, 3,994,732, 3,846,136 and 4,021,249.

In the Formula (J), $R_5$ represents a monovalent substituent except a hydrogen atom. Examples of the substituents represented by $R_5$ include alkyl groups (the number of carbons is preferably from 1 to 20, more preferably from 1 to 12 and still preferably from 1 to 8, e.g., methyl, ethyl, n-propyl, isopropyl, n-butyl, isobutyl, tert-butyl, n-octyl, n-decyl, n-hexadecyl, cyclopropyl, cyclohexyl, etc.), alkenyl groups (the number of carbons is preferably from 2 to 20, more preferably from 2 to 12 and still preferably from 2 to 8, e.g., vinyl, allyl, 2-butenyl, 3-pentenyl, etc.), alkynyl groups (the number of carbons is preferably from 2 to 20, more preferably from 2 to 12 and still preferably from 2 to 8, e.g., propargyl, 3-pentinyl, etc.), aryl groups (the number of carbons is preferably from 6 to 30, more preferably from 6 to 20 and still preferably from 6 to 12, e.g., phenyl, p-methylphenyl, naphthyl, etc.), aralkyl groups (the number of carbons is preferably from 7 to 30, preferably from 7 to 20, more preferably from 7 to 12, and still preferably from 1 to 8, e.g., benzyl, α-methylbenzyl, 2-phenylethyl, naphthylmethyl, (4-methylphenyl)methyl, etc.), amino groups (the number of carbons is preferably from 0 to 20, more preferably from 0 to 10 and still preferably from 0 to 6, e.g., amino, methylamino, diethylamino, dibenzylamino, etc.), alkoxy groups (the number of carbons is preferably from 1 to 20, more preferably from 1 to 12 and still preferably from 1 to 8, e.g., methoxy, ethoxy, butoxy, etc.), aryloxy groups (the number of carbons is preferably from 6 to 20, more preferably from 6 to 16 and still preferably from 6 to 12, e.g., phenyloxy, 2-naphthyloxy, etc.), acyl groups (the number of carbons is preferably from 1 to 20, more preferably from 1 to 16 and still preferably from 1 to 12, e.g., acetyl, benzoyl, formyl, pivaloyl, etc.), alkoxycarbonyl groups (the number of carbons is preferably from 2 to 20, more preferably from 2 to 16 and still preferably from 2 to 12, e.g., methoxycarbonyl, ethoxycarbonyl, etc.), aryloxycarbonyl groups (the number of carbons is preferably from 7 to 20, more preferably from 7 to 16 and still preferably from 7 to 10, e.g., phenyloxycarbonyl, etc.), acyloxy groups (the number of carbons is preferably from 2 to 20, more preferably from 2 to 16 and still preferably from 2 to 10, e.g., acetoxy, benzoyloxy, etc.), acylamino groups (the number of carbons is preferably from 2 to 20, more preferably from 2 to 16 and still preferably from 2 to 10, e.g., acetylamino, benzoylamino, etc.), alkoxycarbonylamino groups (the number of carbons is preferably from 2 to 20, more preferably from 2 to 16 and still preferably from 2 to 12, e.g., methoxycarbonylamino, etc.), aryloxycarbonylamino groups (the number of carbons is preferably from 7 to 20, more preferably from 7 to 16 and still preferably from 7 to 12, e.g., phenyloxycarbonylamino, etc.), sulfonylamino groups (the number of carbons is preferably from 1 to 20, more preferably from 1 to 16 and still preferably from 1 to 12, e.g., methanesulfonylamino, benzenesulfonylamino, etc.), sulfamoyl groups (the number of carbons is preferably from 0 to 20, more preferably from 0 to 16 and still preferably from 0 to 12, e.g., sulfamoyl, methylsulfamoyl, dimethylsulfamoyl, phenylsulfamoyl, etc.), carbamoyl groups (the number of carbons is preferably from 1 to 20, more preferably from 1 to 16 and still preferably from 1 to 12, e.g., carbamoyl, methylcarbamoyl, diethylcarbamoyl, phenylcarbamoyl, etc.), alkylthio groups (the number of carbons is preferably from 1 to 20, more preferably from 1 to 16 and still preferably from 1 to 12, e.g., methylthio, ethylthio, etc.), arylthio groups (the number of carbons is preferably from 6 to 20, more preferably from 6 to 16 and still preferably from 6 to 12, e.g., phenylthio, etc.), sulfonyl groups (the number of carbons is preferably from 1 to 20, more preferably from 1 to 16 and still preferably from 1 to 12, e.g., mesyl, tosyl, etc.), sulfinyl groups (the number of carbons is preferably from 1 to 20, more preferably from 1 to 16 and still preferably from 1 to 12, e.g., methanesulfinyl, benzenesulfinyl, etc.), ureido groups (the number of carbons is preferably from 1 to 20, more preferably from 1 to 16 and still preferably from 1 to 12, e.g., ureido, methylureido, phenylureido, etc.), phosphate-amide groups (the number of carbons is preferably from 1 to 20, more preferably from 1 to 16 and still preferably from 1 to 12, e.g., diethyl phosphate-amide, phenyl phosphate-amide, etc.), hydroxy, mercapto groups, halogen atoms (e.g., fluorine, chlorine, bromine and iodine atoms), cyano, sulfo, carboxyl, nitro, hydroxsamate, sulfino, hydrazino, heterocyclic groups (e.g., imidazolyl, pyridyl, furyl, piperidyl, morpholino, etc.) and the like. These substituents may be further substituted with the other substituents.

$R_5$ is preferably alkyl, alkenyl, alkynyl, aryl, aralkyl, acyl, alkoxycarbonyl, aryloxycarbonyl, acyloxy, acylamino, alkoxycarbonylamino, aryloxycarbonylamino, sulfonylamino, sulfamoyl, carbamoyl, sulfonyl, sulfinyl, hydroxy groups, halogen atoms, and cyano groups, more preferably alkyl, aryl, aralkyl, acyl, hydroxy groups, halogen atoms and cyano groups, still preferably hydrogen atoms, alkyl, aryl, aralkyl groups and halogen atoms, and especially preferably alkyl, aryl and aralkyl groups.

And, m2 represents an integer of 1 to 6, is more preferably 3 or less, and still preferably 2 or less. $(R_5)_{m2}$ indicates that 1 to 6 $R_5$ are each independently present on a phthalazine ring. When m2 is 2 or more, adjacent two $R_5$ may form an aliphatic or aromatic ring. The aliphatic ring is preferably the 3- to 8-membered ring, and more preferably the 5- to 6-membered ring. The aromatic ring is preferably benzene or naphthalene ring. The aliphatic or aromatic ring may be the heterocyclic ring, and preferably the 5- to 6-membered ring.

The methods for producing the phthalazine compounds represented by the Formula (J) include the method where a phthalazine skeleton is formed by condensing a corresponding phthalic acid derivative (phthalaldehyde, phthalic acid anhydride, phthalate ester, etc.) with hydrazine, the method where phthalazine is synthesized by condensing α,α,α',α'-tetrachloro-o-xylene with hydrazine as described in R. G. Elderfield, "Heterocyclic Compounds" (John Wily and Son, Vol 1 to 9, 1950 to 1967) and A. R. Katritzky, "Comprehensive Heterocyclic Chemistry" (Pergamon Press, 1984), the method for cyclizing and producing by reacting an aryl aldazine derivative with a mixture of aluminium chloride and aluminium bromide under a melting condition as described in Tetrahedron Letters, 22:245, 1981, and the method for synthesizing by cyclizing the aldazine compound in the organic solvent with aluminium chloride catalyst as described in JP-A-11-180961. Hereinafter, specific examples of the phthalazine compounds represented by the Formula (J) are shown, but the phthalazine compounds used for the invention are not limited thereto.

J-1

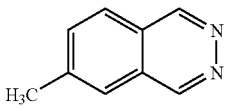

J-2

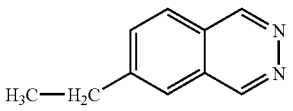

J-3

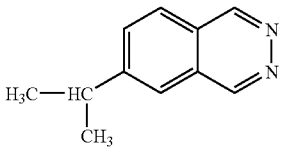

J-4

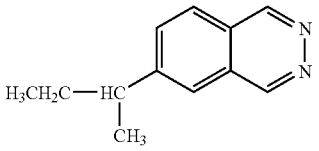

J-5

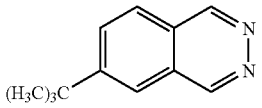

-continued

J-6

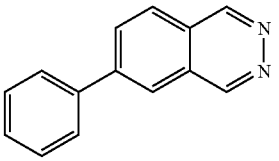

J-7

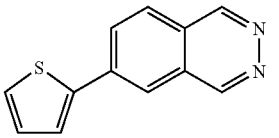

J-8

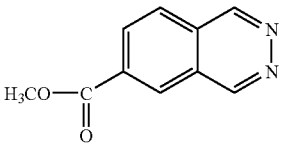

J-9

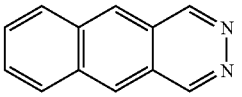

J-10

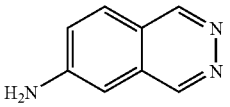

The use amount of the phthalazine compound represented by the Formula (J) is preferably from $10^{-4}$ to 1 mol, more preferably from $10^{-3}$ to 0.3 mol, and still preferably from $10^{-2}$ to 0.3 mol per mol of the silver. The phthalazine compound represented by the Formula (J) may be added by any methods such as solution, powder, solid fine particle dispersion, emulsion and oil protected dispersion. Solid fine particle dispersing is carried out by the pulverizing means known in the art (e.g., a ball mill, vibrating ball mill, sand mill, colloidal mill, jet mill, roller mill, etc.). A dispersing aid may be used when the solid fine particle dispersing is carried out. The phthalazine compound represented by the Formula (J) may be added to any layer at the same face as the photosensitive silver halide and the reducible silver salt on the support, but it is preferable to add to the layer comprising the silver halide or the layer adjacent thereto.

It is also possible to regulate the color tone using the couplers disclosed in JP-A-11-2888057 and EP1134611A2 and the leuco dyes described above in addition to such toning agents. Especially, it is preferable to use the leuco dyes for fine control of the color tone.

The photothermographic imaging materials of the invention are those where photographic images are formed by thermal development, and it is preferred that a toning agent which regulates color tone of the silver if necessary is usually contained in (organic) binder matrix at the dispersed state.

The suitable toning agents used for the invention are disclosed in RD 17029, U.S. Pat. Nos. 4,123,282, 3,994,732, 3,846,136 and 4,021,249, and for example, include the followings.

Included are imides (e.g., succinimide, phthalimide, naphthalimide, N-hydroxy-1,8-naphthalimide); mercaptans (e.g., 3-mercapto-1,2,4-triazole); phthalazine derivatives or metallic salts of these derivatives (e.g., phthalazine, 4-(1-naphthyl) phthalazine, 6-chlorophthalazine, 5,7-dimethyloxyphthalazine and 2,3-dihydro-1,4-phthalazione); the combination of phthalazine and phthalic acid (e.g., phthalic acid, 4-methylphthalic acid, 4-nitrophthalic acid and tetrachlorophthalic acid); and the combination of phthalazine, maleic acid anhydride and at least one compound selected from phthalic acid, 2,3-naphthalene dicarboxylate or o-phenylenic acid derivatives and anhydrides thereof (e.g., phthalic acid, 4-methylphthalic acid, 4-nitrophthalic acid and tetrachlorophthalic acid anhydride). Especially preferable toning agents are phthalazine or the combination of phthalazine with phthalic acid, phthalic acid anhydride.

[Chemical Sensitizer]

Next, described are chemical sensitizers which are given to the photosensitive silver halide grains according to the invention. Photosensitization was given to the photosensitive silver halide of the invention. Specifically, chalcogen sensitization and/or gold sensitization are given, and each preferable sensitizer is selected from the compounds in four groups of (5) sulfur sensitizers (which are represented by Formulas (5-1) to (5-3), or which have nuclei represented by Formulas (5-4) to (5-6)), (6) selenium sensitizers (which are represented by Formulas (6-1) and (6-2)), (7) tellurium sensitizers (which are represented by Formulas (7-1) to (7-6)) and (8) gold sensitizers (which are represented by Formula (8)). The compounds represented by each Formula are described.

In the invention, preferable are tellurium sensitizers described in the above (7) among the chalcogen sensitizers described in the above (5) to (7). More preferably, when combined are gold sensitizers represented by the Formula (8), remarkable sensitization effects and improvement effects of the maximum density are obtained.

A time to give the chemical sensitization of the invention can be selected from the given time from the stage immediately after the photosensitive silver halide particle formation to the stage of a coating solution just before coating, but preferably is a meantime from the completion of desalt after the silver halide particle formation to the addition of coating solution. More preferably, the chemical sensitization is given to the photosensitive silver halide grains, which are then added to and mixed with non-photosensitive aliphatic silver carboxylate particles or the coating solution.

First, sulfur sensitizers are described.

The sulfur-containing chemical sensitizer useful for the invention is a substituted thiourea ligand represented by the above Formula (5-1), (5-2) or (5-3) comprising one or more —S═C(—N<)N< groups having four nitrogen valences substituted with hydrogen or aliphatic substituents which are the same or different. More preferably, four nitrogen valences are substituted with the same aliphatic substituents.

In the above Formula (5-1), $R_{01}$, $R_{02}$, $R_{03}$ and $R_{04}$ independently represent hydrogen, substituted or unsubstituted alkyl groups (including alkylenearyl groups such as benzyl), substituted or unsubstituted aryl groups (including arylenealkyl groups), substituted or unsubstituted cycloalkyl groups, substituted or unsubstituted alkenyl groups, substituted or unsubstituted alkynyl groups and heterocyclic groups.

The useful alkyl groups are branched or straight and can have from 1 to 20 carbon atoms (preferably have from 1 to 5 carbon atoms), the useful aryl groups can have from 6 to 14 carbon atoms in a carbon ring, the useful cycloalkyl groups can have from 5 to 14 carbon atoms in a central ring system, the useful alkenyl and alkynyl groups can be branched or straight and can have from 2 to 20 carbon atoms, and the useful heterocyclic groups can have from 5 to 10 carbon, oxygen, sulfur and nitrogen atoms in the central ring system (can also have condensed rings).

These various monovalent groups can be further substituted with one or more groups which are not limited but include halogen atoms, alkoxycarbonyl, hydroxy, alkoxy, cyano, acyl, acyloxy, carbonyloxyester, sulfonate ester, alkylthio, dialkylamino, carboxylate, sulfonate, hydroxyamino, sulfo, phosphono groups and the other groups which are easily apparent to those skilled in the art. It is possible that $R_{01}$, $R_{02}$, $R_{03}$ and $R_{04}$ are independently alkyl groups.

Or it is possible that $R_{01}$ and $R_{03}$ together, $R_{02}$ and $R_{04}$ together, $R_{01}$ and $R_{02}$ together, or $R_{03}$ and $R_{04}$ together form a substituted or unsubstituted 5- or 7-membered heterocyclic ring.

When $R_{01}$ and $R_{03}$ together, or $R_{02}$ and $R_{04}$ together are bound, the heterocyclic ring can be saturated or unsaturated, and it is possible to comprise oxygen, nitrogen or sulfur atoms in addition to carbon atoms. Useful rings of this type include, but are not limited to, imidazole, pyrroline, pyrrolidine, thiohydantoin, pyridone, morpholine, piperazine and thiomorpholine rings. It is possible to substitute these rings with one or more alkyl (1 to 5 carbons), aryl (6 to 10 carbons in the central ring system), cycloalkyl (5 to 10 carbons in the central ring system), alkoxy, carbonyloxyester, halo, cyano, hydroxy, acyl, alkoxycarbonyl, sulfonate ester, alkylthio, carbonyl, carboxylate, sulfonate, hydroxylamino, sulfo, phosphono groups and the other groups which are easily apparent to those skilled in the art.

When $R_{01}$ and $R_{02}$ together, or $R_{03}$ and $R_{04}$ together are bound, the heterocyclic ring can be saturated or unsaturated, and it is possible to comprise oxygen, nitrogen or sulfur atoms in addition to carbon atoms. Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3,5-triazine-2 (1H)-thione, dihydro-2-thioxo-4,6-(1H, 3H)-pyrimidinedione, dihydro-1,3,5-triazine-2,4-(1H, 3H)-dione and hexahydro-diazepine-2-thione rings. It is possible to substitute these rings with one or more alkyl (1 to 5 carbons), aryl (6 to 10 carbons in the central ring system), cycloalkyl (5 to 10 carbons in the central ring system), carbonyloxyester, halo, cyano, hydroxy, acyl, alkoxycarbonyl, sulfonate ester, alkylthio, carbonyl, alkoxy, carboxylate, sulfonate, hydroxylamino, sulfo, phosphono groups and the other groups which are easily apparent to those skilled in the art.

Preferably, $R_{01}$, $R_{02}$, $R_{03}$ and $R_{04}$ independently represent alkyl, alkenyl, alkynyl, aryl and heterocyclic groups, more preferably alkyl, aryl and alkenyl groups, and most preferably alkenyl groups. The preferable alkenyl group is allyl group. The preferable alkyl group is methyl group. Also especially useful is sulfur-containing 1,1,3,3-tetra substituted thiourea compounds having carboxylate group, sulfonate group or the other acid group having the acid dissociation constant (pKa) of less than 7.

In the Formula (5-2) of the invention, $R_{01}$, $R_{02}$, $R_{03}$, $R_{04}$ and $R_{05}$ have the same definitions as those described for $R_{01}$, $R_{02}$, $R_{03}$ and $R_{04}$ in the Formula (5-1), but are different in the following points.

It is possible that $R_{01}$ and $R_{03}$ together, $R_{02}$ and $R_{04}$ together, $R_{03}$ and $R_{05}$ together, and/or $R_{04}$ and $R_{05}$ together form a substituted or unsubstituted 5- or 7-membered heterocyclic ring (those described for the Formula (5-1)). When these heterocyclic rings are formed by combining $R_{01}$ and $R_{03}$ together, or combining $R_{02}$ and $R_{04}$ together, such heterocyclic rings can have substituents such as alkoxy and dialkylamino groups, and carboxylate, sulfonate, hydroxylamino, sulfo, phosphono and the other acid groups. When these heterocyclic rings are formed by combining $R_{03}$ and $R_{05}$ together, or combining $R_{04}$ and $R_{05}$ together, such heterocyclic rings can be substituted as described for $R_{01}$ and $R_{03}$ in the Formula (5-1). Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3,5-triazine-2 (1H)-thione, dihydro-2-thioxo-4,6-(1H, 3H)-pyrimidinedione, dihydro-1,3,5-triazine-2,4-(1H, 3H)-dione and hexahydrodiazepine-2-thione rings.

For the Formula (5-2), preferable groups for $R_{01}$ to $R_{05}$ are hydrogen, alkyl, alkenyl, alkynyl, aryl and heterocyclic groups, more preferably alkyl, aryl and alkenyl, and most preferably alkenyl groups. The preferable alkenyl is allyl group.

Also, in the Formula (5-2), the most preferable alkyl groups are methyl and ethyl groups. The most preferable aryl groups are phenyl and tolyl groups. The most preferable cycloalkyl groups are cyclopentyl and cyclohexyl groups. The most preferable alkenyl group is allyl group. The most preferable heterocyclic groups are morpholino and piperazino groups.

In the Formula (5-3) of the invention, $R_{01}$, $R_{02}$, $R_{03}$, $R_{04}$, $R_{05}$ and $R_{06}$ have the same definitions as those described for $R_{01}$, $R_{02}$, $R_{03}$, $R_{04}$ and $R_{05}$ in the Formula (5-2). Further, it is possible that $R_{03}$ and $R_{06}$ together, $R_{04}$ and $R_{05}$ together, $R_{01}$ and $R_{03}$ together, $R_{02}$ and $R_{04}$ together, or $R_{05}$ and $R_{06}$ together form a substituted or unsubstituted 5- or 7-membered heterocyclic ring as described for the heterocyclic rings in the Formula (5-2).

$R_{07}$ is not limited to, but is a substituted or unsubstituted alkylene group with 1 to 12 carbons, a substituted or unsubstituted cycloalkylene group with 5 to 8 carbons in a cyclic structure, a substituted or unsubstituted arylene group with 6 to 10 carbons in the cyclic structure, a substituted or unsubstituted bivalent heterocyclic group having 5 to 10 carbon, nitrogen, oxygen and sulfur in the cyclic structure, or a combination of two or more of these bivalent groups, or a bivalent aliphatic or alicyclic linkage group comprising two or more of these group connected via ether, thioether, carbonyl, carbonamide, sulfoamide, amino, imide, thiocarbonyl, thioamide, sulfinyl, sulfonyl or phosphinyl group. Preferably $R_{07}$ is a substituted or unsubstituted alkylene group with at least 2 carbons.

Representative examples of the compounds represented by the Formula (5-1) to (5-3) are as follows.

5-1-1

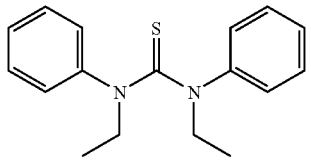

-continued 5-1-2

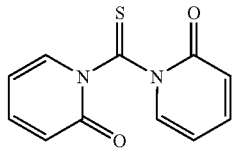

5-1-3

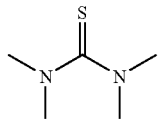

5-1-4

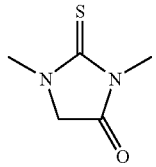

5-1-5

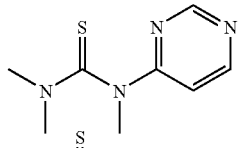

5-1-6

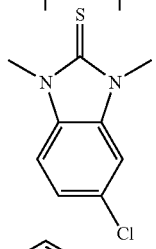

5-1-7

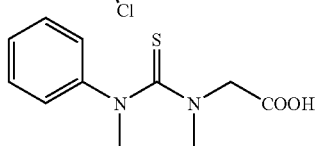

5-1-8

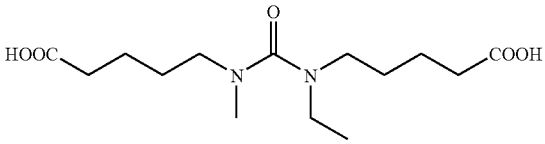

5-1-9

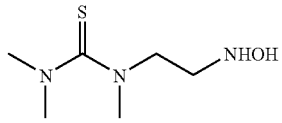

5-1-10

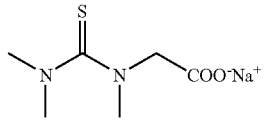

5-2-1

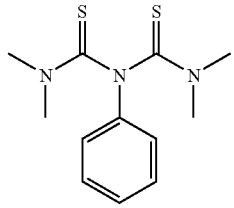

-continued
5-2-2
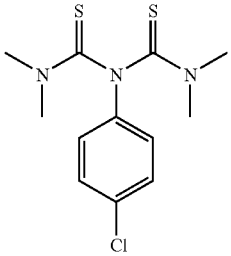
5-2-3
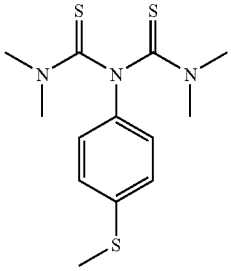
5-2-4
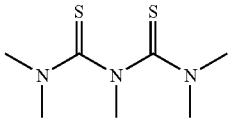
5-2-5
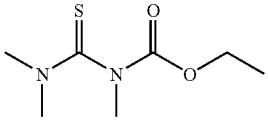
5-2-6
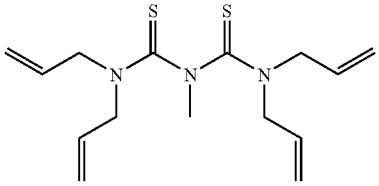
5-2-7
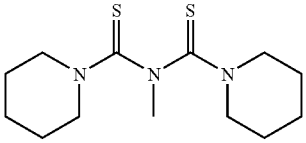
5-2-8
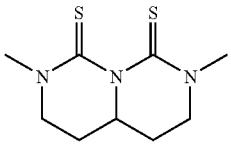
5-2-9
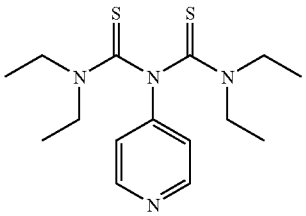
-continued
5-2-10
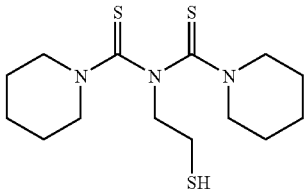
5-2-11
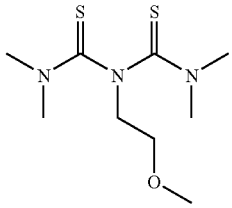
5-2-12
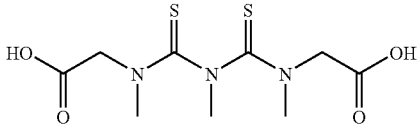
5-3-1
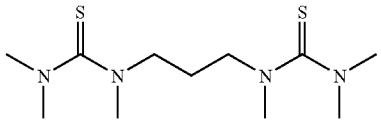
5-3-2
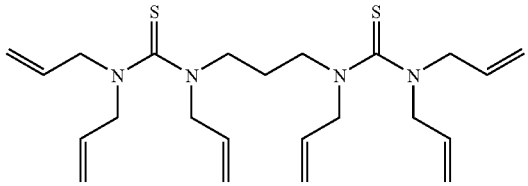
5-3-3
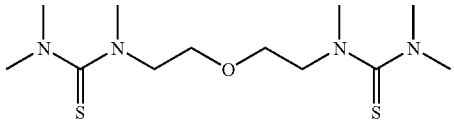
5-3-4
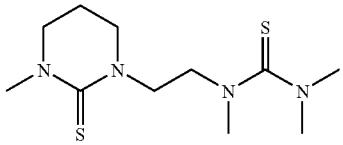
5-3-5
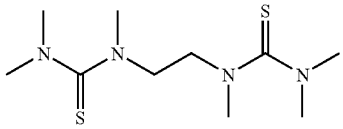
5-3-6
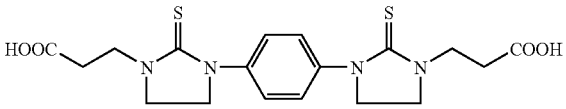
5-3-7
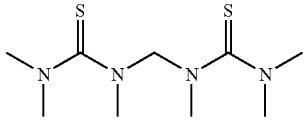

-continued 5-3-8

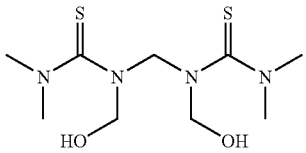

In the invention, it is possible to use the compounds described in JP-A-2002-278019 in addition to the above specific compounds.

Another type of the sulfur-containing chemical sensitizers useful for the invention is the compound where the sulfur atoms are directly bound to a ring in a structure, especially a dyestuff structure, and more preferably the compound where at least some sulfur atoms are bounds as thiocarbonyl group (i.e., >C═S) or —S— group in the actual ring structure of the compound or are incorporated therein. The compounds where both types of sulfur are disposed [i.e., both >C═S and —S— or —S—(C═S—] are desirable for the implementation of the invention. In some cases, the sulfur-containing compounds are the organic sulfur-containing compounds known in the art as dyestuffs for spectral sensitization. Such compounds are described in, for example, U.S. Pat. No. 5,891,615 (Winslow et al). This patent is incorporated herein by reference. When such compounds are decomposed in an oxidative environment, they bring chemical sensitization but not spectral sensitization. In such an embodiment, the method for preparing a photothermographic emulsion further comprises adding the second dyestuff for the spectral sensitization to the photothermographic emulsion in order to spectrally sensitize the silver halide grains.

The preferable sulfur-containing compounds for the chemical sensitization contain thiohydantoin, rhodamine or 2-thio-4-oxo-oxazolidine nucleus. These nuclei are represented by the above structures (5-4), (5-5) and (5-6). Representative example compounds are shown below.

5-4-1

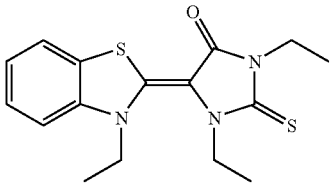

5-4-2

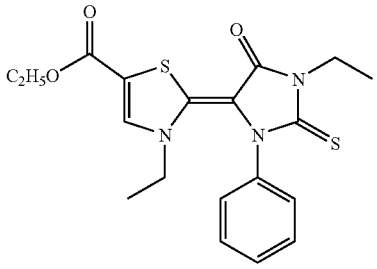

-continued 5-5-1

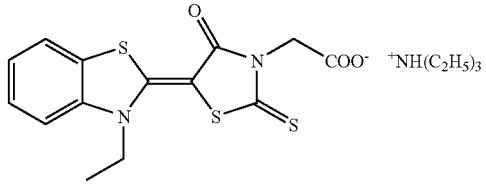

5-5-2

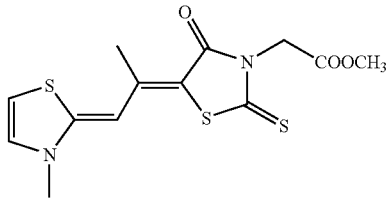

5-5-3

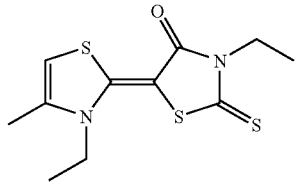

5-5-4

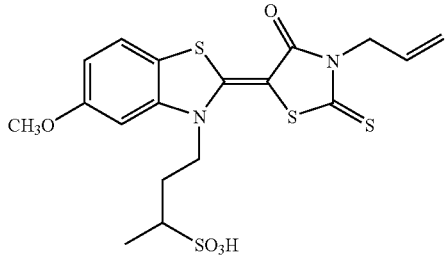

5-5-5

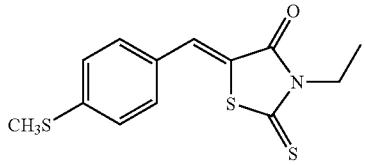

5-5-6

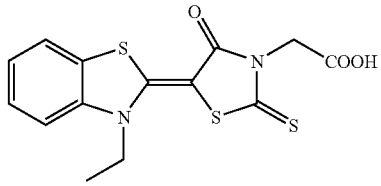

5-5-7

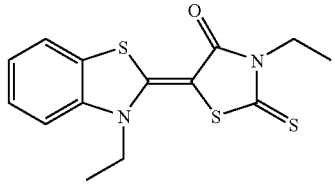

-continued 5-5-8

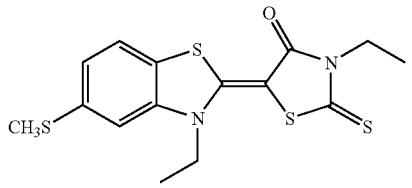

5-5-9

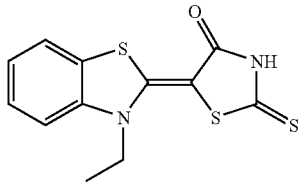

5-6-1

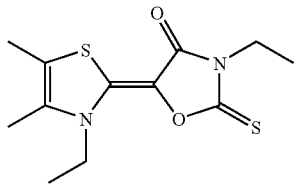

Useful sulfur-containing chemical sensitizers can be purchased from many commercial suppliers (Aldrich Chemical Co., etc.), or can be prepared using easily available starting materials and the procedure known in the art. The starting materials and the procedures are as described in, for example, Belgium Patent No. 813,926 (May 27, 1959), Schroeder, Chem. Rev., pages 181 to 228, 1955, Barluenga et al., Comprehensive Organic Functional Group Transformations, Vol. 6, pages 569 to 585, 1995 (edited by Katrisky et al) and the references cited therein, and Karkhanis et al., Phosphorous and Sulfur, pages 49 to 57, 1985.

Next, selenium sensitizers are described.

In the above Formula (6-1), $Z_{01}$ and $Z_{02}$ may be the same or different, and represent alkyl, alkenyl, aryl, heterocyclic groups, —$NA_1(A_2)$, —$OA_3$ or —$SA_4$. Here, $A_1$, $A_2$, $A_3$ and $A_4$ may be the same or different, and represent alkyl, aryl, and heterocyclic groups. But $A_1$ and $A_2$ may be hydrogen atoms or acyl groups.

Preferably $Z_{01}$ represents alkyl, aryl, or —$NA_1$ ($A_2$), and $Z_{02}$ represents —$NA_5$ ($A_6$). $A_1$, $A_2$, $A_5$ and $A_6$ may be the same or different, and represent hydrogen atom, alkyl, aryl or acyl groups.

In the Formula (6-1), more preferably N,N-dialkyl selenourea, N,N,N'-trialkyl-N'-acyl selenourea, tetraalkyl selenourea, N,N-dialkyl-aryl seleno-amide, and N-alkyl-N-aryl-aryl seleno-amide are represented.

In the Formula (6-2), $Z_3$, $Z_4$ and Zs may be the same or different, and represent aliphatic groups, aromatic groups, heterocyclic groups, —$OA_7$, —$NA_8$(Ag), or —$SA_{10}$, —$SeA_{11}$, $Y_2$ or hydrogen atoms. $A_7$, $A_{10}$ and $A_{11}$ represent aliphatic groups, aromatic groups, heterocyclic groups, hydrogen atoms or cations, A8 and A9 represent aliphatic groups, aromatic groups, heterocyclic groups, or hydrogen atoms, and $Y_2$ represents a halogen atom.

The aliphatic groups represented by $Z_3$, $Z_4$, $Z_5$, $A_7$, $A_8$, $A_{10}$ and All represent straight, branched or cyclic alkyl, alkenyl, alkynyl and aralkyl groups (e.g., methyl, ethyl, n-propyl, t-butyl, n-butyl, n-octyl, n-decyl, n-hexadecyl, cyclopentyl, cyclohexyl, allyl, 2-butenyl, 3-pentenyl, propargyl, 3-pentinyl, benzyl, phenetyl).

In the Formula (6-2), the aromatic groups represented by $Z_3$, $Z_4$, $Z_5$, $A_7$, $A_8$, $A_{10}$ and $A_{11}$ represent monocyclic or condensed cyclic aryl groups (e.g., phenyl, pentafluorophenyl, 4-chlorophenyl, 3-sulfophenyl, α-naphthyl, 4-methylphenyl).

In the Formula (6-2), the heterocyclic groups represented by $Z_3$, $Z_4$, $Z_5$, $A_7$, $A_8$, $A_9$, $A_{10}$ and $A_{11}$ represent 3- to 10-membered saturated or unsaturated heterocyclic groups comprising at least one of nitrogen, oxygen or sulfur atoms (e.g., pyridyl, thienyl, furyl, thiazolyl, imidazolyl, benzimidazolyl).

In the Formula (6-2), the cations represented by $A_7$, $A_{10}$ and $A_{11}$ represent alkali metallic atoms or ammonium, and the halogen atom represented by $Y_2$ represents, for example, fluorine, chlorine, bromine or iodine atom.

In the Formula (6-2), preferably $Z_3$, $Z_4$ or $Z_5$ represents an aliphatic group, aromatic group or —$OA_7$, and $A_7$ represents an aliphatic group or aromatic group.

In the Formula (6-2), more preferably, trialkylphosphine selenide, triarylphosphine selenide, trialkylseleno phosphate, or triarylseleno phosphate is represented.

Specific examples of the selenium sensitizers represented by the Formula (6-1) and (6-2) are shown below.

6-1-1

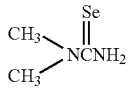

6-1-2

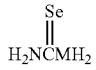

6-1-3

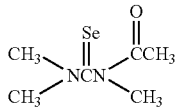

6-1-4

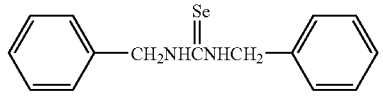

6-1-5

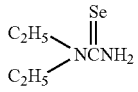

6-1-6

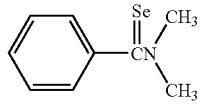

6-1-7

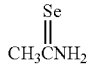

6-1-8

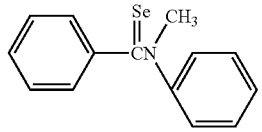

6-1-9

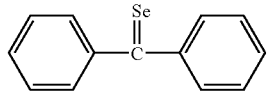

-continued 6-1-10

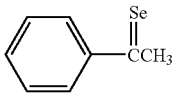

6-2-1

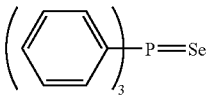

6-2-2

$((n)C_4H_8)_3P{=}Se$ 6-2-3

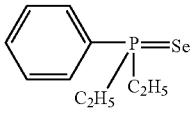

6-2-4

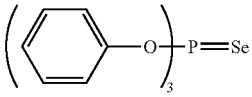

6-2-5

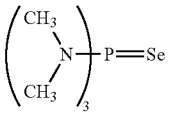

6-2-6

$(C_2H_5O)_3P{=}Se$ 6-2-7

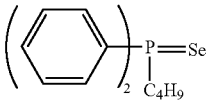

6-2-8

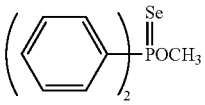

6-2-9

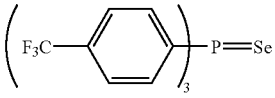

6-2-10

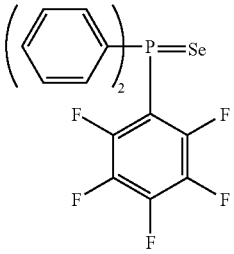

As the other examples of the selenium sensitizers, it is possible to use the compounds described in JP-A-5-45769.

In the invention, the selenium sensitizer could be added by dissolving in water or an organic solvent miscible with water (alcohols, esters, amides, etc.). The use amount of the selenium sensitizer varies depending on the silver halide grains used, chemical maturation condition and the like, but generally it is used at the amount of about $1\times10^{-2}$ to $1\times10^{-2}$ mol, and preferably from about $1\times10^{-7}$ to $1\times10^{-3}$ mol per mol of the silver.

Next, tellurium sensitizers are described.

First, the compounds of the above Formula (7-1) are described. In the Formula (7-1), $R_{11}$, $R_{12}$ and $R_{13}$ represent hydrogen atoms, aliphatic groups, aromatic groups, heterocyclic groups, $OR_{14}$, $NR_{15}(R_{16})$, $SR_{17}$, $OsiR_{18}(R_{19})$ $(R_{20})$ or $X_4$. Here, $R_{14}$ and $R_{17}$ represent hydrogen atoms, aliphatic groups, aromatic groups, heterocyclic groups and cations, $R_{15}$ and $R_{16}$ represent hydrogen atoms, aliphatic groups and aromatic groups, $R_{18}$, $R_{19}$ and $R_{20}$ represent aliphatic groups, and $X_4$ represents a halogen atom.

The aliphatic groups represented by $R_{11}$, $R_{12}$, $R_{13}$, $R_{14}$, $R_{15}$, $R_{16}$, $R_{17}$, $R_{18}$, $R_{19}$ and $R_{20}$ are preferably those with 1 to 30 carbons, and especially straight, branched or cyclic alkyl, alkenyl, alkynyl and aralkyl groups with 1 to 20 carbons. As the alkyl, alkenyl, alkynyl and aralkyl groups, for example, included are methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentinyl, benzyl, phenetyl groups and the like.

The aromatic groups represented by $R_{11}$, $R_{12}$, $R_{13}$, $R_{14}$, $R_{15}$, $R_{16}$ and $R_{17}$ are preferably those with 6 to 30 carbons, and especially monocyclic or condensed cyclic aryl groups with 6 to 20 carbons. For example, phenyl and naphthyl groups are included.

The heterocyclic groups represented by $R_{11}$, $R_{12}$, $R_{13}$, $R_{14}$, $R_{15}$, $R_{16}$ and $R_{17}$ are 3- to 10-membered saturated or unsaturated heterocyclic groups comprising at least one of nitrogen, oxygen or sulfur atoms. These may be monocyclic, or may further form a condensed ring with the other aromatic ring or heterocyclic ring. The heterocyclic groups are preferably 5- to 6-membered aromatic heterocyclic groups, and for example include pyridyl, furyl, thienyl, thiazolyl, imidazolyl, benzimidazolyl and the like.

The cations represented by $R_{14}$ and $R_{17}$ represent alkali metals and ammonium.

The halogen atom represented by $X_4$ represents, for example, fluorine, chlorine, bromine and iodine atoms.

Also, these aliphatic groups, aromatic groups and heterocyclic groups may be substituted, and as the substituents, the followings are included. As the representative substituents, for example, included are alkyl, aralkyl, alkenyl, alkynyl, aryl, alkoxy, aryloxy, amino, acylamino, ureido, urethane, sulfonylamino, sulfamoyl, carbamoyl, sulfonyl, sulfinyl, alkyloxycarbonyl, aryloxycarbonyl, acyl, acyloxy, phosphate-amide, diacylamino, imide, alkylthio, arylthio groups, halogen atoms, cyano, sulfo, carboxy, hydroxy, phosphono, nitro and heterocyclic groups. These groups may be further substituted. When there are two or more substituents, they may be the same or different.

$R_{11}$, $R_{12}$ and $R_{13}$ may be bound together to form a ring along with phosphorus atom, and $R_{15}$ and $R_{16}$ may be bound to form a nitrogen-containing heterocyclic ring.

In the Formula (7-1), preferably $R_{11}$, $R_{12}$ and $R_{13}$ represent aliphatic groups or aromatic groups, and more preferably alkyl groups or aromatic groups.

Specific examples of the compounds represented by the Formula (7-1) of the invention are shown below, but the invention is not limited thereto.

7-1-1

$((n)C_4H_9)_3P{=}Te$ 7-1-2

$((i)C_3H_7)_3P{=}Te$

-continued 7-1-3

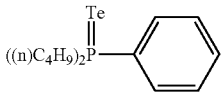

7-1-4

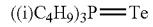

7-1-5

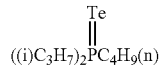

7-1-6

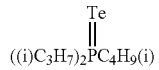

7-1-7

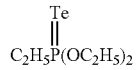

7-1-8

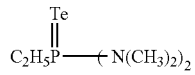

7-1-9

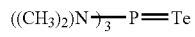

7-1-10

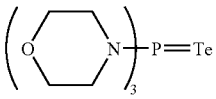

As the other examples of the tellurium sensitizers represented by the Formula (7-1) of the invention, it is possible to use the compounds described in JP-A-5-45769.

Next, the compounds of the above Formula (7-2) are described. In the Formula (7-2), $R_{21}$ represents aliphatic group, aromatic group, heterocyclic group or —$NR_{23}(R_{24})$, and $R_{22}$ represents —$NR_{25}(R_{26})$, —$NR_{27}N(R_{28})R_{29}$ or —$OR_{30}$. Here, $R_{23}$, $R_{24}$, $R_{25}$, $R_{26}$, $R_{27}$, $R_{28}$ $R_{29}$ and $R_{30}$ represent hydrogen atoms, aliphatic groups, aromatic groups, heterocyclic groups or acyl groups. $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, and $R_{23}$ and $R_{30}$ may be bound to form rings.

The aliphatic groups represented by $R_{23}$, $R_{24}$, $R_{25}$, $R_{26}$, $R_{27}$, $R_{28}$, $R_{29}$ and $R_{30}$ are preferably those with 1 to 30 carbons, and especially straight, branched or cyclic alkyl, alkenyl, alkynyl and aralkyl groups with 1 to 20 carbons. As the alkyl, alkenyl, alkynyl and aralkyl groups, for example, included are methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentinyl, benzyl, phenetyl groups and the like.

The aromatic groups represented by $R_{21}$, $R_{22}$, $R_{23}$, $R_{24}$, $R_{25}$, $R_{26}$, $R_{27}$, $R_{28}$, $R_{29}$ and $R_{30}$ are preferably those with 6 to 30 carbons, and especially monocyclic or condensed cyclic aryl groups with 6 to 20 carbons. For example, phenyl and naphthyl groups are included.

The heterocyclic groups represented by $R_{21}$, $R_{22}$, $R_{23}$, $R_{24}$, $R_{25}$, $R_{26}$, $R_{27}$, $R_{28}$, $R_{29}$ and $R_{30}$ are 3- to 10-membered saturated or unsaturated heterocyclic groups comprising at least one of nitrogen, oxygen or sulfur atoms. These may be monocyclic, or further may form a condensed ring with the other aromatic ring or heterocyclic ring. The heterocyclic groups are preferably 5- to 6-membered aromatic heterocyclic groups, and for example include pyridyl, furyl, thienyl, thiazolyl, imidazolyl, benzimidazolyl and the like.

The acyl groups represented by $R_{23}$, $R_{24}$, $R_{25}$, $R_{26}$, $R_{27}$, $R_{28}$, $R_{29}$ and $R_{30}$ are preferably those with 1 to 30 carbons, especially straight or branched acyl groups with 1 to 20 carbons, and for example include acetyl, benzoyl, formyl, pivaloyl, and decanoyl groups.

Here when $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, and $R_{23}$ and $R_{30}$ are bound to form rings, for example, included are alkylene, arylene, aralkylene or alkenylene groups.

Also, these aliphatic groups, aromatic groups and heterocyclic groups may be substituted with the substituents included in the above Formula (7-1).

In the Formula (7-2), preferably, $R_{21}$ represents the aliphatic group and $R_{22}$ represents —$NR_{25}(R_{26})$. $R_{23}$, $R_{24}$, $R_{25}$ and $R_{26}$ represent the aliphatic groups or the aromatic groups.

In the Formula (7-2), more preferably $R_{21}$ represents the aliphatic group or —$NR_{23}(R_{24})$, and $R_{22}$ represents —$NR_{25}(R_{26})$. $R_{23}$, $R_{24}$, $R_{25}$ and $R_{26}$ represent the alkyl groups or the aromatic groups. It is also preferred that $R_{21}$ and $R_{25}$, and $R_{23}$ and $R_{25}$ form the rings via the alkylene, arylene, aralkylene, or alkenylene group.

Specific examples of the compounds represented by the Formula (7-2) of the invention are shown below, but the invention is not limited thereto.

7-2-1

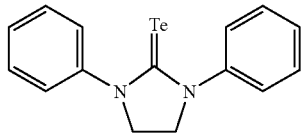

7-2-2

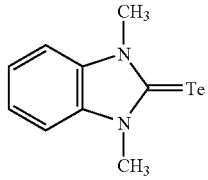

7-2-3

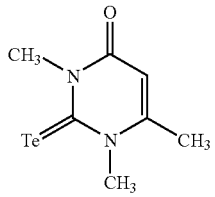

7-2-4

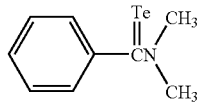

7-2-5

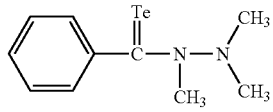

7-2-6

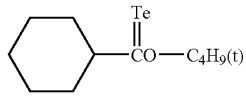

As the other examples of the tellurium sensitizers represented by the Formula (7-2) of the invention, it is possible to use the compounds described in JP-A-5-45769.

Next, the compounds of the above Formula (7-3) to (7-5) are described.

In Formula (7-3), Xs represent the same or different COR, CSR, $CN(R)_2$, CR, $P(R)_2$ or $P(OR)_2$ groups (R is an alkyl group with 1 to 20 carbons, an alkenyl group with 2 to 20 carbons, a carbocyclic or heterocyclic aryl group with 6 to 10 carbons in monocyclic or condensed cyclic system), and those groups are bound to two sulfur atoms via the above carbon or phosphorus atom in the group. Also, p1 is 2 or 4.

In the Formula (7-3), preferably Xs represent the same of different COR, CSR, $CN(R)_2$, $P(R)_2$ or $P(OR)_2$ groups, and more preferably Xs are the same or different $CN(R)_2$ groups. Therefore, it is possible that multiple $X_5$ groups are the same or different groups in the compound of the Formula (7-3).

It is possible that "R" group used to define "$X_5$" is a suitable substituted or unsubstituted alkyl group with 1 to 20 carbons (including all possible isomers such as methyl, ethyl, isopropyl, t-butyl, octyl, decyl, trimethylsilylmethyl and 3-trimethylsilyl-n-propyl), a substituted or unsubstituted alkenyl group with 2 to 20 carbons (including all possible isomers such as ethenyl, 1-propenyl and 2-propenyl), or a substituted or unsubstituted carbocyclic or heterocyclic aryl group (Ar) with 6 to 10 carbons in the monocyclic or condensed cyclic system [phenyl, 4-methylphenyl, anthryl, naphthyl, p-methoxyphenyl, 3,5-dimethylphenyl, p-tolyl, mesityl, pyridyl, xylyl, indenyl, 2,4,6-tri(t-butyl)-phenyl, pentafluorophenyl, p-methoxyphenyl and 2-phenylethyl and the like]. Preferably, R is the substituted or unsubstituted alkyl group with 1 to 8 carbons such as trimethylsilylmethyl and 3-trimethylsilyl-n-propyl. It is possible that multiple R groups are the same groups or different groups in the molecule. Further it is possible that multiple R groups are bound together to form substituted or unsubstituted 5- to 7-membered heterocyclic ring. Also, p1 is 2 or 4, preferably 2.

In the Formula (7-4), $L_2$s represent the same or different ligands derived from neutral Lewis base. $X^1$s represent the same or different halogen atoms, OCN, SCN, $S_2CN(R)_2$, $S_2COR$, $S_2CSRS_2P(OR)_2$, $S_2P(R)_2$, SeCN, TeCN, CN, SR, OR, $N_3$, alkyl groups, aryl groups or $O_2CR$ groups (R is an alkyl group with 1 to 20 carbons, an alkenyl group with 2 to 20 carbons, a carbocyclic or heterocyclic aryl group (Ar) with 6 to 10 carbons in the monocyclic or condensed cyclic system). And, m1 is 0, 1, 2 or 4, and n1 is 2 or 4, provided that n1 is 2 or 4 when m1 is 0 or 2. But n1 is 2 or 4 when m1 is 0 or 2, and n1 is 2 when m1 is 1 or 4.

In the Formula (7-4), preferably $L_2$s are the same or different ligands derived from thiourea or substituted thiourea, and more preferably $L_2$s are the same or different ligands derived from thiourea as defined below. It is possible that multiple $L_2$ groups are the same groups or different groups in the compound of the Formula (7-4).

In the Formula (7-4), preferably $X^1$ represents a halogen atom (chloro or bromo, etc.), SCN or $S_2CN(R)_2$ group, and more preferably $X^1$ represents the halogen atom such as chloro and bromo. It is possible that multiple $X^1$ groups are the same groups or different groups in the compound of the Formula (7-4).

In the Formula (7-4), preferably m1 is 2 and n1 is 2 or 4.

In the Formula (7-5), $X^2$ represents halogen atom, OCN, SCN, $S_2CN(R)_2$, $S_2COR$, $S_2CSRS_2P(OR)_2$, $S_2P(R)_2$, SeCN, TeCN, CN, SR, OR, $N_3$, alkyl group, aryl group or $O_2CR$ group. Here, R is an alkyl group with 1 to 20 carbons, an alkenyl group with 2 to 20 carbons, a carbocyclic or heterocyclic aryl group with 6 to 10 carbons in the monocyclic or condensed cyclic system. R' represents an alkyl or aryl group.

In the Formula (7-5), preferably $X^2$ represents a halogen atom, SCN or SeCN group. More preferably, $X^2$ represents chloro, bromo or SCN group. It is possible that multiple $X^2$ groups are the same groups or different groups in the compound of the Formula (7-5).

In the Formula (7-5), preferably R' is the alkyl group with 1 to 10 carbons and may have substituents. It is possible that multiple R' groups are the same groups or different groups in the compound of the Formula (7-5).

Specific examples of the compounds represented by the Formula (7-3) to (7-5) of the invention are shown below, but the invention is not limited thereto.

7-3-1

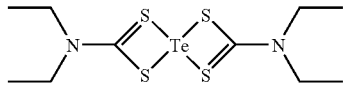

7-3-2

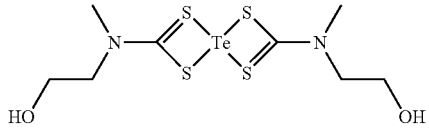

7-3-3

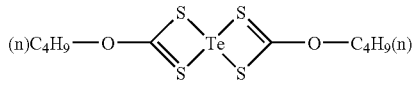

7-3-4

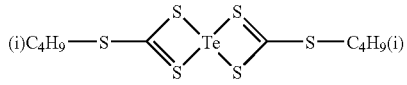

7-3-5

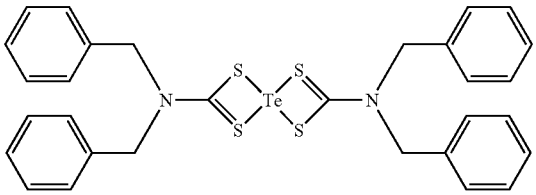

7-4-1

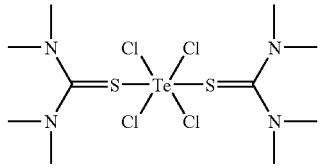

7-4-2

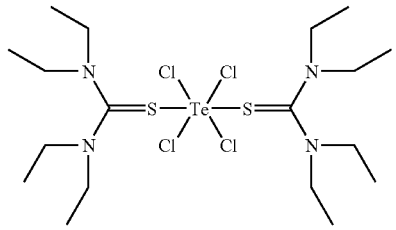

7-4-3

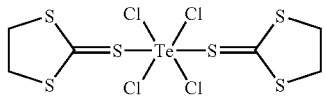

-continued 7-4-4

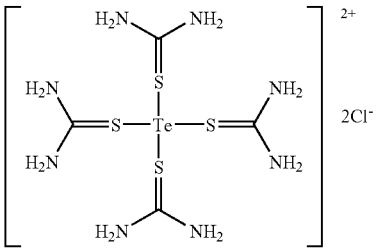

7-4-5

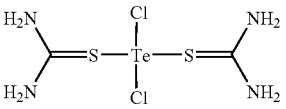

7-4-6: $Te(phenyl)_2(S_2CO\text{-}ethyl)_2$ 7-4-7: $Te(pyridyl)_2Br_2$ 7-4-8: Te(phenyl)Br 7-4-9: Te(p-tolyl) ($S_2CO$-butyl)

7-4-10: Te(p-anisyl) $[S_2CN(ethyl)_2]_2Br$ 7-5-1: $PdBr_2[Te(p\text{-}anisyl)_2]_2$ 7-5-2: $PdCl_2[Te(mesityl)_2]_2$ 7-5-3: $Pd(SCN)_2\{Te[CH_2Si(CH_3)_3]_2\}_2$ 7-5-4: $Te(S_2P(O\text{-}ethyl)_2)_2$ 7-5-5: $Te(S_2P(n\text{-}butyl)_2)_2$ 7-5-6: $Te(S_2C\text{-}phenyl)_2$ 7-5-7: $Te(S_2CS\text{-}i\text{-}propyl)_2$ As the other examples of the tellurium sensitizers represented by the Formula (7-3) to (7-5) of the invention, it is possible to use the compounds described in JP-A-2002-278019.

Useful tellurium-containing chemical sensitizers in the invention can be prepared using easily available starting materials and the procedure known in the art. The starting materials and the procedures are as described in, for example, K. J. Irgolics, "The Organic Chemistry of Tellurium" (Gordon and Breach, NY, 1974); K. J. Irgolics, "Houben Weyl Methods of Organic Chemistry" Vol. E12b, Organotellurium Compounds edited by D. Klamann (George Thieme Verlag, Stuttgart, Germany, 1990); "Synthetic Method of Organometallic and Inorganic Chemistry, Vol. 4 Chapter 3, edited by W. A. Herrmann and C. Zybill (George Thieme Verlag, NY, 1997); K. J. Irgolics, "Tellurium and its Compounds, The Chemistry of Organic Selenium and Tellurium Compounds, Vol. 1 (1986) and Vol. 2 (1987) edited by S. Patai and Z. Rappopr (Wiley, New York); H. J. Gysling, H. R. Luss and D. L. Smith, Inorg. Chem., 18:2696, 1979; and H. J. Gysling, M. Lelental, M. G. Mason and L. J. Gerenser, J. Phot. Sci., 30:55, 1982. The compound II-1 [$TeCl_4$ (tetramethyl thiourea)$_2$] was prepared as described in O. Foss and W. Johannessen, Acta Chem. Scand., 15:1939, 1961. The representative synthesis of the compound (7-4-1) is shown in the international publication corresponding to U.S. patent application Ser. No. 09/746,400.

Next, the compounds of the above Formula (7-6) are described. In the Formula (7-6), $R_{31}$ and $R_{32}$ may be the same or different, and represent aliphatic groups, aromatic groups, heterocyclic groups or —(C═Y')$R_{33}$. $R_{33}$ represents a hydrogen atom, an aliphatic group, an aromatic group, a heterocyclic group, $NR_{34}(R_{35})$, $OR_{36}$ or $SR_{37}$, and Y' represents an oxygen atom, a sulfur atom or $NR_{38}$. $R_{34}$, $R_{35}$, $R_{36}$, $R_{37}$ and $R_{38}$ represent hydrogen atoms, aliphatic groups, aromatic groups and heterocyclic groups, and n2 represents 1 or 2.

The aliphatic groups, aromatic groups and heterocyclic groups represented by $R_{31}$, $R_{32}$, $R_{33}$, $R_{34}$, $R_{35}$, $R_{36}$, $R_{37}$ and $R_{38}$ are the same as defined in the above Formula (7-1). Also, the aliphatic groups, aromatic groups and heterocyclic groups represented by $R_{31}$, $R_{32}$, $R_{33}$, $R_{34}$, $R_{35}$, $R_{36}$, $R_{37}$ and $R_{38}$ may be substituted with the substituents included in the Formula (7-1). Here, $R_{31}$ and $R_{32}$, and $R_{34}$ and $R_{35}$ may be bound to form rings. In the Formula (7-6), preferably $R_{31}$ and $R_{32}$ represent the heterocyclic groups or —(C═Y')—$R_{33}$. $R_{33}$ represents $NR_{34}(R_{35})$ or $OR_{36}$, and Y' represents the oxygen atom. $R_{34}$, $R_{35}$ and $R_{36}$ represent the aliphatic groups, aromatic groups and heterocyclic groups. In the Formula (7-6), more preferably $R_{31}$ and $R_{32}$ represent —(C═Y')—$R_{33}$. $R_{33}$ represents $NR_{34}(R_{35})$, and Y' represents the oxygen atom. $R_{34}$ and $R_{35}$ represent the aliphatic groups, aromatic groups and heterocyclic groups.

Specific examples of the compounds represented by the Formula (7-6) of the invention are shown below, but the invention is not limited thereto.

7-6-1

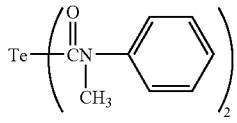

7-6-2

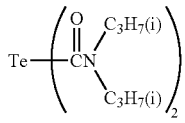

7-6-3

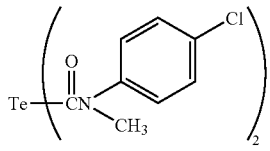

7-6-4

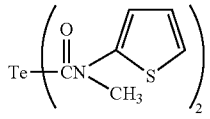

7-6-5

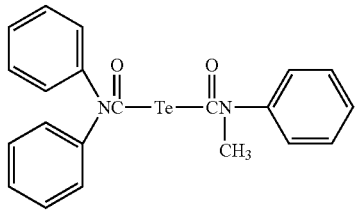

7-6-6

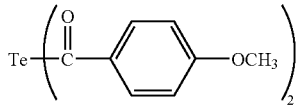

-continued 7-6-7

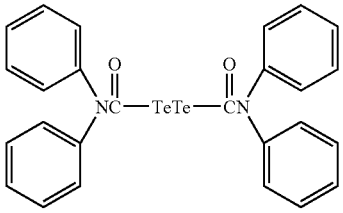

7-6-8

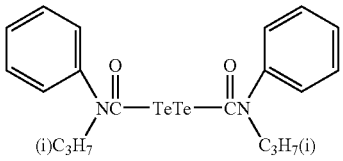

7-6-9

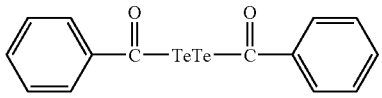

7-6-10

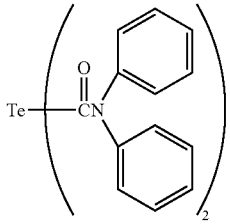

As the other examples of the tellurium sensitizers represented by the Formula (7-6) of the invention, it is possible to use the compounds described in JP-A-5-313284.

Next, gold(III)-containing compounds useful for the implementation technology of the invention are described. In the above Formula (8), L's represent the same or different ligands, each ligand comprises at least one heteroatom capable of forming a bind with the gold, Y is anion, r is an integer of 1 to 8, and q is an integer of 0 to 3.

More especially, L's represent the same or different ligands comprising at least one oxygen, nitrogen, sulfur or phosphorus atom. Examples of such ligands include, but are not limited to, pyridine, bipyridine, terpyridine, $P(phenyl)_3$, carboxylate, imine, phenol, mercaptophenol, imidazole, triazole and dithiooxamide. The preferable L' ligands are derived from terpyridine, $P(phenyl)_3$ and salicylimine compounds. Also, in the above Formula (8), Y represents a relevant counteranion having relevant charge. Useful anions include, but are not limited to, halides (chloride and bromide, etc.), perchlorate, tetrafluoroborate, sulfate, sulfonate, methyl sulfonate, p-toluene sulfonate, tetrafluoroantimonate and nitrate. The halides are preferable. In the structure of the Formula (8), r which is the integer of 1 to 8 (preferably from 1 to 3) is also included, and q is the integer of 1 to 3 (preferably 3). The useful gold(III)-containing chemical sensitizers can be prepared using the methods known in the art. The representative methods are described in the cited references shown in the following Table. Additionally, several gold(III)-containing compounds can be purchased from various commercial suppliers including Alfa Aesar (Wardhill, Mass.).

The gold(III)-containing compounds especially useful for the implementation technology of the invention are the following compounds (8-1) to (8-10).

| COMPOUND | Au(III) COMPLEX | LIGAND-H(L'-H) | PREPARATION METHOD |
|---|---|---|---|
| 8-1 | $AuL'ClBr_2$ | $P(PHENYL)_3$ | F. Mannetal., J. Chem. Soc., 1940, 1235 |
| 8-2 | $AuL'Cl_3$ | 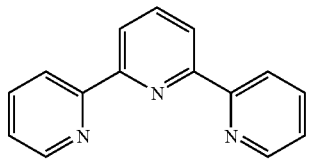 TERPYRIDINE | L. Hollisetal., J. Am. Chem. Soc., 1983, 105, 4293 |
| 8-3 | $AuL'Br_2$ | 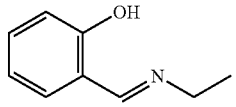 | L. Daretal., J. Chem. Soc., Dalton Trans., 1992, 1907 |
| 8-4 | $AuL'Cl_3$ | 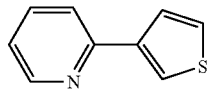 | Y. Fuchitaetal., J. Chem. Soc., Dalton Trans., 1999, 4431 |
| 8-5 | $L'[AuP(PHENYL)_3]_3$ | 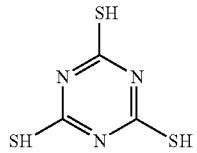 | W. Hunksetal., Inorg. Chem., 1999, 38, 5930 |

-continued

| COM-POUND | Au(III) COMPLEX | LIGAND-H(L'-H) | PREPARATION METHOD |
|---|---|---|---|
| 8-6 | $AuL'Cl_3$ | 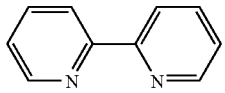 | M. Cinelluetal., J. Chem. Soc., Dalton Trans., 1998, 1735 |
| 8-7 | $AuH(L')_2Cl_2$ | 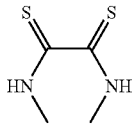 | B. Slootmaekersetal., Spectrochim. Acta. 1996, 52A, 1255 |
| 8-8 | $AuL'Cl_2$ | 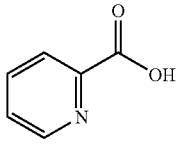 | A. Daretal., J. Chem. Soc., Dalton Trans., 1992, 1907 |
| 8-9 | $Au_2Zn(L')_8$ | 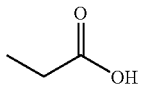 | P. G. Jonesetal., Acta Cryst., 1988, C44 1196 |
| 8-10 | $Au(L')_2Br$ | 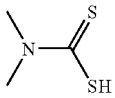 | D. J. Radanovioetal., Trans. Mst. Chem. 1996, 21, 169 |

As the other examples of the gold sensitizers represented by the Formula (8) of the invention, it is possible to use the compounds described in JP-A-2002-278019.

As described above, one or more gold(III)-containing compounds described herein are all used as the chemical sensitizers by combining with one or more sulfur-, selenium- or tellurium-containing compounds.

Chemical sensitization can be given to the silver halide grains used for the present invention. For example, by the methods disclosed in JP-A-2001-249428 and JP-A-2001-249426, a chemical sensitization center (chemical sensitization nuclei) can be formed and imparted using the compound having chalcogen atoms such as sulfur or the noble metal compound which releases noble metal ions such as gold ions. In the present invention, it is especially preferred that the chemical sensitization by the above compound having the chalcogen atom and the chemical sensitization using the noble metal compound are combined.

In the present invention, it is preferred to be chemically sensitized by the compound having the chalcogen atom shown below.

It is preferred that these compounds having the chalcogen atom useful as an organic sensitizer are the compounds having a group capable of being absorbed to the silver halide and an unstable chalcogen atomic site.

As these organic sensitizer, it is possible to use the organic sensitizers having various structures disclosed in JP-A-60-150046, JP-A-4-109240 and JP-A-11-218874, and among them, it is preferred that the sensitizer is at least one type of the compounds having the structure where the chalcogen atom is bound to a carbon atom or phosphorus atom by a double bond. Especially preferred are the compounds of the Formula (1-1) and the Formula (1-2) disclosed in JP-A-2002-250984.

An use amount of the chalcogen atom-containing compound as the organic sensitizer varies depending on the chalcogen compound used, the silver halide grains used and a reaction environment upon giving the chemical sensitization, is preferably from $1\times10^{-8}$ to $1\times10^{-2}$ mol, and more preferably from $1\times10^{-7}$ to $1\times10^{-3}$ mol. The chemical sensitization environment of the present invention is not especially limited, but it is preferred that chalcogen sensitization is given using the organic sensitizer having the chalcogen atom in the presence of the compound capable of vanishing or reducing in size chalcogenated silver or silver nucleus on the photosensitive silver halide grains, or in coexistence of an oxidizing agent capable of oxidizing the silver nucleus. As the sensitization condition, pAg is preferably from 6 to 11 and more preferably from 7 to 10, pH is preferably from 4 to 10 and more preferably from 5 to 8, and it is preferred that the sensitization is given at the temperature of 30° C. or below.

Therefore, in the photothermographic imaging materials of the present invention, it is preferred that the chemical sensitization is given to the photosensitive silver halide at the temperature of 30° C. or below using the chalcogen atom-containing organic sensitizer in the coexistence of the oxidizing agent capable of oxidizing silver nuclei on the particles, ant that used is a photosensitive silver halide emulsion which is mixed with the organic silver salt, dispersed, dehydrated and dried.

Also, it is preferred that the chemical sensitization using these organic sensitizers is carried out in the presence of a spectral sensitizing dye or a heteroatom-containing compound having absorbability to the silver halide grains. Dispersion of chemical sensitization center nuclei can be prevented, and high sensitivity and low photographic fog can be achieved by performing the chemical sensitization in the presence of the compound having the absorbability to the silver halide. The spectral sensitizing dye used in the present invention is described below, but the heteroatom-containing compounds having the absorbability to the silver halide include nitrogen-containing heterocyclic compounds described in JP-A-3-24537. In the nitrogen-containing heterocyclic compounds used for the present invention, heterocyclic rings can include pyrazole ring, pyrimidine ring, 1,2,4-triazole ring, 1,2,3-triazole ring, 1,3,4-thiaziazole ring, 1,2,3-thiaziazole ring, 1,2,4-thiaziazole ring, 1,2,5-thiaziazole ring, 1,2,3,4-tetrazole ring, pyridazine ring, 1,2,3-triazine ring, rings where two to three of these rings are bound, e.g., triazolotriazole ring, diazaindene ring, triazaindene ring, pentaazaindene ring and the like. It is possible to apply the heterocyclic rings where a monocyclic heterocyclic ring and an aromatic ring is condensed, such as phthalazine ring, benzimidazole ring, indazole ring, and benzothiazole ring.

Among them, preferred are azaindene rings, and more preferable are azaindene compounds having a hydroxyl group as a substituent, e.g., hydroxytriazaindene, hydroxytetraazaindene, hydroxypentaazaindene compounds and the like.

The heterocyclic ring may have substituents other than the hydroxyl group. It may have, for example, alkyl, alkylthio, amino, hydroxyamino, alkylamino, dialkylamino, arylamino, carboxyl, alkoxycarbonyl groups, halogen atoms, cyano group and the like as the substituents.

The addition amount of the heterocyclic compound containing them varies in the wide range depending on the sizes and composition of silver halide grains and the other conditions, and the approximate amount is in the range of $1\times10^{-6}$ mol to 1 mol as the amount per mol of the silver halide, and preferably in the range of $1\times10^{-4}$ mol to $1\times10^{-1}$ mol.

The noble metal sensitization can be given to the silver halide grains according to the present invention by utilizing the compound which releases noble metal ions such as gold ions as described above. For example, as the gold sensitizer, it is possible to use aurichloride salts and organic gold compounds.

Also, reducing sensitization methods can be used in addition to the above sensitization methods. As specific compounds for the reducing sensitization, it is possible to use ascorbic acid, thiourea dioxide, stannous chloride, hydrazine derivatives, boron compounds, silane compounds, polyamine compounds and the like. Also, the reducing sensitization can be carried out by maturing with retaining pH 7 or more or pAg 8.3 or less of the photographic emulsion, respectively.

The silver halide given the chemical sensitization according to the present invention may be those formed in the presence of the organic silver salt, those formed in the absence of the organic silver salt, or those where both are mixed.

In the present invention, it is preferred that chemical sensitization is given on the surface of the photosensitive silver halide grains and the chemical sensitization effect substantially disappears after the completion of thermal development. Here, that the chemical sensitization effect substantially disappears is referred to that the sensitivity of the imaging material obtained by the chemical sensitization technology is reduced by 1.1 times of the sensitivity when the chemical sensitization is not given after the completion of the thermal development.

It is preferred that the spectral sensitization is given to the photosensitive silver halide grains used for the present invention by making spectral sensitizing dye absorb. As the spectral sensitizing dye, it is possible to use cyanine dye, merocyanine dye, complex cyanine dye, complex merocyanine dye, holopolar cyanine dye, styryl dye, hemicyanine dye, oxonol dye, hemioxonol dye and the like. For example, it is possible to use the sensitizing dyes described in JP-A-63-159841, JP-A-60-140335, JP-A-63-231437, JP-A-63-259651, JP-A-63-304242, JP-A-63-15245, U.S. Pat. Nos. 4,639,414, 4,740,455, 4,741,966, 4,751,175 and 4,835,096. The useful sensitizing dyes used for the present invention are for example described in the references described or cited in RD17643IV-A section (December in 1978, page 23) and RD18431 X section (August in 1978, page 437). Especially it is preferable to use the sensitizing dye having spectral sensitivity suitable for spectral property of various laser imager and scanner light sources. For example, preferably used are the compounds described in JP-A-9-34078, JP-A-9-54409 and JP-A-9-80679.

Useful cyanine dyes are, for example, the cyanine dyes having basic nuclei such as thiazoline nucleus, oxazoline nucleus, pyrroline nucleus, pyridine nucleus, oxazole nucleus, thiazole nucleus, selenazole nucleus and imidazole nucleus. Useful merocyanine dyes and preferable ones include acidic nuclei such as thiohydantoin nucleus, rhodanine nucleus, oxazolidine dione nucleus, thiazolinedione nucleus, barbituric acid nucleus, thiazolinone nucleus, malononitrile nucleus and pyrazolone nucleus in addition to the above basic nuclei.

In the present invention, it is preferable to use the sensitizing dye especially having spectral responsivity in an infrared area. In the present invention, infrared spectral sensitizing dyes preferably used include the infrared spectral sensitizing dyes disclosed, for example, in U.S. Pat. Nos. 4,536,473, 4,515,888 and 4,959,294.

Concerning the infrared spectral sensitizing dyes used in the present invention, especially preferred are long chain polymethine dyes characterized in that a sulfinyl group is substituted on a benzene ring of a benzazole ring.

The above infrared spectral sensitizing dyes can be readily synthesized by the method, for example, described in F. M. Harmer, The Chemistry of Heterocyclic Compounds, Vol. 18, The Cyanine Dyes and Related Compounds (edited by A. Weissberger, published by Interscience, New York, 1964).

An addition time of these infrared spectral sensitizing dyes may be anytime after the preparation of the silver halide, and for example, they can be added by adding in a solvent or in so-called solid dispersion state by dispersing in a particulate form, to the photosensitive photographic emulsion containing the silver halide grains or the silver halide grains/organic silver salt particles. Also, as is the case with the heteroatom-containing compound having the absorbability to the silver halide grains, prior to the chemical sensitization, after adding to the silver halide grains and making absorb thereto, the chemical sensitization can be also given. This can prevent the dispersion of chemical sensitization center nuclei and can achieve high sensitivity and low photographic fog.

In the present invention, the above infrared spectral sensitizing dyes may be used alone or in combination thereof, and the combination of sensitizing dyes is often used especially for the purpose of strong color sensitization.

In the photographic emulsion containing the silver halide grains or the organic silver salt particles used for the photothermographic imaging materials of the present invention, along with the sensitizing dye, a dye which per se has no spectral sensitizing action or a substance which does not substantially absorb visible light and which expresses a strong color sensitizing effect is included in the photographic emulsion, and this may perform strong color sensitization of the silver halide grains.

Useful sensitizing dyes, the combination of dyes which exhibit the strong color sensitization and the substance exhibiting the strong color sensitization are described in RD 17643 (issued in December, 1978) page 23 IV J section, or JP-B-9-2550, JP-B-43-4933, JP-A-59-19032, JP-A-59-192242 and JP-A-5-341432. In the present invention, as the Supersensitizers, preferred are heterocyclic aromatic mercapto compounds represented by the following Formula or mercapto derivative compounds.

Ar—SM

In the Formula, M is a hydrogen atom or an alkali metal atom, Ar is a heterocyclic aromatic ring or condensed aromatic ring having one or more nitrogen, oxygen, selenium, or tellurium atoms. Preferable heterocyclic aromatic rings or condensed aromatic rings include benzimidazole, naphthimidazole, benzothiazole, naphthothiazole, benzoxazole, naphthoxazole, benzoselenazole, benzotellurazole, imidazole, oxazole, pyrazole, triazole, triazine, pyrimidine, pyridazine, pyrazine, pyridine, purine, quinoline, or quinazoline or the like. However, the other heterocyclic aromatic rings are included.

Besides, the present invention also includes mercapto derivative compounds which substantially produce the above mercapto compounds when contained in the dispersion of the organic acid silver salt or silver halide particle emulsion. Especially, preferable examples include the mercapto derivative compounds represented by the following Formula.

Ar—S—S—Ar

In the Formula, Ar is the same as defined in the case of the mercapto compounds represented by the above Formula.

The above heterocyclic aromatic ring or condensed aromatic ring, for example, can have a substituent selected from the group consisting of halogen atoms (e.g., Cl, Br, I), hydroxyl, amino, carboxyl, alkyl groups (e.g., those having one or more carbon atoms, preferably from 1 to 4 carbon atoms), and alkoxy groups (e.g., those having one or more carbon atoms, preferably from 1 to 4 carbon atoms).

In the present invention, as the Supersensitizer, it is possible to use macrocyclic compounds comprising the compound represented by the Formula (1) disclosed in JP-A-2001-330918 and heteroatoms, in addition to the above Supersensitizers.

It is preferable to use the string color sensitizer at the range of 0.001 to 1.0 mol per mol of the silver in a photographic emulsion layer comprising the organic silver salt and silver halide grains. It is especially preferable to use at the range of 0.01 to 0.5 mol per mol of the silver.

In the present invention, it is preferred that the spectral sensitization is given by making the spectral sensitization dyestuff absorb on the surface of the photosensitive silver halide grains and that the spectral sensitization effect substantially disappears after the completion of thermal development. Here, that the spectral sensitization effect substantially disappears is referred to that the sensitivity of the imaging material obtained by the sensitizing dyestuff and the Supersensitizer is reduced by 1.1 times or less of the sensitivity in the case where the spectral sensitization is not given after the completion of thermal development.

In the present invention, the use of a silver saving agent can further enhance the effects of the invention.

[Silver Saving Agent]

The silver saving agent used in the invention is referred to the compounds capable of reducing the silver amount required for obtaining the constant silver image density. Various action mechanisms for this reduction are thought, but preferred are the compounds having the function to enhance covering power of development silver. Here, the covering power of development silver is referred to optical density per unit amount of the silver.

As the silver saving agent, preferable examples include hydrazine derivative compounds represented by the following Formula (H), vinyl compounds represented by the following Formula (G), and quaternary onium compounds represented by the following Formula (P).

(H)

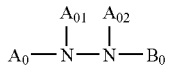

(G)

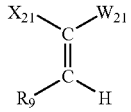

(P)

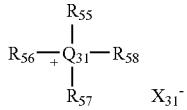

In the Formula (H), $A_0$ represents an aliphatic group, aromatic group, heterocyclic group or —$G_0$—$D_0$— group which may have substituents, respectively, $B_0$ represents a blocking group, $A_{01}$ and $A_{02}$ both represent hydrogen atoms or one represents a hydrogen atom and the other represents an acyl, sulfonyl or oxalyl group. Here, $G_0$ represents —CO—, —COCO—, —CS—, —C(=$NG_1D_1$)—, —SO—, —$SO_2$— or —P(O) ($G_1D_1$) group, $G_1$ represents a simple bond, —O—, —S— or —N($D_1$) group, $D_1$ represents an aliphatic, aromatic, heterocyclic group or hydrogen atom, and when multiple $D_1$ are present in the molecule, they may be the same or different. $D_0$ represents a hydrogen atom, aliphatic, aromatic, heterocyclic, amino, alkoxy, aryloxy, alkylthio or arylthio group. Preferable $D_0$ includes hydrogen atom, alkyl, alkoxy and amino groups.

In the Formula (H), the aliphatic groups represented by A0 are preferably those with 1 to 30 carbons, especially preferably linear, branched or cyclic alkyl groups with 1 to 20 carbons, and include, for example, methyl, ethyl, t-butyl, octyl, cyclohexyl, and benzyl groups. These may be further substituted with appropriate substituents (e.g., aryl, alkoxy, aryloxy, alkylthio, arylthio, sulfoxy, sulfonamide, sulfamoyl, acylamino, ureido groups, etc.)

In the Formula (H), the aromatic group represented by $A_0$ is preferably monocyclic or condensed cyclic aryl group, and for example, includes benzene or naphthalene ring. The heterocyclic group represented by $A_0$ is preferably monocyclic or condensed cyclic heterocyclic group containing at least one heteroatom selected from nitrogen, sulfur and oxygen atoms, and for example includes imidazole, tetrahydrofuran, morpholine, pyridine, pyrimidine, quinoline, thiazole, benzothiazole, thiophene, and furan rings. The aromatic and heterocyclic and —$G_0$—$D_0$ groups of $A_0$ may have substituents. As $A_0$, especially preferred are aryl group and —$G_0$—$D_0$ group.

Also, in the Formula (H), it is preferred that $A_0$ comprises at lease one of anti-diffusion group and silver halide adsorption group. As the anti-diffusion group, preferred is ballast group usually used in additives for unmoving photographs such as coupler, and the ballast groups include alkyl, alkenyl, alkynyl, alkoxy, phenyl, phenoxy, alkylphenoxy groups and the like, which are photographically inert. It is preferred that total number of carbons at substituted moiety is 8 or more.

In the Formula (H), the silver halide adsorption facilitating groups include thio urea, thiourethane, mercapto, thioether, thione, heterocyclic, thioamide heterocyclic, mercapto heterocyclic groups or adsorption groups described in JP-A-64-90439.

In the Formula (H), $B_0$ represents a blocking group, and is preferably —$G_0$—$D_0$ group. $G_0$ represents —CO—, —COCO—, —CS—, —C(=$NG_1D_1$)—, —SO—, —$SO_2$— or —P(O)($G_1D_1$) group, and preferable $G_0$ includes —CO— and —COCO— groups. $G_1$ represents a simple bond, —O—, —S— or —N($D_1$) group, $D_1$ represents an aliphatic, aromatic, heterocyclic group or hydrogen atom, and when multiple $D_1$ are present in the molecule, they may be the same or different. $D_0$ represents a hydrogen atom, aliphatic, aromatic, heterocyclic, amino, alkoxy, aryloxy, alkylthio or arylthio group, and preferable $D_0$ includes hydrogen atom, alkyl, alkoxy and amino groups. $A_0$, and $A_{02}$ both represent hydrogen atoms, or one represents a hydrogen atom and the other represents an acyl group (acetyl, trifluoroacetyl, benzoyl, etc.), sulfonyl group (methanesulfonyl, toluene sulfonyl, etc.) or oxalyl group (ethoxalyl).

These compounds represented by the Formula (H) can be readily synthesized by the methods known in the art. For example, they can be synthesized in reference to U.S. Pat. Nos. 5,464,738 and 5,496,695.

The other hydrazine derivatives which can be preferably used can include the compounds H-1 to H-29 described in columns of 11 to 20 of U.S. Pat. No. 5,545,505, the compounds 1 to 12 described in the columns of 9 to 11 of U.S. Pat. No. 5,464,738, the compounds H-1-1 to H-1-28, H-2-1 to H-2-9, H-3-1 to H-3-12, H-4-1 to H-4-21 and H-5-1 to H-5-5 described in [0042] to [0052] of JP-A-2001-27790, and the compounds of D1 to D206 described in [0020] to [0035] of JP-A-2002-278017. These hydrazine derivatives can be synthesized by the methods known in the art.

Compound examples of the hydrazine derivatives preferably used in the invention are shown below, but the invention is not limited thereto.

(H-1)

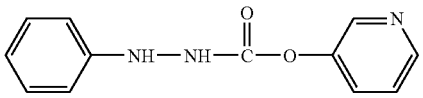

(H-2)

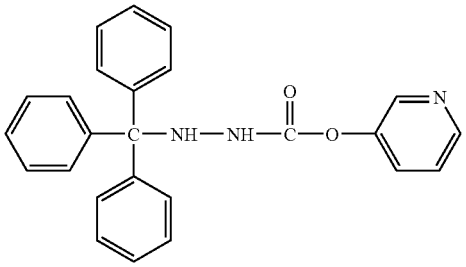

-continued (H-3)

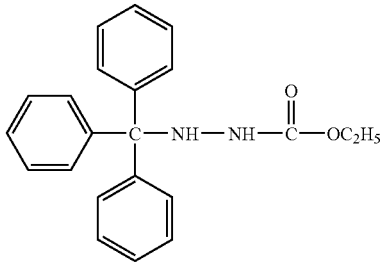

(H-4)

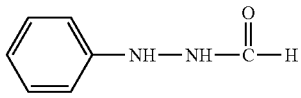

(H-5)

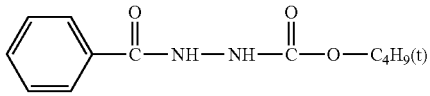

(H-6)

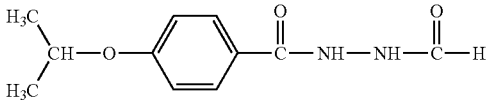

(H-7)

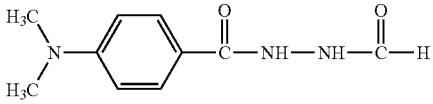

(H-8)

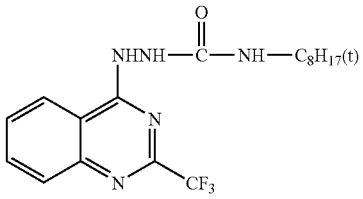

(H-9)

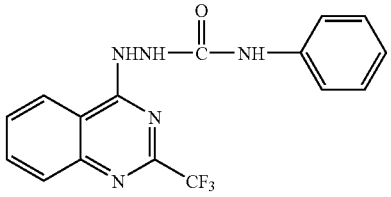

(H-10)

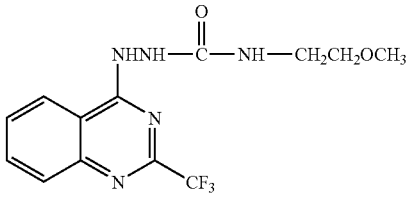

In the Formula (G), $X_{21}$ and $R_9$ are represented in the form of cis, but the form where $X_2$, and $R_9$ are trans is included in the Formula (G). This is the same in the structure representation of the specific compounds.

In the Formula (G), $X_{21}$ represents an electron withdrawing group, and $W_{21}$ represents hydrogen atom, alkyl, alkenyl, alkynyl, aryl, hetero ring groups, halogen atom, acyl, thioacyl, oxalyl, oxyoxalyl, thiooxalyl, oxamoyl, oxycarbonyl, thiocarbonyl, carbamoyl, thiocarbamoyl, sulfonyl, sulfinyl, oxysulfinyl, thiosulfinyl, sulfamoyl, oxysulfinyl, thiosulfinyl, sulfamoyl, phosphoryl, nitro, imino, N-carbonylimino, N-sulfonylimino, dicyanoethylene, ammonium, sulfonium, phosphonium, pyrilium, and immonium groups.

$R_9$ represents halogen atom, hydroxyl, alkoxy, aryloxy, hetero ring oxy, alkenyloxy, acyloxy, alkoxycarbonyloxy, aminocarbonyloxy, mercapto, alkylthio, arylthio, hetero ring thio, alkenylthio, acylthio, alkoxycarbonyl thio, aminocarbonyl thio groups, organic or inorganic salt of hydroxyl or mercapto group (e.g., sodium, potassium, silver salts, etc.), amino, alkylamino, cyclic amino (e.g., pyrolidino), acylamino, oxycarbonylamino, hetero ring groups (nitrogen-containing 5 to 6-membered cyclic ring, e.g., benztriazolyl, imidazolyl, triazolyl, tetrazolyl, etc.), ureido and sulfonamide groups. $X_{21}$ and $W_{21}$, $X_{21}$ and $R_9$ may be bound one another to form a cyclic structure. Rings which $X_{21}$ and $W_{21}$ form include, for example, pyrazolone, pyrazolidinone, cyclopentanedione, β-ketolactone, β-ketolactam and the like.

Further describing for the Formula (G), the electron withdrawing group represented by $X_{21}$ is the substituent where a substituent constant σp can be a positive value. Specifically included are substituted alkyl groups (halogen substituted alkyl etc.), substituted alkenyl groups (cyanovinyl, etc.), substituted/unsubstituted alkynyl groups (trifluoromethylacetylenyl, cyanoacetylenyl, etc.), substituted aryl groups (cyanophenyl, etc.), substituted/unsubstituted hetero ring groups (pyridyl, triazyl, benzoxazolyl, etc.), halogen atoms, cyano group, acyl groups (acetyl, trifluoroacetyl, formyl, etc.), oxalyl groups (methyloxalyl, etc.), oxyoxalyl groups (ethoxalyl, etc.), thiooxalyl groups (ethylthiooxalyl, etc.), oxamoyl groups (methyloxamoyl, etc.), oxycarbonyl groups (ethoxycarbonyl, etc.), carboxyl groups, thiocarbonyl groups (ethylthiocarbonyl, etc.), carbamoyl, thiocarbamoyl, sulfonyl, sulfinyl groups, oxysulfonyl groups (ethoxysulfonyl, etc.), thio sulfonyl groups (ethylthiosulfonyl, etc.), sulfamoyl, oxysulfinyl groups (methoxysulfinyl, etc.), thiosulfinyl groups (methylthiosulfinyl, etc.), sulfinamoyl, phosphoryl, nitro, imino groups, N-carbonylimino groups (N-acetylimino, etc.), N-sulfonylimino groups (N-methanesulfonylimino, etc.), dicyanoethylene, ammonium, sulfonium, phosphonium, pyrilium and immonium, and comprised are hetero rings where ammonium, sulfonium, phosphonium and immonium form the ring. The substituents with the σp value of 0.30 or more are especially preferable.

The alkyl groups represented by $W_{21}$ include methyl, ethyl, trifluoromethyl and the like, the alkenyl groups include vinyl, halogen substituted vinyl, cyanovinyl, and the like, the alkynyl groups include acetylenyl, cyanoacetylenyl and the like, the aryl groups include nitrophenyl, cyanophenyl, pentafluorophenyl, and the like, and the hetero rings include pyridyl, pyrimidyl, triazyl, succinimide, tetrazolyl, triazolyl, imidazolyl, benzoxazolyl and the like. As $W_{21}$, the electron withdrawing group with positive σp value is preferable, and further the value is preferably 0.30 or more.

In the above substituents of $R_9$, preferably included are hydroxyl, mercapto, alkoxy, alkylthio groups, halogen atoms, organic or inorganic salt of hydroxyl or mercapto group, and hetero ring, more preferably included are hydroxyl, alkoxy, organic or inorganic salt of hydroxyl or mercapto group and hetero ring, and especially preferably included is organic or inorganic salt of hydroxyl or mercapto group.

Specific examples of the compounds of the Formula (G) include the compounds CN-01 to CN-13 described in the columns of 13 to 14 of U.S. Pat. No. 5,545,515, the compounds HET-01 to HET-02 described in the column 10 of U.S. Pat. No. 5,635,339, the compounds MA-01 to MA-07 described in the columns of 9 to 10 of U.S. Pat. No. 5,654,130, the compounds IS-01 to IS-04 described in the columns of 9 to 10 of U.S. Pat. No. 5,705,324, and the compounds 1-1 to 218-2 described in [0043] to [0088] of JP-A-2001-125224.

Compound examples preferably used in the invention are shown below, but the invention is not limited thereto.

A-1

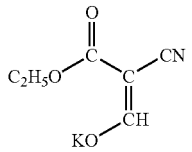

A-2

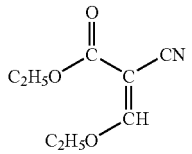

A-3

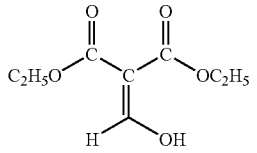

A-4

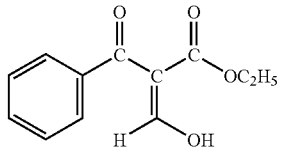

A-5

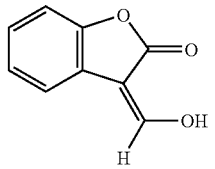

A-6

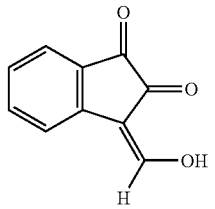

A-7

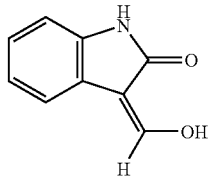

A-8

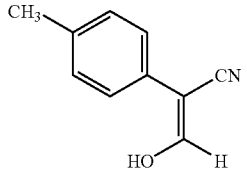

-continued

A-9

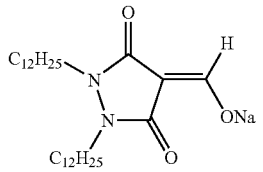

A-10

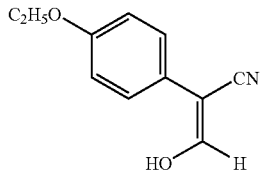

In the Formula (P), $Q_{31}$ represents a nitrogen or phosphorus atom, $R_{55}$, $R_{56}$, $R_{57}$ and $R_{58}$ each represent hydrogen atoms or substituents, and $X_{31}^-$ represents anion. Besides, $R_{55}$ to $R_{58}$ may be linked one another to form a ring.

The substituents represented by $R_{55}$ to $R_{58}$ include alkyl groups (methyl, ethyl, propyl, butyl, hexyl, cyclohexyl, etc.), alkenyl groups (allyl, butenyl, etc.), alkynyl groups (propargyl, butynyl, etc.), aryl groups (phenyl, naphthyl, etc.), heterocyclic groups (piperidinyl, piperadinyl, morpholinyl, pyridyl, furyl, thienyl, tetrahydrofuryl, tetrahydrothienyl, sulfolanyl, etc.), amino groups and the like.

The rings which $R_{55}$ to $R_{58}$ can be linked one another to form include piperidine, morpholine, piperazine, quinuclidine, pyridine, pyrrole, imidazole, triazole, tetrazole rings and the like.

The groups represented by $R_{55}$ to $R_{58}$ may have substituents such as hydroxyl, alkoxy, aryloxy, carboxyl, sulfo, alkyl and aryl groups. $R_{55}$, $R_{56}$, $R_{57}$ and $R_{58}$ are preferably hydrogen atoms and alkyl groups.

Anions represented by $X_{31}^-$ include inorganic and organic anions such as halogen ion, sulfate ion, nitrate ion, acetate ion and p-toluene sulfonate ion.

The above quaternary onium compounds can be readily synthesized according to the methods known in the art, and for example, the above tetrazolium compounds can refer to the method described in Chemical Review, Vol. 55 page 335 to 483. The addition amount of the above silver saving agent is from $1\times10^{-5}$ to 1 mol, and preferably in the range of $1\times10^{-4}$ to $5\times10^{-1}$ mol per mol of the organic silver salt.

In the present invention, it is preferred that at least one type of the silver saving agent is the silane compound.

As the silane compounds used as the silver saving agent in the invention, preferred are alkoxy silane compounds or salts thereof having two or more primary or secondary amino groups as described in JP-2001-192698.

Here, having two or more primary or secondary amino groups indicates comprising two or more of only primary amino groups, two or more of only secondary amino groups, and further one or more of the primary and secondary amino groups, respectively. The salt of alkoxy silane compound indicate an addition compound of an organic or inorganic acid capable of forming onium salt with amino group and the alkoxy silane compound.

Such alkoxy silane compounds or salts thereof can include those described below, but in the invention, as long as it is the alkoxy silane compound or the salt thereof having two or more intramolecular primary or secondary amino groups, it is not limited to these compounds.

(10)-1

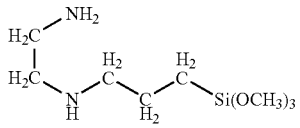

(10)-2

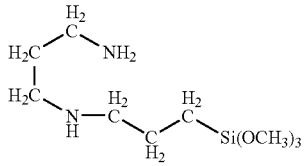

(10)-3

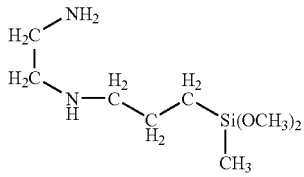

(10)-4

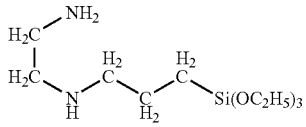

(10)-5

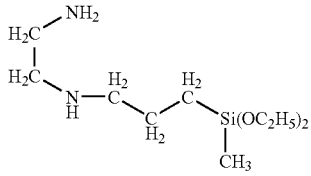

(10)-6

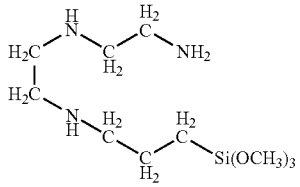

(10)-7

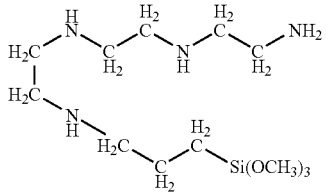

(10)-8

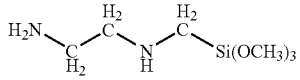

(10)-9

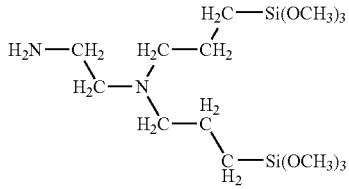

-continued (10)-10

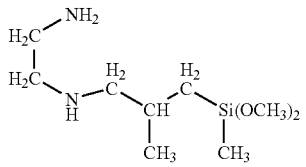

(10)-11

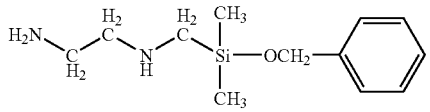

(10)-12

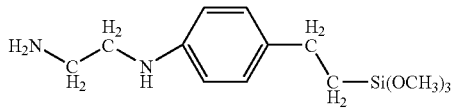

In these compounds, as the alkoxy group which forms alkoxy silyl, the alkoxy group made up of saturated hydrocarbon is preferable, and further, methoxy, ethoxy and isopropoxy groups are preferable because of being more excellent in storage stability. Also, for the purpose of reducing sensitivity variation due to the storage condition before the thermal development, more preferable are the compounds having no unsaturated hydrocarbon in the molecule. Besides, these alkoxy silane compounds or the salts thereof may be used alone or in combination of two or more.

Also, it is preferred that the image formation layer contains Schiff base formed from dehydrated condensation reaction of the alkoxy silane compound having at least one or more primary amino group with the ketone compound.

The use of such Schiff base can save the amount of silver, and affords the images where the photographic fog is low, sensitivity variation is low and gamma does not extremely rise regardless the storage condition before the thermal development. Furthermore, since the primary amine moiety is precedently blocked, when a ketone type solvent is used in the preparation of an image formation layer forming coating liquid described below, it is possible to inhibit the sensitivity variation due to elapsed time after the preparation of the coating liquid.

The ketone compound used for forming Schiff base with the above alkoxy silane compound can be used with no special limitation, but in terms of an odor issue caused when the image is formed by an image formation method described below, those with boiling point of 150° C. or below are preferable, and further those with boiling point of 100° C. or below are more preferable.

Such a Schiff base can include the compounds shown below, but it is not limited thereto as long as it is the Schiff base formed from the dehydrated condensation reaction of alkoxy silane compound having one or more primary amino groups with the ketone compound.

In the above compounds, for the purpose further saving the silver amount, Schiff base having one or more secondary amino groups in the molecule is more preferable. These Schiff bases may be used alone or in combination of two or more.

When alkoxy silane compound or the salt thereof or Schiff base is added in the image formation layer as the silver saving agent, it is preferable to typically add at the range of 0.00001 to 0.05 mol based on 1 mol of the silver. Also when alkoxy silane compound or the salt thereof and Schiff base are added in the image formation layer, both are in the same range.

However, when the addition amount of the above alkoxy silane compound and Schiff base based on 1 mol of the silver slightly increases, there are some cases where the image density at the unexposed part formed by the image formation method described below becomes high. Thus, for the purpose of moderating dependency of the addition amount of alkoxy silane compound or Schiff base to be added based on 1 mol of the silver, it is preferable to further add isocyanate compound having two or more isocyanate groups into the molecule of the image formation layer. As isocyanate compound, it is possible to use the isocyanate compounds used as the crosslinker described above.

The silver salt photothermographic dry imaging material of the invention can use a silver saving agent. The silver saving agent is referred to the compound which can reduce the silver amount required for obtaining the certain silver image density. Various action mechanisms are thought for the function of this reduction, and preferred are the compounds having the function to enhance a covering power of the developed silver. Here, the covering power of the developed silver is referred to the optical density of per unit amount of the silver. As the silver saving agent which can be used in the invention, included are the hydrazine derivative compounds disclosed in the paragraph numbers of [0075] to [0081] of JP-A-2001-66726, the vinyl compounds disclosed in the paragraph numbers of [0109] to [0132] of JP-A-2001-66726 and the quaternary onium compounds disclosed in the paragraph numbers of [0150] to [0158] of JP-A-2001-66726.

The addition amount of the above silver saving agent is in the range of $1\times10^{-5}$ to 1 mol, preferably from $1\times10^{-4}$ to $1\times10^{-1}$ mol per mol of the aliphatic silver carboxylate.

In the present invention, as one type of the silver saving agents, silane compounds can be preferably used. In the invention, it is preferred that the silane compound used as the silver saving agent is alkoxysilane compound having two or more primary or secondary amino groups or the salt thereof as described in JP-2001-192698. Here having two or more primary or secondary amino groups indicates containing two or more of only primary amino groups, two or more of only secondary amino groups and one or more of respective primary and secondary amino groups, and the salt of alkoxysilane compound is referred to an addition product of an inorganic or organic acid capable of forming an onium salt with amino groups and the alkoxysilane compound.

In the photothermographic dry imaging material of the invention can include a so-called matting agent besides glass-like fine particles at the thermal development temperature, the surface of which is hydrophobic, on the sensitive layer or on the opposite side thereof. The material of the matting agent used in the present invention may be either organic materials or inorganic materials. For example, as inorganic materials, the silica described in Switzerland Patent No. 330,158, the glass powder described in French Patent No. 1,296,995, the alkali earth metal or cadmium described in GB Patent No. 1,173,181, carbonate such as zinc and the like, and the like can be used as the matting agent. As organic materials, an organic matting agent such as the amylum described in U.S. Pat. No. 2,322,037, the amylum derivative described in Berugium Patent No. 625,451 or GB Patent No. 981,198 or the like, the polyvinyl alcohol described in JP-B-44-3643 or the like, the polystylene or polymethacrylate described in Switzerland Patent No. 330,158 or the like, the polyacrylonitrile described in U.S. Pat. No. 3,079,257 or the like, the polycarbonate described in U.S. Pat. No. 3,022,169 or the like can be used.

[Outer Layer]

In the present invention, it is preferred that organic or inorganic powder is used as the matting agent in the outer layer of the photothermographic imaging material (side of the image formation layer, also when non-photosensitive layer is installed at an opposite side of the image formation layer with interleaving the support) to control the object of the invention and surface roughness. As the powder used in the invention, it is preferable to use the powder with Mohs hardness of 5 or more. As the powder, it is possible to use by appropriately selecting inorganic or organic powders known in the art. The inorganic powders can include, for example, titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, cerium oxide, corundum, artificial diamond, pomegranate stone, garnet, mica, silica stone, silicon nitride, silicon carbide and the like. The organic powders can include, for example, powders of polymethylmethacrylate, polystyrene, teflon and the like. In these, preferred are the inorganic powders such as $SiO_2$, titanium oxide, $\alpha$-$Al_2O_3$, $\alpha$-$Fe_2O_3$, $\alpha$-FeOOH, $Cr_2O_3$, mica and the like, and especially preferable is $SiO_2$.

In the present invention, it is preferred that the powder has been surface-treated with Si compound or Al compound. When the powder with such surface treatment is used, it is possible to make the surface state of an uppermost layer good. For the content of the Si or Al, preferably Si is from 0.1 to 10% and Al is from 0.1 to 10%, and more preferably Si is from 0.1 to 5% and Al is 0.1 to 5%, and especially preferably Si is 0.1 to 2% and Al is 0.1 to 2% by mass based on the powder. Also it is better that the weight ratio of Si to Al is Si<Al. The surface treatment can be carried out by the method described in JP-A-2-83219. The average particle size of the powder in the invention means the average diameter in spherical powder, the average long axis length in needle-shaped powder, and the average value of maximum diagonal lines in the platy face in plate-shaped powder. It can be easily obtained from the measurement by electron microscopy.

The average particle size of the above organic or inorganic powder is preferably from 0.5 to 10 μm, and more preferably from 1.0 to 8.0 μm.

The average particle size of the organic or inorganic powder comprised in the outermost layer at the side of the photosensitive layer is typically from 0.5 to 8.0 μm, preferably from 1.0 to 6.0 μm, and more preferably from 2.0 to 5.0 μm. The addition amount is typically from 1.0 to 20%, preferably from 2.0 to 15%, and more preferably from 3.0 to 10% by mass based on the amount of the binders used for the outermost layer (a hardening agent is included in the binder amount). The average particle size of the organic or inorganic powder comprised in the outermost layer at the opposite side of the photosensitive layer with interleaving the support is typically from 2.0 to 15.0 μm, preferably from 3.0 to 12.0 μm, and more preferably from 4.0 to 10.0 μm. The addition amount is typically from 0.2 to 10%, preferably from 0.4 to 7%, and more preferably from 0.6 to 5% by mass based on the amount of the binders used for the outermost layer (a hardening agent is included in the binder amount).

Also, a variation coefficient of particle size distribution is preferably 50% or less, more preferably 40% or less and especially preferably 30% or less.

Here, the variation coefficient of particle size distribution is a value represented by the following formula.

$$\{(\text{Standard deviation of particle sizes})/(\text{Mean value of particle sizes})\}\times 100$$

An addition method of the organic or inorganic powder may be the method for coating by precedently dispersing in the coating solution or the method where after coating the coating solution, the organic or inorganic powder is sprayed before the completion of drying. Also when multiple types of the powders are added, both methods may be combined.

Materials of the support used for the photothermographic imaging material according to the invention include various polymer materials, glass, wool fabrics, cotton fabrics, paper, metals (e.g., aluminium) and the like, but flexible sheets or those capable of being made into rolls are suitable in terms of handling as information recording materials. Therefore, as the support in the photothermographic imaging material of the invention, preferred are plastic films (e.g., cellulose acetate film, polyester film, polyethylene terephthalate film, polyethylene naphthalate film, polyamide film, polyimide film, cellulose triacetate film or polycarbonate film), and in the invention, the biaxially stretched polyethylene terephthalate film is especially preferable. A thickness of the support is from about 50 to 300 μm, and preferably from 70 to 180 μm.

In the present invention, it is possible to include conductive compounds such as metal oxide and/or conductive polymer in the component layer to improve the electrostatic property. These may be contained in any layer, but preferably is comprised in the backing layer, the surface protection layer at the side of the photosensitive layer, the under coating layer and the like. In the present invention, preferably used are the conductive compounds described in columns 14 to 20 of U.S. Pat. No. 5,244,773.

Among others, in the invention, it is preferable to contain the conductive metal oxide in the surface protection layer at the side of the backing layer. It has been found that this further enhances the effects of the invention (especially, transport property at the thermal development). Here, the conductive metal oxide is crystalline metal oxide particle. Those comprising oxygen defect and those comprising heterogenous atoms at a small amount which form donors for the metal oxide used are especially preferable because they are highly conductive in general. In particular, the latter is especially preferable because they do not give the photographic fog to the silver halide emulsion. As examples of the metal oxide, preferred are ZnO, $TiO_2$, $SnO_2$, $Al_2O_3$, $In_2O_3$, $SiO_2$, MgO, BaO, $MoO_3$, $V_2O_5$ and the like, or composite oxides thereof, and in particular ZnO, $TiO_2$ and $SnO_2$ are preferable. As examples comprising heterogenous atoms, for example, the addition of Al, In to ZnO, the addition of Sb, Nb, P, halogen elements to $SnO_2$, and the addition of Nb, Ta to $TiO_2$ are effective. The addition amount of these heterogenous atoms is preferably in the range of 0.01 to 30 mol %, and the range of 0.1 to 10 mol % is especially preferable. Further also, to improve fine particle dispersibility and transparency, silicon compounds may be added at making fine particles. The metal oxide fine particles used for the invention have conductivity, and volume resistivity thereof is $10^7$ Ωcm or less, and especially $10^5$ Ωcm or less. These oxides are described in JP-A-56-143431, JP-A-56-120519, and JP-A-58-62647. Further also, the conductive materials by making the above metal oxides adhere to the other crystalline metal oxide particles or fibrous matters (e.g., titanium oxide) may be used, as described in JP-B-59-6235.

The particle size which can be utilized is preferably 1 μm or less, but when it is 0.5 μm or less, stability after the dispersion is good and the particles are easy-to-use. Also, to make light scattering small as possible, when the conductive particles of 0.3 μm or less are utilized, it becomes possible to form the clear imaging material, and thus it is extremely preferable. Also when the conductive metal oxide is needle-shaped or fibrous, it is preferred that the length is 30 μm or less and the diameter is 1 μm or less, and especially preferable is that the length is 10 μm or less, the diameter is 0.3 μm or less and a length/diameter ratio is 3 or more. Besides, $SnO_2$ is commercially available from Ishihara Sangyo Co. Ltd., and it is possible to use SNS10M, SN-100P, SN-100D, FSS10M and so on.

The photothermographic imaging material of the invention has the image formation layer which is at least one layer of the photosensitive layer on the support. Only the image formation layer may be formed on the support, but it is preferred that at least one layer of the non-photosensitive layer is formed on the image formation layer. For example, it is preferred that the protection layer is installed on the image formation layer for the purpose of protecting the image formation layer, and the back coat layer is installed at the opposite side of the support to prevent sticking between the photothermographic imaging materials or at the photothermographic imaging material roll. As the binders used for these protection layer and back coat layer, selected are polymers where the glass transition temperature is higher than that in the image formation layer and scratch and deformation unlikely occur, such as cellulose acetate and cellulose acetate butyrate from the binders.

For adjusting gradation, two or more of the image formation layers may be placed at one side of the support, or one or more may be placed at both side of the support.

[Dye]

In the photothermographic imaging material according to the invention, it is preferred that a filter layer is formed at the same side or the opposite side of the image formation layer, or dyes or pigments are contained in the image formation layer in order to control the amount or wavelength distribution of light transmitting the image formation layer.

As the dyes used in the invention, it is possible to use the compounds known in the art, which absorb light in various wavelength areas depending on color sensitivity of the photothermographic imaging material.

For example, in the case of making the photothermographic imaging material according to the invention an image recording material by infrared light, it is preferable to use squalirium dye having thiopyrylium nuclei (herein called thiopyrylium squalirium dye) and squalirium dye having pyrylium nuclei (herein called pyrylium squalirium dye) as disclosed in JP-A-2001-83655, and thiopyrylium chroconium dye or pyrylium chroconium dye which are similar to squalirium dyes.

The compounds having squalirium nuclei are the compound having l-cyclobutene-2-hydroxy-4-one in the molecular structure, and the compounds having chroconium nuclei are the compounds having 1-cyclopentene-2-hydroxy-4,5-dione in the molecular structure. Here, the hydroxy groups may be dissociated. Hereinafter, herein, these pigments are collectively called squalirium dyes for convenience. As the dye, the compounds of JP-A-8-201959 are also preferable.

When the prevention of irradiation is performed using the dye having the absorption at a visual light area, it is preferred that the color of the dye does not substantially remain after the image formation, and especially it is preferable to make thermal achromatizing material and a basic precursor function as an anti-irradiation layer by adding to the non-photosensitive layer. For this technology, it is possible to employ the methods described in JP-A-11-231457.

The above dye is generally used at the amount where the optical density exceeds 0.1, preferably from 0.2 to 2.0 when measured at an aimed wavelength. The addition amount of the dye for obtaining such an optical density is from about 0.001 to 1.0 g/m$^2$. The addition amount in this case indicates the total addition amounts when added to multiple layers. The layer to which the dye should be preferably added may be any of component layers, but it takes priority to contain in the non-photosensitive layer at the opposite side of the photosensitive layer viewed from the support in order to minimize the reduction of sensitivity.

[Coating of Component Layer]

It is preferred that the photothermographic imaging material of the invention is formed by making the coating solutions where the materials of each component layer described above are dissolved or dispersed in the solvent, overlaying and coating these coating solutions in plurality simultaneously, and then performing the treatment with heat. Here, "overlaying and coating in plurality simultaneously" means that the coating solution of each component layer (e.g., photosensitive layer, protection layer) is made, coating and drying are not repeated for each layer when coated on the support, and each component layer can be formed in the state where overlaying and coating is simultaneously performed and the drying step can be also simultaneously performed. That is, an upper layer is installed before a remaining amount of the total solvent in a lower layer becomes 70% or less by mass.

The method where respective layers are overlaid and coated in plurality simultaneously is not especially limited, and for example, it is possible to use the methods known in the art such as a bar coater method, curtain coat method, immersion method, air knife method, hopper coating method, and extrusion coating method. In these, preferred is the coating manner of previous measure type called the extrusion coating method. The extrusion coating method is suitable for precise coating and organic solvent coating because there is no volatilization on a slide face such as a slide coating method. This coating method was described for the side having the photosensitive layer, but it is the same in the case of coating along with the under coating layer when the back coat layer is installed. The simultaneous overlaying and coating method in the photothermographic imaging material is described in JP-A-2000-15173 in detail.

In the present invention, for a coated silver amount, it is preferable to select an appropriate amount depending on the purpose of the photothermographic imaging material. In the case of making an image for medical use a target, the amount is preferably 0.3 g/m$^2$ or more and 1.5 g/m$^2$ or less, and more preferably 0.5 g/m$^2$ or more and 1.5 g/m$^2$ or less. It is preferred that in the coated silver amount, the amount derived from the silver halide is from 2 to 18% based on the total silver amount. More preferably it is from 5 to 15%.

Also, in the present invention, a coating density of the silver halide grains of 0.01 μm or more (converted particle size of a corresponding sphere) is preferably $1\times10^{14}$/m$^2$ or more and $1\times10^{18}$/m$^2$ or less, and more preferably $1\times10^{15}$/m$^2$ or more and $1\times10^{17}$/m$^2$ or less.

Furthermore, the coating density of the non-photosensitive long chain aliphatic carboxylate silver is $1\times10^{-17}$ g or more and $1\times10^{-14}$ g or less, and more preferably $1\times10^{-16}$ g or more and $1\times10^{-15}$ g or less per silver halide particle of 0.01 μm or more (converted particle size of a corresponding sphere).

When coated in the condition within the above range, the preferable effects are obtained in terms of optical maximum density of silver image per constant coated silver amount, i.e., silver covering power and the color tone of the silver image.

In the present invention, it is preferred that the photothermographic imaging material contains the solvent at the range of 5 to 1000 mg/m$^2$ at the development. It is more preferable to adjust to be 100 to 500 mg/m$^2$. That makes the photothermographic imaging material with high sensitivity, low photographic fog and high maximum density.

The solvents include those described in [0030] of JP-A-2001-264930. But it is not limited thereto. Also these solvents can be used alone or in combination of several types.

The content of the above solvent in the photothermographic imaging material can be adjusted by condition changes such as temperature condition and the like in the drying step after the coating step. Also, the content of the solvent can be measured by gas chromatography under the condition suitable for detecting the contained solvent.

[Wrapping Body]

When the photothermographic imaging material of the invention is stored, it is preferable to store by housing in a wrapping body in order to prevent density change and occurrence of photographic fog with time. A void ratio in the wrapping body could be from 0.01 to 10%, and preferably from 0.02 to 5%. A nitrogen partial pressure in the wrapping body could be made 80% or more, and preferably 90% or more by performing nitrogen charging.

[Exposure of Photothermographic Imaging Material]

In the photothermographic imaging material of the invention, it is common to use laser light when recording the image. At exposure of the photothermographic imaging material of the invention, it is desirable to use a proper light source for the color sensitivity imparted to the material. For example, when the material is made one which can be sensitive to the infrared light, it can be applied for any light sources in the infrared light area, but infrared semiconductor laser (780 nm, 820 nm) is preferably used in terms of points where laser power is high and the photothermographic imaging material can be made transparent.

In the present invention, it is preferred that the exposure is carried out by laser scanning exposure, but various methods can be employed for the exposure methods. For example, the first preferable method includes the method using a laser scanning exposure machine where angles made by an exposure face of the imaging material and the scanning laser light do not substantially become perpendicular.

Here, "do not substantially become perpendicular" is referred to the angels of preferably 55° or more and 88° or less, more preferably 60° or more and $_{86}$° or less, still preferably 65° or more and 84° or less and most preferably 70° or more and 82° or less as the angle most closed to the perpendicular during the laser scanning.

The diameter of a beam spot on the exposure face of the imaging material when the laser light is scanned on the imaging material is preferably 200 μm or less, and more preferably 100 μm or less. This is preferable in that the smaller spot diameter can reduce a shift angle from the perpendicular of a laser light entry angle. A lower limit of the beam spot diameter is 10 μm. By performing the laser scanning exposure in this way, it is possible to reduce image quality deterioration due to reflected light such as an occurrence of interference fringe like unevenness.

Also, as the second method, it is also preferred that the exposure in the invention is carried out using a laser scanning exposure machine which emits the scanning laser light which is vertical multiple mode. Compared to the scanning laser light in vertical single mode, it further reduces the image quality deterioration such as the occurrence of interference fringe like unevenness.

To make the vertical multiple mode, the method by combining lights, the method by utilizing returned light and the method by loading high frequency superposition could be used. The vertical multiple mode means that the exposure wavelength is not a single, and typically the distribution of exposure wavelength could be 5 nm or more, and preferably 10 nm or more. An upper limit of the exposure wavelength is not especially limited, but typically is about 60 nm.

Furthermore, as the third method, it is preferable to form the image by scanning exposure using two or more laser lights.

Such an image recording method by utilizing multiple laser lights is the technology used for image writing means of laser printers and digital copying machines where the image with multiple lines are written by one scanning on the requisition of high resolution and high speed, and for example is known by JP-A-60-166916. This is the method where the laser light emitted from the light source unit is deflected and scanned by polygon mirror, and the imaging is performed on the photosensitive body via fθ lens, and this is principally the same laser scanning optical apparatus as a laser imager and the like.

In the imaging of the laser light on the photosensitive body in the image writing means of the laser printer and the digital copying machine, next laser light is imaged with shifting by one line from the imaging site of one laser light, for the use where multiple lines of the image are written by one scanning. Specifically, two light beam come close with an interval of some 10 μm order on an image face in a sub-scanning direction one another, when print density is 400 dpi (dpi indicates a dot number per inch, i.e., 2.54 cm), the pitch of two beams in the sub-scanning direction is 63.5 μm, and in the case of 600 dpi, it is 42.3 μm. Differently from the method which shifs by resolution segment to the sub-scanning direction in this way, in the invention, it is preferred that the image is formed by condensing two or more lasers with different entry angles on the exposure face at the same site. At that time, it is preferable to make the range of $0.9\times E \leqq E_n \times N \leqq 1.1\times E$ when an exposure energy on the exposure face is E when written by typical one laser light (wavelength λ[nm]), and when N of laser lights used for the exposure heve the same wavelength (wavelength λ[nm]) and the same exposure energy (En). The energy is secured on the exposure face in this way, the reflection of each laser light to the image formation layer is reduced because the exposure energy of the laser is low, and thus the occurrence of interference fringe is inhibited.

In the above, multiple laser lights with the same wavelength as λ were used, but those with different wavelength may be used. In this case, it is preferable to make the range $(\lambda-30)<\lambda_1, \lambda_2 \ldots \lambda_n \leqq (\lambda+30)$.

In the image recording methods of the above first, second and third aspects, as the laser used for the scanning exposure, it is possible to use by appropriately selecting solid lasers such as ruby laser, YAG laser and glass laser; gas lasers such as He—Ne laser, Ar ion laser, Kr ion laser, $CO_2$ laser, CO laser, He—Cd laser, $N_2$ laser and excimer laser; semiconductor laser such as InGap laser, AlGaAs laser, GaAsP laser, InGaAs laser, InAs laser, $CdSnP_2$ laser and GaSb laser; chemical lasers and pigment lasers generally well-known in conjugation with the use, but in these, it is preferable to use the laser light by the semiconductor laser with wavelength of 600 to 1200 nm in terms of the maintenance and the size of light source. In the laser light used for the laser imager and laser image setter, when scanned on the photothermographic imaging material, the beam spot diameter on the exposure face of the material is generally in the range of 5 to 75 μm as a minor axis diameter and 5 to 100 μm as a major axis diameter. For the laser light scanning velocity, an optimal value by photothermographic imaging material can be set by sensitivity and laser power at a laser oscillation wavelength inherent for the photothermographic imaging material.

[Thermal Development Apparatus]

The thermal development apparatus of the invention is made up of a film supplying portion represented by a film tray, a laser image recording portion, a photothermographic portion where uniform and stable heat is supplied on whole area of the photothermographic imaging material, and a transport portion from the film supplying portion, via the laser recording, to discharge of the photothermographic imaging material where the image is formed by the thermal development out of the apparatus. A specific example of this aspect of the thermal development apparatus is shown in FIG. 1.

A photothermographic apparatus 100 has a feeding portion 110 where a sheet-shaped photothermographic imaging material (photothermographic element or also referred to as film simply) is fed by one, an exposure portion 120 where the fed film F is exposed, a developing portion 130 where the exposed film is developed, a cooling portion 150 where the development is stopped, and an accumulating portion 160, and made up of multiple rollers such as a supplying roller pair 140 for supplying the film F from the feeding portion, a supplying roller pair 144 for delivering the film to the developing portion, and transport roller pairs 141, 142, 143 and 145 for smoothly transporting the film between the portions. The developing portion is made up of a heat drum 1 having multiple opposed rollers 2 capable of heating with retaining in adherence with a periphery as a heating means for the development of the film F, and a peeling tab 6 for peeling the developed film F and delivering to the cooling portion.

A transport velocity of the photothermographic imaging material is preferably in the range of 10 to 200 mm/sec.

The developing condition of the photothermographic imaging material of the invention varies depending on instruments, apparatus and means used, but typically, the development is carried out by heating the photothermographic imaging material exposed to an image at suitable high temperature. A latent image obtained after the exposure is developed by heating the photothermographic imaging material at moderately high temperature (from about 80 to 200° C., preferably from about 100 to 200° C.) for a sufficient time period (generally from about one second to about two minutes).

When the heating temperature is lower than 80° C., sufficient image density is not obtained in a short time, and when it is higher than 200° C., the binders are melted and adverse effects are given not only to the image itself but also to transport ability and a developing machine such as transfer to the rollers. The silver image is produced by an oxidation reduction reaction between the organic silver salt (functions as the oxidizing agent) and the reducing agent due to heating. This reaction process progresses with supplying no process liquid such as water from the outside.

As instruments, apparatus or means for heating, for example, a hot plate, iron, hot roller, typical heating means as a thermogenesis machine using carbon or white titanium may be used. More preferably, in the photothermographic imaging material with the protection layer, it is preferred that heating process is carried out by contacting the face at the side having the protection layer with the heating means in terms of performing uniform heating, heat efficiency and working property. It is preferred that the development is performed by transporting and heat processing with contacting the face at the side having the protection layer with the heat rollers.

In the invention, it is preferred that on the image obtained by thermally developing at a heating temperature of 123° C. for a developing time of 13.5 sec, an average gradation is from 2.0 to 4.0 at the optical density of 0.25 to 2.5 for diffused light in a characteristic curve shown on a rectangular coordinates where unit lengths of diffuse density (Y axis) and common logarithm exposure amount (X axis) are equal. By making the above gradation by appropriately regulating the sensitivity and the coated silver amount of the photosensitive silver halide grains and the layer components, it becomes possible to obtain the images with high diagnostic recognition.

At the time of development, the photothermographic dry imaging material of the invention is adjusted so that the solvent will be 40 to 4500 ppm, preferably, 100 to 500 ppm. Thereby, a photothermographic dry imaging material having high sensitivity, low photographic fog and high maximum density is obtained.

The solvents include those described in a paragraph number [0030] of JP-A-2001-264930, but are not limited thereto. Also, these solvents can be used alone or in combination with several types.

As the solvents, included are ketones such as acetone, methylethylketone and isophorone, alcohols such as methyl alcohol, ethyl alcohol, isopropyl alcohol, cyclohexanol and benzyl alcohol, glycols such as ethyleneglycol, diethyleneglycol, triethyleneglycol, propyleneglycol and hexyleneglycol, ether alcohols such as ethyleneglycol monomethylether and diethyleneglycol monoethylether, ethers such as isopropylether, esters such as ethyl acetate and butyl acetate, chlorides such as methylene chloride and dichlorobenzene, and hydrocarbons and the like. Additionally, the solvents include, but are not limited to, water, formamide, dimethyl formamide, toluidine, tetrahydrofuran, acetic acid and the like. These solvents can be used alone or in combination with several types.

Besides, the content of the above-described solvents in the photothermographic dry imaging material can be adjusted according to the condition change such as temperature condition or the like in the drying step after the coating step. Also, the content of the solvents can be measured by a gas chromatography under conditions suitable for detecting the solvents.

EXAMPLES

Hereinafter, the present invention is described in detail by examples, but the invention is not limited thereto.

Example 1

<<Manufacture of Support>>

Corona discharge treatment at 0.5 kV.A.min/$m^2$ was given to one side face of a polyethylene terephthalate film base (thickness 175 μm) blue-colored at a density of 0.170, and then using the following under coat coating solution A, an under coating layer a was applied on it such that the thickness of dried film became 0.2 μm. The corona discharge treatment at 0.5 kV.A.min/$m^2$ was similarly given to another face, and then using the following under coat coating solution B, an under coating layer b was applied on it such that the thickness of dried film became 0.1 μm. Subsequently, heat treatment was carried out at 130° C. for 15 min in a heat treating type oven having a film transport apparatus made up of multiple roller groups to make a support.

(Preparation of Under Coat Coating Solution A)

Copolymer latex solution (270 g) of 30% of n-Butyl acrylate, 20% of t-butyl acrylate, 25% of styrene and 25% of hydroxyethyl acrylate by mass (solid content 30%), 0.6 g of surfactant (UL-1) and 0.5 g methylcellulose were mixed. Further, a dispersing solution obtained by adding 1.3 g of silica particles (Syloid 350, supplied from Fuji Silysia Chemical Ltd.) to 100 g of water and dispersing by a ultrasonic dispersing machine (Ultrasonic Generator, frequency 25 kHz, 600 W supplied from ALEX Corporation) for 30 min was added, and finally the mixture was filled up with water to 1000 ml to make the under coat coating solution A.

(Preparation of Under Coat Coating Solution B)

The colloidal tin oxide dispersing solution (37.5 g), 3.7 g of the copolymer latex solution (solid content 30%) of 20% of n-butyl acrylate, 30% of t-butyl acrylate, 27% of styrene and 28% of 2-hydroxyethyl acrylate by mass, 14.8 g of the copolymer latex solution (solid content 30%) of 40% of n-butyl acrylate, 20% of styrene and 40% of glycidyl methacrylate by mass, and 0.1 g of the surfactant (UL-1) were mixed, and filled up with water to 1000 ml to make the under coat coating solution B.

(Preparation of Colloidal Tin Oxide Dispersing Solution)

Tin chloride hydrate (65 g) was dissolved in 2000 ml of a water/ethanol mix solution to prepare a uniform solution. Then, this was boiled to yield coprecipitate. The produced precipitate was taken out by decantation, and washed with distilled water several times. Silver nitrate was dripped in the distilled water with which the precipitate was washed and it was confirmed that there was no chlorine ion reaction. Subsequently, distilled water was added to the washed precipitate and the total amount was made 2000 ml. Further, 40 ml of 30% aqueous ammonia was added, the aqueous solution was heated and concentrated until the volume became 470 ml to prepare the colloidal tin oxide dispersing solution.

UL-1

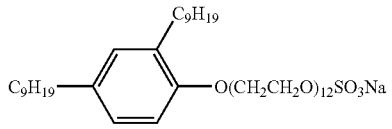

<<Coating of Back Face Side>>

Cellulose acetate butyrate (84.2 g) (Eastman Chemical Company, CAB381-20) and 4.5 g of polyester resin (Bostic Inc., Vitel PE2200B) was added to and dissolved in 830 g of methylethylketone (hereinafter abbreviated MEK) with stirring. Then, 0.3 g of the infrared dye 1 was added to the dissolved solution, and further 4.5 g of the fluorinated surfactant (supplied from Asahi Glass Co., Ltd., Surflon KH40) and 2.3 g of the fluorinated surfactant (supplied from Dainippon Ink And Chemicals, Incorporated, Megafag F120K) dissolved in 43.2 g of methanol were added and thoroughly stirred until being dissolved. Finally, 75 g of silica (supplied from W. R. Grace, Syloid 64×6000) dispersed in MEK at a concentration of 1% by mass by a dissolver type homogenizer was added and stirred to prepare the coating solution for the back face side.

INFRARED DYE 1

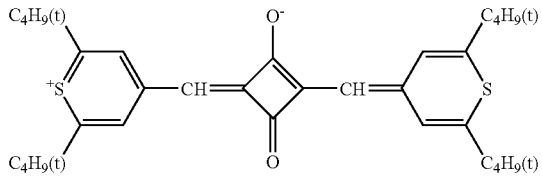

The back face coating solution prepared in this way was coated on the prepared under coating layer a of the support by an extruding coater such that the thickness of dried film became 3.5 μm, and dried. Drying was performed over 5 min using a drying wind with a drying temperature of 100° C. and a dew point of 10° C.

<<Preparation of Photosensitive Silver Halide Emulsion>>

[Preparation of Photosensitive Silver Halide Emulsion 1]

| | |
|---|---|
| (Solution A1) | |
| Phenylcarbamoyled gelatin | 88.3 g |
| Compound A (*1) (aqueous solution of 10% methanol) | 10 ml |
| Potassium bromide | 0.32 g |
| are filled up with water to 5429 ml. | |
| (Solution B1) | |
| Aqueous solution of 0.67 mol/L silver nitrate | 2635 ml |
| (Solution C1) | |
| Potassium bromide | 51.55 g |
| Potassium iodide | 1.47 g |
| are filled up with water to 660 ml | |
| (Solution D1) | |
| Potassium bromide | 154.9 g |
| Potassium iodide | 4.41 g |
| $K_3OsCl_6$ + $K_4[Fe(CN)_6]$ (dopants, corresponding to 2 × $10^{-5}$ mol/Ag, respectively) | 50.0 ml |
| are filled up with water to 1982 ml | |
| (Solution E1) | |
| Aqueous solution of 0.4 mol/L potassium bromide amount for control of the following silver potential | |
| (Solution F1) | |
| Potassium hydroxide | 0.71 g |
| is filled up with water to 20 ml. | |
| (Solution G1) | |
| Aqueous solution of 56% acetic acid | 18.0 ml |
| (Solution H1) | |
| Sodium carbonate anhydride | 1.72 g |
| is filled up with water to 151 ml. | |

(*1) Compound: $HO(CH_2CH_2O)_n(CH(CH_3)CH_2O)_{17}(CH_2CH_2O)_mH$ (m + n = 5 to 7)

Using a mix agitator described in JP-B-58-58288, ¼ amount of the solution B1 and the whole amount of the solution C1 were added to the solution A1 over 4 min 45 sec by the simultaneous mixing method with controlling the temperature at 30° C. and pAg at 8.09 to perform nucleus formation. After one min, the whole amount of the solution F1 was added. In the meantime, the adjustment of pAg was appropriately performed using the solution E1. After 6 min, the temperature was elevated to 40° C., and ¾ amount of the solution B1 and the whole amount of the solution D1 were added over 14 min 15 sec by the simultaneous mixing method with controlling pAg at 8.09. After stirring for 5 min, the whole amount of the solution G1 to precipitate a silver halide emulsion. Supernatant was eliminated with leaving 2000 ml of a precipitated portion, 10 L of water was added and stirred to precipitate the silver halide emulsion again. The supernatant was eliminated with leaving 1500 ml of the precipitated portion, further 10L of water was added and stirred to precipitate the silver halide emulsion. The supernatant was eliminated with leaving 1500 ml of the precipitated portion, subsequently the solution H1 was added, the temperature was elevated to 60° C., and the solution was further stirred for 120 min. Finally, the pH was adjusted to 5.8 and water was added such that the amount became 1161 g per mol of the silver amount to yield the emulsion.

This emulsion was monodisperse cubic iodide bromide silver particles with the average particle size of 0.050 μm, the variation coefficient of particle sizes of 12% and [100] face ratio of 92%.

<<Preparation of Photosensitive Layer Coating Solution>>

(Preparation of Powder Aliphatic Silver Carboxylate A)

Behenic acid (130.8 g), 67.7 g of arachidic acid, 43.6 g of stearic acid and 2.3 g of palmitic acid were dissolved in 4720 ml of pure water at 80° C. Next, 540.2 ml of an aqueous solution of 1.5 mol/L sodium hydroxide was added, 6.9 ml of concentrated nitric acid was added, and subsequently cooled to 55° C. to yield a solution of sodium fatty acid. The solution of sodium fatty acid was stirred for 20 min with retaining the temperature at 55° C., then 45.3 g (corresponding to 0.39 mol of the silver) of the above photosensitive silver halide emulsion 1 and 450 ml of pure water were added and stirred for 5 min.

Next, 702.6 ml of 1 mol/L silver nitrate solution was added over 2 min and stirred for 10 min to yield an aliphatic silver carboxylate dispersion. Subsequently, the obtained aliphatic silver carboxylate dispersion was transferred into a water-washing vessel, distilled water was added and stirred, then left to float and separate the aliphatic silver carboxylate dispersion, and lower water soluble salts were eliminated. Subsequently, water-washing with distilled water and discharging water were repeated until the electric conductivity of the discharged water became 50 μS/cm, and then centrifugation and dehydration were carried out. The resultant cake-shaped aliphatic silver carboxylate was dried using a flash dryer, Flash Jet Dryer (supplied from Seishin Enterprise Co., Ltd.) by an operation condition of nitrogen gas atmosphere and hot wind temperature at a dryer inlet until the water content became 0.1% to yield the powder aliphatic silver carboxylate A. An infrared moisture meter was used for the water content measurement of the aliphatic silver carboxylate composition.

(Preparation of Predispersing Solution A)

Polyvinyl butyral resin (14.57 g) was dissolved in 1457 g of MEK, 500 g of the above powder aliphatic silver carboxylate A was gradually added with stirring using a dissolver, DISPERMAT CA-40M type supplied from VMA-GETZMANN, and mixed thoroughly to prepare the predispersing solution A.

(Preparation of Photosensitive Emulsion Dispersing Solution A)

The predispersing solution A prepared above was supplied to a media type dispersing machine, DISPERMAT SL-C12EX type (supplied from VMA-GETZMANN) where zirconia beads (supplied from Toray Industries, Inc., Toreselam) with a diameter of 0.5 mm were filled up to 80% of an inner volume such that a staying time in a mill is 1.5 min using a pump, the dispersion was carried out at a mill peripheral velocity of 8 m/s to prepare the photosensitive emulsion dispersing solution A.

(Preparation of Stabilizer Solution)

The stabilizer 1 (1.0 g) and 0.31 g of potassium acetate were dissolved in 4.97 g of methanol to prepare the stabilizer solution.

(Preparation of Infrared Sensitizing Dyestuff Solution A)

The infrared sensitizing dyestuff 1 (19.2 mg), 1.488 g of 2-chloro-benzoic acid, 2.779 g of the stabilizer 2 and 365 mg of 5-methyl-2-mercaptobenzimidazole were dissolved in 31.3 ml of MEK in a dark place to prepare the infrared sensitizing dyestuff solution A.

(Preparation of Additive Solution A)

The following thiuronium salt 1 (50 mg) was dissolved in 5.0 g of methanol to prepare the additive solution A.

(Preparation of Additive Solution B)

Sodium benzenethiosulfonate (1.0 g) was dissolved in 9.0 g of MEK to prepare the additive solution B.

(Preparation of Additive Solution a)

The following developer (27.98 g), 0.7 g of the following yellow coloring leuco dye, 1.54 g of 4-methyl phthalate and 0.48 g of the above infrared dye 1 were dissolved in 110 g of MEK to make the additive solution a.

(Preparation of Additive Solution b)

The Antifoggant 2 (1.56 g) and 3.43 g of phthalazine were dissolved in 40.9 g of MEK to make the additive solution b.

(Preparation of Additive Solution c)

The following vinyl compound A (0.5 g) was dissolved in 39.5 g of MEK to make the additive solution c.

(Preparation of Photosensitive Layer Coating Solution A)

Under an atmosphere of inert gas (nitrogen 97%), the above photosensitive emulsion dispersing solution A (50 g) and 15.11 g of MEK were retained at 21° C. with stirring, 390 μl of the Antifoggant 1 (10% methanol solution) was added, and stirred for 1 hour. Further, 494 μl of calcium bromide (10% methanol solution) was added and stirred for 20 min. Subsequently, 167 ml of the above stabilizer solution was added and stirred for 10 min, then 1.32 g of the above infrared sensitizing dye solution A was added and stirred for 1 hour, 6.4 g of the above additive solution A and 0.5 g of the additive solution B were sequentially added, immediately after this, the temperature was cooled to 13° C. and the mixture was further stirred for 30 min. With retaining the temperature at 13° C., 13.31 g of butyral resin (Butvar) was added as the binder resin and stirred for 30 min, then 1.084 g of tetrachlorophthalic acid (9.4% by mass in MEK solution), and stirred for 15 min. With further stirring, 12.43 g of the additive solution a, 1.6 ml of Desmodur N3300/aliphatic isocyanate supplied from Mobey (10% in MEK solution), 4.27 g of the additive solution b and 4.0 g of the additive solution c were sequentially added and stirred to obtain the photosensitive layer coating solution A.

<<Preparation of Surface Protection Layer Coating Solution>>

Cellulose acetate butyrate (96 g)(Eastman Chemical, CAB171-15), 4.5 g of polymethylmethacrylate (Rohm & Haas, Paraloid A-21), 1.5 g of vinylsulfone compound (VSC), 1.0 g of benzotriazole and 1.0 g of the fluorinated surfactant (Asahi Glass Co., Ltd., Surflon KH40) were added to and dissolved in 865 g of MEK with stirring. Next, 30 g of the following matting agent dispersion was added and stirred to prepare the surface protection layer coating solution.

(Preparation of Matting Agent Dispersion)

Cellulose acetate butyrate (7.5 g CAB171-15, supplied from Eastman Chemical) was dissolved in 42.5 g of MEK, 5 g of calcium carbonate (Speciality Minerals, Super-Pflex 200) was added thereto and dispersed by the dissolver type homogenizer at 8000 rpm for 30 min to prepare the matting agent dispersion.

STABILIZER 1

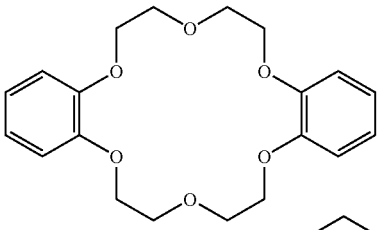

STABILIZER 2

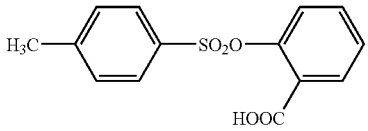

INFRARED SENSITING DYE 1

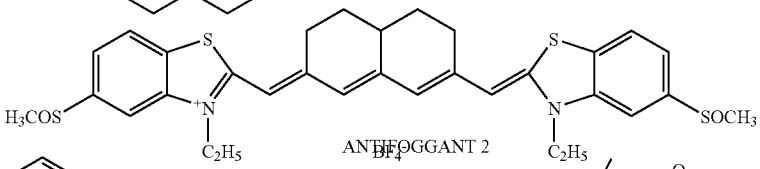

ANTIFOGGANT 2

ANTIFOGGANT 1

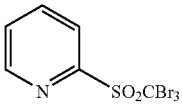

VSC

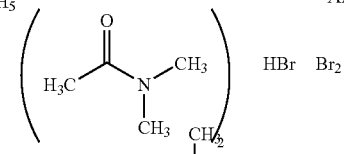

DEVELOPER 1

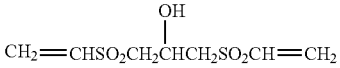

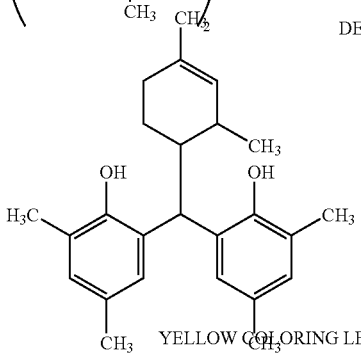

THIURONIUM SALT 1

YELLOW COLORING LEUCO DYE 1

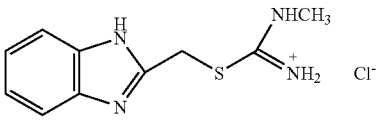

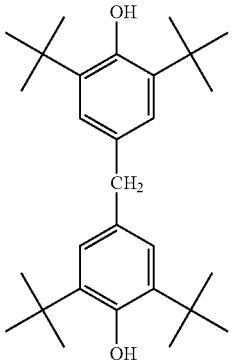

VINYL COMPOUND A

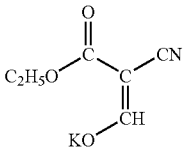

<<Manufacture of Silver Salt Photothermographic Dry Imaging Material>>

(Manufacture of Sample 101)

The sample 101 was made by simultaneously overlaying and coating the photosensitive layer coating solution A and the surface protection layer coating solution prepared above on the under coating layer b made above of the support using an extrusion type coater known in the art. The coating was carried out such that the coated silver amount of the photosensitive layer is 1.5 g/m$^2$ and the dried film thickness of the surface protection layer is 2.5 μm. Subsequently, drying was carried out for 10 min using the drying wind with the drying temperature at 75° C. and the dew temperature at 10° C.

(Manufacture of Samples 102 to 115)

The samples 102 to 115 were made as is the case with the manufacture of the sample 101 except for combining types of the photosensitive silver halide emulsion in the photosensitive layer coating solution A, the presence or absence of the tertiary alcohol addition at the preparation of the aliphatic silver carboxylate and change levels of the cyan coloring leuco dye as described in Table 1.

[Preparation of Photosensitive Silver Halide Emulsion 2]

The photosensitive silver halide emulsion 2 was prepared as is the case with the preparation of the photosensitive silver halide emulsion 1 described in the example 1, except that the temperature was changed to 27° C., at which ¾ amount of the solution B1 and the whole amount of the solution D1 were added over 14 min 15 sec by the simultaneous mixing method with controlling pAg at 8.09.

This emulsion was monodisperse cubic iodide bromide silver particles with the average particle size of 0.030 μm, the variation coefficient of particle sizes of 14% and the [100] face rate of 90%.

[Preparation of Photosensitive Silver Halide Emulsion 3]

The photosensitive silver halide emulsion 3 was prepared as is the case with the preparation of the photosensitive silver halide emulsion 1 described in the example 1, except that the temperature was changed to 60° C., at which ¾ amount of the solution B1 and the whole amount of the solution D1 were added over 14 min 15 sec by the simultaneous mixing method with controlling pAg at 8.09.

This emulsion was monodisperse cubic iodide bromide silver particles with the average particle size of 0.080 μm, the variation coefficient of particle sizes of 14% and the [100] face rate of 92%.

(Preparation of Powder Aliphatic Silver Carboxylate in the Presence of t-butyl Alcohol)

The powder aliphatic silver carboxylate was prepared in the presence of t-butyl alcohol as is the case with the preparation of the powder aliphatic silver carboxylate A in the example 1, except that after obtaining the aliphatic sodium salt, with retaining the temperature at 55° C., 347 ml of t-butyl alcohol, t-BuOH was added and stirred for 20 min and the photosensitive silver halide emulsion was changed to one described in Table 1.

(Preparation of Powder Aliphatic Silver Carboxylate in the Presence of 1,1-dimethyl-1-ethylmethanol)

The powder aliphatic silver carboxylate was prepared in the presence of 1,1-dimethyl-1-ethylmethanol as is the case with the preparation of the powder aliphatic silver carboxylate A in the example 1, except that after obtaining the aliphatic sodium salt, with retaining the temperature at 55° C., 545 ml of 1,1-dimethyl-1-ethylmethanol was added and stirred for 20 min and the photosensitive silver halide emulsion was changed to one described in Table 1.

(Preparation of Powder Aliphatic Silver Carboxylate in the Presence of 1,1-dimethyl-1-phenylmethanol)

The powder aliphatic silver carboxylate was prepared in the presence of 1,1-dimethyl-1-phenylmethanol as is the case with the preparation of the powder aliphatic silver carboxylate A in the example 1, except that after obtaining the aliphatic sodium salt, with retaining the temperature at 55° C., 638 ml of 1,1-dimethyl-1-phenylmethanol was added and stirred for 20 min and the photosensitive silver halide emulsion was changed to one described in Table 1.

(Preparation of Leuco Dye Additive Solution of the Invention)

In the preparation of the additive solution a in the example 1, the cyan coloring leuco dye shown in Table 1 was additionally added and the additive solution where the leuco dye was mixed and dissolved in the additive solution a was prepared such that the leuco dye and the above yellow coloring leuco dye were combined, and the amount added to the coating solution was not changed. The amount of each leuco dye dissolved in the additive solution was all 0.07 g regardless of its type.

In the sample 115, the type of the silver ion

TABLE 1

| | CONFIGURATION | | | | | |
|---|---|---|---|---|---|---|
| | AgXPARTICLE SIZE(PERCENTAGE %) | | | | | |
| SAMPLE No. | SILVER HALIDE EMULSION-2 0.03 μm | SILVER HALIDE EMULSION-1 0.05 μm | SILVER HALIDE EMULSION-3 0.08 μm | TERTIARY ALCOHOL | CYAN COLORING LEUCO DYE | REMARKS |
| 101 | — | 100 | — | — | — | COMP. |
| 102 | 30 | 70 | — | — | — | COMP. |
| 103 | — | 100 | — | t-BuOH | — | COMP. |
| 104 | 30 | 70 | — | t-BuOH | — | COMP. |
| 105 | — | 100 | — | — | CA-3 | COMP. |
| 106 | 30 | 70 | — | — | CA-3 | INV. |
| 107 | — | 100 | — | t-BuOH | CA-3 | COMP. |
| 108 | 30 | 70 | — | t-BuOH | CA-3 | INV. |
| 109 | 70 | 30 | — | t-BuOH | CA-3 | COMP. |

TABLE 1-continued

| | CONFIGURATION | | | | | |
|---|---|---|---|---|---|---|
| | AgXPARTICLE SIZE(PERCENTAGE %) | | | | | |
| SAMPLE No. | SILVER HALIDE EMULSION-2 0.03 μm | SILVER HALIDE EMULSION-1 0.05 μm | SILVER HALIDE EMULSION-3 0.08 μm | TERTIARY ALCOHOL | CYAN COLORING LEUCO DYE | REMARKS |
| 110 | 15 | 70 | 15 | t-BuOH | CA-3 | INV. |
| 111 | 15 | 70 | 15 | *1 | CA-3 | INV. |
| 112 | 15 | 70 | 15 | *2 | CA-3 | INV. |
| 113 | 15 | 70 | 15 | t-BuOH | CA-5 | INV. |
| 114 | 15 | 70 | 15 | t-BuOH | CA-8 | INV. |
| 115 | 15 | 70 | 15 | t-BuOH | CA-3 | INV. |

*1 1,1-DIMETHYL-1-ETHYLMETANOL
*2 1,1-DIMETHYL-1-PHENYLMETHANOL

DEVELOPER 2

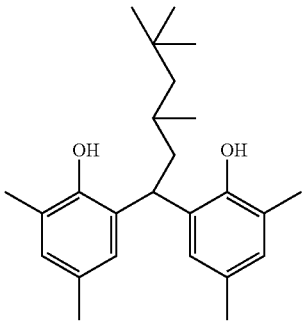

<<Evaluation of Exposure, Development Processing and Respective Property Values>>

(Exposure and Development Processing)

Each sample made above was stored at 25° C. and at 50% RH (condition A) for 10 days, and subsequently exposure by laser scanning was given from the photosensitive layer coated side of each sample using an exposing machine making semiconductor laser (maximum output of 70 mW by combining two waves with maximum output of 35 mW) with wavelength of 800 to 820 nm at high frequency superposition in vertical multiple mode an exposure source. At that time, the image was formed by making an angle of an exposure face of the sample and the exposure laser light 75 degree. In this method, compared to the case of making the angle 90 degree, good results such as less unevenness and unexpected sharpness were obtained.

Subsequently, using an automatic developing machine having a heat drum, the thermal development was carried out at 125° C. for 15 sec such that the surface protection layer of the sample was contacted with the surface of heat drum, and then the photothermographic imaging material was transport out of the apparatus. At that time, the transport velocity from the imaging material supplying portion to the image exposure portion, the transport velocity at the image exposure portion, and the transport velocity at the thermal development portion was 20 mm/sec, respectively. Also, the above exposure and development were carried out in a room adjusted at 23° C. and at 50% RH.

(Measurement of Sensitivity and Photographic Fog Density)

In the formed image obtained as the above, the density was measured using a photographic densitometer, and a property curve was made which is made up of a horizontal axis-sensitivity and a vertical axis-density. For a relative sensitivity, a reciprocal of an exposure amount which gives 1.0 higher density than that at an unexposed part was defined as the sensitivity, and the photographic fog density (minimum density) and the maximum density were measured. The relative density was represented by a relative value when the sensitivity of the sample 101 was made 100.

(Measurement of u* and v* in CIE 1976 Color Space)

($R^2$ Value Condition A)

From each sample stored at 25° C. and at 50% RH (condition A) for 10 days, a developed wedge sample with 4 stages comprising an unexposed part, and optical density at 0.5, 1.0 and 1.5 was made using the above thermal development apparatus. Each wedge density part made in this way was measured by CM-3600d (supplied from Minolta Co., Ltd.), and u* and v* were calculated. At that time, under the measurement condition making F7 light source the light source and making an angle of field 10°, the measurement was carried out in a transmission measurement mode. Measured u* and v* were plotted on a graph where the horizontal and vertical axes were made u* and v*, respectively, a linear regression straight line was obtained and made a multiple determination $R^2$ value condition A. This value is the value indicating the degree of color tone change. The closer to 1.0 the value is, it indicates the lesser change of color tone at each density and to be preferable.

($R^2$ Value Condition B)

Under the environment at 45° C. and at 55% RH, the developed sample made in the above $R^2$ value condition A was continuously radiated for 3 days by a commercially available white fluorescent light disposed such that an illuminance at both side surfaces of the photosensitive layer is 9000 Lux, and subsequently, the linear regression straight line was obtained completely as with the $R^2$ value condition A, and made a multiple determination $R^2$ value condition B. This evaluation is a quantitative value indicating the degree of color tone change at each density after the storage of the image.

(Average $R^2$ Value)

In the above method for obtaining $R^2$ value condition A, the completely same exposure and development were continuously given to 100 sheets, 100 developed samples for each density were made, the average value of respective $R^2$ values was obtained to make the average $R^2$ value. This indicates reproducibility of the $R^2$ value in every development.

(Evaluation of Image Density Unevenness Resistance)

Each sample was left under the above condition A for 10 days, then thermally developed by the same method as that for the above sensitivity and photographic fog measurement, subsequently the obtained image was visually evaluated, and the image density unevenness resistance was evaluated according to the following criteria.

A: No image unevenness

B: Slight image unevenness is observed by steady gaze but in practically acceptable range C: Obvious image unevenness is observed and quality with with a thickness such that a film thickness after heat setting is 175 μm.

This undrawn PET film was vertically drawn to 3.3 times using rollers with different periphery velocity, and then horizontally drawn to 4.5 times using a tenter. At that time, the temperatures were 110° C. and 130° C., respectively. Subsequently, this was heat-set at 240° C. for 20 sec, and relaxed by 4% in a horizontal direction at the same temperature. Subsequently, after slitting a chock portion of the tenter, a knurling was given at both ends, and the film was rolled up at 40 N/cm$^2$ to yield a roll-shaped support with the thickness of 175 μm.

TABLE 2

| SAMPLE No. | PHOTOGRAPHIC FOG | RELATIVE SENSITIVITY | MAXIMUM DENSITY | $R^2$ VALUE CONDITION A | $R^2$ VALUE CONDITION B | AVERAGE $R^2$ VALUE | DENSITY UNEVENNESS | REMARKS |
|---|---|---|---|---|---|---|---|---|
| 101 | 0.20 | 100 | 3.30 | 0.88 | 0.86 | 0.85 | C | COMP. |
| 102 | 0.19 | 85 | 3.50 | 0.81 | 0.76 | 0.77 | C | COMP. |
| 103 | 0.20 | 100 | 3.30 | 0.90 | 0.88 | 0.87 | C | COMP. |
| 104 | 0.19 | 88 | 3.50 | 0.83 | 0.77 | 0.79 | C | COMP. |
| 105 | 0.20 | 102 | 3.30 | 0.95 | 0.93 | 0.91 | B | COMP. |
| 106 | 0.18 | 110 | 3.65 | 1.00 | 0.99 | 0.99 | A | INV. |
| 107 | 0.20 | 103 | 3.30 | 0.91 | 0.88 | 0.89 | B | COMP. |
| 108 | 0.18 | 105 | 3.75 | 1.00 | 0.99 | 0.99 | A | INV. |
| 109 | 0.18 | 70 | 3.65 | 0.86 | 0.80 | 0.82 | B | COMP. |
| 110 | 0.18 | 115 | 3.75 | 1.00 | 0.99 | 0.99 | A | INV. |
| 111 | 0.18 | 115 | 3.75 | 1.00 | 0.99 | 0.99 | A | INV. |
| 112 | 0.18 | 115 | 3.75 | 1.00 | 0.99 | 0.99 | A | INV. |
| 113 | 0.18 | 116 | 3.71 | 1.00 | 0.99 | 0.99 | A | INV. |
| 114 | 0.18 | 115 | 3.79 | 1.00 | 0.99 | 0.99 | A | INV. |
| 115 | 0.18 | 115 | 3.75 | 1.00 | 0.99 | 0.99 | A | INV. |

As is obvious from the results in Table 2, the maximum density becomes high but the color tone is deteriorated only when the photosensitive silver halide grains are formed within the particle size ratio of the invention or when the non-photosensitive aliphatic silver carbonate particles are formed in the presence of tertiary alcohol.

On the other hand, when the cyan coloring leuco dye of the invention is combined, any $R^2$ value comes close to 1.00, and the image can be improved to the preferable color tone.

This indicates that the image is improved to the preferable color tone at each density, indicating that the image storage stability after the development and the reproducibility in every processing are extremely excellent.

Further surprisingly, in the samples of the invention, density unevenness after the development was improved. The reason for this is not unclear, but when visually observed, not only the density unevenness in the same hue but also effects of delicate hue are included, and thus it is believed that the change of hue at each density becomes extremely small due to the color tone improvement effect of the invention.

Example 2

<<Manufacture of Polyethylene Terephthalate Support>>

Polyethylene terephthalate with an intrinsic viscosity IV=0.66 (measured in phenol/tetrachloroethane=6/4 (mass ratio) at 25° C.)(hereinafter abbreviated as PET) was obtained using terephthalic acid and ethyleneglycol according to the standard method. This was pelletized, then dried at 130° C. for 4 hours, melted at 300° C., then extruded from a T type die, and rapidly cooled to make an undrawn film (Surface Corona Treatment of Support)

Using a solid state corona treating equipment 6 KVA model supplied from Piller Technologies, both sides of the support were treated at 20 m/min under the room temperature. From read values of current and voltage at that time, it was found that the support was treated with 0.375 kV.A.min/m$^2$. At that time, a treating frequency was 9.6 kHz and a gap clearance of an electrode and dielectric material roll was 1.6 mm.

<<Manufacture of under coated support>>

(Manufacture of ground coat layer coating solution)

(Coating solution for under coating layer at image formation side)

| | |
|---|---|
| PES resin A-520 supplied from Takamatsu Oil & Fat Co., Ltd. (30% by mass solution) | 234 g |
| Polyethyleneglycol monononylphenylether (average ethylene oxide number = 8.5, 10% by mass solution) | 21.5 g |
| Polymer fine particles (MP-1000, average particle size of 0.4 μm, supplied from Soken Chemical & Engineering Co., Ltd.) | 0.91 g |
| Distilled water | 935 ml |

(Coating solution for under coating layer first layer at back face side)

| | |
|---|---|
| Styrene-butadiene copolymer latex (solid content 40% by mass, mass ratio of styrene/butadiene = 68/32) | 158 g |
| 2,4-Dichloro-6-hydroxy-S-triazine sodium salt (8% by mass aqueous solution) | 20 g |
| Sodium laurylbenzenesulfonate (1% by mass aqueous solution) | 10 ml |

-continued

| <<Manufacture of under coated support>> | |
|---|---|
| Distilled water | 854 ml |
| (Coating solution for under coating layer second layer at back face side) | |
| $SnO_2/SbO$ (9/1 mass ratio, average particle size of 0.038 μm, 17% by mass dispersion) | 84 g |
| Gelatin (10% by mass aqueous solution) | 89.2 g |
| Metolose TC-5 (supplied from Shin-Etsu Chemical Co., Ltd., 2% by mass aqueous solution) | 8.6 g |
| MP-1000 (supplied from Soken Chemical & Engineering Co., Ltd.) | 0.01 g |
| Sodium dodecylbenzenesulfonate (1% by mass aqueous solution) | 10 ml |
| NaOH (1% by mass) | 6 ml |
| Proxel (supplied from ICI Inc.) | 1 ml |
| Distilled water | 805 ml |

The above corona discharge treatment was given to both sides of the biaxially stretched PET support with the thickness of 175 μm made above, and subsequently, the above coating solution for the under coating layer at the side of image formation face was coated on the image formation layer face by a wire bar such that the wet coated amount was 6.6 ml/m$^2$ (per one side) and dried at 180° C. for 5 min. Then, the above coating solution for the under coating layer first layer at the side of back face was coated on the back face thereof (back face side) by the wire bar such that the wet coated amount was 5.7 ml/m$^2$ and dried at 180° C. for 5 min. Further, the above coating solution for the under coating layer second layer at the side of back face was coated on the back face (back face side) by the wire bar such that the wet coated amount was 7.7 ml/m$^2$ and dried at 180° C. for 6 min to make the under coated support.

<<Preparation of Back Face Side Coating Solution>>

(Preparation of Solid Fine Particle Dispersion (a) of Base Precursor)

A base precursor compound 1 (64 g), 28 g of diphenylsulfone, 10 g of Demol N, the surfactant supplied from Kao Corporation were mixed with 220 ml of distilled water, and the mixed solution was dispersed into beads using a sand mill (1.14L, Sand Grinder Mill supplied from Imex Corporation) to yield the solid fine particle dispersion (a) of the base precursor compound with the average particle size of 0.2 μm.

BESE PRECURSOR COMPOUND 1

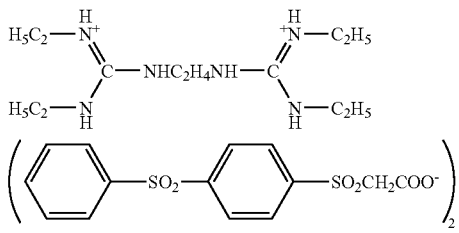

(Preparation of Dye Solid Fine Particle Dispersion)

A cyanine dye compound 1 (9.6 g) and 5.8 g of sodium p-dodecylbenzenesulfonate were mixed with 305 ml of distilled water, and the mixed solution was dispersed into beads using the sand mill (1.14L, Sand Grinder Mill supplied from Imex Corporation) to yield the dye solid fine particle dispersion with the average particle size of 0.2 μm.

CYANINE DYE COMPOUNND 1

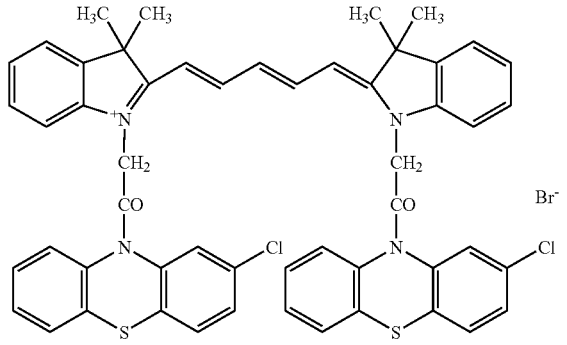

(Preparation Anti-Halation Layer Coating Solution)

Gelatin (17 g), 9.6 g of polyacrylamide, 56 g of the above solid fine particle dispersion (a), 50 g of the above dye solid fine particle dispersion, 1.5 g of monodisperse polymethylmethacrylate fine particles (average particle size 8.0 μm, particle size standard deviation 0.4), 0.03 g of benzisothiazolin, 2.2 g of sodium polyethylene sulfonate, 0.1 g of a blue dye compound, and 844 ml of water were mixed to yield the anti-halation layer coating solution.

BLUE DYE COMPOUND 1

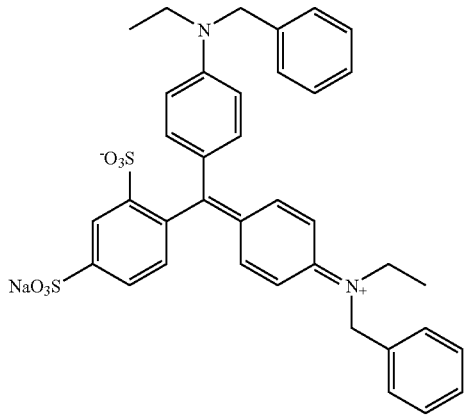

(Preparation of Back Face Protection Layer Coating Solution)

A vessel was kept at 40° C., 50 g of gelatin, 0.2 g of sodium polyethylene sulfonate, 2.4 g of N,N-ethylene bis (vinylsulfone acetamide), 1 g of sodium t-octylphenoxyethoxyethane sulfonate, 30 mg of benzisothiazolin, 37 mg of the fluorinated surfactant (F-1), 150 mg of the fluorinated surfactant (F-2), 64 mg of the fluorinated surfactant (F-3), 32 mg of the fluorinated surfactant (F-4), 8.8 g of acrylic acid/ethylacrylate copolymer (copolymerization ratio of 5/95), 0.6 g of aerosol OT (supplied from American Cyanamid Corporation), 1.8 g of liquid paraffin emulsion as the liquid paraffin, and 950 ml of water were mixed to make the back face protection layer coating solution.

F-1: $C_8F_{17}SO_2N(n\text{-}C_3H_7)CH_2COOK$

F-2: $C_8F_{17}SO_2N(n\text{-}C_3H_7)CH_2CH_2O—(CH_2CH_2O)n\text{-}H$

F-3: $C_8F_{17}SO_2N(n\text{-}C_3H_7)CH_2CH_2O—(CH_2CH_2O)_4CH_2CH_2CH_2CH_2SO_3Na$

F-4: $C_8F_{17}SO_2K$

<<Preparation of Image Formation Face Side Coating Solution>>

<<Preparation of Photosensitive Silver Halide Emulsion>>

[Preparation of Photosensitive Silver Halide Emulsion 4]

The photosensitive silver halide emulsion 1 prepared in the example 1 was kept at 38° C. with stirring, 5 ml of methanol solution of 0.34% by mass of 1,2-benzisothiazolin-3-one was added, after 40 min, the methanol solution of sensitizing dye D-1 at $1.2\times10^{-3}$ mol per mol of the silver was added, and after 1 min the temperature was elevated to 47° C. Twenty minutes after the temperature elevation, the methanol solution of sodium benzenethiosulfonate at $7.6\times10^{-5}$ mol per mol of the silver was added, after further 5 min, the methanol solution of tellurium sensitizer C at $2.9\times10^{-4}$ mol per mol of the silver was added and matured for 91 min. Subsequently, 1.3 ml of the methanol solution od 0.8% by mass of N,N'-dihydroxy-N"-diethylmelamine was added to prepare the photosensitive silver halide emulsion 4.

SENSITIZING DYE D-1

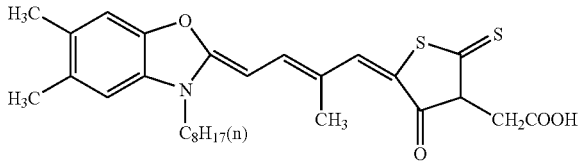

TELLURIUM SENSITIZER C

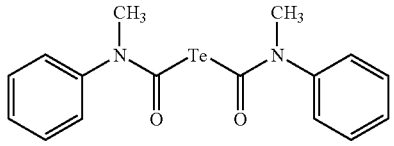

[Preparation of Photosensitive Silver Halide Emulsion 5]

The photosensitive silver halide emulsion 5 was obtained as is the case with the preparation of photosensitive silver halide emulsion 4, except that the silver halide emulsion given sensitization was changed to the photosensitive silver halide emulsion 2 prepared in the example 1, the amount of the sensitizing dye D-1 in methanol solution was changed to $6.0\times10^{-3}$ mol per mol of the silver, and the addition amount of the tellurium sensitizer was changed to $5.2\times10^{-4}$ mol per mol of the silver.

[Preparation of Photosensitive Silver Halide Emulsion 6]

The photosensitive silver halide emulsion 6 was obtained as is the case with the preparation of photosensitive silver halide emulsion 4, except that the silver halide emulsion given sensitization was changed to the photosensitive silver halide emulsion 3 prepared in the example 1, the amount of the sensitizing dye D-1 in methanol solution was changed to $7.5\times10^{-3}$ mol per mol of the silver, and the addition amount of the tellurium sensitizer was changed to $1.1\times10^{-4}$ mol per mol of the silver.

(Preparation of Mixed Emulsion for Coating Solution)

The photosensitive silver halide emulsions 4 to 6 prepared above were combined as shown in Table 3, an aqueous solution of 1% by mass of benzothiazolium iodide was added at $7\times10^{-3}$ mol per mol of the silver. Further, the water was added such that the content of the silver halide per kg of the mixed emulsion for the coating solution is 38.2 g as the silver.

<<Preparation of Additives>>

(Preparation of Fatty Acid Silver Dispersion 1)

Behenic acid supplied form Henkel (product name: Edenor C22-85R)(87.6 kg), 423 L of distilled water, 49.2 L of an aqueous solution of 5 mol/L NaOH and 120 L of t-butyl alcohol were mixed, and stirred at 75° C. for one hour to react and yield the sodium behenate solution. Separately, 206.2 L of the aqueous solution of 40.4 kg of silver nitrate (pH 4.0) was prepared and kept at 10° C. A reaction vessel in which 665 L of distilled water was placed was kept at 30° C., and the whole amounts of the sodium behenate solution and the silver nitrate solution were added with thoroughly stirring at a constant flow rate over 93 min 15 sec and 90 min, respectively. At that time, only the silver nitrate solution was added for 11 min after the start of addition of the silver nitrate solution, then the addition of the sodium behenate solution was started, and for 14 min 15 sec after the completion of the addition of the silver nitrate solution, only the sodium behenate solution was added. At that time, the temperature in the reaction vessel was 30° C., and the outside temperature was controlled such that the solution temperature was constantly kept. The temperature of piping in an addition system of the sodium behenate solution was kept by circulating warm water outside of double piping, and the solution temperature at an outlet of an addition nozzle front end was adjusted to 75° C. Also, the temperature of piping in the addition system of the silver nitrate solution was kept by circulating cold water outside of double piping. The addition positions of the sodium behenate solution and the silver nitrate solution were symmetrically disposed by making a stirring axis a center, and adjusted at a height not to contact the reaction solution.

After the completion of addition of the sodium behenate solution, the solution was left at the same temperature for 20 min with stirring, the temperature was elevated to 35° C. over 30 min, and then maturation was carried out for 210 min. Immediately after the completion of maturation, a solid content was filtrated by centrifuged filtration, and the solid content was washed until the conductivity of the filtrate became 30 μS/cm to yield the fatty acid silver salt. The resultant solid content was stored as a wet cake without being dried.

When shape of the resultant silver behenate particles was evaluated by electron microscope photographing, it was scale-like crystal with a=0.14 μm, b=0.4 μm, and c=0.6 μm as the average value, the average aspect ratio of 5.2, the average diameter of corresponding spheres of 0.52 μm and the variation coefficient of the corresponding spheres of 15%. The above coefficients, a, b and c were sides of a rectangular solid in order from the short when the shape of the organic acid silver salt particles was approximated to the rectangular solid.

Polyvinyl alcohol (brand name: PVA-217)(19.3 kg) and water were added to the wet cake corresponding to 260 kg of the dried solid content to make the whole amount 1000 kg. The mixture was made into slurry by a dissolver blade, and further predispersed by a pipeline mixer (PM-10 type, supplied from MIZUHO Industries Co., Ltd.).

Next, the predispersed neat solution was treated three times by adjusting pressure of a dispersing machine (using a brand name: Microfluidizer M-610, a Z type interaction chamber supplied from Microfluidex International Corporation) at 124 MPa to yield the fatty acid silver dispersion 1.

(Preparation of Fatty Acid Silver Dispersion 2)

The fatty acid silver dispersion 2 was prepared as is the case with the preparation of the fatty acid silver dispersion 1 described above, except that 665 L of distilled water was changed to 635 L of the distilled water and 30 L of t-butyl alcohol.

(Preparation of Reducing Agent Complex-1 Dispersion)

Water (10 kg) was added to 10 kg of the complex of the developer 1 used in the example 1 and triphenylphosphine oxide (1:1), 0.12 kg of triphenylphosphine oxide and 16 kg of an aqueous solution of 10% by mass of modified polyvinyl alcohol (Poval MP203 supplied from Kuraray Co., Ltd.) and thoroughly mixed to make slurry. This slurry was delivered by a diaphragm pump and dispersed for 4 hours 30 min by a horizontal type sand mill (UVM-2, supplied from Imex Corporation) in which zirconia beads with an average diameter of 0.5 mm were filled. Subsequently, 0.2 g of benzisothiazolinone sodium salt and water were added and prepared such that the concentration of reducing agent is 22% by mass to yield the reducing agent complex-1 dispersion. In the reducing agent complex particles obtained in this way, a median diameter was 0.45 μm and the maximum particle size was 1.4 μm or less. The resultant reducing agent complex-1 dispersion was filtrated by a polypropylene filter with a pore size of 3.0 μm to eliminate foreign substances such as dusts.

(Preparation of Development Accelerator-1 Dispersion)

The development accelerator-1 (10 kg) and 20 kg of the aqueous solution of 10% by mass of modified polyvinyl alcohol (Poval MP203 supplied from Kuraray Co., Ltd.) were added to 10 kg of water and thoroughly mixed to make slurry. This slurry was delivered by the diaphragm pump and dispersed for 3 hours 30 min by a horizontal type sand mill (UVM-2, supplied from Imex Corporation) in which zirconia beads with an average diameter of 0.5 mm were filled. Subsequently, 0.2 g of benzisothiazolinone sodium salt and water were added and prepared such that the concentration of reducing agent is 20% by mass to yield the development accelerator-1 dispersion. In the development accelerator-1 particles obtained in this way, a median diameter was 0.48 μm and the maximum particle size was 1.4 μm or less. The resultant development accelerator-1 dispersion was filtrated by a polypropylene filter with a pore size of 3.0 μm to eliminate foreign substances such as dusts.

DEVELOPMENT ACCELERATOR-1

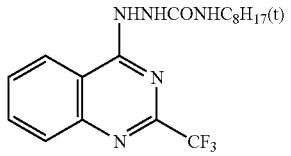

As is the case with the development accelerator-1 dispersion described above, a dispersion of 20% by mass of the yellow leuco dye with the following structure was prepared.

YELLOW LEUCO DYE

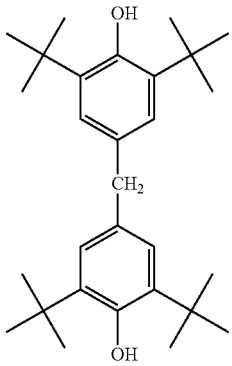

(Preparation of Mercapto Compound)

(Preparation of Mercapto Compound-1 Aqueous Solution)

The mercapto compound-1: (1-(3-sulfophenyl)-5-mercaptotetrazole sodium salt)(7 g) was dissolved in 993 g of water to make 0.7% by mass of the aqueous solution.

(Preparation of Mercapto Compound-2 Aqueous Solution)

The mercapto compound-2: (1-(3-methylureido)-5-mercaptotetrazole sodium salt)(20 g) was dissolved in 980 g of water to make 2.0% by mass of the aqueous solution.

(Preparation of Polyhalogen Compounds)

(Preparation of Organic Polyhalogen Compound-1 Dispersion)

Organic polyhalogen compound-1: (tribromomethanesulfonylbenzene)(10 kg), 10 kg of the aqueous solution of 20% by mass of modified polyvinyl alcohol (Poval MP203 supplied from Kuraray Co., Ltd.) and 0.4 kg of the aqueous solution of 20% by mass of sodium triisopropylnaphthalene sulfonate were added to 14 kg of water and thoroughly mixed to make slurry. This slurry was delivered by the diaphragm pump and dispersed for 5 hours by a horizontal type sand mill (UVM-2, supplied from Imex Corporation) in which zirconia beads with an average diameter of 0.5 mm were filled. Subsequently, 0.2 g of benzisothiazolinone sodium salt and water were added and adjusted such that the concentration of organic polyhalogen compound is 26% by mass to yield the organic polyhalogen compound-1 dispersion. In the organic polyhalogen compound-1 particles obtained in this way, a median diameter was 0.41 μm and the maximum particle size was 2.0 μm or less. The resultant organic polyhalogen compound-1 dispersion was filtrated by a polypropylene filter with a pore size of 10.0 μm to eliminate foreign substances such as dusts.

(Preparation of Organic Polyhalogen Compound-2 Dispersion)

The organic polyhalogen compound-2: (N-butyl-3-tribromomethanesulfonylbenzamide)(10 kg), 20 kg of the aqueous solution of 10% by mass of modified polyvinyl alcohol (Poval MP203 supplied from Kuraray Co., Ltd.) and 0.4 kg of the aqueous solution of 20% by mass of sodium triisopropylnaphthalene sulfonate were thoroughly mixed to make slurry. This slurry was delivered by the diaphragm pump and dispersed for 5 hours by a horizontal type sand mill (UVM-2, supplied from Imex Corporation) in which zirconia beads with an average diameter of 0.5 mm were filled. Subsequently, 0.2 g of benzisothiazolinone sodium salt and water were added and adjusted such that the concentration of organic polyhalogen compound is 30% by mass. This dispersion was heated at 40° C. for 5 hours to yield the organic polyhalogen compound-2 dispersion. In the organic polyhalogen compound-2 particles obtained in this way, a median diameter was 0.40 μm and the maximum particle size was 1.3 μm or less. The resultant organic polyhalogen compound-1 dispersion was filtrated by a polypropylene filter with a pore size of 3.0 μm to eliminate foreign substances such as dusts.

(Preparation of Phthalazine Compound-1 Solution)

The modified polyvinyl alcohol MP203 supplied from Kuraray Co., Ltd. (8 kg) was dissolved in 174.57 kg of water, then 3.15 kg of the aqueous solution of 20% by mass of sodium triisopropylnaphthalene sulfonate and 14.28 kg of the aqueous solution of 70% by mass of phthalazine compound-1: (6-isopropylphthalazine) were added to prepare the solution of 5% by mass of phthalazine compound-1.

(Preparation of Pigment-1 Dispersion)

C.I. Pigment Blue 60 (64 g) and 6.4 g of Demol N supplied from Kao Corporation were added to 250 g of water, and mixed to make slurry. Zirconia beads (800 g) with the average diameter of 0.5 mm were prepared and placed together in a vessel, and dispersed by a dispersing machine (1/4G Sand Grinder Mill supplied from Imex Corporation) for 25 hours to yield the pigment-1 dispersion. The average particle size of the pigment-1 particles comprised in the pigment dispersion obtained in this way was 0.21 μm.

(Preparation of Emulsion Layer Coating Solution)

The fatty acid silver dispersion (1000 g) obtained above, 276 ml of water, 33.2 g of the pigment-1 dispersion, 21 g of the organic polyhalogen compound-1 dispersion, 58 g of the organic polyhalogen compound-2 dispersion, 173 g of the phthalazine compound-1 solution, 2380 g of 20% by mass of gelatin, 299 g of the reducing agent complex-1 dispersion, 6 g of the development accelerator-1 dispersion, 2 g of the yellow leuco dye dispersion, 9 ml of the mercapto compound-1 aqueous solution, and 27 ml of the mercapto compound-2 aqueous solution were sequentially added. Just before coating, 117 g of the silver halide emulsion (described as the silver mass ratio in Table 3) was added and thoroughly mixed to prepare the emulsion layer coating solution-1. It was immediately delivered to a coating die and coated.

The viscosity of the above emulsion layer coating solution was 25 mPa·s at 40° C. (No.1 rotor, 60 rpm) when it was measured by a B type viscometer of Tokyo Keiki Co., Ltd. The viscosity of the coating solution at 25° C. using RFS fluid spectrometer supplied from Rheometrics Far East Ltd. was 230, 60, 46, 24, and 18 mPa·s at a shear rate of 0.1, 1, 10, 100 and 1000 (1/second), respectively. The amount of zirconium in the coating solution was 0.38 mg per 1 g of the silver.

(Preparation of Intermediate Layer Coating Solution)

The aqueous solution (27 ml) of 5% by mass of aerosol OT (supplied from American Cyanamid Corporation) and 135 ml of the aqueous solution of 20% by mass of diammonium phthalate were added to polyvinyl alcohol PVA-205 (supplied from Kuraray Co., Ltd.)(1000 g), 272 g of 5% by mass of the pigment dispersion, and 4200 ml of the solution of 19% by mass of methylmethacrylate/styrene/butylacrylate/hydroxyethylmethacrylate/acrylic acid copolymer (copolymerization ratio 64/9/20/5/2) latex, water was added to fill up the total amount of 10000 g and pH was adjusted to 7.5 with NaOH to make the intermediate layer coating solution, which was then delivered to the coating die to become 9.1 ml/m$^2$. The viscosity of the coating solution was 58 mPa·s.

(Preparation of Protection Layer First Layer Coating Solution)

Inert gelation (64 g) was dissolved in water, then 80 g of the solution of 27.5% by mass of methylmethacrylate/styrene/butylacrylate/hydroxyethylmethacrylate/acrylic acid copolymer (copolymerization ratio 64/9/20/5/2) latex, 23 ml of methanol solution of 10% by mass of phthalic acid, 23 ml of the aqueous solution of 10% by mass of 4-methyl phthalate, 28 ml of 0.5 mol/L sulfuric acid, 5 ml of the aqueous solution of 5% by mass of aerosol OT (supplied from American Cyanamid Corporation), 0.5 g of phenoxy ethanol and 0.1 g of benzisothiazolin were added thereto, and water was added to fill up the total amount of 750 g to make the coating solution. Just before coating, 26 ml of 4% by mass of chrome alum was added and mixed by a static mixer, and the coating solution was delivered to the coating die to become 18.6 ml/m$^2$. The viscosity of the coating solution was 20 mPa·s.

(Preparation of Protection Layer Second Layer Coating Solution)

Inert gelation (80 g) was dissolved in water, then 102 g of the solution of 27.5% by mass of methylmethacrylate/styrene/butylacrylate/hydroxyethylmethacrylate/acrylic acid copolymer (copolymerization ratio 64/9/20/5/2) latex, 3.2 ml of the solution of 5% by mass of the fluorinated surfactant (N-perfluorooctylsulfonyl-N-propylalanine potassium salt), 32 ml of the aqueous solution of 2% by mass of the fluorinated surfactant (polyethyleneglycol mono(N-perfluorooctylsulfonyl-N-propyl-2-aminoethyl)ether [ethylene oxide average polymerization degree=15]), 23 ml of the solution of 5% by mass of aerosol OT (supplied from American Cyanamid Corporation), 4 g of polymethylmethacrylate fine particles (average particle size 0.7 μm), 21 g of polymethylmethacrylate fine particles (average particle size 4.5 μm), 1.6 g of 4-methyl phthalate, 4.8 g of phthalic acid, 44 ml of 0.5 mol/L sulfuric acid and 10 mg of benzisothiazolin was added thereto, and water was added to fill up the total amount of 650 g. Just before coating, 445 ml of the aqueous solution containing 4% by mass of chrome alum and 0.67% by mass of phthalic acid was added thereto and mixed therewith by the static mixer to make the surface protection layer coating solution, which was then delivered to the coating die to become 8.3 ml/m$^2$. The viscosity of the coating solution was 19 mPa·s.

<<Manufacture of Silver Salt Photothermographic Dry Imaging Material>>

(Manufacture of Sample 201)

The above anti-halation layer coating solution and the back face protection layer coating solution were simultaneously overlaid and coated on the back face side of the above under coated support such that the coated solid content of the solid fine particle dye is 0.04 g/m$^2$ and such that the coated gelatin amount is 1.7 g/m$^2$, respectively, and dried to make the back layer.

The emulsion layer coating solution, the intermediate layer coating solution, the protection layer first layer and the protection layer second layer were simultaneously overlaid and coated in sequence from the under coating face on the opposite face of the back face by a slide bead mode to make the sample 201 which was the silver salt photothermographic dry imaging material. At that time, the temperature was adjusted at 31° C. in the emulsion and intermediate layers, 36° C. in the protection layer first layer and 37° C. in the protection layer second layer. The coated amount (g/m$^2$) of each compound in the emulsion layer is as follows.

| | |
|---|---|
| Silver behenate | 5.55 |
| Pigment (C.I. Pigment Blue 60) | 0.036 |
| Polyhalogen compound-1 | 0.12 |
| Polyhalogen compound-2 | 0.37 |
| Phthalazine compound-1 | 0.19 |
| Gelatin | 9.97 |
| Reducing agent complex-1 | 1.41 |
| Development accelerator-1 | 0.024 |
| Yellow leuco dye | 0.010 |
| Mercapto compound-1 | 0.002 |
| Mercapto compound-2 | 0.012 |
| Silver halide (as the silver) | 0.091 |

A coating and drying condition is as follows. The coating was carried out at a speed of 160 m/min, an interval between the front end of coating die and the support was from 0.10 to 0.30 mm, and the pressure in a decompression chamber was set at 196 to 882 Pa lower than the atmospheric pressure. Electric neutralization of the support was performed by an ionic wind before the coating. In a subsequent chilling zone, the coating solution was cooled by the wind at a dry-bulb temperature of 10 to 20° C., then the support was delivered without contact, and dried by the dry wind at the dry-bulb temperature of 23 to 45° C. and a wet-bulb temperature of 15 to 21° C. in a vine-winding type no contact drying apparatus. After drying, the humidity was regulated at the relative humidity of 40 to 60% at 25° C., and the support was heated such that a film face was at 70 to 90° C. After heating, the film face was cooled to 25° C.

For the matting degree of the photothermographic imaging material made, Bekk smoothness was 550 sec at the side of the image formation layer face and 130 sec at the back face. Also, pH on the film face at the side of the image formation layer face was 6.0.

(Manufacture of Samples 202 to 214)

The samples 202 to 214 were made as is the case with the above sample 101, except for combining types of the binders used for the photosensitive layer, types of the cyan leuco dyes, types and ratios of the photosensitive silver halide emulsion and the non-photosensitive aliphatic silver carboxylate, which were used for the emulsion layer coating solution of the above sample 101, as described in Table 3. But, for the cyan leuco dye of the invention, 20% by mass of the dispersion was prepared and added to the coating solution as with the development accelerator and the yellow leuco dye. The coated amount thereof was made 0.010 g/m$^2$.

(Preparation of Cyan Coloring Leuco Dye Dispersion of the Invention)

As with the development accelerator-1 dispersion, the dispersion of 20% by mass of each cyan leuco dye of the invention shown in Table 3 was prepared.

(Binders Used for Photosensitive Layer)

AS shown in Table 3, binders used for respective samples were prepared as follows.

PVA-217 supplied from Kuraray co., Ltd. was used. Hereinafter, the method for preparing the latex 1 to 3 is described.

<Preparation of Latex Solution>

The latex with Tg=22° C. (*latex 1) was prepared according to the following method. Ammonium persulfate and an anion surfactant were used as a polymerization initiator and an emulsifier, respectively, 70.0% by mass of styrene, 27.0% by mass of butadiene and 3.0% by mass of acrylic acid by mass were emulsified and polymerized, and subsequently aging was performed at 80° C. for 8 hours. Then, the polymer was cooled to 40° C., pH was adjusted at 7.0 with an aqueous ammonia, and further Sundet BL supplied from Sanyo Chemical Industries Ltd. was added to become 0.22%. Next, the aqueous solution of 5% sodium hydroxide was added to make pH 8.3, and further pH was adjusted at 8.4 with the aqueous ammonia. A molar ratio of $Na^+$ ion to $NH_4^+$ ion used at that time was 1:2.3. Further, 0.15 ml of the aqueous solution of 7% of benzisothiazolinone sodium salt was added for 1 kg of this solution to prepare the latex solution 1.

*Latex 1: the latex of styrene (70.0)/butadiene (27.0)/acrylic acid (3.0)

In the latex prepared above, Tg is 22° C., the average particle size is 0.1 μm, the concentration is 43% by mass, the equilibrium water content at 25° C. and at 60% RH is 0.6% by mass, the ionic conductivity is 4.2 mS/cm (a thermal conductivity meter CM-30S supplied from DKK-TOA Corporation was used for the measurement of ionic conductivity and the neat latex solution (43% by mass) was measured at 25° C.), and pH is 8.4. The latex with different Tg can be prepared by the same method by appropriately changing the ratio and types of styrene and butadiene.

*Latex 2: the latex of styrene (68.0)/butadiene (30.0)/acrylic acid (2.0). The Tg was 20° C.

*Latex 3: the latex of styrene (75.0)/butadiene (15.0)/methyl methacrylate (10.0). The Tg was 31° C.

In the sample 214, the developer 1 was changed to the following developer 3 at the same amount.

TABLE 3

| | CONFIGURATION | | | | | | |
|---|---|---|---|---|---|---|---|
| | | | AgXPARTICLE SIZE(PERCENTAGE %) | | | | |
| SAMPLE No. | PHOTO-SENSITIVE LAYER BINDER | CYAN COLORING LEUCO DYE | SILVER HALIDE EMULSION-5 0.03 μm | SILVER HALIDE EMULSION-4 0.05 μm | SILVER HALIDE EMULSION-6 0.08 μm | TERTIARY ALCOHOL | RE-MARKS |
| 201 | GELATIN | — | 15 | 70 | 15 | — | COMP. |
| 202 | PVA-217 | — | 15 | 70 | 15 | — | COMP. |
| 203 | LATEX 1 | — | 15 | 70 | 15 | — | COMP. |
| 204 | LATEX 2 | — | 15 | 70 | 15 | — | COMP. |
| 205 | LATEX 3 | — | 15 | 70 | 15 | — | COMP. |
| 206 | GELATIN | CA-3 | 15 | 70 | 15 | — | INV. |

TABLE 3-continued

| | CONFIGURATION | | | | | | |
|---|---|---|---|---|---|---|---|
| | | | AgXPARTICLE SIZE(PERCENTAGE %) | | | | |
| SAMPLE No. | PHOTO-SENSITIVE LAYER BINDER | CYAN COLORING LEUCO DYE | SILVER HALIDE EMULSION-5 0.03 μm | SILVER HALIDE EMULSION-4 0.05 μm | SILVER HALIDE EMULSION-6 0.08 μm | TERTIARY ALCOHOL | RE-MARKS |
| 207 | PVA-217 | CA-3 | 15 | 70 | 15 | — | INV. |
| 208 | LATEX 1 | CA-3 | 15 | 70 | 15 | — | INV. |
| 209 | LATEX 2 | CA-3 | 15 | 70 | 15 | — | INV. |
| 210 | LATEX 3 | CA-3 | 15 | 70 | 15 | — | INV. |
| 211 | LATEX 1 | CA-5 | 15 | 70 | 15 | — | INV. |
| 212 | LATEX 1 | CA-8 | 15 | 70 | 15 | — | INV. |
| 213 | LATEX 1 | CA-3 | 15 | 70 | 15 | t-BuOH | INV. |
| 214 | LATEX 1 | CA-3 | 15 | 70 | 15 | t-BuOH | INV. |

DEVELOPER 3

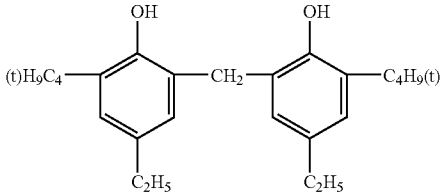

Each sample was evaluated as is the case with the example 1. The obtained results are shown in Table 4.

TABLE 4

| SAM-PLE No. | PHOTO-GRAPHIC FOG | RELATIVE SENSI-TIVITY | MAXIMUM DENSITY | $R^2$ VALUE CONDITION A | $R^2$ VALUE CONDITION B | AV-ERAGE $R^2$ VALUE | DENSITY UN-EVENNESS | RE-MARKS |
|---|---|---|---|---|---|---|---|---|
| 201 | 0.20 | 100 | 3.25 | 0.92 | 0.89 | 0.91 | B | COMP. |
| 202 | 0.22 | 105 | 3.21 | 0.88 | 0.85 | 0.90 | B | COMP |
| 203 | 0.20 | 97 | 3.20 | 0.85 | 0.81 | 0.88 | B | COMP. |
| 204 | 0.20 | 95 | 3.33 | 0.85 | 0.80 | 0.85 | B | COMP. |
| 205 | 0.20 | 98 | 3.31 | 0.82 | 0.79 | 0.83 | B | COMP. |
| 206 | 0.19 | 110 | 3.41 | 1.00 | 1.00 | 1.00 | A | INV. |
| 207 | 0.19 | 112 | 3.40 | 1.00 | 1.00 | 1.00 | A | INV. |
| 208 | 0.18 | 114 | 3.45 | 1.00 | 1.00 | 1.00 | A | INV. |
| 209 | 0.18 | 113 | 3.43 | 1.00 | 1.00 | 1.00 | A | INV. |
| 210 | 0.18 | 112 | 3.41 | 1.00 | 1.00 | 1.00 | A | INV. |
| 211 | 0.18 | 113 | 3.45 | 1.00 | 1.00 | 1.00 | A | INV. |
| 212 | 0.18 | 115 | 3.45 | 1.00 | 1.00 | 1.00 | A | INV. |
| 213 | 0.17 | 107 | 3.50 | 1.00 | 1.00 | 1.00 | A | INV. |
| 214 | 0.18 | 110 | 3.46 | 0.99 | 0.99 | 0.99 | A | INV. |

As is obvious from the results in Table 4, only when the binder of the photosensitive layer is changed to the binder of the invention, the high maximum density is obtained but the color tone is deteriorated.

By combining the cyan leuco dye of the invention, the color tone is improved without impairing the high maximum density.

It is found that more preferable color tone is obtained and reproducibility in every thermal development is high by further combining the particle sizes of the photosensitive silver halide grains of the invention and by combining the formation of the non-photosensitive aliphatic silver carboxylate particles in the presence of tertiary alcohol.

Example 3

<<Manufacture of Support>>

Corona discharge treatment at 0.5 kV A min/$m^2$ was given to one side face of a polyethylene terephthalate film base (thickness 175 μm) blue-colored at a density of 0.170, and then using the following under coat coating solution A, an under coating layer a was applied on it such that the thickness of dried film became 0.2 μm. The corona discharge treatment at 0.5 kV A min/$m^2$ was similarly given to another face, and then using the following under coat coating solution B, an under coating layer b was applied on it such that the thickness of dried film became 0.1 μm. Subsequently, heat treatment was carried out at 130° C. for 15 min in a heat treating type oven having a film transport apparatus made up of multiple roller groups to make a support.

(Preparation of Under Coat Coating Solution A)

Copolymer latex solution (270 g) of 30% of n-Butyl acrylate, 20% of t-butyl acrylate, 25% of styrene and 25% of hydroxyethyl acrylate by mass (solid content 30%), 0.6 g of surfactant (UL-1) and 0.5 g methylcellulose were mixed. Further, a dispersing solution obtained by adding 1.3 g of silica particles (Syloid 350, supplied from Fuji Silysia Chemical Ltd.) to 100 g of water and dispersing by a ultrasonic dispersing machine (Ultrasonic Generator, frequency 25 kHz, 600 W supplied from ALEX Corporation) for 30 min was added, and finally the mixture was filled up with water to 1000 ml to make the under coat coating solution A.

(Preparation of Under Coat Coating Solution B)

The colloidal tin oxide dispersing solution (37.5 g), 3.7 g of the copolymer latex solution (solid content 30%) of 20% of n-butyl acrylate, 30% of t-butyl acrylate, 27% of styrene and 28% of 2-hydroxyethyl acrylate by mass, 14.8 g of the copolymer latex solution (solid content 30%) of 40% of n-butyl acrylate, 20% of styrene and 40% of glycidyl methacrylate by mass, and 0.1 g of the surfactant (UL-1) were mixed, and filled up with water to 1000 ml to make the under coat coating solution B.

(Preparation of Colloidal Tin Oxide Dispersing Solution)

Tin chloride hydrate (65 g) was dissolved in 2000 ml of a water/ethanol mix solution to prepare a uniform solution. Then, this was boiled to yield coprecipitate. The produced precipitate was taken out by decantation, and washed with distilled water several times. Silver nitrate was dripped in the distilled water with which the precipitate was washed and it was confirmed that there was no chlorine ion reaction. Subsequently, distilled water was added to the washed precipitate and the total amount was made 2000 ml. Further, 40 ml of 30% aqueous ammonia was added, the aqueous solution was heated and concentrated until the volume became 470 ml to prepare the colloidal tin oxide dispersing solution.

UL-1

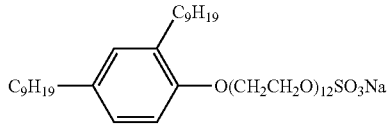

<<Coating of Back Face Side>>

Cellulose acetate butyrate (84.2 g) (Eastman Chemical Company, CAB381-20) and 4.5 g of polyester resin (Bostic Inc., Vitel PE2200B) was added to and dissolved in 830 g of methylethylketone (hereinafter abbreviated MEK) with stirring. Then, 0.3 g of the infrared dye 1 was added to the dissolved solution, and further 4.5 g of the fluorinated surfactant (supplied from Asahi Glass Co., Ltd., Surflon KH40) and 2.3 g of the fluorinated surfactant (supplied from Dainippon Ink And Chemicals, Incorporated, Megafag F120K) dissolved in 43.2 g of methanol were added and thoroughly stirred until being dissolved. Finally, 75 g of silica (supplied from W. R. Grace, Syloid 64×6000) dispersed in MEK at a concentration of 1% by mass by a dissolver type homogenizer was added and stirred to prepare the coating solution for the back face side.

INFRARED DYE 1

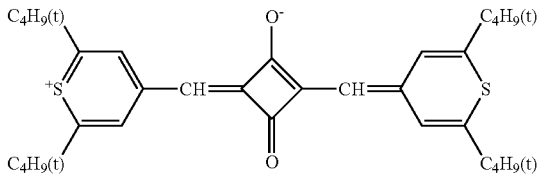

The back face coating solution prepared in this way was coated on the prepared under coating layer a of the support by an extruding coater such that the thickness of dried film became 3.5 μm, and dried. Drying was performed over 5 min using a drying wind with a drying temperature of 100° C. and a dew point of 10° C.

| Preparation of photosensitive silver halide emulsion | |
|---|---|
| [Preparation of photosensitive silver halide emulsion 1] | |
| (Solution A1) | |
| Phenylcarbamoyled gelatin | 88.3 g |
| Compound A (*1) (aqueous solution of 10% methanol) | 10 ml |
| Potassium bromide | 0.32 g |
| are filled up with water to 5429 ml. | |
| (Solution B1) | |
| Aqueous solution of 0.67 mol/L silver nitrate | 2635 ml |
| (Solution C1) | |
| Potassium bromide | 51.55 g |
| Potassium iodide | 1.47 g |
| are filled up with water to 660 ml | |
| (Solution D1) | |
| Potassium bromide | 154.9 g |
| Potassium iodide | 4.41 g |
| $K_3OsCl_6$ + $K_4[Fe(CN)_6]$ (dopants, corresponding to $2 \times 10^{-5}$ mol/Ag, respectively) | 50.0 ml |
| are filled up with water to 1982 ml | |
| (Solution E1) | |
| Aqueous solution of 0.4 mol/L potassium bromide amount for control of the following silver potential | |
| (Solution F1) | |
| Potassium hydroxide | 0.71 g |
| is filled up with water to 20 ml. | |
| (Solution G1) | |
| Aqueous solution of 56% acetic acid | 18.0 ml |
| (Solution H1) | |
| Sodium carbonate anhydride | 1.72 g |
| is filled up with water to 151 ml. | |

(*1) Compound: $HO(CH_2CH_2O)_n(CH(CH_3)CH_2O)_{17}(CH_2CH_2O)_mH$ (m + n = 5 to 7)

Using a mix agitator described in JP-B-58-58288, ¼ amount of the solution B1 and the whole amount of the solution C1 were added to the solution A1 over 4 min 45 sec by the simultaneous mixing method with controlling the temperature at 30° C. and pAg at 8.09 to perform nucleus formation. After one min, the whole amount of the solution F1 was added. In the meantime, the adjustment of pAg was appropriately performed using the solution E1. After 6 min, the temperature was elevated to 40° C., and ¾ amount of the solution B1 and the whole amount of the solution D1 were added over 14 min 15 sec by the simultaneous mixing method with controlling pAg at 8.09. After stirring for 5 min, the whole amount of the solution G1 to precipitate a silver halide emulsion. Supernatant was eliminated with leaving 2000 ml of a precipitated portion, 10 L of water was added and stirred to precipitate the silver halide emulsion again. The supernatant was eliminated with leaving 1500 ml of the precipitated portion, further 10L of water was added and stirred to precipitate the silver halide emulsion. The supernatant was eliminated with leaving 1500 ml of the precipitated portion, subsequently the solution H1 was added, the temperature was elevated to 60° C., and the solution was further stirred for 120 min. Finally, the pH was adjusted to 5.8 and water was added such that the amount became 1161 g per mol of the silver amount to yield the emulsion.

This emulsion was monodisperse cubic iodide bromide silver particles with the average particle size of 0.050 μm, the variation coefficient of particle sizes of 12% and face ratio of 92%.

<<Preparation of Photosensitive Layer Coating Solution>>

(Preparation of Powder Aliphatic Silver Carboxylate A)

Behenic acid (130.8 g), 67.7 g of arachidic acid, 43.6 g of stearic acid and 2.3 g of palmitic acid were dissolved in 4720 ml of pure water at 80° C. Next, 540.2 ml of an aqueous solution of 1.5 mol/L sodium hydroxide was added, 6.9 ml of concentrated nitric acid was added, and subsequently cooled to 55° C. to yield a solution of sodium fatty acid. The solution of sodium fatty acid was stirred for 20 min with retaining the temperature at 55° C., then 45.3 g (corresponding to 0.39 mol of the silver) of the above photosensitive silver halide emulsion 1 and 450 ml of pure water were added and stirred for 5 min.

Next, 702.6 ml of 1 mol/L silver nitrate solution was added over 2 min and stirred for 10 min to yield an aliphatic silver carboxylate dispersion. Subsequently, the obtained aliphatic silver carboxylate dispersion was transferred into a water-washing vessel, distilled water was added and stirred, then left to float and separate the aliphatic silver carboxylate dispersion, and lower water soluble salts were eliminated. Subsequently, water-washing with distilled water and discharging water were repeated until the electric conductivity of the discharged water became 50 μS/cm, and then centrifugation and dehydration were carried out. The resultant cake-shaped aliphatic silver carboxylate was dried using a flash dryer, Flash Jet Dryer (supplied from Seishin Enterprise Co., Ltd.) by an operation condition of nitrogen gas atmosphere and hot wind temperature at a dryer inlet until the water content became 0.1% to yield the powder aliphatic silver carboxylate A. An infrared moisture meter was used for the water content measurement of the aliphatic silver carboxylate composition.

(Preparation of Predispersing Solution A)

Polyvinyl butyral resin (14.57 g) was dissolved in 1457 g of MEK, 500 g of the above powder aliphatic silver carboxylate A was gradually added with stirring using a dissolver, DISPERMAT CA-40M type supplied from VMA-GETZMANN, and mixed thoroughly to prepare the predispersing solution A.

(Preparation of Photosensitive Emulsion Dispersing Solution A)

The predispersing solution A prepared above was supplied to a media type dispersing machine, DISPERMAT SL-C12EX type (supplied from VMA-GETZMANN) where zirconia beads (supplied from Toray Industries, Inc., Toreselam) with a diameter of 0.5 mm were filled up to 80% of an inner volume such that a staying time in a mill is 1.5 min using a pump, the dispersion was carried out at a mill peripheral velocity of 8 m/s to prepare the photosensitive emulsion dispersing solution A.

(Preparation of Stabilizer Solution)

The stabilizer 1 (1.0 g) and 0.31 g of potassium acetate were dissolved in 4.97 g of methanol to prepare the stabilizer solution.

(Preparation of Infrared Sensitizing Dyestuff Solution A)

The infrared sensitizing dyestuff 1 (19.2 mg), 1.488 g of 2-chloro-benzoic acid, 2.779 g of the stabilizer 2 and 365 mg of 5-methyl-2-mercaptobenzimidazole were dissolved in 31.3 ml of MEK in a dark place to prepare the infrared sensitizing dyestuff solution A.

(Preparation of Additive Solution A)

The following thiuronium salt 1 (50 mg) was dissolved in 5.0 g of methanol to prepare the additive solution A.

(Preparation of Additive Solution a)

The following developer (27.98 g), 0.7 g of the following yellow coloring leuco dye, 1.54 g of 4-methyl phthalate and 0.48 g of the above infrared dye 1 were dissolved in 110 g of MEK to make the additive solution a.

(Preparation of Additive Solution b)

The Antifoggant 2 (1.56 g) and 3.43 g of phthalazine were dissolved in 40.9 g of MEK to make the additive solution b.

(Preparation of Photosensitive Layer Coating Solution A)

Under an atmosphere of inert gas (nitrogen 97%), the above photosensitive emulsion dispersing solution A (50 g) and 15.11 g of MEK were retained at 21° C. with stirring, 390 μl of the Antifoggant 1 (10% methanol solution) was added, and stirred for 1 hour. Further, 494 μl of calcium bromide (10% methanol solution) was added and stirred for 20 min. Subsequently, 167 ml of the above stabilizer solution was added and stirred for 10 min, then 1.32 g of the above infrared sensitizing dye solution A was added and stirred for 1 hour, 6.4 g of the above additive solution A was added, immediately after this, the temperature was cooled to 13° C. and the mixture was further stirred for 30 min. With retaining the temperature at 13° C., 13.31 g of butyral resin (Butvar) was added as the binder resin and stirred for 30 min, then 1.084 g of tetrachlorophthalic acid (9.4% by mass in MEK solution), and stirred for 15 min. With further stirring, 12.43 g of the additive solution a, 1.6 ml of Desmodur N3300/aliphatic isocyanate supplied from Mobey (10% in MEK solution) and 4.27 g of the additive solution b were sequentially added and stirred to obtain the photosensitive layer coating solution A.

<<Preparation of Surface Protection Layer Coating Solution>>

Cellulose acetate butyrate (96 g)(Eastman Chemical, CAB171-15), 4.5 g of polymethylmethacrylate (Rohm & Haas, Paraloid A-21), 1.5 g of vinylsulfone compound (VSC), 1.0 g of benzotriazole and 1.0 g of the fluorinated surfactant (Asahi Glass Co., Ltd., Surflon KH40) were added to and dissolved in 865 g of MEK with stirring. Next, 30 g of the following matting agent dispersion was added and stirred to prepare the surface protection layer coating solution.

(Preparation of Matting Agent Dispersion)

Cellulose acetate butyrate (7.5 g CAB171-15, supplied from Eastman Chemical) was dissolved in 42.5 g of MEK, 5 g of calcium carbonate (Speciality Minerals, Super-Pflex 200) was added thereto and dispersed by the dissolver type homogenizer at 8000 rpm for 30 min to prepare the matting agent dispersion.

STABILIZER-1

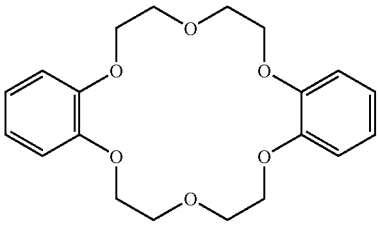

STABILIZER-2

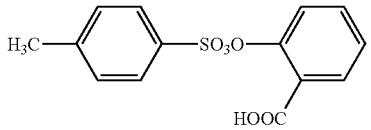

INFRARED SENTITING DYE-1

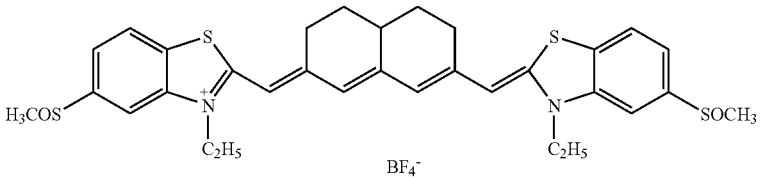

ANTIFOGGANT-2

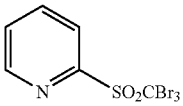

ANTIFOGGANT-1

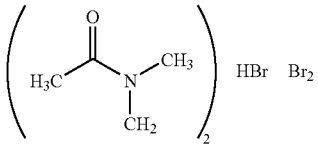

THIURONIUM SALT-1

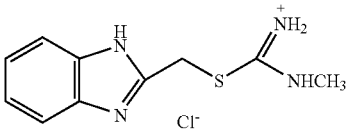

DEVELOPER-1

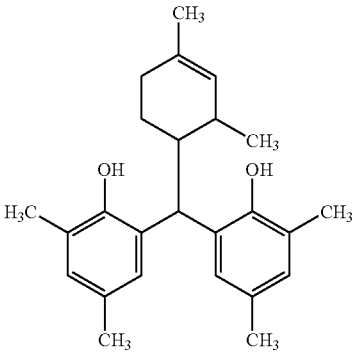

YELLOW COLORING LEUCO DYE-1

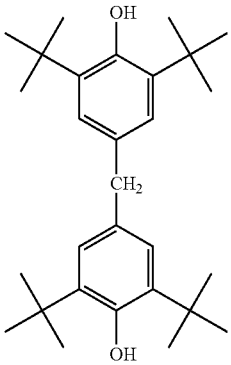

<<Manufacture of Silver Salt Photothermographic Dry Imaging Material>>

(Manufacture of Sample No. 301)

The sample No. 301 was made by simultaneously overlaying and coating the photosensitive layer coating solution A and the surface protection layer coating solution prepared above on the under coating layer b of the support made above using the extrusion type coater known in the art. The cyan coloring dye described in Table 5 was added at 0.7 g to the additive solution a. The coating was performed such that the coated silver amount is 1.5 g/m$^2$ in the photosensitive layer and such that the dried film thickness of the surface protection layer is 2.5 μm. Subsequently, drying was performed using drying wind with a drying temperature of 75° C. and a dew point temperature of 10° C. for 10 min.

(Manufacture of Samples Nos. 302 to 328)

The samples Nos. 302 to 328 were made as is the case with the sample No. 301 except for combining the compounds of the invention as described in Table 5.

The compounds represented by the Formulas (1) to (4) of the invention were added to and mixed with the photosensitive coating solution as the final additives, stirred for 30 min, and then the coating was performed. For the above all four compounds, 1.25% by mass of the additive solution was prepared and the addition amount was 4.0 g. Also, the sulfur sensitizers represented by the Formulas (5-1) to (5-6) were all initially added to and stirred in the photosensitive coating solution, and after one hour, the Antifoggant 1 was added. The addition amount was $5.0\times10^{-5}$ mol/Ag mol. The gold sensitizer represented by the Formula (8) was added 10 min after the addition of calcium bromide solution, and after 30 min, the infrared sensitizing dyestuff solution A was added. The addition amount was $1.0\times10^{-6}$ mol/Ag mol.

TABLE 5

| SAMPLE No. | CYAN COLORING LEUCO DYE | INHIBITOR FORMULA (1) | (2) | (3) | (4) | CHEMICAL SENSITIZER FORMULA (5) | (6) | WITHIN OR OUTSIDE INVENTION |
|---|---|---|---|---|---|---|---|---|
| 301 | CA-3 | — | — | — | — | — | — | OUTSIDE |
| 302 | CA-3 | — | — | — | — | 5–1–1 | — | OUTSIDE |
| 303 | CA-3 | — | — | — | — | 5–5–8 | — | OUTSIDE |
| 304 | CA-3 | 1–48 | — | — | — | — | — | OUTSIDE |
| 305 | CA-3 | — | 2–23 | — | — | — | — | OUTSIDE |
| 306 | CA.3 | — | — | 3–21 | — | — | — | OUTSIDE |
| 307 | CA-3 | — | — | — | 4–5 | — | — | OUTSIDE |
| 308 | CA-3 | 1–48 | 2–23 | 3–21 | 4–5 | — | — | OUTSIDE |
| 309 | CA-3 | 1–48 | — | — | — | 5–1–1 | — | WITHIN |
| 130 | CA-3 | 1–48 | — | — | — | 5–5–8 | — | WITHIN |
| 311 | CA-3 | — | 2–23 | — | — | 5–1–1 | — | WITHIN |
| 312 | CA-3 | — | 2–23 | — | — | 5–5–8 | — | WITHIN |
| 313 | CA-3 | — | — | 3–21 | — | 5–1–1 | — | WITHIN |
| 314 | CA-3 | — | — | 3–21 | — | 5–5–8 | — | WITHIN |
| 315 | CA-3 | — | — | — | 4–5 | 5–1–1 | — | WITHIN |
| 316 | CA-3 | — | — | — | 4–5 | 5–5–8 | — | WITHIN |
| 317 | CA-3 | 1–48 | 2–23 | 3–21 | 4–5 | 5–1–1 | — | WITHIN |
| 318 | CA-3 | 1–81 | 2–23 | 3–21 | 4–5 | 5–1–1 | — | WITHIN |
| 319 | CA-3 | 1–48 | 2–24 | 3–21 | 4–5 | 5–1–1 | — | WITHIN |
| 320 | CA-3 | 1–48 | 2–23 | 3–1 | 4–5 | 5–1–1 | — | WITHIN |
| 321 | CA-3 | 1–48 | 2–23 | 3–21 | 4–5 | 5–1–1 | — | WITHIN |
| 322 | CA-3 | 1–48 | 2–23 | 3–21 | 4–5 | 5–5–8 | — | WITHIN |
| 323 | CA-3 | 1–48 | 2–23 | 3–21 | 4–5 | 5–1–1 | 8–2 | WITHIN |
| 324 | CA-3 | 1–48 | 2–23 | 3–21 | 4–5 | 5–1–1 | 8–1 | WITHIN |
| 325 | CA-3 | 1–48 | 2–23 | 3–21 | 4–5 | 5–5–8 | 8–2 | WITHIN |
| 326 | CA-3 | 1–48 | 2–23 | 3–21 | 4–5 | 5–5–8 | 8–1 | WITHIN |
| 327 | CA-5 | 1–48 | 2–23 | 3–21 | 4–5 | 5–1–1 | 8–2 | WITHIN |
| 328 | CA-8 | 1–48 | 2–23 | 3–21 | 4–5 | 5–1–1 | 8–2 | WITHIN |

<<Evaluation of Exposure, Development Processing and Respective Property Values>>

(Exposure and Development Processing)

Each sample made above was stored at 25° C. and at 50% RH (condition A) for 10 days, and subsequently exposure by laser scanning was given from the photosensitive layer coated side of each sample using an exposing machine making semiconductor laser (maximum output of 70 mW by combining two waves with maximum output of 35 mW) with wavelength of 800 to 820 nm at high frequency superposition in vertical multiple mode an exposure source. At that time, the image was formed by making an angle of an exposure face of the sample and the exposure laser light 75 degree. In this method, compared to the case of making the angle 90 degree, good results such as less unevenness and unexpected sharpness were obtained.

Subsequently, using an automatic developing machine having a heat drum, the thermal development was carried out at 125° C. for 15 sec such that the surface protection layer of the sample was contacted with the surface of heat drum, and then the photothermographic imaging material was transport out of the apparatus. At that time, the transport velocity from the imaging material supplying portion to the image exposure portion, the transport velocity at the image exposure portion, and the transport velocity at the thermal development portion was 20 mm/sec, respectively. Also, the above exposure and development were carried out in a room adjusted at 23° C. and at 50% RH.

(Measurement of Sensitivity and Photographic Fog Density)

In the formed image obtained as the above, the density was measured using a photographic densitometer, and a property curve was made which is made up of a horizontal axis-sensitivity and a vertical axis-density. For a relative sensitivity, a reciprocal of an exposure amount which gives 1.0 higher density than that at an unexposed part was defined as the sensitivity, and the photographic fog density (minimum density) and the maximum density were measured. The relative density was represented by a relative value when the sensitivity of the sample 301 was made 100.

(Measurement of u* and v* in CIE 1976 Color Space)

($R^2$ Value Condition A)

From each sample stored at 25° C. and at 50% RH (condition A) for 10 days, a developed wedge sample with 4 stages comprising an unexposed part, and optical density at 0.5, 1.0 and 1.5 was made using the above thermal development apparatus. Each wedge density part made in this way was measured by CM-3600d (supplied from Minolta Co., Ltd.), and u* and v* were calculated. At that time, under the measurement condition making F7 light source the light source and making an angle of field 10°, the measurement was carried out in a transmission measurement mode. Measured u* and v* were plotted on a graph where the horizontal and vertical axes were made u* and v*, respectively, a linear regression straight line was obtained and made a multiple determination $R^2$ value condition A. This value is the value indicating the degree of color tone change. The closer to 1.0 the value is, it indicates the lesser change of color tone at each density and to be preferable.

Each sample was stored at 40° C. and at 80% RH (condition B) for 10 days, subsequently the exposure and the development were given as with the above, the photographic fog at that time was obtained, and the difference from the condition A was obtained.

Photographic fog after the storage with moisture=Photographic fog (condition B)−Photographic fog (condition A)

(Evaluation of Image Density Unevenness Resistance)

Each sample was left under the above condition A for 10 days, then thermally developed by the same method as that for the above sensitivity and photographic fog measurement, subsequently the obtained image was visually evaluated, and the image density unevenness resistance was evaluated according to the following criteria.

A: No image unevenness

B: Slight image unevenness is observed by steady gaze but in practically acceptable range C: Obvious image unevenness is observed and quality with practical problem The results are shown in Table 6.

TABLE 6

| SAMPLE No. | PHOTOGRAPHIC FOG | RELATIVE SENSITIVITY | MAXIMUM DENSITY | COLOR TONE $R^2$ | COLOR TONE SLOPE | CHANGE RATE OF PHOTOGRAPHIC FOGAFTER | IMAGE UNEVENNESS | WITHIN OR OUTSIDE INVENTION |
|---|---|---|---|---|---|---|---|---|
| 301 | 0.22 | 100 | 3.2 | 0.89 | 0.65 | 125 | C | OUTSIDE |
| 302 | 0.26 | 116 | 3.35 | 0.80 | 0.52 | 153 | B | OUTSIDE |
| 303 | 0.25 | 115 | 3.4 | 0.78 | 0.51 | 150 | B | OUTSIDE |
| 304 | 0.21 | 90 | 2.8 | 0.85 | 0.60 | 121 | B | OUTSIDE |
| 305 | 0.21 | 88 | 2.8 | 0.86 | 0.61 | 122 | B | OUTSIDE |
| 306 | 0.21 | 95 | 2.9 | 0.85 | 0.60 | 121 | B | OUTSIDE |
| 307 | 0.21 | 85 | 2.8 | 0.84 | 0.62 | 120 | B | OUTSIDE |
| 308 | 0.20 | 75 | 2.6 | 0.82 | 0.60 | 123 | B | OUTSIDE |
| 309 | 0.18 | 123 | 3.5 | 0.99 | 0.85 | 107 | A | WITHIN |
| 310 | 0.18 | 121 | 3.5 | 0.99 | 0.84 | 108 | A | WITHIN |
| 311 | 0.18 | 122 | 3.5 | 0.99 | 0.83 | 108 | A | WITHIN |
| 312 | 0.18 | 122 | 3.5 | 0.99 | 0.85 | 107 | A | WITHIN |
| 313 | 0.19 | 128 | 3.5 | 0.99 | 0.82 | 107 | A | WITHIN |
| 314 | 0.19 | 127 | 3.5 | 0.99 | 0.82 | 108 | A | WITHIN |
| 315 | 0.18 | 122 | 3.5 | 0.99 | 0.85 | 107 | A | WITHIN |
| 316 | 0.18 | 121 | 3.5 | 0.99 | 0.87 | 107 | A | WITHIN |
| 317 | 0.16 | 120 | 3.5 | 1.00 | 0.95 | 106 | A | WITHIN |
| 318 | 0.16 | 121 | 3.5 | 1.00 | 0.94 | 105 | A | WITHIN |
| 319 | 0.16 | 121 | 3.5 | 1.00 | 0.95 | 105 | A | WITHIN |
| 320 | 0.16 | 120 | 3.5 | 1.00 | 0.93 | 106 | A | WITHIN |
| 321 | 0.16 | 120 | 3.5 | 1.00 | 0.95 | 105 | A | WITHIN |
| 322 | 0.16 | 121 | 3.5 | 1.00 | 0.96 | 106 | A | WITHIN |
| 323 | 0.17 | 135 | 3.6 | 1.00 | 0.77 | 109 | A | WITHIN |
| 324 | 0.17 | 136 | 3.6 | 1.00 | 0.78 | 110 | A | WITHIN |
| 325 | 0.17 | 134 | 3.6 | 1.00 | 0.77 | 111 | A | WITHIN |
| 326 | 0.17 | 136 | 3.6 | 1.00 | 0.77 | 110 | A | WITHIN |
| 327 | 0.17 | 135 | 3.6 | 1.00 | 0.76 | 111 | A | WITHIN |
| 328 | 0.17 | 135 | 3.6 | 1.00 | 0.77 | 110 | A | WITHIN |

From Table 6, it is shown that the good results are obtained in the samples according to the invention.

Example 4

The samples Nos. 401 to 418 were made by combining the compounds of the invention as described in Table 7.

TABLE 7

| SAMPLE No. | CYAN COLORING LEUCO DYE | INHIBITOR FORMULA (1) | INHIBITOR FORMULA (2) | INHIBITOR FORMULA (3) | INHIBITOR FORMULA (4) | CHEMICAL SENSITIZER FORMULA (6) | CHEMICAL SENSITIZER FORMULA (8) | WITHIN OR OUTSIDE INVENTION |
|---|---|---|---|---|---|---|---|---|
| 401 | CA-3 | — | — | — | — | 6–2–1 | — | OUTSIDE |
| 402 | CA-3 | — | — | — | — | 6–1–4 | — | OUTSIDE |

TABLE 7-continued

| SAMPLE No. | CYAN COLORING LEUCO DYE | INHIBITOR FORMULA (1) | (2) | (3) | (4) | CHEMICAL SENSITIZER FORMULA (6) | (8) | WITHIN OR OUTSIDE INVENTION |
|---|---|---|---|---|---|---|---|---|
| 403 | CA-3 | 1–48 | — | — | — | 6–2–1 | — | WITHIN |
| 404 | CA-3 | 1–48 | — | — | — | 6–1–4 | — | WITHIN |
| 405 | CA-3 | — | 2–23 | — | — | 6–2–1 | — | WITHIN |
| 406 | CA-3 | — | 2–23 | — | — | 6–1–4 | — | WITHIN |
| 407 | CA-3 | — | — | 3–21 | — | 6–2–1 | — | WITHIN |
| 408 | CA-3 | — | — | 3–21 | — | 6–1–4 | — | WITHIN |
| 409 | CA-3 | — | — | — | 4–5 | 6–2–1 | — | WITHIN |
| 410 | CA-3 | — | — | — | 4–5 | 6–1–4 | — | WITHIN |
| 411 | CA-3 | 1–48 | 2–23 | 3–21 | 4–5 | 6–2–1 | — | WITHIN |
| 412 | CA-3 | 1–48 | 2–23 | 3–21 | 4–5 | 6–1–4 | — | WITHIN |
| 413 | CA-3 | 1–48 | 2–24 | 3–21 | 4–5 | 6–2–1 | 8-2 | WITHIN |
| 414 | CA-3 | 1–48 | 2–23 | 3–21 | 4–5 | 6–2–1 | 8-1 | WITHIN |
| 415 | CA-3 | 1–48 | 2–23 | 3–21 | 4–5 | 6–1–4 | 8-2 | WITHIN |
| 416 | CA-3 | 1–48 | 2–23 | 3–21 | 4–5 | 6–1–4 | 8-I | WITHIN |
| 417 | CA-5 | 1–48 | 2–23 | 3–21 | 4–5 | 6–2–1 | 8.2 | WITHIN |
| 418 | CA-8 | 1–48 | 2–23 | 3–21 | 4–5 | 6–2–1 | 8-2 | WITHIN |

The addition of the compounds represented by the Formula (1) to (4) of the invention was performed as described in the example 3. Also, the selenium sensitizers represented by the Formulas (6-1) and (6-2) were added at the same time as that for the sulfur sensitizers represented by the Formulas (5-1) to (5-6) as described in the example 3. The addition amount was $2.0\times10^{-5}$ mol/Ag mol. The gold sensitizer represented by the Formula (8) was added as described in the example 3.

The same evaluation as that in the example 3 was performed for each sample. The results are shown in Table 8.

TABLE 8

| SAMPLE No. | PHOTO-GRAPHIC FOG | RELATIVE SENSITIVITY | MAXIMUM DENSITY | COLOR TONE $R^2$ | COLOR TONE SLOPE | CHANGE RATE OF PHOTO-GRAPHIC FOGAFTER | IMAGE UNEVEN-NESS | WITHIN OR OUTSIDE INVENTION |
|---|---|---|---|---|---|---|---|---|
| 401 | 0.27 | 100 | 3.4 | 0.75 | 0.51 | 160 | B | OUTSIDE |
| 402 | 0.27 | 98 | 3.3 | 0.76 | 0.52 | 162 | B | OUTSIDE |
| 403 | 0.19 | 100 | 3.4 | 1.00 | 0.90 | 110 | A | WITHIN |
| 404 | 0.19 | 101 | 3.4 | 1.00 | 0.89 | 112 | A | WITHIN |
| 405 | 0.19 | 100 | 3.5 | 1.00 | 0.90 | 110 | A | WITHIN |
| 406 | 0.19 | 100 | 3.5 | 1.00 | 0.90 | 111 | A | WITHIN |
| 407 | 0.20 | 105 | 3.4 | 1.00 | 0.85 | 110 | A | WITHIN |
| 408 | 0.20 | 103 | 3.4 | 1.00 | 0.85 | 110 | A | WITHIN |
| 409 | 0.19 | 100 | 3.4 | 1.00 | 0.90 | 109 | A | WITHIN |
| 410 | 0.19 | 101 | 3.4 | 1.00 | 0.91 | 110 | A | WITHIN |
| 411 | 0.18 | 100 | 3.4 | 1.00 | 0.90 | 105 | A | WITHIN |
| 412 | 0.18 | 100 | 3.4 | 1.00 | 0.90 | 105 | A | WITHIN |
| 413 | 0.19 | 125 | 3.7 | 0.99 | 0.88 | 116 | A | WITHIN |
| 414 | 0.19 | 123 | 3.8 | 0.99 | 0.88 | 115 | A | WITHIN |
| 415 | 0.19 | 125 | 3.7 | 0.99 | 0.87 | 115 | A | WITHIN |
| 416 | 0.19 | 124 | 3.6 | 0.99 | 0.88 | 114 | A | WITHIN |
| 417 | 0.19 | 125 | 3.7 | 0.99 | 0.88 | 115 | A | WITHIN |
| 418 | 0.19 | 125 | 3.7 | 0.99 | 0.88 | 116 | A | WITHIN |

From Table 8, it is shown that the good results are obtained in the samples according to the invention.

Example 5

The samples Nos. 501 to 523 were made by combining the compounds of the invention as described in Table 9.

TABLE 9

| SAMPLE No. | CYAN COLORING LEUCO DYE | INHIBITOR FORMULA (1) | (2) | (3) | (4) | CHEMICAL SENSITIZER FORMULA (5) | (6) | (7) | (8) | WITHIN OR OUTSIDE INVENTION |
|---|---|---|---|---|---|---|---|---|---|---|
| 501 | CA-3 | — | — | — | — | — | — | 7–1–3 | | OUTSIDE |
| 502 | CA-3 | — | — | — | — | — | — | 7–2–1 | — | OUTSIDE |
| 503 | CA-3 | — | — | — | — | — | — | 7–3–1 | — | OUTSIDE |
| 504 | CA-3 | — | — | — | — | — | — | 7–4–1 | — | OUTSIDE |
| 505 | CA-3 | — | — | — | — | — | — | 7–5–1 | — | OUTSIDE |
| 506 | CA-3 | — | — | — | — | — | — | 7–6–1 | — | OUTSIDE |
| 507 | CA-3 | 1–48 | 2–23 | 3–21 | 4–5 | — | — | 7–1–3 | — | WITHIN |
| 508 | CA-3 | 1–48 | 2–23 | 3–21 | 4–5 | — | — | 7–2–1 | — | WITHIN |
| 509 | CA-3 | 1–48 | 2–23 | 3–21 | 4–5 | — | — | 7–3–1 | — | WITHIN |
| 510 | CA-3 | 1–48 | 2–23 | 3–21 | 4–5 | — | — | 7–4–1 | — | WITHIN |
| 511 | CA-3 | 1–48 | 2–23 | 3–21 | 4–5 | — | — | 7–5–1 | — | WITHIN |
| 512 | CA-3 | 1–48 | 2–24 | 3–21 | 4–5 | — | — | 7–6–1 | — | WITHIN |
| 513 | CA-3 | 1–81 | 2–23 | 3–21 | 4–5 | — | — | 7–6–1 | — | WITHIN |
| 514 | CA-3 | 1–48 | 2–23 | 3–21 | 4–5 | — | — | 7–6–1 | — | WITHIN |
| 513 | CA-3 | 1–48 | 2–23 | 3–1 | 4–5 | — | — | 7–6–1 | — | WITHIN |
| 516 | CA-3 | 1–48 | 2–23 | 3–21 | 4–2 | — | — | 7–6–1 | — | WITHIN |
| 517 | CA-3 | 1–48 | 2–23 | 3–21 | 4–5 | — | — | 7–6–1 | 8–2 | WITHIN |
| 518 | CA-3 | 1–48 | 2–23 | 3–21 | 4–5 | 5–1–11 | — | 7–6–1 | 8–2 | WITHIN |
| 519 | CA-3 | 1–48 | 2–23 | 3–21 | 4–5 | — | 6–1–4 | 7–6–1 | 8–2 | WITHIN |
| 520 | CA-3 | 1–48 | 2–23 | 3–21 | 4–5 | 5–1–11 | 6–1–4 | 7–6–1 | 8–2 | WITHIN |
| 521 | CA-3 | 1–48 | 2–23 | 3–21 | 4–5 | 5–1–11 | 6–1–4 | 7–6–1 | — | WITHIN |
| 522 | CA-5 | 1–48 | 2–23 | 3–21 | 4–5 | 5–1–11 | 6–1–4 | 7–6–1 | 8–2 | WITHIN |
| 523 | CA-8 | 1–48 | 2–23 | 3–21 | 4–5 | 5–1–11 | 6–1–4 | 7–6–1 | 8–2 | WITHIN |

The addition of the compounds represented by the Formulas (1) to (4) of the invention was performed as described in the examples 3 and 4. Also, for the tellurium sensitizers represented by the Formulas (7-1) and (7-6), the additive solution was prepared every bit as those of the sulfur sensitizers represented by the Formulas (5-1) to (5-6) described in the example 3, added 10 min after the addition of calcium bromide solution, after 10 min the gold sensitizer represented by the Formula (8) of the invention was added, and after further 30 min, the infrared sensitizing dyestuff solution A was added. The addition amount of the tellurium sensitizer was $1.0\times10^{-5}$ mol/Ag mol. The addition amount of the gold sensitizer represented by the Formula (8) was performed as described in the examples 3 and 4.

The same evaluation as that in the example 3 was performed for each sample. The results are shown in Table 10.

TABLE 10

| SAMPLE No. | PHOTOGRAPHIC FOG | RELATIVE SENSITIVITY | MAXIMUM DENSITY | COLOR TONE $R^2$ | COLOR TONE SLOPE | CHANGE RATE OF FOG AFTER (%) | IMAGE UNEVENNESS | WITHIN OR OUTSIDE INVENTION |
|---|---|---|---|---|---|---|---|---|
| 501 | 0.27 | 100 | 3.5 | 0.51 | 0.49 | 168 | B | OUTSIDE |
| 502 | 0.28 | 99 | 3.5 | 0.51 | 0.51 | 170 | B | OUTSIDE |
| 503 | 0.28 | 100 | 3.5 | 0.51 | 0.50 | 170 | B | OUTSIDE |
| 504 | 0.29 | 98 | 3.5 | 0.51 | 0.49 | 171 | B | OUTSIDE |
| 505 | 0.28 | 98 | 3.5 | 0.51 | 0.51 | 170 | B | OUTSIDE |
| 506 | 0.28 | 100 | 3.5 | 0.51 | 0.50 | 170 | B | OUTSIDE |
| 507 | 0.21 | 100 | 3.5 | 1.00 | 0.91 | 115 | A | WITHIN |
| 508 | 0.20 | 101 | 3.5 | 1.00 | 0.90 | 114 | A | WITHIN |
| 509 | 0.21 | 100 | 3.5 | 1.00 | 0.91 | 115 | A | WITHIN |
| 510 | 0.21 | 103 | 3.5 | 1.00 | 0.91 | 116 | A | WITHIN |
| 511 | 0.20 | 100 | 3.5 | 1.00 | 0.92 | 115 | A | WITHIN |
| 512 | 0.21 | 100 | 3.5 | 1.00 | 0.91 | 115 | A | WITHIN |
| 513 | 0.21 | 101 | 3.5 | 1.00 | 0.91 | 117 | A | WITHIN |
| 514 | 0.21 | 100 | 3.5 | 1.00 | 0.88 | 115 | A | WITHIN |
| 515 | 0.21 | 100 | 3.5 | 1.00 | 0.91 | 115 | A | WITHIN |
| 516 | 0.20 | 100 | 3.5 | 1.00 | 0.91 | 114 | A | WITHIN |
| 517 | 0.21 | 120 | 3.8 | 0.99 | 0.88 | 12 | A | WITHIN |
| 518 | 0.21 | 135 | 3.9 | 0.99 | 0.89 | 121 | A | WITHIN |
| 519 | 0.20 | 145 | 4.0 | 0.99 | 0.88 | 1210 | A | WITHIN |
| 520 | 0.21 | 160 | 4.0 | 0.99 | 0.88 | 120 | A | WITHIN |
| 521 | 0.20 | 130 | 3.9 | 0.99 | 0.88 | 122 | A | WITHIN |
| 522 | 0.21 | 159 | 4.0 | 0.99 | 0.90 | 120 | A | WITHIN |
| 523 | 0.21 | 158 | 4.0 | 0.99 | 0.88 | 120 | A | WITHIN |

From Table 10, it is shown that the good results are obtained in the samples according to the invention.

Example 6

<Manufacture of Support Given Under Coating for Photograph>

Corona discharge treatment at 8 W/m$^2$.min was given to both faces of a commercially available PET film with thickness of 175 μm and optical density of 0.170 (measured by a densitometer PDA-65 supplied from Konica Corporation) biaxially stretched and thermally fixed which was blue-colored with blue dye, the following under coating solution a-1 was applied on one side face such that the thickness of dried film is 0.8 μm, and was dried to make an under coating layer A-1. Also, the following under coating solution b-1 was applied on an opposite side face such that the thickness of dried film is 0.8 μm, and was dried to make an under coating layer B-1.

BLUE DYE

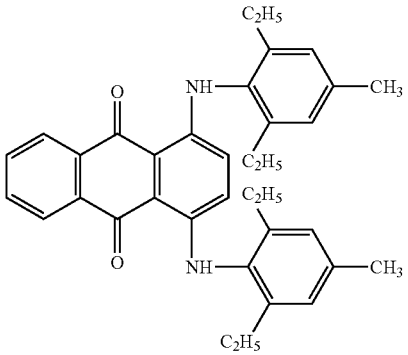

| <Undercoating solution a-1> | |
|---|---|
| Copolymer latex solution (solid 30%) of butylacrylate (30% by mass) t-butylacrylate (20% by mass) styrene (25% by mass) 2-hydroxyethylacrylate (25% by mass) | 270 g |
| (C-1) | 0.6 g |
| Hexamethylene-1,6-bis (ethylene urea) | 0.8 g |
| are filled up with water to 1 liter. | |
| <Under coating solution b-1> | |
| Copolymer latex solution (solid 30%) of butylacrylate (40% by mass) styrene (20% by mass) glycidylacrylate (40% by mass) | 270 g |
| (C-1) | 0.6 g |
| Hexamethylene-1,6-bis (ethylene urea) | 0.8 g |
| are filled up with water to 1 liter. | |

Subsequently, the corona discharge treatment at 8 W/m$^2$.min was given to upper surfaces of the under coating layers A-1 and B-1, the following under coating upper layer coating solution a-2 was applied on the under coating layer A-1 such that the thickness of dried film is 0.1 μm as the under coating upper layer A-2, and the following under coating upper layer coating solution b-2 was applied on the under coating layer A-1 such that the thickness of dried film is 0.4 μm as the under coating upper layer B-2 which has antistatic function.

| <Under coating upper layer coating solution a-2> | |
|---|---|
| Gelatin weight corresponding to | 0.4 g/m$^2$ |
| (C-1) | 0.2 g |
| (C-2) | 0.2 g |
| (C-3) | 0.1 g |
| silica particles (average particle size, 3 μm) | 0.1 g |
| are filled up with water to 1 liter. | |

| <Under coating upper layer coating solution b-2> | |
|---|---|
| Sb doped $SnO_2$ (SNS10M supplied from Ishihara Sangyo Co. Ltd.) | 60 g |
| latex solution of which component is (C-4) | 80 g |
| ammonium sulfate | 0.5 g |
| (C-5) | 12 g |
| Polyethyleneglycol | 6 g |
| are filled up with water to 1 liter. | |

(C-1)

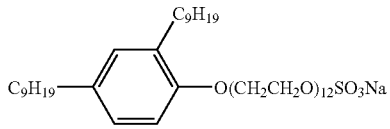

(C-2)

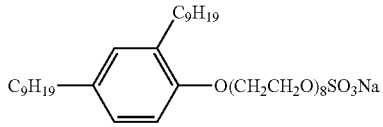

(C-3)

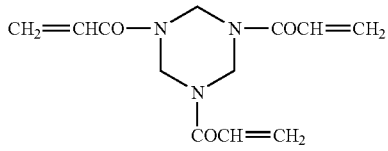

(C-4)

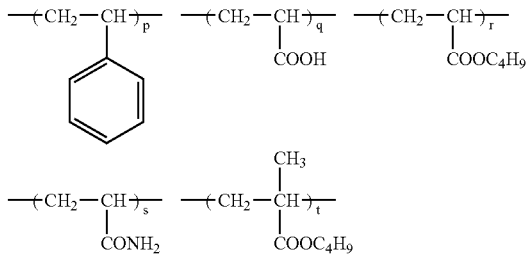

p:q:r:s:t = 40:5:10:5:40 (MASS RATIO)

(C-5)

THREE-IN-ONE MIXTURE OF

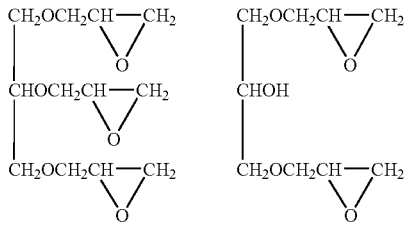

-continued

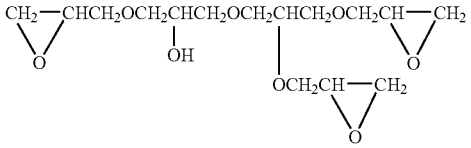

<Preparation of Back Coat Layer Coating Solution>

Cellulose acetate propionate (84.2 g)(Eastman Chemical Company, CAP 482-20) and polyester resin (4.5 g) (Bostic Inc., Vitel PE2200) were added and dissolved in methylethylketone (MEK) (830 g) with stirring. Next, 0.30 g of infrared dye 1 was added to the dissolved solution, further 4.5 g of Fluorinated type surfactant (Asahi Glass Co., Ltd., Surflon KH40) and 2.3 g of Fluorinated type surfactant (Dainippon Ink And Chemicals, Incorporated, Megafag F 120K) dissolved in 43.2 g of methanol were added, and thoroughly stirred until dissolved. Next, 2.5 g of oleyloleate was added. Finally, 75 g of silica (W. R. Grace & Co., Inc., Syloid 64×600) dispersed in methylethylketone at a concentration of 1% by mass using a dissolver type homogenizer was added, and stirred to prepare the back coat layer coating solution.

INFRARED DYE 1

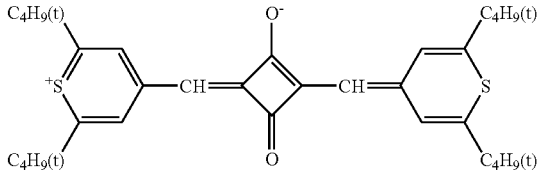

| <Preparation of back coat layer protection layer (surface protection layer) coating solution> | |
|---|---|
| Cellulose acetate butyrate (10% methylethylketone solution) | 0.03 g |
| Monodisperse silica (average particle size: 8 μm) with monodisperse degree of 15% (surface-treated with aluminium at 1% by mass based on total mass of silica) | |
| $C_8F_{17}(CH_2CH_2O)_{12}C_8F_{17}$ | 0.05 g |
| Fluorinated surfactant (SF-3) | 0.01 g |
| Stearic acid | 0.1 g |
| Oleyloleate | 0.1 g |
| α-alumina (Mohs hardness: 9) | 0.1 g |

<Preparation of photosensitive silver halide emulsion A>

| | |
|---|---|
| (A1) | |
| Phenylcarbamoyled gelatin | 88.3 g |
| compound (A) (10% methanol solution) | 10 ml |
| potassium bromide | 0.32 g |
| are filled up with water to 5429 ml. | |
| (B1) | |
| An aqueous solution of silver nitrate at 0.67 mol/L | 2635 ml |
| (C1) | |
| Potassium bromide | 51.55 g |
| potassium iodide | 1.47 g |
| are filled up with water to 660 ml | |
| (D1) | |
| Potassium bromide | 151.6 g |
| potassium iodide | 7.67 g |

-continued

| | |
|---|---|
| potassium hexacycloiridium (IV) acid (1% solution) | 0.93 ml |
| potassium hexacyanoiron (II) acid | 0.004 g |
| potassium hexachloroosmium (IV) acid | 0.004 g |
| are filled up with water to 1982 ml. | |
| (E1) | |
| Aqueous solution of potassium bromide at 0.4 mol/L amount to control the following silver potential | |
| (F1) | |
| Potassium hydroxide | 0.71 g |
| is filled up with water to 20 ml. | |
| (G1) | |
| Aqueous solution of 56% acetic acid | 18.0 ml |
| (H1) | |
| Sodium carbonate anhydride | 1.72 g |
| is filled up with water to 151 ml | |
| Compound (A) $HO(CH_2CH_2O)_n(CH(CH)_3CH_2O)_{17}(CH_2CH_2O)_mH$ (m + n = 5 to 7) | |

Using the mixing stirrer shown in JP-B-58-58288 and JP-B-58-58289, ¼ amount of the solution (B1) and total amount of the solution (C1) were added to the solution (A) with controlling the temperature at 20° C. and pAg at 8.09 by the simultaneous mixing method over 4 min 45 sec to perform the nuclear formation. After 1 min, the total amount of the solution (F1) was added. Using (E1), the pAg value was appropriately controlled in the meantime. After 6 hours, ¾ amount of the solution (B1) and the total amount of the solution (D1) were added with controlling the temperature at 20° C. and pAg at 8.09 by the simultaneous mixing method over 14 min 15 sec. After stirring for 5 min, the temperature was lowered to 40° C. and the total amount of the solution (G1) was added to precipitate silver halide emulsion. Leaving 2000 ml of the precipitated portion, supernatant was eliminated, and 10L of water was added to precipitate the silver halide emulsion again. Leaving 1500 ml of the precipitated portion, the supernatant was eliminated, 10 L of water was further added, then after stirring, the silver halide emulsion was precipitated again. Leaving 1500 ml of the precipitated portion, the supernatant was eliminated, subsequently, the solution (H1) was added, the temperature was elevated to 60° C., and the stirring was further performed for 120 min. Finally, pH was adjusted to 5.8 and water was added to become 1161 g per mol of the silver amount to yield the photosensitive silver halide emulsion A.

This emulsion was made up of monodisperse cubic iodide bromide silver particles with average particle size of 25 nm, variation coefficient of particle sizes of 12% and [100] face ratio of 92% (The content of AgI was 3.5 mol %).

<Preparation of Photosensitive Silver Halide Emulsion B>

The preparation was carried out as is the case with the preparation of photosensitive silver halide emulsion A, except that the temperature at addition by the simultaneous mixing method was changed to 40° C. This emulsion was made up of monodisperse cubic iodide bromide silver particles with average particle size of 50 nm, variation coefficient of particle sizes of 12% and [100] face ratio of 92% (The content of AgI was 3.5 mol %).

<Preparation of Powder Organic Silver Salt A>

Behenic acid (130.8 g), arachidic acid (67.7 g), stearic acid (43.6 g), and palmitic acid (2.3 g) were dissolved in 4720 ml of pure water at 80° C. Next, 540.2 ml of an aqueous solution of sodium hydroxide at 1.5 mol/L was added, and 6.9 ml of concentrated nitric acid was added, and subsequently the mixture was cooled to 55° C. to yield sodium fatty acid solution. With retaining the temperature of this sodium fatty acid solution at 55° C., the above photosensitive silver halide emulsions (the type and amount described in Tables 11-1, 12-1, 13-1 and 14-1), and 450 ml of pure water were added and stirred for 5 min.

Next, 468.4 ml of silver nitrate solution at 1 mol/L was added over 2 min, and stirred for 10 min to yield an organic silver salt dispersion. Subsequently, the resultant organic silver salt dispersion was transferred to a water washing vessel, deionized water was added, stirred, left to separate the organic silver salt by surfacing, and lower water-soluble salts were eliminated. Subsequently, water washing and discharging water were repeated until a conductivity of the discharged water became 2 μS/cm, water was discharged by centrifugation, and then the resultant cake-shaped organic silver salt was dried using a flash dryer, Flash Jet Dryer (supplied from Seishin Enterprise Co., Ltd.) by the operation condition of nitrogen gas atmosphere and dryer inlet hot wind until a water content became 0.1% to yield the dried powder organic silver salt A.

An infrared moisture meter was used for the measurement of the water content in the organic silver salt composition.

<Preparation of Predispersing Solution A>

As the image formation layer binder, a predispersing solution A was prepared by dissolving 14.57 g of —$SO_3K$ group-containing polyvinyl butyral (Tg: 75° C., 0.2 mmol/g of —$SO_3K$ is contained) in 1457 g of methylethylketone, gradually adding 500 g of the powder organic silver salt A with stirring by a dissolver DISPERMAT CA-40M type supplied from VMA-GETZMANN, and thoroughly mixing.

<Preparation of Photosensitive Emulsion Dispersion 1>

A photosensitive emulsion dispersion 1 was prepared by supplying the predispersing solution A to a media type dispersion machine DISPERMAT SL-C12EX type (supplied from VMA-GETZMANN) in which zirconia beads (Toreselam, supplied from Toray Industries Inc.) with diameter of 0.5 mm were filled at 80% of inner volume such that a staying time in a mill is 1.5 min using a pump, and performing dispersion at a mill peripheral velocity of 8 m/s.

<Preparation of Stabilizer Solution>

A stabilizer solution was prepared by dissolving 1.0 g of a stabilizer 1 and 0.31 g of potassium acetate in 4.97 g of methanol.

<Preparation of Infrared Sensitizing Dye Solution A>

An infrared sensitizing dye solution A was prepared by dissolving 19.2 mg of the infrared sensitizing dye, 1.488 g of 2-chloro-benzoic acid, 2.779 g of the stabilizer 2 and 365 mg of 5-methyl-2-mercaptobenzimidazole in 31.3 ml of MEK in a dark place.

<Preparation of Addition Solution a>

An addition solution a was made by dissolving the reducing agent (the compound and amount described in Tables 11-1, 12-2, 13-2 14-2), the compound (the compound and amount described in Tables 11-1, 12-1, 12-2, 13-2, 14-1 and 14-2) represented by the Formula (A-6) or cyan coloring dye, 1.54 g of 4-methyl phthalate and 0.48 g of the infrared dye 1 in 110 g of MEK.

<Preparation of Addition Solution b>

An addition solution b was made by dissolving the Antifoggant (the type and amount described in Table 13-1 and explanation parts of Tables 11-1, 11-2, 12-1, 12-2, 12-3, 14-1, 14-2, 14-3) and the toner (the type and amount described in Table 14-1 and explanation parts of Tables 11-1, 11-2, 12-1, 12-2, 12-3, 13-1, 13-2, 13-3) in 40.9 g of MEK.

<Preparation of Addition Solution c>

An addition solution c was made by dissolving 0.5 g of the silver saving agent (the type described in Tables 11-2, 12-2, 13-2 and 14-2) in 39.5 g of MEK.

<Preparation of Addition Solution d>

An addition solution d was made by dissolving 1 g of Supersensitizer 1 in 9 g of MEK.

<Preparation of Addition Solution e>

An addition solution e was made by dissolving 1.0 g of potassium p-toluene thiosulfonate in 9.0 g of MEK.

<Preparation of Addition Solution f>

An addition solution f was made by dissolving the Antifoggant (the type and amount described in Tables 11-1 and 12-1 and explanation parts of Tables 13-1, 13-2, 13-3, 14-1, 14-2, 14-3) in 9.0 g of MEK.

STABILIZER 1

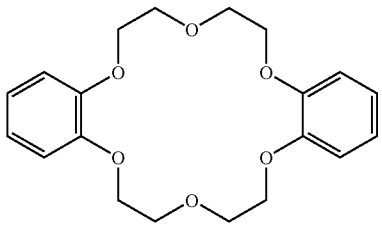

STABILIZER 2

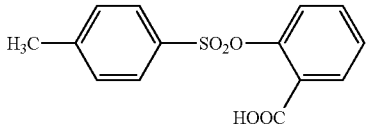

ANTIFOGGANT 2

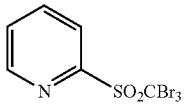

-continued

INFRARED SENSITING DYE

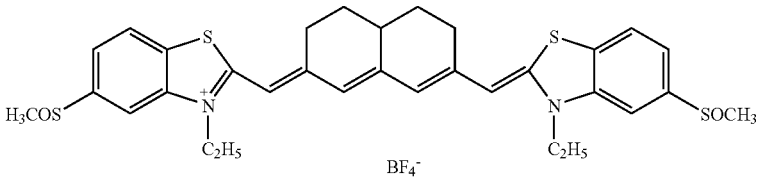

SUPERSENSITIZER 1

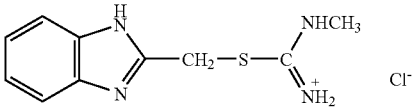

<Preparation of Image Formation Layer Coating Solution>

Under an inert gas atmosphere (97% nitrogen), the photosensitive emulsion dispersion 1 (50 g) and 15.11 g of MEK were kept at 21° C. with stirring, 1000 μm of a chemical sensitizer S-5 (0.5% methanol solution) was added, after 2 min, 390 μl of the Antifoggant 1 (10% methanol solution) was added, and stirred for one hour. Further, 494 μl of calcium bromide (10% methanol solution) was added, stirred for 10 min, subsequently, a gold sensitizer Au-5 at the amount corresponding to 1/20 mol of the above organic chemical sensitizer was added, and further stirred for 20 min. Subsequently, 167 ml of the stabilizer solution was added, stirred for 10 min, then 1.32 g of the infrared sensitizing dye solution A was added, and stirred for one hour. Subsequently, the temperature was lowered to 13° C. and the stirring was performed for additional 30 min. With holding the temperature at 13° C., 6.4 g of the addition solution d, 0.5 g of the addition solution e, 0.5 g of the addition solution f, and 13.31 g of the binder used for the predispersing solution A were added, stirred for 30 min, then 1.084 g of tetrachlorophthalic acid (9.4% by mass in MEK solution) was added, and stirred for 15 min. The image formation layer coating solution was obtained by sequentially adding and stirring 12.43 of the addition solution a, 1.6 ml of Desmodur N3300/aliphatic isocyanate supplied from Mobey (10% MEK solution), 4.27 g of the addition solution b and 4.0 g of the addition solution c with further continuing to stir.

CHEMICAL SENSITIZER S-5

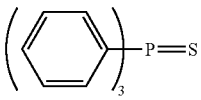

Au-5

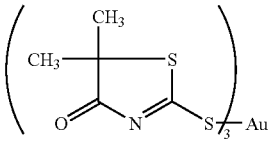

ANTIFOGGANT 1

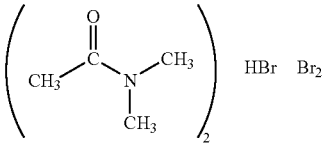

-continued

ANTIFOGGANT 3

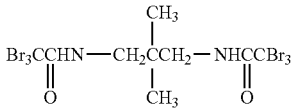

ANTIFOGGANT 4

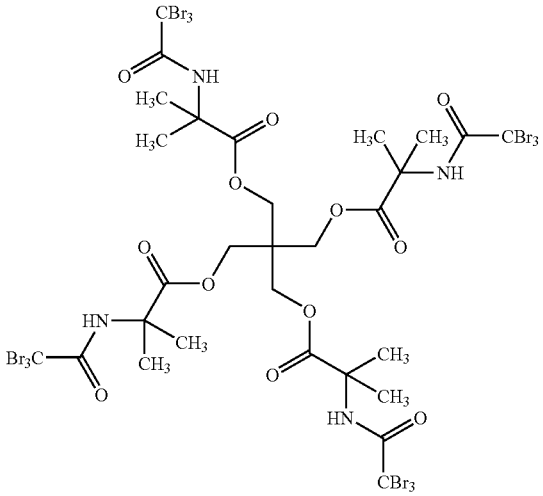

| <Preparation of image formation layer protection layer lower layer (surface protection layer lower layer)> | |
|---|---|
| Acetone | 5 g |
| Methylethylketone | 21 g |
| Cellulose acetate butyrate | 2.3 g |
| Methanol | 7 g |
| Phthalazine | 0.25 g |
| Monodisperse silica with monodisperse degree of 15% (average particle size: 3 μm) (surface-treated with aluminium at 1% by mass based on total weight of silica) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorinated surfactant (SF-17) | 0.01 g |
| Stearic acid | 0.1 g |
| Butyl stearate | 0.1 g |
| α-Alumina (Mohs hardness: 9) | 0.1 g |

| <Preparation of image formation layer protection layer upper layer (surface protection layer upper layer)> | |
|---|---|
| Acetone | 5 g |
| Methylethylketone | 21 g |

-continued

| | |
|---|---|
| Cellulose acetate butyrate | 2.3 g |
| Methanol | 7 g |
| Phthalazine | 0.25 g |
| Monodisperse silica with monodisperse degree of 15% (average particle size: 3 μm) (surface-treated with aluminium at 1% by mass based on total weight of silica) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorinated surfactant (SF-17) | 0.01 g |
| Stearic acid | 0.1 g |
| Butyl stearate | 0.1 g |
| α-Alumina (Mohs hardness: 9) | 0.1 g |

<Manufacture of Photothermographic Imaging Material>

The back coat layer coating solution and the back coat layer protection layer coating solution prepared above were coated on the under coating upper layer B-2 by an extrusion coater at a coating velocity of 50 m/min such that the thickness of each dried film was 3.5 μm. The drying was carried out over 5 min using dried wind with drying temperature at 100° C. and dew point at 10° C.

The photothermographic imaging materials Nos. 1 to No. 113 shown in Tables 11-1, 11-2, 12-1 to 12-3, 13-1 to 13-3 and 14-1 to 14-3 were manufactured by simultaneously overlaying and coating the image formation layer coating solution and the image formation layer protection layer (surface protection layer) coating solution on the under coating upper layer A-2 using the extrusion coater at the coating velocity of 50 m/min. The coating was carried out such that a coated silver amount is 1.2 g/m$^2$ in the image formation layer and the thickness of dried film is 2.5 μm (surface protection layer upper layer: 1.3 μm, surface protection layer lower layer: 1.2 μm) in the image formation protection layer (surface protection layer). Subsequently, the drying was carried out for 10 min using the dried wind with drying temperature 75° C. and dew point at 10° C.

The sample No. 26 was made as is the case with the sample No. 22, except that the fluorinated surfactant in the back coat layer protection layer and the image formation layer protection layer (upper and lower layers) was changed from SF-17 to $C_8F_{17}SO_3Li$ in the sample 22.

The sample No. 55 was made as is the case with the sample No. 51, except that the fluorinated surfactant in the back coat layer protection layer and the image formation layer protection layer (upper and lower layers) was changed from SF-17 to $C_8F_17SO_3Li$ in the sample 51.

The sample No. 83 was made as is the case with the sample No. 79, except that the fluorinated surfactant in the back coat layer protection layer and the image formation layer protection layer (upper and lower layers) was changed from SF-17 to $C_8F_{17}SO_3Li$ in the sample 79.

The sample No. 111 was made as is the case with the sample No. 107, except that the fluorinated surfactant in the back coat layer protection layer and the image formation layer protection layer (upper and lower layers) was changed from SF-17 to $C_8F_{17}SO_3Li$ in the sample 107.

The sample No. 24 was made as is the case with the sample No. 22, except that —$SO_3K$ group-containing polyvinyl butyral (Tg 65° C., 0.2 mmol/g of $SO_3K$ is contained) was used in place of —$SO_3K$ group-containing polyvinyl butyral (Tg 75° C., 0.2 mmol/g of $SO_3K$ is contained) as the image formation layer binder in the preparation of the predispersing solution A in the sample No. 22.

The sample No. 53 was made as is the case with the sample No. 51, except that —$SO_3K$ group-containing polyvinyl butyral (Tg 65° C., 0.2 mmol/g of $SO_3K$ is contained) was used in place of —$SO_3K$ group-containing polyvinyl butyral (Tg 75° C., 0.2 mmol/g of $SO_3K$ is contained) as the image formation layer binder in the preparation of the predispersing solution A in the sample No. 51.

The sample No. 81 was made as is the case with the sample No. 79, except that —$SO_3K$ group-containing polyvinyl butyral (Tg 65° C., 0.2 mmol/g of $SO_3K$ is contained) was used in place of —$SO_3K$ group-containing polyvinyl butyral (Tg 75° C., 0.2 mmol/g of $SO_3K$ is contained) as the image formation layer binder in the preparation of the predispersing solution A in the sample No. 79.

The sample No. 109 was made as is the case with the sample No. 107, except that —$SO_3K$ group-containing polyvinyl butyral (Tg 65° C., 0.2 mmol/g of $SO_3K$ is contained) was used in place of —$SO_3K$ group-containing polyvinyl butyral (Tg 75° C., 0.2 mmol/g of $SO_3K$ is contained) as the image formation layer binder in the preparation of the predispersing solution A in the sample No. 107.

<Exposure and Development Processing>

The photothermographic imaging materials Nos. 1 to No. 113 manufactured above were cut into half-cut size (34.5 cm×43.0 cm), and then processed by the following procedure using the thermal development apparatus shown in FIG. 1.

The photothermographic imaging material F was taken out from the film tray C, transported to the laser exposure portion 121, and subsequently given exposure by laser scanning using an exposure machine where semiconductor laser (maximum output is made 70 mW by joining two of maximum output 35 mW per one) with vertical multiple mode of wavelength 810 nm at high frequency superposition is made an exposure source, from the side of the image formation layer face. At that time, the image was formed by making the angle of the exposure face of the photothermographic imaging material F and the exposure laser beam L 75°. Subsequently, the photothermographic imaging material F was transported to the developing portion 130, the heat drum 1 heated at 125° C. for 15 sec to perform thermal development such that the protection layer at the side of the image formation layer of the photothermographic imaging material F was in contact with the surface of the drum, and then photothermographic imaging material was taken out of the apparatus. At that time, the transport velocity from the feeding portion 110 to the exposure portion 121, the transport velocity at the exposure portion and the transport velocity at the developing portion were 20 mm/sec, respectively. The exposure and the development were carried out in the room adjusted at 23° C. and 50% RH. The exposure was performed gradually by reducing the amount of exposure energy of log E0.05 per one step from the maximum output.

<Image Density>

The value at the maximum density part of the image obtained in the above condition is measured by a photographic densitometer and shown as the image density.

<<Gradation (Ga)>>

The density of the obtained sensitometry sample was measured using PDM 65 transmission densitometer (supplied from Konica Corporation), and the characteristic curve was obtained by computer processing of the measurement result. The average gradation, Ga value at the optical density of 0.25 to 2.5 was obtained from this characteristic curve.

<<Silver Color Tone>>

Silver color tone after the processing was visually evaluated by printing X-ray photographs of the chest and using Schaukasten. As a standard sample, the film of wet processing for the laser imager supplied from Konica Corporation was used, and the relative color tone to the standard sample was visually evaluated with the following criteria by 0.5 increment.

5: Same tone as the standard sample

4: Preferable tone similar to the standard sample

3: Level with no practical problem although the tone is slightly different from the standard sample 2: Tone clearly different from the standard sample 1: Undesirable tone different from the standard sample <<Changes of Silver Color Tone with Time>>

The same exposure and development as the above were given to the obtained imaging material, which was then stored at 50° C. and at the humidity of 55% for one day, and subsequently the silver color tone was evaluated. The evaluation of the silver color tone was carried out by visual evaluation with the same criteria as those of the above evaluation rating on a scale of 1.0 to 5.0 which is good.

<<Light Radiated Image Stability>>

The obtained imaging material was given the exposure and development processing as with the above, then attached on Schaukasten with luminance of 1000 Lux and left for 10 days, and subsequently the change of the image was evaluated with the following criteria by 0.5 increment.

5: Nearly no change

4: Slight tone change is observed

3: Tone change and increase of photographic fog are partially observed

2. Tone change and increase of photographic fog are considerably observed

1: Tone change and increase of photographic fog are noticeable, occurrence of strong density unevenness on whole area <<Image Stability at Storage with High Temperature>>

The obtained imaging material was given the exposure and development processing as with the above, then stored at 20° C. and at humidity of 55% for 7 days, subsequently the density of the photographic fog part was measured, and the increase of photographic fog before and after the storage was evaluated.

$\Delta D$min(Increase of photographic fog concentration)= (Photographic fog concentration after the storage at 20° C.)−(Photographic fog concentration immediately after the development)

<<Density Unevenness>>

The density unevenness at the thermal development was visually evaluated with five scales. A no problem level is 5, and every 0.5 scale was evaluated.

<<Transportability>>

The development processing was carried out fifty times using the thermal development processing apparatus shown in FIG. 1, and number of times where transport defect occurred was measured.

The courses and results are shown in Tables 11-1, 11-2, 12-1 to 12-3, 13-1 to 13-3 and 14-1 to 14-3.

TABLE 11-1

| Sample No | TYPE AND ADDITION AMOUNT OF PHOTOSENSITIVE HALOGENATED EMULSION (g) | TYPE AND ADDITION AMOUNT OF COMPOUND USED IN ADDITIVE SOLUTION (g) | TYPE AND ADDITION AMOUNT OF COMPOUND OF FOMULA (A-6)(g) | TYPE AND ADDITION AMOUNT OF CYAN COLORING LEUCO DYE (g) | TYPE AND ADDITION AMOUNT OF REDUCING AGENT (g) |
|---|---|---|---|---|---|
| 1 | A = 36.2, B = 9.1 | (8-1) = 1.0 | (3-1) = 0.159 | (CA-9) = 0.159 | (1*) |
| 2 | A = 36.2, B = 9.1 | (8-1) = 1.0 | (3-1) = 0.159 | (CA-9) = 0.159 | (1-7) = 27.98 |
| 3 | A = 36.2, B = 9.1 | (8-1) = 1.0 | (3-1) = 0.159 | (CA-9) = 0.159 | (1-15) = 27.98 |
| 4 | A = 36.2, B = 9.1 | (8-1) = 1.0 | (3-1) = 0.159 | (CA-9) = 0.159 | (1-43) = 27.98 |
| 5 | A = 36.2, B = 9.1 | (8-1) = 1.0 | (3-1) = 0.159 | (CA-9) = 0.159 | (1-45) = 27.98 |
| 6 | A = 36.2, B = 9.1 | (8-1) = 1.0 | (3-1) = 0.159 | (CA-9) = 0.159 | (1-66) = 27.98 |
| 7 | A = 36.2, B = 9.1 | (8-1) = 1.0 | (3-1) = 0.159 | (CA-9) = 0.159 | (1-78) = 27.98 |
| 8 | A = 36.2, B = 9.1 | (8-1) = 1.0 | (3-1) = 0.159 | (CA-9) = 0.159 | (1-80) = 27.98 |
| 9 | A = 36.2, B = 9.1 | (8-1) = 1.0 | (3-1) = 0.159 | (CA-9) = 0.159 | (1-83) = 27.98 |
| 10 | A = 36.2, B = 9.1 | (8-1) = 1.0 | (3-1) = 0.159 | (CA-9) = 0.159 | (2*) = 27.98 |
| 11 | A = 36.2, B = 9.1 | (8-1) = 1.0 | (3-1) = 0.159 | (CA-1) = 0.159 | (1-7) = 27.98 |
| 12 | A = 36.2, B = 9.1 | (8-1) = 1.0 | (3-1) = 0.159 | (CA-2) = 0.159 | (1-7) = 27.98 |
| 13 | A = 36.2, B = 9.1 | (8-1) = 1.0 | (3-1) = 0.159 | (CA-5) = 0.159 | (1-7) = 27.98 |
| 14 | A = 36.2, B = 9.1 | (8-1) = 1.0 | (3-1) = 0.159 | (CA-8) = 0.159 | (1-7) = 27.98 |
| 15 | A = 36.2, B = 9.1 | (8-1) = 1.0 | (3-1) = 0.159 | (CA-8) = 0.159 | (1-7) = 27.98 |
| 16 | A = 36.2, B = 9.1 | (8-1) = 1.0 | (3-1) = 0.159 | (CA-8) = 0.159 | (1-7) = 27.98 |
| 17 | A = 36.2, B = 9.1 | (8-1) = 1.0 | (3-1) = 0.159 | (CA-8) = 0.159 | (1-7) = 27.98 |
| 18 | A = 36.2, B = 9.1 | (8-2) = 1.0 | (3-1) = 0.159 | (CA-9) = 0.159 | (1-7) = 27.98 |
| 19 | A = 36.2, B = 9.1 | (8-5) = 1.0 | (3-1) = 0.159 | (CA-9) = 0.159 | (1-7) = 27.98 |
| 20 | A = 36.2, B = 9.1 | (8-10) = 1.0 | (3-1) = 0.159 | (CA-9) = 0.159 | (1-7) = 27.98 |
| 21 | A = 45.3 | (8-1) = 1.0 | (3-1) = 0.159 | (CA-9) = 0.159 | (1-7) = 27.98 |
| 22 | A = 45.3 | (8-1) = 1.0 | NIL | (CA-9) = 0.159 | (1-7) = 27.98 |
| 23 | A = 45.3 | (8-1) = 1.0 | NIL | (CA-9) = 0.159 | (1-7) = 27.98 |
| 24 | A = 45.3 | (8-1) = 1.0 | NIL | (CA-9) = 0.159 | (1-7) = 27.98 |
| 25 | A = 45.3 | (8-1) = 1.0 | NIL | (CA-9) = 0.159 | (1-7) = 27.98 |
| 26 | A = 45.3 | (8-1) = 1.0 | NIL | (CA-9) = 0.159 | (1-7) = 27.98 |

TABLE 11-1-continued

| Sample No | TYPE AND ADDITION AMOUNT OF PHOTOSENSITIVE HALOGENATED EMULSION (g) | TYPE AND ADDITION AMOUNT OF COMPOUND USED IN ADDITIVE SOLUTION (g) | TYPE AND ADDITION AMOUNT OF COMPOUND OF FOMULA (A-6)(g) | TYPE AND ADDITION AMOUNT OF CYAN COLORING LEUCO DYE (g) | TYPE AND ADDITION AMOUNT OF REDUCING AGENT (g) |
|---|---|---|---|---|---|
| 27 | A = 45.3 | NIL | NIL | (CA-9) = 0.159 | (1-7) = 27.98 |
| 28 | A = 45.3 | (8-1) = 1.0 | NIL | NIL | (1-7) = 27.98 |

1*: (1-91) = 4.20, (1-7) = 23.78
2*: 1,1-Bis (2-hydroxy-3,5-dimethylphenyl)-3,5-trimethylhexane

TABLE 11-2

| SAMPLE No. | TYPE AND ADDITION AMOUNT OF SILVER SAVING AGENT (g) | IMAGE DENSITY | AVERAGE GRADATION Ga | SILVER COLOR TONE | CHANGE OF SILVER COLOR TONE WITH TIME | LIGHT RADIATED IMAGE STABILITY | REMARKS |
|---|---|---|---|---|---|---|---|
| 1 | Al | 4.5 | 2.7 | 5.0 | 3.0 | 5.0 | INV. |
| 2 | Al | 4.2 | 2.7 | 5.0 | 5.0 | 5.0 | INV. |
| 3 | Al | 4.2 | 2.7 | 5.0 | 5.0 | 5.0 | INV. |
| 4 | Al | 3.9 | 2.7 | 5.0 | 5.0 | 5.0 | INV. |
| 5 | Al | 3.9 | 2.7 | 5.0 | 5.0 | 5.0 | INV. |
| 6 | Al | 3.9 | 2.7 | 5.0 | 5.0 | 5.0 | INV. |
| 7 | Al | 3.9 | 2.7 | 5.0 | 5.0 | 5.0 | INV. |
| 8 | Al | 3.9 | 2.7 | 5.0 | 5.0 | 5.0 | INV. |
| 9 | Al | 3.9 | 2.7 | 5.0 | 5.0 | 5.0 | INV. |
| 10 | Al | 3.9 | 2.7 | 4.0 | 4.0 | 4.0 | INV. |
| 11 | Al | 4.2 | 2.7 | 5.0 | 5.0 | 5.0 | INV. |
| 12 | Al | 1.2 | 2.7 | 5.0 | 5.0 | 5.0 | INV. |
| 13 | Al | 4.2 | 2.7 | 5.0 | 5.0 | 5.0 | INV. |
| 14 | Al | 4.2 | 2.7 | 5.0 | 5.0 | 5.0 | INV. |
| 15 | (H-6) | 4.2 | 3.1 | 5.0 | 5.0 | 5.0 | INV. |
| 16 | (l)-I | 4.1 | 2.8 | 5.0 | 5.0 | 5.0 | INV. |
| 17 | (3*) | 4.1 | 2.7 | 5.0 | 5.0 | 5.0 | INV. |
| 18 | Al | 4.2 | 2.7 | 5.0 | 5.0 | 5.0 | INV. |
| 19 | Al | 4.1 | 2.7 | 5.0 | 5.0 | 5.0 | INV. |
| 20 | Al | 4.1 | 2.7 | 5.0 | 5.0 | 5.0 | INV. |
| 21 | Al | 3.9 | 2.6 | 5.0 | 5.0 | 5.0 | INV. |
| 22 | Al | 3.8 | 2.6 | 4.0 | 4.0 | 5.0 | INV. |
| 23 | NIL | 3.4 | 2.3 | 4.0 | 4.0 | 5.0 | INV. |
| 24 | Al | 3.9 | 2.6 | 4.0 | 5.0 | 5.0 | INV. |
| 25 | Al | 3.5 | 2.5 | 4.0 | 4.0 | 5.0 | INV. |
| 26 | Al | 3.8 | 2.6 | 4.0 | 4.0 | 5.0 | INV. |
| 27 | Al | 3.3 | 2.6 | 3.0 | 2.0 | 4.0 | COMP. |
| 28 | Al | 3.2 | 2.6 | 3.0 | 3.0 | 4.0 | COMP. |

3*: Triphenyl tetrazolium

In all the samples, the Antifoggant 2=0.5 g, the Antifoggant 3=0.5 g and the Antifoggant 4=0.5 g were used as the Antifoggant in the additive solution b.

In all the samples, 3.43 g of phthalazine was used as the toning agent in the additive solution b.

TABLE 12-1

| SAMPLE No. | TYPE AND ADDITION AMOUNT OF PHOTOSENSITIVE HALOGENATED EMULSION (g) | TYPE AND ADDITION AMOUNT OF COMPOUND USED IN ADDITIVE SOLUTION f (g) | TYPE AND ADDITION AMOUNT OF COMPOUND OF FOMULA (A-6)/(g) |
|---|---|---|---|
| 29 | A = 36.2, B = 9.1 | (9-1) = 1.0 | (3-1) = 0.159 |
| 30 | A = 36.2, B = 9.1 | (9-1) = 1.0 | (3-1) = 0.159 |
| 31 | A = 36.2, B = 9.1 | (9-1) = 1.0 | (3-1) = 0.159 |
| 32 | A = 36.2, B = 9.1 | (9-1) = 1.0 | (3-1) = 0.159 |
| 33 | A = 36.2, B = 9.1 | (9-1) = 1.0 | (3-1) = 0.159 |
| 34 | A = 36.2, B = 9.1 | (9-1) = 1.0 | (3-1) = 0.159 |
| 35 | A = 36.2, B = 9.1 | (9-1) = 1.0 | (3-1) = 0.159 |
| 36 | A = 36.2, B = 9.1 | (9-1) = 1.0 | (3-1) = 0.159 |

TABLE 12-1-continued

| SAMPLE No. | TYPE AND ADDITION AMOUNT OF PHOTOSENSITIVE HALOGENATED EMULSION (g) | TYPE AND ADDITION AMOUNT OF COMPOUND USED IN ADDITIVE SOLUTION f (g) | TYPE AND ADDITION AMOUNT OF COMPOUND OF FOMULA (A-6)/(g) |
|---|---|---|---|
| 37 | A = 36.2, B = 9.1 | (9-1) = 1.0 | (3-1) = 0.159 |
| 38 | A = 36.2, B = 9.1 | (9-1) = 1.0 | (3-1) = 0.159 |
| 39 | A = 36.2, B = 9.1 | (9-1) = 1.0 | (3-1) = 0.159 |
| 40 | A = 36.2, B = 9.1 | (9-1) = 1.0 | (3-1) = 0.159 |
| 41 | A = 36.2, B = 9.1 | (9-1) = 1.0 | (3-1) = 0.159 |
| 42 | A = 36.2, B = 9.1 | (9-1) = 1.0 | (3-1) = 0.159 |
| 43 | A = 36.2, B = 9.1 | (9-1) = 1.0 | (3-1) = 0.159 |
| 44 | A = 36.2, B = 9.1 | (9-1) = 1.0 | (3-1) = 0.159 |
| 45 | A = 36.2, B = 9.1 | (9-1) = 1.0 | (3-1) = 0.159 |
| 46 | A = 36.2, B = 9.1 | (9-2) = 1.0 | (3-1) = 0.159 |
| 47 | A = 36.2, B = 9.1 | (9-5) = 1.0 | (3-1) = 0.159 |
| 48 | A = 36.2, B = 9.1 | (9-10) = 1.0 | (3-1) = 0.159 |
| 49 | A = 36.2, B = 9.1 | (9-12) = 1.0 | (3-1) = 0.159 |
| 50 | A = 45.3 | (9-1) = 1.0 | (3-1) = 0.159 |

TABLE 12-1-continued

| SAMPLE No. | TYPE AND ADDITION AMOUNT OF PHOTOSENSITIVE HALOGENATED EMULSION (g) | TYPE AND ADDITION AMOUNT OF COMPOUND USED IN ADDITIVE SOLUTION f (g) | TYPE AND ADDITION AMOUNT OF COMPOUND OF FOMULA (A-6)/(g) |
|---|---|---|---|
| 51 | A = 45.3 | (9-1) = 1.0 | NIL |
| 52 | A = 45.3 | (9-1) = 1.0 | NIL |
| 53 | A = 45.3 | (9-1) = 1.0 | NIL |
| 54 | A = 45.3 | (9-1) = 1.0 | NIL |
| 55 | A = 45.3 | (9-1) = 1.0 | NIL |
| 56 | A = 45.3 | NIL | NIL |
| 57 | A = 45.3 | (9-1) = 1.0 | NIL |

TABLE 12-2

| SAMPLE No. | TYPE AND ADDITION AMOUNT OF CYAN COLORING LEUCO DYE (g) | TYPE AND ADDITION AMOUNT OF REDUCING AGENT (g) | TYPE AND ADDITION AMOUNT OF SILVER SAVING AGENT (g) |
|---|---|---|---|
| 29 | (CA-9) = 0.159 | (1*) | A1 |
| 30 | (CA-9) = 0.159 | (1-7) = 27.98 | A1 |
| 31 | (CA-9) = 0.159 | (1-15) = 27.98 | A1 |
| 32 | (CA-9) = 0.159 | (1-43) = 27.98 | A1 |
| 33 | (CA-9) = 0.159 | (1-45) = 27.98 | A1 |
| 34 | (CA-9) = 0.159 | (1-66) = 27.98 | A1 |
| 35 | (CA-9) = 0.159 | (1-78) = 27.98 | A1 |

TABLE 12-2-continued

| SAMPLE No. | TYPE AND ADDITION AMOUNT OF CYAN COLORING LEUCO DYE (g) | TYPE AND ADDITION AMOUNT OF REDUCING AGENT (g) | TYPE AND ADDITION AMOUNT OF SILVER SAVING AGENT (g) |
|---|---|---|---|
| 36 | (CA-9) = 0.159 | (1-80) = 27.98 | A1 |
| 37 | (CA-9) = 0.159 | (1-83) = 27.98 | A1 |
| 38 | (CA-9) = 0.159 | (2*) = 27.98 | A1 |
| 39 | (CA-1) = 0.159 | (1-7) = 27.98 | A1 |
| 40 | (CA-2) = 0.159 | (1-7) = 27.98 | A1 |
| 41 | (CA-5) = 0.159 | (1-7) = 27.98 | A1 |
| 42 | (CA-8) = 0.159 | (1-7) = 27.98 | A1 |
| 43 | (CA-8) = 0.159 | (1-7) = 27.98 | (H-6) |
| 44 | (CA-8) = 0.159 | (1-7) = 27.98 | (1)-1 |
| 45 | (CA-8) = 0.159 | (1-7) = 27.98 | (3*) |
| 46 | (CA-9) = 0.159 | (1-7) = 27.98 | A1 |
| 47 | (CA-9) = 0.159 | (1-7) = 27.98 | A1 |
| 48 | (CA-9) = 0.159 | (1-7) = 27.98 | A1 |
| 49 | (CA-9) = 0.159 | (1*) | A1 |
| 50 | (CA-9) = 0.159 | (1-7) = 27.98 | A1 |
| 51 | (CA-9) = 0.159 | (1-7) = 27.98 | A1 |
| 52 | (CA-9) = 0.159 | (1-7) = 27.98 | NIL |
| 53 | (CA-9) = 0.159 | (1-7) = 27.98 | A1 |
| 54 | (CA-9) = 0.159 | (1-7) = 27.98 | A1 |
| 55 | (CA-9) = 0.159 | (1-7) = 27.98 | A1 |
| 56 | (CA-9) = 0.159 | (1-7) = 27.98 | A1 |
| 57 | NIL | (1*) | A1 |

1*: (1-91) =4.20, (1-7) 23.78

2*: 1,1-Bis (2-hydroxy-3,5-dimethylphenyl)-3,5-trimethylhexane

3*: Triphenyl tetrazolium

TABLE 12-3

| SAMPLE No. | IMAGE DENSITY | AVERAGE GRADATION Ga | SIVER COLOR TONE | SIVER COLOR TONE WITH TIME | CHANGE OF RADIATED IMAGE STABILITY | LIGHT REMARKS |
|---|---|---|---|---|---|---|
| 29 | 4.4 | 2.7 | 5.0 | 5.0 | 5.0 | INV. |
| 30 | 4.2 | 2.7 | 5.0 | 5.0 | 5.0 | INV. |
| 31 | 4.1 | 2.7 | 5.0 | 5.0 | 5.0 | INV. |
| 32 | 3.9 | 2.7 | 5.0 | 5.0 | 5.0 | INV. |
| 33 | 3.8 | 2.7 | 5.0 | 5.0 | 5.0 | INV. |
| 34 | 3.8 | 2.7 | 5.0 | 5.0 | 5.0 | INV. |
| 35 | 3.9 | 2.7 | 5.0 | 5.0 | 5.0 | INV. |
| 36 | 3.9 | 2.7 | 5.0 | 5.0 | 5.0 | INV. |
| 37 | 3.8 | 2.7 | 5.0 | 5.0 | 5.0 INV. | |
| 38 | 3.7 | 2.7 | 4.0 | 4.0 | 4.0 | INV. |
| 39 | 4.2 | 2.7 | 5.0 | 5.0 | 5.0 | INV. |
| 40 | 4.2 | 2.7 | 5.0 | 5.0 | 5.0 | INV. |
| 41 | 4.2 | 2.7 | 5.0 | 5.0 | 5.0 | INV. |
| 42 | 4.2 | 2.7 | 5.0 | 5.0 | 5.0 | INV. |
| 43 | 4.2 | 3.0 | 5.0 | 5.0 | 5.0 | INV. |
| 44 | 4.0 | 2.8 | 5.0 | 5.0 | 5.0 | INV. |
| 45 | 4.0 | 2.6 | 5.0 | 5.0 | 5.0 | INV. |
| 46 | 4.2 | 2.7 | 5.0 | 5.0 | 5.0 | INV. |
| 47 | 4.1 | 2.7 | 5.0 | 5.0 | 5.0 | INV. |
| 48 | 4.1 | 2.7 | 5.0 | 5.0 | 5.0 | INV. |

TABLE 12-3-continued

| SAMPLE No. | IMAGE DENSITY | AVERAGE GRADATION Ga | SIVER COLOR TONE | SIVER COLOR TONE WITH TIME | CHANGE OF RADIATED IMAGE STABILITY | LIGHT REMARKS |
|---|---|---|---|---|---|---|
| 49 | 4.2 | 2.7 | 5.0 | 5.0 | 5.0 | INV. |
| 50 | 3.9 | 2.6 | 5.0 | 5.0 | 5.0 | INV. |
| 51 | 3.8 | 2.6 | 4.0 | 4.0 | 5.0 | INV. |
| 52 | 3.4 | 2.2 | 4.0 | 4.0 | 5.0 | INV. |
| 53 | 3.8 | 2.6 | 4.0 | 4.5 | 5.0 | INV. |
| 54 | 3.5 | 2.4 | 4.0 | 4.0 | 5.0 | INV. |
| 55 | 3.7 | 2.6 | 4.0 | 4.0 | 5.0 | INV. |
| 56 | 3.2 | 2.5 | 3.0 | 2.0 | 3.5 | COMP. |
| 57 | 3.1 | 2.5 | 2.5 | 3.0 | 4.0 | COMP. |

In all the samples, the Antifoggant 2=0.5 g, the Antifoggant 3=0.5 g and the Antifoggant 4=0.5 g were used as the Antifoggant in the additive solution b.

In all the samples, 3.43 g of phthalazine was used as the toning agent in the additive solution b.

TABLE 13-1

| SAMPLE No. | TYPE AND ADDITION AMOUNT OF PHOTOSENSITIVE HALOGENATED EMULSION (g) | TYPE AND ADDITION AMOUNT OF ANTIFOGGANT IN ADDITIVE SOLUTION b (g) |
|---|---|---|
| 58 | A = 36.2, B = 9.1 | P0-3/ANTIFOGGANT 2 = 0.78/0.78 |
| 59 | A = 36.2, B = 9.1 | P0-3/ANTIFOGGANT 2 = 0.78/0.78 |
| 60 | A = 36.2, B = 9.1 | P0-3/ANTIFOGGANT 2 = 0.78/0.78 |
| 61 | A = 36.2, B = 9.1 | P0-3/ANTIFOGGANT 2 = 0.78/0.78 |
| 62 | A = 36.2, B = 9.1 | P0-3/ANTIFOGGANT 2 = 0.78/0.78 |
| 63 | A = 36.2, B = 9.1 | P0-3/ANTIFOGGANT 2 = 0.78/0.78 |
| 64 | A = 36.2, B = 9.1 | P0-3/ANTIFOGGANT 2 = 0.78/0.78 |
| 65 | A = 36.2, B = 9.1 | P0-3/ANTIFOGGANT 2 = 0.78/0.78 |
| 66 | A = 36.2, B = 9.1 | P0-3/ANTIFOGGANT 2 = 0.78/0.78 |
| 67 | A = 36.2, B = 9.1 | P0-3/ANTIFOGGANT 2 = 0.78/0.78 |
| 68 | A = 36.2, B = 9.1 | P0-3/ANTIFOGGANT 2 = 0.78/0.78 |
| 69 | A = 36.2, B = 9.1 | P0-3/ANTIFOGGANT 2 = 0.78/0.78 |
| 70 | A = 36.2, B = 9.1 | P0-3/ANTIFOGGANT 2 = 0.78/0.78 |
| 71 | A = 36.2, B = 9.1 | P0-3/ANTIFOGGANT 2 = 0.78/0.78 |
| 72 | A = 36.2, B = 9.1 | P0-3/ANTIFOGGANT 2 = 0.78/0.78 |
| 73 | A = 36.2, B = 9.1 | P0-3/ANTIFOGGANT 2 = 0.78/0.78 |
| 74 | A = 36.2, B = 9.1 | P0-3/ANTIFOGGANT 2 = 0.78/0.78 |
| 75 | A = 36.2, B = 9.1 | P0-3/ANTIFOGGANT 2 = 0.78/0.78 |
| 76 | A = 36.2, B = 9.1 | P0-3/ANTIFOGGANT 2 = 0.78/0.78 |
| 77 | A = 36.2, B = 9.1 | P0-3/ANTIFOGGANT 2 = 0.78/0.78 |
| 78 | A = 45.3 | P0-3/ANTIFOGGANT 2 = 0.78/0.78 |
| 79 | A = 45.3 | P0-3/ANTIFOGGANT 2 = 0.78/0.78 |
| 80 | A = 45.3 | P0-3/ANTIFOGGANT 2 = 0.78/0.78 |
| 81 | A = 45.3 | P0-3/ANTIFOGGANT 2 = 0.78/0.78 |
| 82 | A = 45.3 | P0-3/ANTIFOGGANT 2 = 0.78/0.78 |
| 83 | A = 45.3 | P0-3/ANTIFOGGANT 2 = 0.78/0.78 |
| 84 | A = 45.3 | (4*) |
| 85 | A = 45.3 | P0-3/ANTIFOGGANT 2 = 0.78/0.78 |

4*: Antifoggant 3 = 0.78 g, Antifoggant 4 = 0.78 g

TABLE 13-2

| SAMPLE No. | TYPE AND ADDITION AMOUNT OF COMPOUND OF FOMULA (A-6)(g) | TYPE AND ADDITION AMOUNT OF CYAN COLORING LEUCO DYE (g) | TYPE AND ADDITION AMOUNT OF REDUCING AGENT (g) | TYPE AND ADDITION AMOUNT OF SILVER SAVING AGENT (g) |
|---|---|---|---|---|
| 58 | (3-1) = 0.159 | (CA-9) = 0.159 | (1*) | A1 |
| 59 | (3-1) = 0.159 | (CA-9) = 0.159 | (1-7) = 27.98 | A1 |
| 60 | (3-1) = 0.159 | (CA-9) = 0.159 | (1-15) = 27.98 | A1 |
| 61 | (3-1) = 0.159 | (CA-9) = 0.159 | (1-43) = 27.98 | A1 |
| 62 | (3-1) = 0.159 | (CA-9) = 0.159 | (1-45) = 27.98 | A1 |
| 63 | (3-1) = 0.159 | (CA-9) = 0.159 | (1-66) = 27.98 | A1 |
| 64 | (3-1) = 0.159 | (CA-9) = 0.159 | (1-78) = 27.98 | A1 |
| 65 | (3-1) = 0.159 | (CA-9) = 0.159 | (1-80) = 27.98 | A1 |
| 66 | (3-1) = 0.159 | (CA-9) = 0.159 | (1-83) = 27.98 | A1 |
| 67 | (3-1) = 0.159 | (CA-9) = 0.159 | (2*) = 27.98 | A1 |
| 68 | (3-1) = 0.159 | (CA-1) = 0.159 | (1-7) = 27.98 | A1 |
| 69 | (3-1) = 0.159 | (CA-2) = 0.159 | (1-7) = 27.98 | A1 |
| 70 | (3-1) = 0.159 | (CA-5) = 0.159 | (1-7) = 27.98 | A1 |
| 71 | (3-1) = 0.159 | (CA-8) = 0.159 | (1-7) = 27.98 | A1 |
| 72 | (3-1) = 0.159 | (CA-8) = 0.159 | (1-7) = 27.98 | (H-6) |
| 73 | (3-1) = 0.159 | (CA-8) = 0.159 | (1-7) = 27.98 | (1)-1 |
| 74 | (3-1) = 0.159 | (CA-8) = 0.159 | (1-7) = 27.98 | (3*) |
| 75 | (3-1) = 0.159 | (CA-9) = 0.159 | (1-7) = 27.98 | A1 |
| 76 | (3-1) = 0.159 | (CA-9) = 0.159 | (1-7) = 27.98 | A1 |
| 77 | (3-1) = 0.159 | (CA-9) = 0.159 | (1-7) = 27.98 | A1 |
| 78 | (3-1) = 0.159 | (CA-9) = 0.159 | (1-7) = 27.98 | A1 |
| 79 | NIL | (CA-9) = 0.159 | (1-7) = 27.98 | A1 |
| 80 | NIL | (CA-9) = 0.159 | (1-7) = 27.98 | NIL |
| 81 | NIL | (CA-9) = 0.159 | (1-7) = 27.98 | A1 |
| 82 | NIL | (CA-9) = 0.159 | (1-7) = 27.98 | A1 |
| 83 | NIL | (CA-9) = 0.159 | (1-7) = 27.98 | A1 |
| 84 | NIL | (CA-9) = 0.159 | (1-7) = 27.98 | A1 |
| 85 | NIL | NIL | (1-7) = 27.98 | A1 |

1*: (1-91) = 4.20, (1-7) = 23.78

2*: 1,1-Bis (2-hydroxy-3,5-dimethylphenyl)-3,5-trimethylhexane

3*: Triphenyl tetrazolium

TABLE 13-3

| SAMPLE No. | IMAGE DENSITY | AVERAGE GRADATION Ga | SIVER COLOR TONE | LIGHT RADIATED IMAGE STABILITY | IMAGE STORAGE STABILITY AT ROOM TEMPERATURE | REMARKS |
|---|---|---|---|---|---|---|
| 58 | 4.6 | 2.7 | 5.0 | 5.0 | 0.004 | INV. |
| 59 | 4.3 | 2.7 | 5.0 | 5.0 | 0.003 | INV. |
| 60 | 4.2 | 2.7 | 5.0 | 5.0 | 0.003 | INV. |
| 61 | 4.0 | 2.8 | 5.0 | 5.0 | 0.002 | INV. |
| 62 | 4.0 | 2.8 | 5.0 | 5.0 | 0.002 | INV. |
| 63 | 3.9 | 2.8 | 5.0 | 5.0 | 0.002 | INV. |
| 64 | 4.0 | 2.7 | 5.0 | 5.0 | 0.002 | INV. |
| 65 | 4.0 | 2.7 | 5.0 | 5.0 | 0.002 | INV. |
| 66 | 4.0 | 2.7 | 5.0 | 5.0 | 0.002 | INV. |
| 67 | 3.9 | 2.7 | 4.0 | 4.5 | 0.003 | INV. |
| 68 | 4.3 | 2.7 | 5.0 | 5.0 | 0.002 | INV. |
| 69 | 4.2 | 2.7 | 5.0 | 5.0 | 0.002 | INV. |
| 70 | 4.3 | 2.7 | 5.0 | 5.0 | 0.002 | INV. |
| 71 | 4.3 | 2.7 | 5.0 | 5.0 | 0.002 | INV. |
| 72 | 4.4 | 3.2 | 5.0 | 5.0 | 0.003 | INV. |
| 73 | 4.2 | 2.9 | 5.0 | 5.0 | 0.003 | INV. |
| 74 | 4.1 | 2.8 | 5.0 | 5.0 | 0.002 | INV. |
| 75 | 4.3 | 2.7 | 5.0 | 5.0 | 0.002 | INV. |
| 76 | 4.2 | 2.8 | 5.0 | 5.0 | 0.003 | INV. |
| 77 | 4.2 | 2.7 | 5.0 | 5.0 | 0.003 | INV. |
| 78 | 4.0 | 2.7 | 5.0 | 5.0 | 0.004 | INV. |
| 79 | 3.9 | 2.6 | 4.0 | 4.5 | 0.004 | INV. |
| 80 | 3.5 | 2.4 | 4.0 | 4.5 | 0.003 | INV. |
| 81 | 3.9 | 2.7 | 4.0 | 4.5 | 0.005 | INV. |
| 82 | 3.5 | 2.6 | 4.0 | 4.5 | 0.004 | INV. |
| 83 | 3.8 | 2.6 | 4.0 | 4.5 | 0.004 | INV. |
| 84 | 3.4 | 2.6 | 3.0 | 3.0 | 0.027 COMP. | |
| 85 | 3.2 | 2.5 | 2.5 | 3.5 | 0.009 COMP. | |

In all the samples, the Antifoggant containing 1.0 g of vinyl sulfone, $(CH_2{=}CH{-}SO_2CH_2)_2CHOH$ was used as the Antifoggant in the additive solution f.

In all the samples, 3.43 g of phthalazine was used as the toning agent in the additive solution b.

TABLE 14-1

| SAMPLE No. | TYPE AND ADDITION AMOUNT OF PHOTOSENSITIVE HALOGENATED EMULSION (g) | TYPE AND ADDITION AMOUNT OF TONING AGENT IN ADDITIVE SOLUTION b (g) | TYPE AND ADDITION AMOUNT OF COMPOUND OF FOMULA (A-6)/(g) |
|---|---|---|---|
| 86 | A = 36.2, B = 9.1 | J-3 = 3.43 | (3-1) = 0.159 |
| 87 | A = 36.2, B = 9.1 | J-3 = 3.43 | (3-1) = 0.159 |
| 88 | A = 36.2, B = 9.1 | J-3 = 3.43 | (3-1) = 0.159 |
| 89 | A = 36.2, B = 9.1 | J-3 = 3.43 | (3-1) = 0.159 |
| 90 | A = 36.2, B = 9.1 | J-3 = 3.43 | (3-1) = 0.159 |
| 91 | A = 36.2, B = 9.1 | J-3 = 3.43 | (3-1) = 0.159 |
| 92 | A = 36.2, B = 9.1 | J-3 = 3.43 | (3-1) = 0.159 |
| 93 | A = 36.2, B = 9.1 | J-3 = 3.43 | (3-1) = 0.159 |
| 94 | A = 36.2, B = 9.1 | J-3 = 3.43 | (3-1) = 0.159 |
| 95 | A = 36.2, B = 9.1 | J-3 = 3.43 | (3-1) = 0.159 |
| 96 | A = 36.2, B = 9.1 | J-3 = 3.43 | (3-1) = 0.159 |
| 97 | A = 36.2, B = 9.1 | J-3 = 3.43 | (3-1) = 0.159 |
| 98 | A = 36.2, B = 9.1 | J-3 = 3.43 | (3-1) = 0.159 |
| 99 | A = 36.2, B = 9.1 | J-3 = 3.43 | (3-1) = 0.159 |
| 100 | A = 36.2, B = 9.1 | J-3 = 3.43 | (3-1) = 0.159 |
| 101 | A = 36.2, B = 9.1 | J-3 = 3.43 | (3-1) = 0.159 |
| 102 | A = 36.2, B = 9.1 | J-3 = 3.43 | (3-1) = 0.159 |
| 103 | A = 36.2, B = 9.1 | J-4 = 3.43 | (3-1) = 0.159 |
| 104 | A = 36.2, B = 9.1 | J-5 = 3.43 | (3-1) = 0.159 |
| 105 | A = 36.2, B = 9.1 | J-8 = 3.43 | (3-1) = 0.159 |
| 106 | A = 45.3 | J-3 = 3.43 | (3-1) = 0.159 |
| 107 | A = 45.3 | J-3 = 3.43 | NIL |
| 108 | A = 45.3 | J-3 = 3.43 | NIL |
| 109 | A = 45.3 | J-3 = 3.43 | NIL |

TABLE 14-1-continued

| SAMPLE No. | TYPE AND ADDITION AMOUNT OF PHOTOSENSITIVE HALOGENATED EMULSION (g) | TYPE AND ADDITION AMOUNT OF TONING AGENT IN ADDITIVE SOLUTION b (g) | TYPE AND ADDITION AMOUNT OF COMPOUND OF FOMULA (A-6)/(g) |
|---|---|---|---|
| 110 | A = 45.3 | J-3 = 3.43 | NIL |
| 111 | A = 45.3 | J-3 = 3.43 | NIL |
| 112 | A = 45.3 | PHTHALAZINE | NIL |
| 113 | A = 45.3 | J-3 = 3.43 | NIL |

TABLE 14-2

| SAMPLE No. | TYPE AND ADDITION AMOUNT OF CYAN COLORING LEUCO DYE (g) | TYPE AND ADDITION AMOUNT OF REDUCING AGENT (g) | TYPE AND ADDITION AMOUNT OF SILVER SAVING AGENT (g) | IMAGE DENSITY |
|---|---|---|---|---|
| 86 | (CA-9) = 0.159 | (1*) | A1 | 4.4 |
| 87 | (CA-9) = 0.159 | (1-7) = 27.98 | A1 | 4.2 |
| 88 | (CA-9) = 0.159 | (1-15) = 27.98 | A1 | 4.1 |
| 89 | (CA-9) = 0.159 | (1-43) = 27.98 | A1 | 3.9 |
| 90 | (CA-9) = 0.159 | (1-45) = 27.98 | A1 | 3.8 |
| 91 | (CA-9) = 0.159 | (1-66) = 27.98 | A1 | 3.8 |
| 92 | (CA-9) = 0.159 | (1-78) = 27.98 | A1 | 3.8 |
| 93 | (CA-9) = 0.159 | (1-80) = 27.98 | A1 | 3.8 |
| 94 | (CA-9) = 0.159 | (1-83) = 27.98 | A1 | 3.8 |
| 95 | (CA-9) = 0.159 | (2*) = 27.98 | A1 | 3.8 |
| 96 | (CA-1) = 0.159 | (1-7) = 27.98 | A1 | 4.1 |
| 97 | (CA-2) = 0.159 | (1-7) = 27.98 | A1 | 4.2 |
| 98 | (CA-5) = 0.159 | (1-7) = 27.98 | A1 | 4.1 |

TABLE 14-2-continued

| SAMPLE No. | TYPE AND ADDITION AMOUNT OF CYAN COLORING LEUCO DYE (g) | TYPE AND ADDITION AMOUNT OF REDUCING AGENT (g) | TYPE AND ADDITION AMOUNT OF SILVER SAVING AGENT (g) | IMAGE DENSITY |
|---|---|---|---|---|
| 99 | (CA-8) = 0.159 | (1-7) = 27.98 | A1 | 4.2 |
| 100 | (CA-8) = 0.159 | (1-7) = 27.98 | (H-6) | 4.2 |
| 101 | (CA-8) = 0.159 | (1-7) = 27.98 | (1)-1 | 4.0 |
| 102 | (CA-8) = 0.159 | (1-7) = 27.98 | (3*) | 4.0 |
| 103 | (CA-9) = 0.159 | (1-7) = 27.98 | A1 | 4.1 |
| 104 | (CA-9) = 0.159 | (1-7) = 27.98 | A1 | 4.0 |
| 105 | (CA-9) = 0.159 | (1-7) = 27.98 | A1 | 4.0 |
| 106 | (CA-9) = 0.159 | (1-7) = 27.98 | A1 | 3.9 |
| 107 | (CA-9) = 0.159 | (1-7) = 27.98 | A1 | 3.7 |
| 108 | (CA-9) = 0.159 | (1-7) = 27.98 | NIL | 3.4 |
| 109 | (CA-9) = 0.159 | (1-7) = 27.98 | A1 | 3.8 |
| 110 | (CA-9) = 0.159 | (1-7) = 27.98 | A1 | 3.5 |
| 111 | (CA-9) = 0.159 | (1-7) = 27.98 | A1 | 3.7 |
| 112 | (CA-9) = 0.159 | (1-7) = 27.98 | A1 | 3.4 |
| 113 | NIL | (1-7) = 27.98 | A1 | 3.2 |

1*: (1-91) = 4.2, (1-7) = 23.78
2*: 1,1-Bis (2-hydroxy-3,5-dimethylphenyl)-3,5-trimethylhexane
3*: Triphenyl tetrazolium

TABLE 14-3

| SAMPLE No. | AVERAGE GRADATION Ga | SILVER COLOR TONE | LIGHT RADIATED IMAGE STABILITY | DENSITY UNEVENNESS AT THERMAL DEVELOPMENT | REMARKS |
|---|---|---|---|---|---|
| 86 | 2.7 | 5.0 | 5.0 | 5.0 | INV. |
| 87 | 2.7 | 5.0 | 5.0 | 5.0 | INV. |
| 88 | 2.7 | 5.0 | 5.0 | 5.0 | INV. |
| 89 | 2.6 | 5.0 | 5.0 | 5.0 | INV. |
| 90 | 2.6 | 5.0 | 5.0 | 5.0 | INV. |
| 91 | 2.7 | 5.0 | 5.0 | 5.0 | INV. |
| 92 | 2.6 | 5.0 | 5.0 | 5.0 | INV. |
| 93 | 2.7 | 5.0 | 5.0 | 5.0 | INV. |
| 94 | 2.7 | 5.0 | 5.0 | 5.0 | INV. |
| 95 | 2.7 | 4.0 | 4.0 | 5.0 | INV. |
| 96 | 2.7 | 5.0 | 5.0 | 5.0 | INV. |
| 97 | 2.7 | 5.0 | 5.0 | 5.0 | INV. |
| 98 | 2.7 | 5.0 | 5.0 | 5.0 | INV. |
| 99 | 2.7 | 5.0 | 5.0 | 5.0 | INV. |
| 100 | 3.0 | 5.0 | 5.0 | 5.0 | INV. |
| 101 | 2.7 | 5.0 | 5.0 | 5.0 | INV. |
| 102 | 2.7 | 5.0 | 5.0 | 5.0 | INV. |
| 103 | 2.7 | 5.0 | 5.0 | 5.0 | INV. |
| 104 | 2.6 | 5.0 | 5.0 | 5.0 | INV. |
| 105 | 2.7 | 5.0 | 5.0 | 5.0 | INV. |
| 106 | 2.6 | 5.0 | 5.0 | 5.0 | INV. |
| 107 | 2.5 | 4.0 | 4.5 | 5.0 | INV. |
| 108 | 2.4 | 4.0 | 4.5 | 5.0 | INV. |
| 109 | 2.6 | 4.0 | 4.5 | 5.0 | INV. |
| 110 | 2.4 | 4.0 | 4.5 | 5.0 | INV. |
| 111 | 2.6 | 4.0 | 4.5 | 4.0 | INV. |
| 112 | 2.5 | 3.5 | 4.0 | 2.5 | COMP. |
| 113 | 2.5 | 2.5 | 4.0 | 3.0 | COMP. |

In all the samples, the Antifoggant 2=0.5 g, the Antifoggant 3=0.5 g and the Antifoggant 4=0.5 g were used as the Antifoggant in the additive solution b.

In all the samples, the Antifoggant containing 1.0 g of vinyl sulfone, $(CH_2{=}CH{-}SO_2CH_2)_2CHOH$ was used as the Antifoggant in the additive solution f.

From Tables 11-1, 11-2, 12-1 to 12-3, 13-1 to 13-3 and 14-1 to 14-3, it is obvious that the photothermographic imaging materials of the invention are high density and excellent in silver color tone, light radiated image stability, change of silver color tone with time, density unevenness at the thermal development, and image storage stability in the storage at room temperature, compared to the comparative photothermographic imaging materials.

Also when the samples 22 and 26, 55 and 51, 83 and 79, and 111 and 107 were compared, it was found that the samples 22, 51, 79 and 107 had more excellent properties in transportability and environmental suitability (accumulation in vivo).

Also when the samples 24 and 22, 53 and 51, 81 and 79, and 109 and 107 were compared, it was found that the samples 22, 51, 79 and 107 had more excellent properties in image storage stability in the storage at high temperature.

In the above, the Examples of the present invention are explained. However, it is needless to say that the present invention is not limited to such Examples, but various modifications are possible in a range within the scope of the present invention.

According to the present invention, it was possible to provide silver salt photothermographic dry imaging materials with high density and low photographic fog, which are excellent in storage stability, and image stability after the thermal development, and further thermal development stability, as well as the image recording method and the image forming method using the same.

Further, according to the invention, it was possible to provide the silver salt photothermographic dry imaging material with low photographic fog, high sensitivity and high maximum density where the increase of photographic fog density is inhibited at a long term storage and which is excellent in image color tone and further excellent in rapid development suitability, as well as the image recording method and the image forming method using the same.

Moreover, according to the invention, obtained were the photothermographic imaging materials with high density, which were excellent in light radiated image stability, silver color tone, change of silver color tone with time, density unevenness at the thermal development, and image storage stability in the storage at room temperature.

The entire disclosure of Japanese Patent Application Nos. 2002-340720, 2002-342196 and 2002-343793 filed on Nov. 25, 2002, Nov. 26, 2002 and Nov. 27, 2002, respectively, including specification, claims, drawings and summary are incorporated herein by reference in its entirety.

What is claimed is:

1. A silver salt photothermographic dry imaging material comprising:

non-photosensitive aliphatic carboxylic acid silver salts;

a photosensitive emulsion containing photosensitive silver halide grains;

a silver ion reducing agent;

a binder; and a cyan coloring leuco dye, wherein the non-photosensitive aliphatic carboxylic acid silver salts are manufactured by making a silver ion-containing solution using water or a mixture of water and an organic solvent as a solvent react with an alkali metal salt of aliphatic carboxylic acid-containing solution using water, an organic solvent or a mixture of water and the organic solvent as a solvent under existence of tertiary alcohol.

2. The material of claim 1, wherein the binder contains latex of polymer with an equilibrium water content of 2% or less by mass at 25° C. and at 60% RH.

3. The material of claim 1, wherein coefficient of determination $R^2$ of a linear regression straight line is 0.998 or more and 1.000 or less, the $R^2$ being made by measuring each density at optical density of 0.5, 1.0, 1.5 and minimum optical density on a silver image obtained after thermal development processing of the silver salt photothermographic dry imaging material and by disposing u* and v* at the above each optical density on two dimensional coordinates where a horizontal and vertical axes in CIE 1976 (L*u*v*) color space are made u* and v*, respectively; and v* value of an intersection point with the vertical axis of the linear regression straight line is −5 or more and 5 or less; and a slope (v*/u*) is 0.7 or more and 2.5 or less.

4. A method for recording an image on the material of claim 1, comprising:

performing image exposure according to a vertical multiple mode laser scanning exposure apparatus.

5. A method for forming an image after performing image recording on the material of claim 1, comprising:

thermal developing in a state containing 40 to 4500 ppm of organic solvent.

* * * * *